US012465183B2

(12) United States Patent
Shonfeld et al.

(10) Patent No.: US 12,465,183 B2
(45) Date of Patent: Nov. 11, 2025

(54) HANDHELD SURFACE CLEANER

(71) Applicant: SharkNinja Operating LLC, Needham, MA (US)

(72) Inventors: Zachary Shonfeld, Cambridge, MA (US); AiMin Xu, Jiangsu (CN); Jemma Beedie, Greater London (GB); Devan Schappler, Waltham, MA (US); Oliver Holmes, Greater London (GB); Eleanor Saunders, Greater London (GB); Lois Jones, Greater London (GB); Adam Udy, Eastbourne (GB)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 19/036,762

(22) Filed: Jan. 24, 2025

(65) Prior Publication Data

US 2025/0275655 A1 Sep. 4, 2025

Related U.S. Application Data

(63) Continuation of application No. PCT/CN2024/134016, filed on Nov. 25, 2024.
(Continued)

(51) Int. Cl.
*A47L 9/16* (2006.01)
*A47L 9/12* (2006.01)

(52) U.S. Cl.
CPC ..... *A47L 9/1608* (2013.01); *A47L 9/12* (2013.01); *A47L 9/1675* (2013.01); *A47L 9/1683* (2013.01)

(58) Field of Classification Search
CPC ..... A47L 9/16; A47L 9/1608; A47L 9/165; A47L 9/1658; A47L 9/1675;
(Continued)

(56) References Cited

U.S. PATENT DOCUMENTS 4,382,804 A * 5/1983 Mellor ..... B01D 45/08 209/714
5,379,483 A 1/1995 Pino
(Continued)

FOREIGN PATENT DOCUMENTS

CN 203724037 U 7/2014
CN 203898194 U 10/2014
(Continued)

OTHER PUBLICATIONS

International Search Report and Written Opinion for PCT Pat. App. No. PCT/CN2024/134016 mailed Mar. 6, 2025. (10 pages).

*Primary Examiner* — Tom Rodgers
*Assistant Examiner* — Michael A Gump
(74) *Attorney, Agent, or Firm* — Mintz, Levin, Cohn, Ferris, Glovsky and Popeo, P.C.

(57) ABSTRACT

Various illustrative handheld surface cleaners and methods of using handheld surface cleaners are provided. In an exemplary implementation, the handheld surface cleaner is configured to use suction to draw debris into the handheld surface cleaner. The suction also causes air to be drawn into the handheld surface cleaner. The handheld surface cleaner is configured to separate the air and the debris on board the handheld surface cleaner to allow the air to exit the handheld surface cleaner and to allow the debris to be collected in the handheld surface cleaner for later disposal.

19 Claims, 64 Drawing Sheets

Related U.S. Application Data

(60) Provisional application No. 63/560,916, filed on Mar. 4, 2024.

(58) Field of Classification Search
CPC ..... A47L 9/1683; A47L 9/1691; A47L 9/102; A47L 9/1666; A47L 9/12; A47L 5/24; B01D 45/14
USPC ..... 15/344
See application file for complete search history.

(56) References Cited

U.S. PATENT DOCUMENTS 5,914,416 A * 6/1999 Thode ..... A47L 9/1675 55/467
6,434,785 B1 8/2002 Vandenbelt et al.
7,210,195 B2 5/2007 Howie et al.
7,479,171 B2 1/2009 Cho et al.
8,146,201 B2 4/2012 Conrad
8,302,250 B2 11/2012 Dyson et al.
8,429,788 B1 4/2013 Lovelady et al.
D691,338 S 10/2013 Schultz et al.
8,806,712 B2 8/2014 Griffith
8,836,257 B2 9/2014 Savitz
9,011,564 B2 4/2015 De Wit et al.
9,021,654 B2 5/2015 Fischer
9,155,437 B2 10/2015 Williams et al.
9,186,028 B2 11/2015 White et al.
9,320,404 B2 4/2016 Gornik et al.
9,402,521 B2 8/2016 Bassett et al.
9,402,522 B2 8/2016 Bassett et al.
9,408,512 B2 8/2016 Roth
9,554,682 B2 1/2017 Van Der Kooi et al.
9,593,685 B2 3/2017 Marioni
9,756,999 B2 9/2017 Vines
9,763,551 B2 9/2017 Murchie et al.
9,788,698 B2 10/2017 Morin et al.
9,816,221 B2 11/2017 Harwood et al.
9,844,308 B2 12/2017 Thorne et al.
9,883,782 B2 2/2018 York et al.
9,962,048 B2 5/2018 Conrad et al.
10,071,328 B2 9/2018 Williams et al.
10,244,912 B2 4/2019 Box et al.
10,264,934 B2 4/2019 Conrad
10,288,072 B2 5/2019 Arnoldi
10,299,646 B2 5/2019 Hyun et al.
10,362,912 B2 7/2019 Hyun et al.
10,376,112 B2 8/2019 Conrad
10,390,670 B2 8/2019 Robinson et al.
10,406,535 B2 9/2019 Ni
10,413,853 B2 9/2019 Kawamoto et al.
10,433,687 B2 10/2019 Dimbylow
10,441,121 B2 10/2019 Conrad et al.
10,506,904 B2 12/2019 Conrad et al.
10,555,651 B2 2/2020 Williams et al.
10,568,479 B2 2/2020 Ni
10,765,285 B2 9/2020 Goff
10,813,510 B2 10/2020 Brown et al.
10,813,512 B2 10/2020 Cho et al.
10,827,891 B2 11/2020 Conrad
10,837,439 B2 11/2020 Ubidia
10,888,206 B2 1/2021 Moeller
10,888,881 B2 1/2021 Herman et al.
10,913,648 B2 2/2021 Ubidia
11,059,054 B2 7/2021 Conrad
11,089,933 B2 8/2021 Xia et al.
11,101,088 B2 8/2021 Holsten
11,109,728 B2 9/2021 Lee
11,173,427 B2 11/2021 Bayati et al.
11,229,338 B2 1/2022 Royale
11,234,573 B1 2/2022 Hangyu
11,284,757 B2 3/2022 Ni
11,317,774 B2 5/2022 Yun et al.
11,395,570 B2 7/2022 Cebasek et al.
11,419,465 B2 8/2022 Yuen et al.
11,426,038 B2 8/2022 James et al.
11,439,285 B2 9/2022 Conrad et al.
11,445,871 B2 9/2022 Conrad
11,478,119 B2 10/2022 Irfan et al.
11,497,366 B2 11/2022 Xu et al.
11,517,166 B2 12/2022 Percy-Raine et al.
11,523,725 B2 12/2022 Quintero et al.
11,529,033 B2 12/2022 Conrad
11,540,683 B2 1/2023 Fadel
11,559,039 B2 1/2023 Hoffmann et al.
11,612,290 B2 3/2023 Conrad
11,638,509 B2 5/2023 Ryu et al.
11,700,987 B2 7/2023 Kang
11,717,128 B2 8/2023 Conrad et al.
11,744,421 B2 9/2023 Conrad
11,766,157 B2 9/2023 Percy-Raine et al.
11,771,278 B2 10/2023 Conrad et al.
11,779,176 B2 10/2023 Krebs et al.
11,826,007 B2 11/2023 Conrad et al.
11,832,781 B2 12/2023 Han et al.
11,844,476 B2 12/2023 Royale
11,844,487 B2 12/2023 Kim et al.
11,857,052 B2 1/2024 Conrad
11,903,539 B2 2/2024 Miller
11,903,548 B2 2/2024 Conrad
11,910,989 B2 2/2024 Knight et al.
D1,021,303 S 4/2024 Williams et al.
11,963,652 B2 4/2024 Percy-Raine et al.
11,963,654 B2 4/2024 Nam et al.
11,963,657 B2 4/2024 Pruiett
11,966,232 B2 4/2024 Ratanaphanyarat et al.
11,969,135 B2 4/2024 Lubbers et al.
11,980,334 B2 5/2024 Conrad
11,992,167 B2 5/2024 Conrad
12,004,705 B2 6/2024 Pohlman et al.
12,035,872 B2 7/2024 Paulla et al.
2003/0106858 A1* 6/2003 Elsom Sharpe ..... A47L 9/102 210/512.1
2018/0160871 A1* 6/2018 Cho ..... A47L 9/1666
2018/0333736 A1 11/2018 Krebs
2019/0328190 A1 10/2019 Wellens
2020/0383532 A1 12/2020 Zuger et al.
2021/0059492 A1 3/2021 Taylor et al.
2021/0207604 A1 7/2021 Erlich et al.
2022/0022720 A1 1/2022 Moser et al.
2022/0183518 A1 6/2022 Amoretti
2022/0257071 A1 8/2022 Zheng et al.
2022/0299354 A1 9/2022 Cunnah et al.
2022/0330767 A1 10/2022 Buttery et al.
2022/0338695 A1 10/2022 Zhou et al.
2023/0000300 A1 1/2023 Ortmann
2023/0000303 A1 1/2023 Shin et al.
2023/0018446 A1 1/2023 O'shaughnessy et al.
2023/0022866 A1 1/2023 Heo
2023/0039475 A1 2/2023 Al-Shorachi et al.
2023/0104985 A1 4/2023 Kwon et al.
2023/0165418 A1 6/2023 Braendle
2023/0181419 A1 6/2023 Fister
2023/0320546 A1 10/2023 Al-Shorachi et al.
2023/0329503 A1 10/2023 Lee et al.
2023/0355051 A1 11/2023 Wesley
2023/0363607 A1 11/2023 Niemke
2024/0008697 A1 1/2024 Harmelink et al.
2024/0008702 A1 1/2024 Stuive et al.
2024/0049936 A1 2/2024 Kumar et al.
2024/0049937 A1 2/2024 Zeitler
2024/0065506 A1 2/2024 Lee et al.
2024/0065508 A1 2/2024 Jung et al.
2024/0090716 A1 3/2024 Cole et al.
2024/0090717 A1 3/2024 Ni et al.
2024/0148206 A1 5/2024 Jang et al.
2024/0180379 A1 6/2024 Conrad
2024/0180381 A1 6/2024 Dang et al.

(56) References Cited

U.S. PATENT DOCUMENTS

| | | | | |
|---|---|---|---|---|
| 2024/0252012 | A1 | 8/2024 | Yan et al. | |
| 2024/0382056 | A1* | 11/2024 | Conrad | B01D 45/16 |

FOREIGN PATENT DOCUMENTS

| | | | |
|---|---|---|---|
| CN | 203898195 | U | 10/2014 |
| CN | 204698456 | U | 10/2015 |
| CN | 105078358 | A | 11/2015 |
| CN | 204931576 | U | 1/2016 |
| CN | 205006785 | U | 2/2016 |
| CN | 205144437 | U | 4/2016 |
| CN | 103445717 | B | 6/2016 |
| CN | 103445718 | B | 6/2016 |
| CN | 104305938 | B | 8/2016 |
| CN | 104337470 | B | 8/2016 |
| CN | 104398211 | B | 12/2016 |
| CN | 106308683 | A | 1/2017 |
| CN | 104433968 | B | 5/2017 |
| CN | 105078357 | B | 9/2017 |
| CN | 105078359 | B | 11/2017 |
| CN | 105105684 | B | 11/2017 |
| CN | 107788908 | A | 3/2018 |
| CN | 108125616 | A | 6/2018 |
| CN | 108402994 | A | 8/2018 |
| CN | 108403035 | A | 8/2018 |
| CN | 109253109 | A | 1/2019 |
| CN | 110049702 | A | 7/2019 |
| CN | 110292329 | A | 10/2019 |
| CN | 110537878 | A | 12/2019 |
| CN | 110649853 | B | 1/2021 |
| CN | 112450797 | A | 3/2021 |
| CN | 112690691 | A | 4/2021 |
| CN | 112704427 | A | 4/2021 |
| CN | 213155647 | U | 5/2021 |
| CN | 112890665 | A | 6/2021 |
| CN | 112932358 | A | 6/2021 |
| CN | 113347911 | A | 9/2021 |
| CN | 113455960 | A | 10/2021 |
| CN | 113693483 | A | 11/2021 |
| CN | 215348672 | U | 12/2021 |
| CN | 215899525 | U | 2/2022 |
| CN | 110996744 | B | 3/2022 |
| CN | 112690692 | B | 5/2022 |
| CN | 112674635 | B | 6/2022 |
| CN | 113440073 | B | 6/2022 |
| CN | 114569009 | A | 6/2022 |
| CN | 114601376 | A | 6/2022 |
| CN | 114794964 | A | 7/2022 |
| CN | 114886341 | A | 8/2022 |
| CN | 115067826 | A | 9/2022 |
| CN | 115067830 | A | 9/2022 |
| CN | 115253492 | A | 11/2022 |
| CN | 114190846 | B | 12/2022 |
| CN | 115444307 | A | 12/2022 |
| CN | 218165166 | U | 12/2022 |
| CN | 115721205 | A | 3/2023 |
| CN | 115227134 | B | 5/2023 |
| CN | 116115125 | A | 5/2023 |
| CN | 115067829 | B | 6/2023 |
| CN | 116269079 | A | 6/2023 |
| CN | 116406993 | A | 7/2023 |
| CN | 116407044 | A | 7/2023 |
| CN | 219306599 | U | 7/2023 |
| CN | 112515587 | B | 9/2023 |
| CN | 116772971 | A | 9/2023 |
| CN | 116784717 | A | 9/2023 |
| CN | 117017134 | A | 11/2023 |
| CN | 113117401 | B | 12/2023 |
| CN | 117181662 | A | 12/2023 |
| CN | 117356959 | A | 1/2024 |
| CN | 117426716 | A | 1/2024 |
| CN | 117582153 | A | 2/2024 |
| CN | 113827144 | B | 3/2024 |
| CN | 117652914 | A | 3/2024 |
| CN | 113520214 | B | 5/2024 |
| CN | 118021201 | A | 5/2024 |
| CN | 118235990 | A | 6/2024 |
| CN | 114109795 | B | 8/2024 |
| CN | 118614809 | A | 9/2024 |
| DE | 202015105892 | U1 | 2/2017 |
| EP | 0215165 | B1 | 7/1991 |
| EP | 2459043 | A1 | 6/2012 |
| EP | 2612582 | A1 | 7/2013 |
| EP | 1959809 | B1 | 5/2014 |
| EP | 2644073 | B1 | 2/2016 |
| EP | 2868249 | B1 | 11/2016 |
| EP | 2902630 | B1 | 1/2018 |
| EP | 3868268 | A1 | 8/2021 |
| EP | 3763265 | B1 | 6/2023 |
| EP | 4209161 | A1 | 7/2023 |
| EP | 4212084 | A1 | 7/2023 |
| EP | 4238470 | A1 | 9/2023 |
| EP | 4260785 | A1 | 10/2023 |
| EP | 3939486 | B1 | 2/2024 |
| EP | 4368087 | A1 | 5/2024 |
| EP | 4406465 | A1 | 7/2024 |
| WO | 2023111556 | A1 | 6/2023 |
| WO | 2023235671 | A1 | 12/2023 |
| WO | 2024003565 | A1 | 1/2024 |
| WO | 2024003658 | A1 | 1/2024 |
| WO | 2024037489 | A1 | 2/2024 |
| WO | 2024071622 | A1 | 4/2024 |
| WO | 2024156395 | A1 | 8/2024 |

* cited by examiner

HANDHELD SURFACE CLEANER

CROSS REFERENCES TO RELATED APPLICATIONS

The present application is a continuation of PCT Patent Application No. PCT/CN2024/134016 entitled "Handheld Surface Cleaner" filed Nov. 25, 2024, which claims priority to U.S. Provisional Patent Application No. 63/560,916 entitled "Cleaning Apparatus" filed Mar. 4, 2024, which are hereby incorporated by reference in their entireties.

FIELD

The present disclosure generally relates to handheld surface cleaners.

BACKGROUND

Surface cleaning apparatuses (also referred to herein as "surface cleaners") are configured to be maneuvered over a surface to be cleaned (e.g., a floor, upholstery, etc.). While being maneuvered over the surface to be cleaned, the surface cleaning apparatus is configured to collect in the surface cleaning apparatus debris deposited on and/or in the surface to be cleaned. The debris can include liquid, hair, dirt, and/or other matter. The debris can later be disposed of as waste from the surface cleaning apparatus.

Water and/or other cleaning liquid can be applied to the surface to be cleaned to help clean the surface using the surface cleaning apparatus. The debris collected by the surface cleaning apparatus can include excess water and/or other cleaning liquid that was applied to the surface.

The surface cleaning apparatus can be configured to use suction in drawing the debris into the surface treatment apparatus. The suction may also help free, dislodge, or otherwise facilitate collection of the debris by the surface treatment apparatus.

In instances in which the surface cleaning apparatus applies suction and collects liquid, both air and liquid can be drawn into the surface cleaning apparatus in addition to any other debris. The air drawn into the surface cleaning apparatus should be allowed to escape from the surface cleaning apparatus while the surface cleaning apparatus is in use since it is not feasible to contain all the drawn-in air within the surface cleaning apparatus. However, it can be difficult to allow for air to be released from the surface cleaning apparatus while the surface cleaning apparatus is in use without debris also being released from the surface cleaning apparatus, which is messy and undesirable.

SUMMARY

In general, handheld surface cleaners and methods of using handheld surface cleaners are provided.

In one aspect, a cleaning system is provided that in one implementation includes a handheld surface cleaner. The handheld surface cleaner includes an inlet through which debris and air are allowed to enter the handheld surface cleaner, a main body, a tank, a separator, a separator motor, and a suction motor. Debris and air are configured to enter the handheld surface cleaner through the inlet. The tank is configured to contain and store therein the debris. The separator is configured to separate the debris and the air to allow the debris to be collected in the tank and to allow the air to exit the handheld surface cleaner. The separator has an open proximal end through which the air exits the separator.

The separator has a plurality of holes in a sidewall of the separator through which the debris exits the separator. The separator motor is configured to drive rotation of the separator. The rotation of the separator is configured to direct the debris through the plurality of holes. The suction motor is configured to provide a suction force to draw the debris and air into the inlet and into the separator.

The cleaning system can have any number of variations. For example, the plurality of holes can be configured to be open with the separator rotating, and the plurality of holes can be configured to be closed with the separator not rotating. Further, each of the plurality of holes can have an associated cover that is configured to move automatically from an active configuration, in which the covers do not cover their associated holes, and a resting configuration, in which the covers cover their associated holes; and/or the handheld surface cleaner can also include a centrifugal seal upstream of the separator. Further, the rotation of the separator can be configured to cause the covers to move from the resting configuration to the active configuration, and the separator stopping rotating can be configured to cause the covers to move from the active configuration to the resting configuration.

For another example, the plurality of holes can be open regardless of whether the separator is rotating. Further, the handheld surface cleaner can also include a duckbill valve upstream of the separator.

For yet another example, the handheld surface cleaner can also include a first filter upstream of the separator, and the handheld surface cleaner can also include a second filter downstream of the separator.

For still another example, the handheld surface cleaner can also include a controller configured to control the suction motor and the separator motor based on a measured current of the separator motor. Further, the controller can be configured to cause the suction motor and the separator motor to be powered off in response to the measured current being greater than a predetermined threshold current value. Further, the controller can be configured to cause the suction motor to be powered off before the separator motor is powered off in response to the measured current being greater than a predetermined threshold current value. Further, the handheld surface cleaner can also include a current sensor operably coupled to the controller and configured to measure the current of the separator motor.

For yet another example, the handheld surface cleaner can also include a shaft operatively coupling the separator and the separator motor with an outer bearing and an inner plug, and the outer bearing and the inner plug can be keyed. Further, the inner plug can be formed of rubber.

For another example, the tank can be configured to releasably couple to the main body; with the tank releasably coupled to the main body, the suction motor and the separator motor can be allowed to be turned on; and with the tank not being releasably coupled to the main body, the suction motor and the separator motor can be disabled from being turned on. Further, the handheld surface cleaner can also include a switch that is configured to be activated and allow power to be provided to the suction motor and the separator motor with the tank releasably coupled to the main body and that is configured to be deactivated and prevent power from being provided to the suction motor and the separator motor with the tank not releasably coupled to the main body; and/or the handheld surface cleaner can also include a controller; the controller can be configured to determine whether the tank is releasably coupled to the main body; the controller can be configured to, in response to determining that the tank is releasably coupled to the main body, allow the suction motor and the separator motor to be powered on; and the controller can be configured to, in response to determining that the tank is not releasably coupled to the main body, prevent the suction motor and the separator motor from being powered on.

For yet another example, a separator assembly of the handheld surface cleaner can include the separator and the separator motor, and the separator assembly can be configured to be removable from the main body with the tank.

For another example, a separator assembly of the handheld surface cleaner can include the separator and the separator motor, and the separator motor can be configured to be removable from the tank with the main body with the separator remaining coupled to the tank.

For yet another example, the handheld surface cleaner can include a rechargeable power supply located at the main body. Further, the rechargeable power supply can include a rechargeable battery; and/or the cleaning system can also include a tray configured to seat the handheld surface cleaner for storage, and, with the handheld surface cleaner seated in the tray, the rechargeable power supply can be configured to be recharged using a charger.

For another example, the cleaning system can also include a tray configured to seat the handheld surface cleaner for storage.

For still another example, the cleaning system can also include a plurality of attachments configured to be selectively coupled one at a time to the inlet, and the plurality of attachments can include at least two of a stain tool attachment, a crevice tool attachment, and a pet hair tool attachment. Further, the cleaning system can also include a tray configured to seat simultaneously the handheld surface cleaner and the at least two of the stain tool attachment, the crevice tool attachment, and the pet hair tool attachment.

For another example, the tank can be configured to releasably couple to the main body.

For still another example, the cleaning system can also include a tray configured to seat the handheld surface cleaner. Further, the handheld surface cleaner can include a rechargeable power supply located at the main body, and the rechargeable power supply can be configured to be recharged with the tray seating the handheld surface cleaner. Further, the rechargeable power supply can include a rechargeable battery, and/or the cleaning system can also include a plurality of attachments configured to be selectively coupled one at a time to the inlet, and the plurality of attachments can include at least two of a stain tool attachment, a crevice tool attachment, and a pet hair tool attachment. Further, the tray can be configured to seat simultaneously the handheld surface cleaner and the at least two of the stain tool attachment, the crevice tool attachment, and the pet hair tool attachment.

For yet another example, the cleaning system can also include a spray bottle including a spray head and a dual cleaning solution container configured to be releasably coupled to the spray head, and the spray head can be configured to expel a liquid cleaning solution to a surface to be cleaned by the handheld surface cleaner. Further, the cleaning system can also include a tray configured to seat simultaneously the handheld surface cleaner and the spray bottle. Further, the cleaning system can also include a plurality of attachments configured to be selectively coupled one at a time to the inlet, and the plurality of attachments can include at least two of a stain tool attachment, a crevice tool attachment, and a pet hair tool attachment. Further, the tray can be configured to seat simultaneously the handheld surface cleaner, the spray bottle, and the at least two of the stain tool attachment, the crevice tool attachment, and the pet hair tool attachment.

In another implementation, a cleaning system is provided that includes a handheld surface cleaner that includes an inlet, a tank, a separator, a separator motor, a suction motor, and a controller. Debris and air are allowed to enter the handheld surface cleaner through the inlet. The tank is configured to contain and store therein the debris. The separator is configured to separate the debris and the air to allow the debris to be collected in the tank and to allow the air to exit the handheld surface cleaner. The separator motor is configured to drive rotation of the separator. The rotation of the separator is configured to direct the debris toward the tank. The suction motor is configured to provide a suction force to draw the debris and air into the inlet and into the separator. The controller is configured to control the suction motor and the separator motor based on a measured current of the separator motor.

The cleaning system can include any number of variations. For example, the controller can be configured to cause the suction motor and the separator motor to be powered off in response to the measured current being greater than a predetermined threshold current value. Further, the controller can be configured to cause the suction motor to be powered off before the separator motor is powered off in response to the measured current being greater than the predetermined threshold current value, or the controller can be configured to cause the suction motor and the separator motor to be powered off simultaneously in response to the measured current being greater than the predetermined threshold current value.

For another example, the handheld surface cleaner can also include a current sensor operably coupled to the controller and configured to measure the current of the separator motor.

For another example, the separator can have an open proximal end through which the air exits the separator, and the separator can have a plurality of holes in a sidewall of the separator through which the debris exits the separator. In some implementations, the plurality of holes can be open with the separator rotating, and the plurality of holes can be closed with the separator not rotating. Further, each of the plurality of holes can have an associated cover that is configured to move automatically from an active configuration, in which the covers do not cover their associated holes, and a resting configuration, in which the covers cover their associated holes; and/or the handheld surface cleaner can also include a centrifugal seal upstream of the separator. Further, the rotation of the separator can be configured to cause the covers to move from the resting configuration to the active configuration, and the separator stopping rotating can be configured to cause the covers to move from the active configuration to the resting configuration. In some implementations, the plurality of holes can be open regardless of whether the separator is rotating. Further, the handheld surface cleaner can also include a duckbill valve upstream of the separator.

For yet another example, the handheld surface cleaner can also include a first filter upstream of the separator, and the handheld surface cleaner can also include a second filter downstream of the separator.

For another example, the handheld surface cleaner can also include a main body; the controller can be configured to determine whether the tank is releasably coupled to the main body; the controller can be configured to, in response to determining that the tank is releasably coupled to the main body, allow the suction motor and the separator motor to be powered on; and the controller can be configured to, in response to determining that the tank is not releasably coupled to the main body, prevent the suction motor and the separator motor from being powered on.

For yet another example, a separator assembly of the handheld surface cleaner can include the separator and the separator motor, and the separator assembly can be configured to be removable from the tank.

For another example, the handheld surface cleaner can also include a main body, a separator assembly of the handheld surface cleaner can include the separator and the separator motor, and the separator motor can be configured to be removable from the tank with the main body, the separator remaining coupled to the tank.

For yet another example, the handheld surface cleaner can include a power supply. Further, the power supply can include a battery. Further, the battery can include a rechargeable battery.

For still another example, the cleaning system can also include a plurality of attachments configured to be selectively coupled one at a time to the inlet, and the plurality of attachments can include at least two of a stain tool attachment, a crevice tool attachment, and a pet hair tool attachment. Further, the cleaning system can also include a tray configured to seat simultaneously the handheld surface cleaner and the at least two of the stain tool attachment, the crevice tool attachment, and the pet hair tool attachment.

For another example, the tank can be configured to releasably couple to the main body.

For still another example, the cleaning system can also include a tray configured to seat the handheld surface cleaner. Further, the handheld surface cleaner can include a rechargeable power supply, and the rechargeable power supply can be configured to be recharged with the tray seating the handheld surface cleaner. Further, the rechargeable power supply can include a rechargeable battery, and/or the cleaning system can also include a plurality of attachments configured to be selectively coupled one at a time to the inlet, and the plurality of attachments can include at least two of a stain tool attachment, a crevice tool attachment, and a pet hair tool attachment. Further, the tray can be configured to seat simultaneously the handheld surface cleaner and the at least two of the stain tool attachment, the crevice tool attachment, and the pet hair tool attachment.

For yet another example, the cleaning system can also include a spray bottle including a spray head and a dual cleaning solution container configured to be releasably coupled to the spray head, and the spray head can be configured to expel a liquid cleaning solution to a surface to be cleaned by the handheld surface cleaner. Further, the cleaning system can also include a tray configured to seat simultaneously the handheld surface cleaner and the spray bottle. Further, the cleaning system can also include a plurality of attachments configured to be selectively coupled one at a time to the inlet, and the plurality of attachments can include at least two of a stain tool attachment, a crevice tool attachment, and a pet hair tool attachment. Further, the tray can be configured to seat simultaneously the handheld surface cleaner, the spray bottle, and the at least two of the stain tool attachment, the crevice tool attachment, and the pet hair tool attachment.

In another implementation, a cleaning system includes a body of a surface cleaner, a suction motor, a tank, a separator, and a lid. The suction motor is configured to provide a suction force to draw debris and air into the surface cleaner. The tank is coupled to the body and includes a cavity configured to receive and store the debris drawn into the surface cleaner. The separator is configured to rotate to separate the debris from the air drawn into the surface cleaner by directing the debris radially outward into the cavity of the tank. The lid of the tank defines an air flow path along which the air separated from the debris flows from the separator toward an air exit hole formed in the body of the surface cleaner. The lid in a closed position closes an opening of the tank, and the lid in an open position allows the debris to exit the cavity through the opening. The tank is configured to be removed from the body with the lid in the closed position.

The cleaning system can have any number of variations. For example, the cleaning system can also include a separator motor configured to drive the rotation of the separator, and the separator motor can be configured to be removed from the body with the tank.

For another example, the cleaning system can also include a separator motor configured to drive the rotation of the separator, and the tank can be configured to be removed from the body without the separator motor.

For yet another example, the tank can be configured to be removed from the body with the separator in the tank, and the lid moving from the closed position to the open position can be configured to cause the separator to be removed from the tank.

For still another example, the cleaning system can also include a separator motor configured to drive the rotation of the separator, and the lid moving from the closed position to the open position can be configured to cause the separator motor and the separator to be removed from the tank.

For another example, the separator can have an open distal end through which the air enters the separator, the separator can have an open proximal end through which the air exits the separator toward the air flow path, and the separator can have a plurality of holes in a sidewall of the separator through which the debris exits the separator.

For still another example, the cleaning system can also include a centrifugal seal upstream of the separator, and the centrifugal seal can be configured to rotate with the separator. Further, the separator can have a plurality of holes in a sidewall of the separator through which the debris exits the separator, each of the plurality of holes can have an associated cover that is configured to move automatically from an active configuration, in which the covers do not cover their associated holes, and a resting configuration, in which the covers cover their associated holes, the rotation of the separator can be configured to cause the covers to move from the resting configuration to the active configuration, and the separator stopping rotating can be configured to cause the covers to move from the active configuration to the resting configuration; or the separator can have a plurality of holes in a sidewall of the separator through which the debris exits the separator, and the plurality of holes can be open regardless of whether the separator is rotating; and/or the cleaning system can include a valve upstream of the separator, and the valve can be configured to allow the debris and air drawn into the surface cleaner to flow proximally toward the separator and can be configured to prevent the debris and air drawn into the surface cleaner from flowing distally.

For yet another example, the cleaning system can also include a valve upstream of the separator, and the valve can be configured to allow the debris and air drawn into the surface cleaner to flow proximally toward the separator and can be configured to prevent the debris and air drawn into the surface cleaner from flowing distally.

For still another example, the cleaning system can also include a first filter upstream of the separator, and a second filter downstream of the separator.

For yet another example, the tank can be configured to releasably couple to the body, and the cleaning system can also include a controller configured to: determine whether the tank is releasably coupled to the body, in response to determining that the tank is releasably coupled to the body, allow the suction motor to be powered on, and, in response to determining that the tank is not releasably coupled to the body, prevent the suction motor from being powered on.

For still another example, the cleaning system can also include a rechargeable power supply. Further, the rechargeable power supply can include a rechargeable battery.

For another example, the cleaning system can also include a tray configured to seat the surface cleaner for storage.

For yet another example, the cleaning system can also include a plurality of attachments configured to be selectively coupled one at a time to an inlet of the surface cleaner, and the plurality of attachments can include at least two of a stain tool attachment, a crevice tool attachment, and a pet hair tool attachment. Further, the cleaning system can also include a tray configured to seat simultaneously for storage the surface cleaner and the at least two of the stain tool attachment, the crevice tool attachment, and the pet hair tool attachment.

For another example, the tank can be configured to be removed from the body with the separator in the tank.

For yet another example, the tank can be configured to be removed from the body with the separator remaining coupled to the body.

In another implementation, a cleaning system includes a handheld surface cleaner that includes a distal inlet through which debris and air are allowed to enter the handheld surface cleaner, a tank, a separator, a first filter, a first seal, a barrier, and a second filter. The separator is configured to rotate to separate the debris from the air by directing the debris radially outward into the cavity of the tank and directing the air to an air flow path along which the air flows toward an air exit hole of the handheld surface cleaner. The first filter is downstream of the inlet and upstream of the separator, and the first filter is configured to filter debris above a first predetermined size from flowing to the separator. The first seal is downstream of the first filter and upstream of the separator, and the first seal is configured to prevent the debris contained and stored in the tank from reaching the first filter. The barrier is downstream of the inlet and upstream of the air exit hole, and the barrier is configured to prevent the debris contained and stored in the tank from reaching the air flow path. The second filter is downstream of the inlet and upstream of the air exit hole, and the second filter is configured to filter debris above a second predetermined size from flowing to the air exit hole.

The cleaning system can vary in any number of ways. For example, the barrier can include one of a second seal and a bracket that defines the air flow path.

For another example, the barrier can include a second seal and can include a bracket that defines the air flow path, and the second seal can be sandwiched between the separator and the bracket.

For yet another example, the separator and the first seal can be configured to rotate together relative to the first filter, the second filter, and the barrier.

For still another example, the handheld surface cleaner can also include a hosing in which the first filter is at least partially disposed, the separator and the first seal can be configured to rotate together relative to the hosing, and the rotation of the first seal can be configured to cause the first seal to move a distance proximally relative to the hosing. Further, the first seal can remain at least partially disposed within the hosing with the first seal rotating, or the first seal can be configured to abut the hosing with the first seal not rotating and configured to not abut the hosing with the first seal rotating.

For yet another example, the handheld surface cleaner can also include a valve downstream of the inlet and upstream of the separator, and the valve can be configured to allow the debris and air to flow proximally toward the separator and configured to prevent the debris and air drawn into the surface cleaner from flowing distally toward the inlet. Further, the valve can be located entirely distal to the first seal, or the valve can extend proximally into the first seal.

For another example, the separator can have a plurality of holes in a sidewall of the separator through which the debris exits the separator, each of the plurality of holes can have an associated cover that is configured to move automatically from an active configuration, in which the covers do not cover their associated holes, and a resting configuration, in which the covers cover their associated holes, the rotation of the separator can be configured to cause the covers to move from the resting configuration to the active configuration. Further, the separator stopping rotating can be configured to cause the covers to move from the active configuration to the resting configuration; or the separator can have a plurality of holes in a sidewall of the separator through which the debris exits the separator, and the plurality of holes can be open regardless of whether the separator is rotating.

For still another example, the handheld surface cleaner can also include a rechargeable power supply. Further, the rechargeable power supply can include a rechargeable battery.

For another example, the cleaning system can also include a tray configured to seat the handheld surface cleaner for storage.

For yet another example, the cleaning system can also include a plurality of attachments configured to be selectively coupled one at a time to the inlet, and the plurality of attachments can include at least two of a stain tool attachment, a crevice tool attachment, and a pet hair tool attachment. Further, the cleaning system can also include a tray configured to seat simultaneously for storage the handheld surface cleaner and the at least two of the stain tool attachment, the crevice tool attachment, and the pet hair tool attachment.

In another implementation, a cleaning system includes a surface cleaner that includes an inlet, a separator, and a motor. Debris and air re configured to be suctioned into the surface cleaner through the inlet. The separator is proximal to the inlet, has an outlet opening, has a plurality of holes formed in a sidewall of the separator, and has a plurality of covers. Each one of the plurality of covers is associated with at least one of the plurality of holes. The motor is configured to drive rotation of the separator. The rotation of the separator is configured to: cause the plurality of covers to move from a closed position, in which each of the plurality of covers closes the associated at least one of the plurality of holes, to an open position, in which each of the plurality of covers does not close the associated at least one of the plurality of holes; separate the debris from the air by directing the debris radially outward through the plurality of holes; and direct the air out of the separator through the outlet opening. The rotation of the separator stopping is configured to: cause the plurality of covers to move from the open position to the closed position.

The cleaning system can vary in any number of ways. For example, each of the plurality of covers in the closed position can provide a fluid seal of the associated at least one of the plurality of holes.

For another example, each of the plurality of covers can be attached to the separator along a single edge of the cover.

For yet another example, each of the plurality of covers can be flexible. Further, the separator can be rigid.

For still another example, the outlet opening can be at a proximal end of the separator, the separator can include an inlet opening at a distal end of the separator, and the inlet opening can be configured to allow the debris and air are allowed to enter the separator through the inlet opening.

For another example, the sidewall of the separator can extend from the inlet opening to the outlet opening.

For yet another example, wherein the surface cleaner can also include a tank having a cavity configured to contain and store therein the debris that is directed radially outward through the plurality of holes. Further, the surface cleaner can also include an air exit hole configured to allow the air that is directed out of the separator through the outlet opening to exit to external atmosphere.

For another example, the handheld cleaner can also include at least one of: a first filter upstream of the separator, and a second filter downstream of the separator.

For yet another example, each one of the plurality of covers can be associated with only one of the plurality of holes.

In another implementation, a cleaning system includes a surface cleaner including an inlet, a tank, and a rotatable separator. Debris and air is configured to be suctioned into the surface cleaner through the inlet. The tank is configured to contain and store therein the debris. The rotatable separator is proximal to the inlet and is configured to separate the debris and the air to allow the debris to be collected in the tank and to allow the air to exit the surface cleaner. The rotatable separator includes a body and a seal. The body has a plurality of side holes through which the debris is configured to exit the separator for collection in the tank. The seal has an inner passageway through which the debris and air flows toward the body. The seal is configured to prevent the debris in the tank from passing to the inlet.

The surface cleaner can have any number of variations. For example, the body can have a plurality of side holes through which the debris exits the separator. Further, each of the plurality of holes can have an associated cover that is configured to move automatically from an active configuration, in which the covers do not cover their associated holes, and a resting configuration, in which the covers cover their associated holes, and the covers can be configured to cooperate with the seal to prevent the debris in the tank from passing to the inlet; or the plurality of side holes can be open regardless of whether the rotatable separator is rotating.

For another example, the rotatable separator and the motor can be configured to be removed as a unit from the tank.

For yet another example, the rotatable separator can be configured to be removed from the tank without the motor.

For another example, the rotatable separator can also include a first plurality of arms extend proximally from the body, and the rotatable separator can also include a second plurality of arms extend distally from the body.

For still another example, the surface cleaner can also include at least one of: a first filter upstream of the separator, and a second filter downstream of the separator.

For another example, the surface cleaner can also include a motor configured to drive the rotation of the rotatable separator.

In another implementation, a cleaning system includes a handheld surface cleaner that includes a proximal handle, a distal inlet, a tank, and a separator. The proximal handle defines a first longitudinal axis. Debris and air are allowed to enter the handheld surface cleaner through the distal inlet. The tank includes a cavity configured to contain and store therein the debris. The separator is proximal to the inlet and distal to the handle. The separator is configured to separate the debris and the air to allow the debris to be collected in the cavity and to allow the air to exit the handheld surface cleaner. The first flow path from the distal inlet to the separator defines a second longitudinal axis. The first longitudinal axis is at an angle relative to the second longitudinal axis that is in a range of about 150 degrees to about 170 degrees. The separator is located along the second longitudinal axis.

The cleaning system can have any number of variations. For example, the handheld surface cleaner can be configured to allow the air and the debris that enters the device to flow along the first flow path and diverge from the first flow path at the separator. Further, the separator can include an inlet opening through which debris and air cam be allowed to enter the separator, an outlet opening through which the air is configured to exit the separator, and a plurality of holes formed in a sidewall of the body and through which the debris is configured to exit the separator.

For another example, the separator can be configured to direct the debris into the tank along a debris flow path that is different from an air flow path along which air flows downstream of the separator. Further, the air flow path downstream of the separator can define a third longitudinal axis that is transverse to the first flow path.

For yet another example, the separator can be configured to rotate to separate the debris and the air, the cleaning system can also include a motor configured to drive rotation of the separator, and the motor can be located along the second longitudinal axis. Further, the separator can include an inlet opening through which debris and air can be allowed to enter the separator, an outlet opening through which the air is configured to exit the separator, and a plurality of holes formed in a sidewall of the body and through which the debris is configured to exit the separator.

For still another example, the cleaning system can also include a motor configured to provide a suction force to draw the debris and the air into the inlet, and the motor can be offset from the first and second longitudinal axes.

For yet another example, the cleaning system can also include a body configured to releasably attach to the tank, the handle can define a proximal portion of the body, and the separator can be disposed in the tank and is configured to be released from the body with the tank.

For another example, the handle can define a pistol grip.

For yet another example, the cleaning system can also include a rechargeable battery, the rechargeable battery can be seated in an interior of the handle, the separator can be configured to rotate to separate the debris and the air, and the rechargeable battery can be configured to power rotation of the separator. Further, the separator can be configured to rotate to separate the debris and the air, the cleaning system can also include a motor configured to drive the rotation of the separator, the rechargeable battery can be configured to provide power to the motor, and the motor can be located along the second longitudinal axis; and/or the separator can include an inlet opening through which debris and air can be allowed to enter the separator, an outlet opening through which the air is configured to exit the separator, and a plurality of holes formed in a sidewall of the body and through which the debris is configured to exit the separator.

In another implementation, a cleaning system includes a handheld surface cleaner that includes an inlet, a cavity, a separator, and a filter. Debris and air are allowed to enter the handheld surface cleaner through the inlet. The cavity is configured to contain and store therein the debris. The separator is configured to separate the debris and the air to allow the debris to be collected in the cavity and to allow the air to exit the handheld surface cleaner. The filter is configured to be coupled to the handheld surface cleaner and be located upstream of the separator. The handheld surface cleaner is configured to releasably couple to a selected one of a plurality of attachments. The handheld surface cleaner is configured to prevent the attachment from being attached to the handheld surface cleaner unless the filter is coupled to the handheld surface cleaner.

The handheld surface cleaner can vary in any number of ways. For example, the handheld surface cleaner can also include a lockout member, the filter can include an arm configured to engage the lockout member with the filter coupled to the handheld surface cleaner, the lockout member not being engaged with the arm can be configured to prevent the attachment from being attached to the handheld surface cleaner, and the lockout member being engaged with the arm can be configured to allow the attachment to be attached to the handheld surface cleaner. Further, the handheld surface cleaner can also include a housing configured to be removably coupled to the handheld surface cleaner after the filter has been removably coupled to the handheld surface cleaner, and the housing can be configured to releasably couple to the attachment. Further, the distal housing can include at least one of: at least one hook configured to engage at least one groove of the attachment, and at least one groove configured to engage at least one hook of the attachment.

For another example, the handheld surface cleaner can also include a housing configured to be removably coupled to the handheld surface cleaner only after the filter has been removably coupled to the handheld surface cleaner, and the housing can be configured to releasably couple to the attachment.

For yet another example, the filter can be a singular part.

For still another example, the filter can include first and second parts movably attached to one another to allow the filter to move between open and closed configurations. Further, the filter can include a lock configured to lock the first and second parts in the closed configuration.

For yet another example, the handheld surface cleaner can also include a first seal configured to be located upstream of the separator and downstream of the filter. Further, the filter can include a second seal configured to located upstream of the first seal. Further, the handheld surface cleaner can also include a third seal configured to located downstream of the first seal.

For another example, the handheld surface cleaner can also include a motor configured to provide a suction force to draw the debris and air into the inlet and into the separator, and the filter can include a seal configured to move open automatically by the suction force.

For yet another example, the handheld surface cleaner can also include a motor configured to drive rotation of the separator.

For another example, the handheld surface cleaner can also include a second filter downstream of the separator.

For still another example, the handheld surface cleaner can also include a tank that has the cavity formed therein, the filter can be configured to be removably attached to the tank, and the handheld surface cleaner can also include a body configured to be removably coupled to the tank. Further, the handheld surface cleaner can also include a motor at the body configured to provide a suction force to draw the debris and air into the inlet and into the separator, and the filter can include a seal configured to move open automatically by the suction force.

For another example, the cleaning system can also include the plurality of attachments. Further, the plurality of attachments can include at least two of a stain tool attachment, a crevice tool attachment, and a pet hair tool attachment.

In another implementation, a handheld surface cleaner includes a body, an inlet, a tank, a separator, a separator motor, a power source, a controller, and a switch. Debris and air are allowed to enter the handheld surface cleaner through the inlet. The tank is configured to removably couple to the body and to contain and store therein the debris. The separator is configured to separate the debris and the air to allow the debris to be collected in the tank and to allow the air to exit the handheld surface cleaner. The separator motor is configured to drive the rotation of the separator. The controller is operatively coupled to the separator motor and is configured to control the separator motor. The switch is operatively coupled to the controller and is configured to be activated automatically in response to the tank being removably coupled to the body. The switch being activated is configured to allow the power source to supply power to the separator motor. The switch being deactivated is configured to prevent the power source from supplying power to the separator motor.

The cleaning system can vary in any number of ways. For example, the tank can include a protrusion configured to automatically press the switch in response to the tank being removably coupled to the body, and the controller can be configured to allow the separator motor to drive the rotation of the separator only with the switch activated. Further, the protrusion can extend from a latch configured to lock the tank and the body together; and/or the handheld surface cleaner can also include a housing having a recessed area with a width, the switch can be located in the recessed area of the housing, and the protrusion can be configured to enter the recessed area of the housing to activate the switch. Further, the width can be too small for a finger of a user to enter the recessed area.

For another example, the handheld surface cleaner can also include a latch configured to move between a locked configuration, in which the latch locks the tank and the body together, and an unlocked configuration, in which the tank and the body are not locked together, and the latch moving from the unlocked configuration to the locked configuration can be configured to cause the switch to be activated. Further, the latch can include a protrusion configured to automatically press the switch in response to the tank being removably coupled to the body, and the controller can be configured to allow the separator motor to drive the rotation of the separator only with the switch activated; and/or the handheld surface cleaner can also include a housing having a recessed area with a width, the switch can be located in the recessed area of the housing, and the latch can be configured to enter the recessed area of the housing to activate the switch. Further, the width can be too small for a finger of a user to enter the recessed area.

For still another example, with the switch activated, a circuit including the power supply and the separator motor can be closed, and, with the switch deactivated, a circuit including the power supply and the separator motor can be open.

For yet another example, the body can include a first electrical connector, the tank can include a second electrical connector, and the first and second electrical connectors can be configured to engage automatically to establish an electrical connection between the separator motor and the controller in response to the tank being removably coupled to the body. Further, the electrical connection can be isolated from a flow path of the debris and the air in the handheld surface cleaner.

For still another example, the separator motor can be at the tank and can be configured to be removed from the body with the tank.

For yet another example, the separator motor can be at the body and can be configured to be removed from the tank with the body.

For another example, the tank can be configured to be removably coupled to the body using a selected one of rotational motion and translational motion. Further, the tank can be configured to be detached from the body using rotational motion.

For yet another example, the handheld surface cleaner can also include a suction motor at the body and configured to provide a suction force to draw debris and air into the handheld surface cleaner.

For another example, the separator motor can also be configured to provide a suction force to draw debris and air into the handheld surface cleaner.

In another implementation, a cleaning system includes a handheld surface cleaner that includes a body, an inlet, a tank, and a separator. Debris and air are allowed to enter the handheld surface cleaner through the inlet. The tank is configured to removably couple to the body and to contain and store therein the debris. The separator is configured to separate the debris and the air to allow the debris to be collected in the tank and to allow the air to exit the handheld surface cleaner. The tank is configured to be removably coupled to the body using a selected one of translational motion along a first longitudinal axis extending from the inlet to the separator and rotational motion about a rotational axis offset from the first longitudinal axis.

The cleaning system can have any number of variations. For example, the tank can be configured to be detached from the body using the rotational motion.

For another example, the tank can include a first attachment mechanism, the body can include a second attachment mechanism, and the first and second attachment mechanisms can be configured to be engaged throughout the rotational motion. Further, the first and second attachment mechanisms can be configured to not be engaged until an end of the translational motion, and/or one of the first and second attachment mechanisms can include a hook and the other of the first and second attachment mechanisms can include an opening. Further, the handheld surface cleaner can also include a bias element biasing the hook downwardly, the hook can be configured to be seated in the opening at a start of the rotational motion, and the hook can be configured to automatically enter the opening after a start of the translational motion.

For yet another example, one of the tank and the body can include a hook, the other of the tank and the body can include an opening, the hook can be configured to be seated in the opening at a start of the rotational motion, and the hook can be configured to automatically enter the opening after a start of the translational motion.

For still another example, the handheld surface cleaner can also include a handle at the body, and, with the tank removably coupled to the body, the handle can define a second longitudinal axis that is at a transverse angle to the longitudinal axis. Further, the first longitudinal axis can intersect the handle, and/or the handle can define a pistol grip.

For another example, the tank can include a first electrical connector, the body can include a second electrical connector, and the first and second electrical connectors can be configured to engage automatically to establish an electrical connection between the separator motor and the controller in response to the tank being removably coupled to the body. Further, the electrical connection can be isolated from a flow path of the debris and the air in the handheld surface cleaner.

For yet another example, the handheld surface cleaner can also include a motor configured to drive rotation of the separator. Further, the handheld surface cleaner can also include a controller, the handheld surface cleaner can also include a microswitch operatively coupled to the controller and configured to be activated automatically in response to the tank being removably coupled to the body, and the controller can be configured to allow the motor to drive the rotation of the separator only with the microswitch activated. Further, the tank can include a protrusion configured to automatically press the microswitch in response to the tank being removably coupled to the body.

For still another example, the handheld surface cleaner can also include a motor configured to drive rotation of the separator, the handheld surface cleaner can also include a controller, the handheld surface cleaner can also include a microswitch, the handheld surface cleaner can also include a latch configured to move between a locked configuration, in which the latch locks the tank and the body together, and an unlocked configuration, in which the tank and the body are not locked together, the latch moving from the unlocked configuration to the locked configuration can be configured to cause the microswitch to be activated, and the controller can be configured to prevent the motor from driving the rotation of the separator unless the microswitch is activated.

For yet another example, the handheld surface cleaner can also include a motor configured to provide a suction force to draw the debris and the air into the handheld surface cleaner.

In another implementation, a cleaning system includes a handheld surface cleaner that includes a body, a tank, and a separator. The body includes a first electrical connector. The tank includes a second electrical connector, and the tank is configured to removably couple to the body. The separator is configured to separate debris and air to allow the debris to be collected in the tank and to allow the air to exit the handheld surface cleaner. The first and second electrical connectors are configured to engage automatically to establish an electrical connection in response to the tank being removably coupled to the body. The handheld surface cleaner can be configured to allow the debris and the air flow in the handheld surface cleaner along a flow path that is isolated from the electrical connection.

The cleaning system can vary in any number of ways. For example, the flow path can include a common flow path along which the debris and the air flow to the separator, a debris flow path along which the debris flows from the separator, and an air flow path that is different from the debris flow path and along which the air flows from the separator. Further, the common flow path can defines a first longitudinal axis, and the tank can be configured to be removably coupled to the body using a selected one of translational motion along the first longitudinal axis and rotational motion about a rotational axis offset from the first longitudinal axis.

For another example, the handheld surface cleaner can also include a motor configured to drive rotation of the separator, the handheld surface cleaner can also include a power supply, and the power supply can be configured to provide power to the motor with the electrical connection established.

For yet another example, the handheld surface cleaner can include a motor configured to drive rotation of the separator. Further, the motor can be located at the tank, the handheld surface cleaner can also include a power supply at the body, and the power supply can be configured to provide power to the motor with the electrical connection established.

For still another example, the first electrical connector can include a pair of conductive plates. Further, the second electrical connector can include a pair of pogo pins.

For another example, a separator assembly of the handheld surface cleaner can include the separator and the first electrical connector, and the separator assembly can be configured to be removably coupled with the tank and can be configured to be removably coupled to the body with the tank. Further, the separator assembly can also include a motor configured to drive rotation of the separator, the handheld surface cleaner can also include a power supply at the body, and the power supply can be configured to provide power to the motor with the electrical connection established.

For yet another example, the handheld surface cleaner can also include a motor configured to drive rotation of the separator, and the handheld surface cleaner can also include a housing that houses the motor and includes the first electrical connector. Further, the motor, the housing, and the separator can be configured to be removed as a unit from the tank and to be coupled as a unit to the tank. Further, the handheld surface cleaner can also include a power supply at the body, and the power supply can be configured to provide power to the motor with the electrical connection established.

For still another example, the handheld surface cleaner can also include a motor configured to provide a suction force to draw the debris and the air into the handheld surface cleaner.

For another example, the body can define a handle of the handheld surface cleaner.

For yet another example, the handheld surface cleaner can be configured to always maintain the flow path being isolated from the electrical connection.

In another implementation, a cleaning system includes a handheld surface cleaner that includes an inlet, a tank, a rotatable separator, and a valve. Debris and air can be allowed to enter the handheld surface cleaner through the inlet. The rotatable separator is configured to be located in the tank downstream of the inlet and is configured to separate the debris and the air to allow the debris to be collected in the tank and to allow the air to exit the handheld surface cleaner. The valve is removably coupled to the tank, is configured to be located in the tank downstream of the inlet and upstream of the rotatable separator, and is configured to allow flow of the debris and the air in only one direction from the inlet toward the separator.

The cleaning system can vary in any number of ways. For example, the handheld surface cleaner can also include a housing that houses the valve, and the housing and the valve can be configured to be removed as a unit from the tank.

For another example, the handheld surface cleaner can also include a body configured to be removably coupled to the tank. Further, the valve can be configured to be removed from the tank only with the body not being removably coupled with the body, and/or the body can define a handle of the handheld surface cleaner.

For yet another example, a first plurality of arms can extend proximally from a body of the rotatable separator and can be configured to rotate with the rotatable separator around the valve. Further, a second plurality of arms can extend distally from the body of the separator, the handheld surface cleaner can also include a housing downstream of the separator through which the air is configured to flow after exiting the separator, and the second plurality of arms can be configured to rotate with the rotatable separator around the housing. Further, the handheld surface cleaner can also include a motor configured to drive the rotation of the separator, and the motor can be located at least partially within the housing.

For another example, the handheld surface cleaner can also include a filter non-removably coupled to the tank and located upstream of the valve.

For yet another example, the handheld surface cleaner can also include a filter removably coupled to the tank and located upstream of the valve in a distal portion of the tank, and the valve can be configured to be removed from the tank only through an open proximal end of the tank. Further, the handheld surface cleaner can also include a second filter removably coupled to the tank and located downstream of the separator.

For still another example, the separator can be removably coupled to the tank, and the valve can be configured to be removed from the tank only with the separator not being removably coupled with the tank. Further, the separator can be configured to be removed from the tank through an open proximal end of the tank, and the valve can be configured to be removed from the tank through the open proximal end of the tank; and/or the handheld surface cleaner can also include a motor configured to drive the rotation of the separator, and the motor and the separator can be configured to be removed as a unit from the tank.

For yet another example, the valve can be a duckbill valve.

In another implementation, a cleaning system includes a handheld surface cleaner that includes an inlet, a tank, a separator, a lid, and a cap. Debris and air can be allowed to enter the handheld surface cleaner through the inlet. The separator is configured to separate the debris and the air to allow the debris to be collected in the tank and to allow the air to exit the handheld surface cleaner. The lid is configured to be removed from the tank to allow the debris collected in the tank to be removed from the tank through an open end of the tank. The cap is separate from the lid and is configured to allow the debris collected in the tank to be removed from the tank through an opening formed in a sidewall of the tank. The cap is attached to the tank and is configured to be removed completely from the tank and replaced on the tank.

The cleaning system can have any number of variations. For example, the cap can be movable between an open position, in which the opening is not sealed, and a closed position, in which the opening is sealed, and the handheld surface cleaner can also include a bias element configured to bias the cap to the closed position.

For another example, the cap can be movable between an open position, in which the opening is not sealed, and a closed position, in which the opening is sealed, and the cap can include a lock configured to lock the cap in the closed position.

For yet another example, the inlet can be in a distal portion of the tank, the open end of the tank can be at a proximal end of the tank, and the cap can be located between the inlet and the open end.

For still another example, the handheld surface cleaner can also include a motor configured to drive rotation of the separator, and the handheld surface cleaner can also include a controller configured to control the motor based on a measured current of the motor. Further, the handheld surface cleaner can also include a suction motor configured to provide a suction force to draw the debris and air into the inlet, and the controller can also be configured to control the suction motor based on the measured current of the separator motor.

For yet another example, the separator can be non-removably coupled to the lid.

For another example, the handheld surface cleaner can also include a motor configured to drive rotation of the separator, and the motor can be non-removably coupled to the lid.

For yet another example, the handheld surface cleaner can also include a motor configured to drive rotation of the separator, the handheld surface cleaner can also include a body configured to be removably coupled to the tank, the body can define a handle of the handheld surface cleaner, and the motor can be at the body and can be configured to be removed from the tank with the body.

For still another example, the handheld surface cleaner can also include a body configured to be removably coupled to the tank, and the lid can be configured to be removable from the tank only with the body removed from the tank. Further, the handheld surface cleaner can also include a suction motor at the body, and the suction motor can be configured to provide a suction force to draw the debris and air into the inlet.

For another example, the cap can be pivotally attached to the tank.

In another aspect, a separation apparatus is provided that in one implementation includes a separator that includes a body, an inlet opening, an outlet opening, a plurality of holes, and a plurality of covers. Debris and air can be allowed to enter the separator through the inlet opening. The air is configured to exit the separator through the outlet opening. The plurality of holes are formed in a sidewall of the body. The debris is configured to exit the separator through the plurality of holes. Each one of the plurality of covers is configured to move from a sealed configuration, in which each of the plurality of covers seals closed an associated at least one of the plurality of holes, to an unsealed configuration, in which each of the plurality of covers does not seal closed the associated at least one of the plurality of holes.

The separation apparatus can vary in any number of ways. For example, rotation of the separator can be configured to cause the plurality of covers to move from the sealed configuration to the unsealed configuration, and the rotation of the separator stopping is configured to cause the plurality of covers to move from the unsealed configuration to the sealed configuration. Further, the separator is configured to rotate about a longitudinal axis extending between the inlet opening and the outlet opening, and/or the separation apparatus can also include a motor configured to drive the rotation of the separator.

For another example, each of the plurality of covers can be attached to the body along a single edge of the cover.

For yet another example, each of the plurality of covers can be flexible.

For another example, the separator can also include a plurality of blades positioned downstream of the inlet opening and upstream of the outlet opening.

For yet another example, the body can be a singular element. Further, the body can be rigid, and each of the plurality of covers can be flexible.

For still another example, the body can include an inner body and an outer body that is attached to the inner body. Further, the separator can also include a plurality of blades positioned downstream of the inlet opening and upstream of the outlet opening, the blades can be formed on the inner body, and the holes can be formed in the outer body; and/or the inner and outer bodies can be rigid, and each of the plurality of covers can be flexible.

For another example, the separator can also include a first plurality of arms extend proximally from the body, and the separator can also include a second plurality of arms extend distally from the body.

For yet another example, the separation apparatus can also include a surface cleaner that includes the separator, the surface cleaner can also include an inlet through which the debris and the air is configured to be suctioned into the surface cleaner, and the separator can be downstream of the inlet. Further, the surface cleaner can also a motor configured to drive rotation of the separator; the surface cleaner can also include a tank having a cavity configured to contain and store therein the debris that enters the separator, with the plurality of covers in the sealed configuration an interior of the separator can not be in fluid communication with the cavity through the plurality of holes, and with the plurality of covers in the unsealed configuration the interior of the separator can be in fluid communication with the cavity through the plurality of holes; the surface cleaner can be configured to be handheld; and/or the surface cleaner can also include at least one of a first filter upstream of the separator, and a second filter downstream of the separator. Further, the surface cleaner can also include an air exit hole configured to allow the air that is directed out of the separator through the outlet opening to exit to external atmosphere.

For another example, each one of the plurality of covers can be associated with only one of the plurality of holes.

In another aspect, a method of using a handheld surface cleaner as described herein is provided.

In another aspect, a separator as described herein is provided. The separator can be configured to be used, for example, with a handheld surface cleaner.

In another aspect, a method of using a separator as described herein is provided. The separator can be configured to be used, for example, with a handheld surface cleaner.

In another aspect, a separator assembly as described herein is provided. The separator assembly can be configured to be used, for example, with a handheld surface cleaner.

In another aspect, a method of using a separator assembly as described herein is provided. The separator assembly can be configured to be used, for example, with a handheld surface cleaner.

BRIEF DESCRIPTION OF DRAWINGS

This disclosure will be more fully understood from the following detailed description taken in conjunction with the accompanying drawings, in which:

FIG. 63AA is side cross-sectional view of a portion of the handheld surface cleaner of FIG. 63A with one implementation of a tool engaging the duckbill valve assembly;

FIG. 63BB is a perspective view of a cap of the handheld surface cleaner of FIG. 63A;

FIG. 63CC is a perspective cross-sectional view of a portion of the handheld surface cleaner of FIG. 63A;

FIG. 63DD is a perspective view of a portion of the handheld surface cleaner of FIG. 63A with a distal housing of the handheld surface cleaner removed;

FIG. 63EE is a perspective view of the distal housing of the handheld surface cleaner of FIG. 63A;

FIG. 63FF is another perspective view of the distal housing of FIG. 63EE;

FIG. 63GG is a perspective view of another implementation of a main body of a handheld surface cleaner;

FIG. 63HH is another perspective view of the main body of FIG. 63GG;

FIG. 63II is a perspective view of a portion of a DC charger cord;

FIG. 63JJ is a perspective view and inset exploded view of another implementation of a separator;

FIG. 63KK is a perspective view and inset exploded view of yet another implementation of a separator;

FIG. 66A is a perspective view of another implementation of a tray;

FIG. 66B is another perspective view of the tray of FIG. 66A;

FIG. 66C is a perspective cross-sectional view of the tray of FIG. 66A;

FIG. 67 is a perspective view of a portion of another implementation of a tray and a perspective view of one implementation of a removable cup;

FIG. 68A is a perspective view of one implementation of a charger;

FIG. 68B is another perspective view of the charger of FIG. 68A;

FIG. 69 is a perspective view of another implementation of a tray with implementations of a handheld surface cleaner, attachments, and a spray bottle seated by the tray;

FIG. 70A is a perspective view of yet another implementation of a tray with implementations of a handheld surface cleaner and attachments seated by the tray;

FIG. 70B is another perspective view of the tray of FIG. 70A with the handheld surface cleaner and the attachments seated by the tray and with the charger of FIG. 68A operatively coupled to the handheld surface cleaner;

FIG. 70C is a perspective view of a portion of the handheld surface cleaner and portion of the tray of FIG. 70A and a portion of the charger of FIG. 68A;

FIG. 71 is perspective view of another implementation of a tray;

FIG. 72A is a perspective view of yet another implementation of a tray;

Figure 72A:
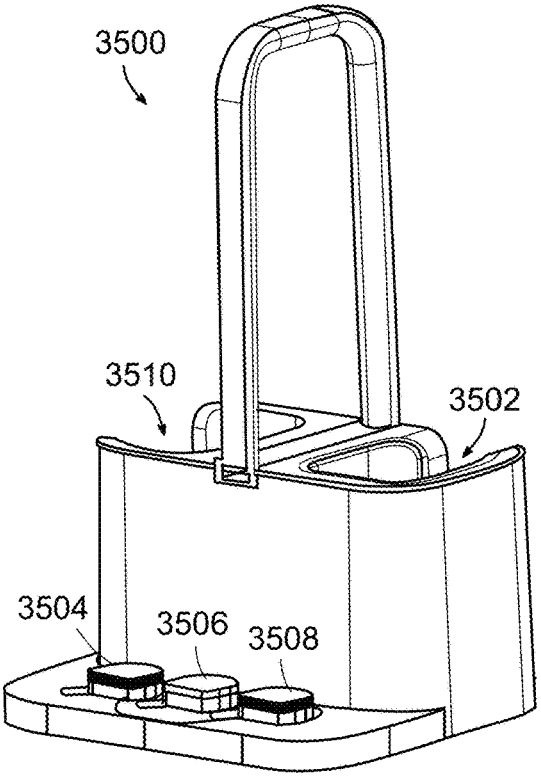
Figure 72B:
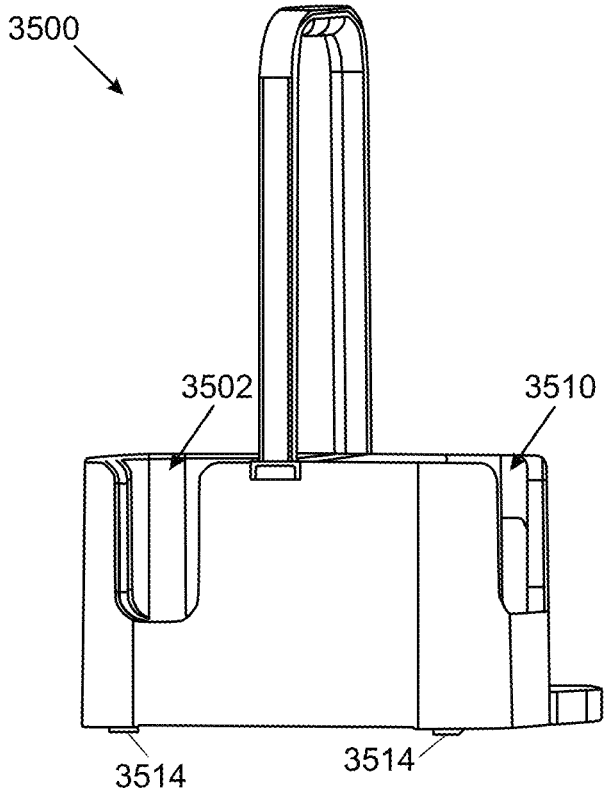
Figure 72C:
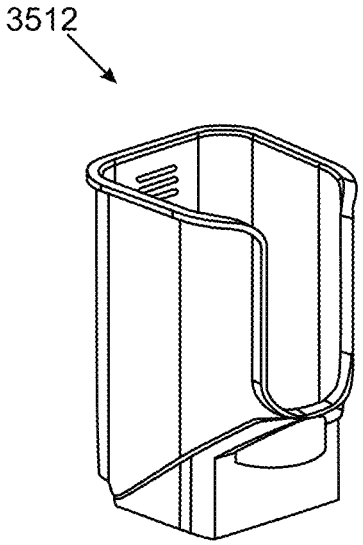
Figure 72D:
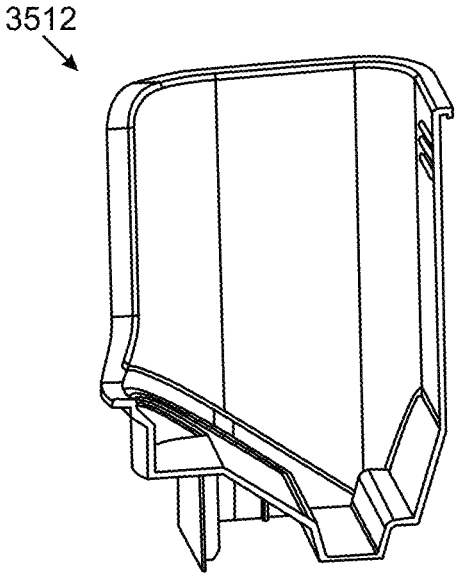
Figure 74:
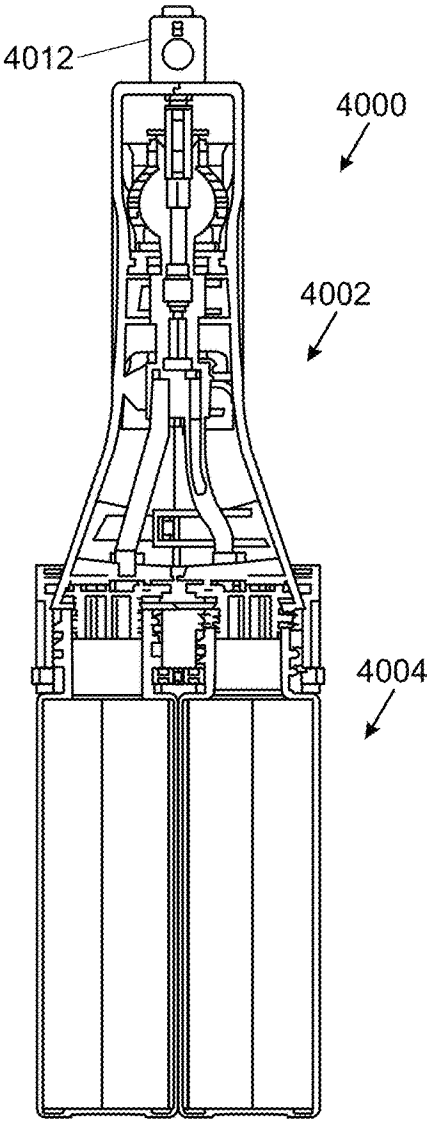
Figure 73:
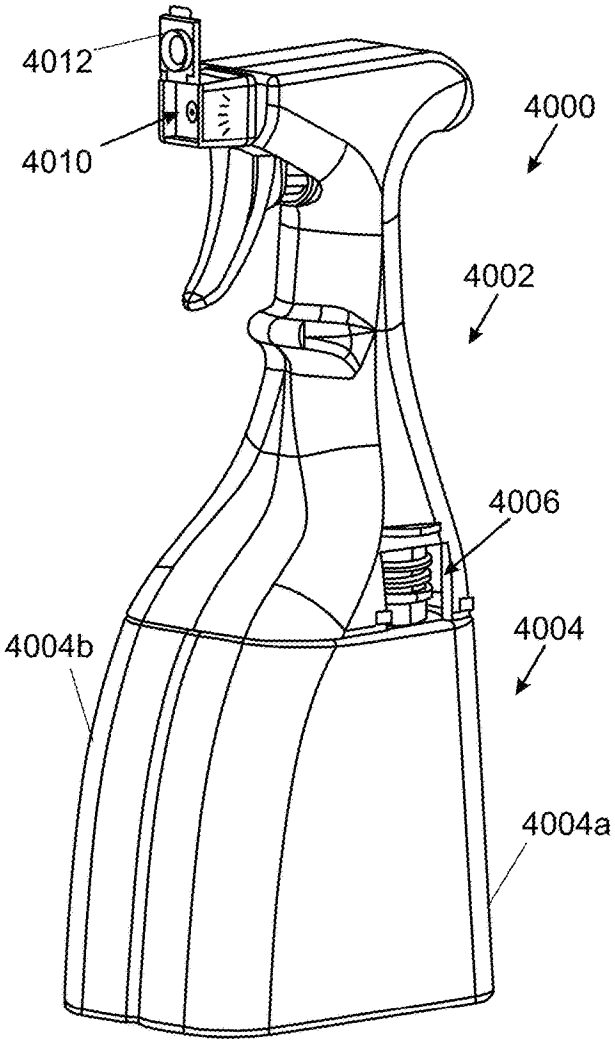
Figure 75:
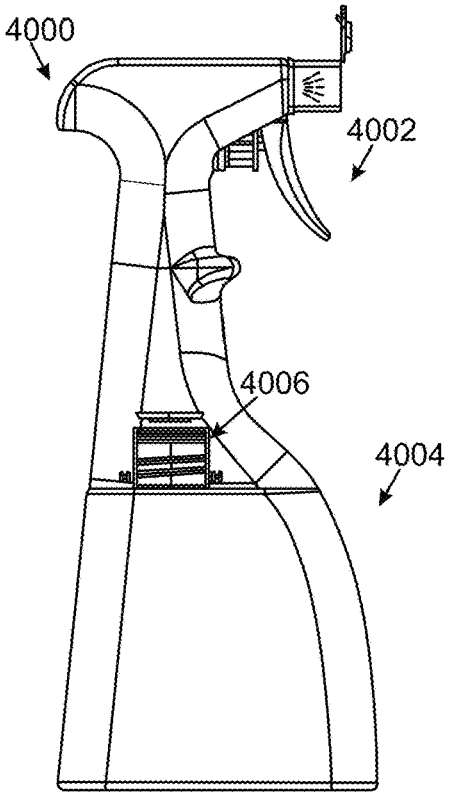
Figure 76:
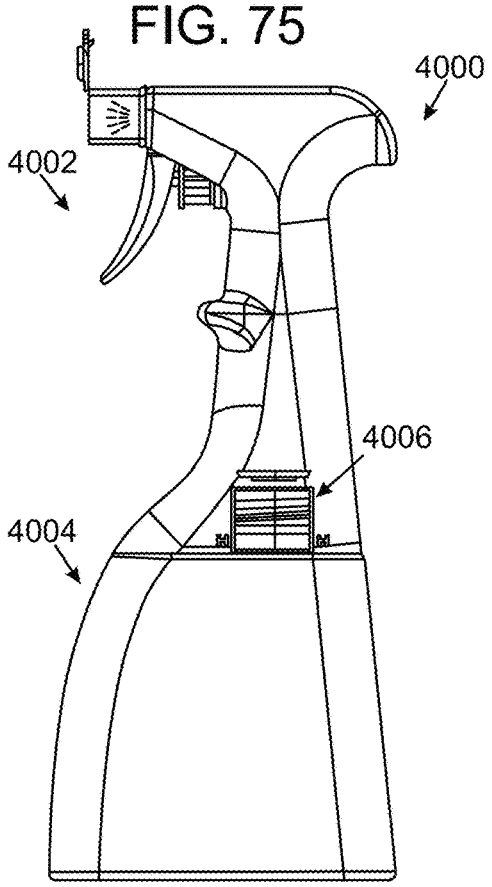
Figure 77:
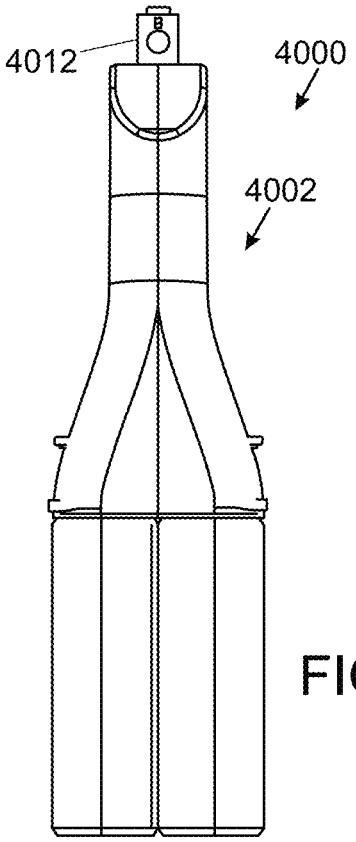
Figure 78:
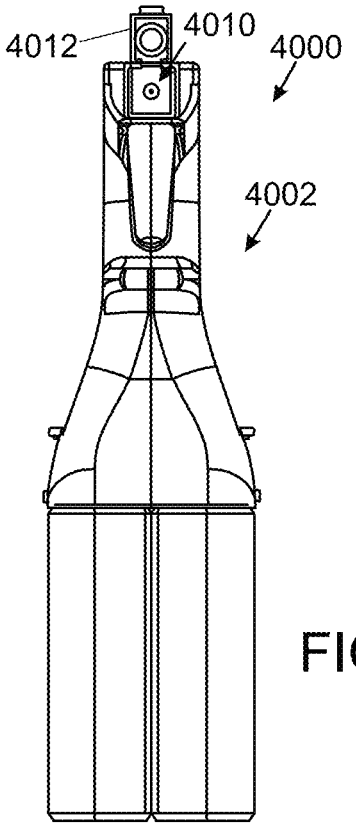
Figure 79:
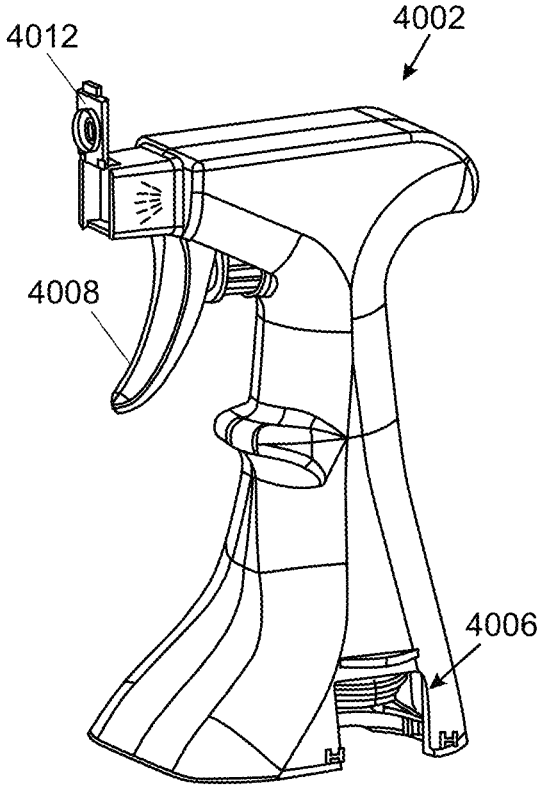
Figure 80:
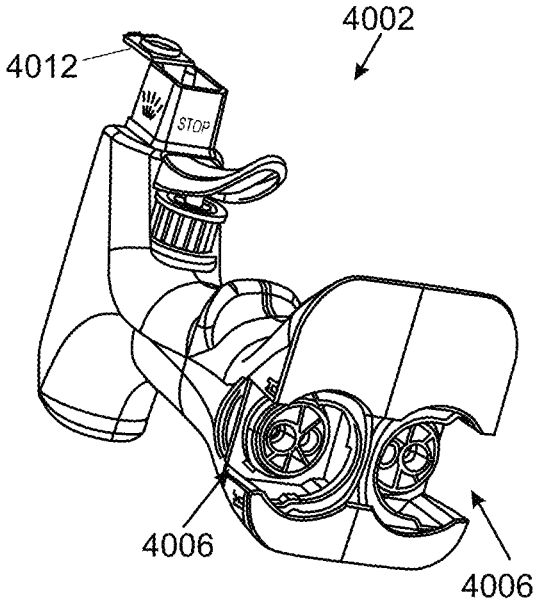
Figure 81:
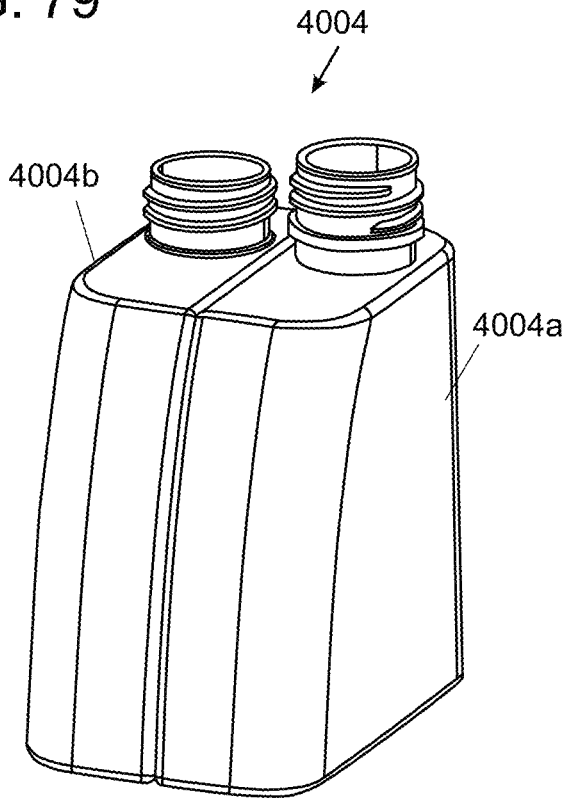
Figure 82:
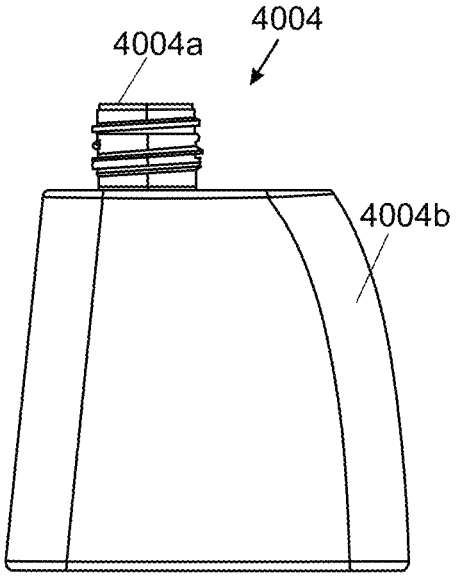
Figure 83:
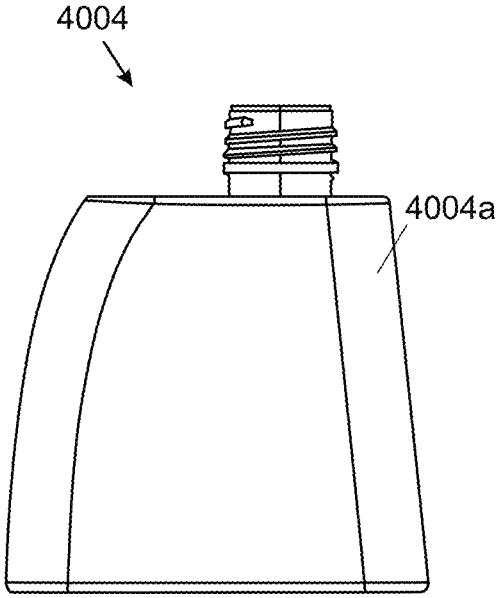
Figure 84:
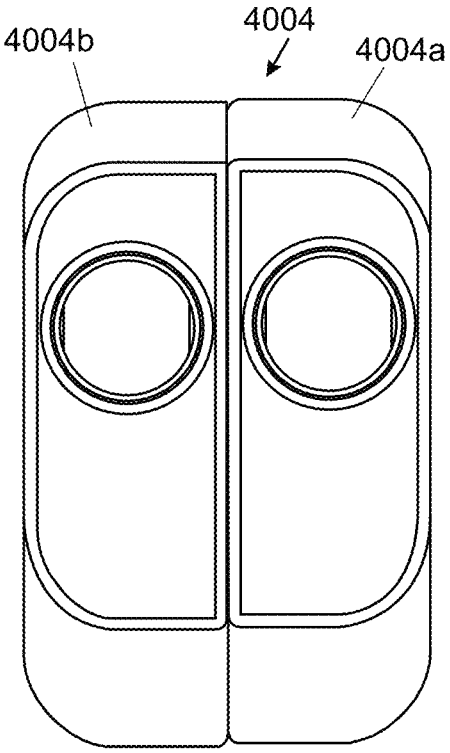
Figure 85:
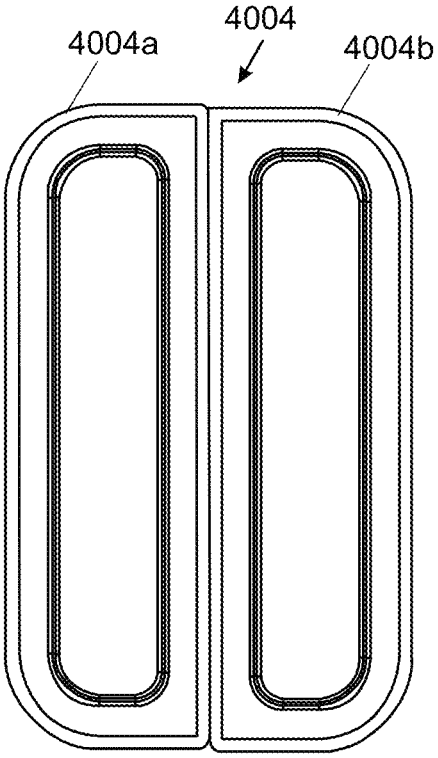
Figure 86A:
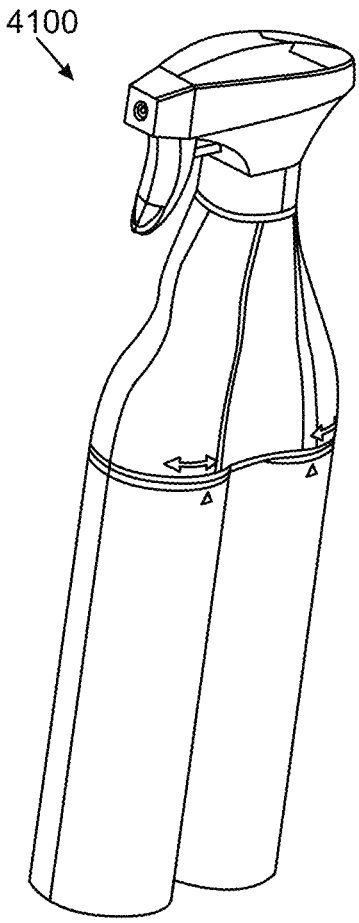
Figure 86B:
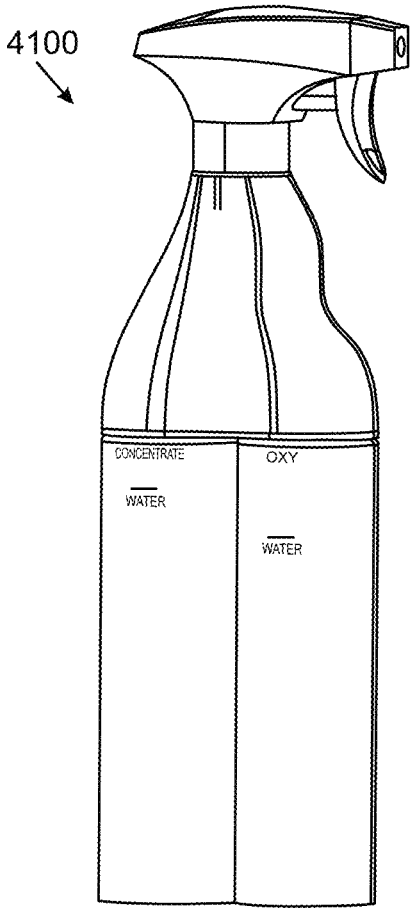
Figure 87:
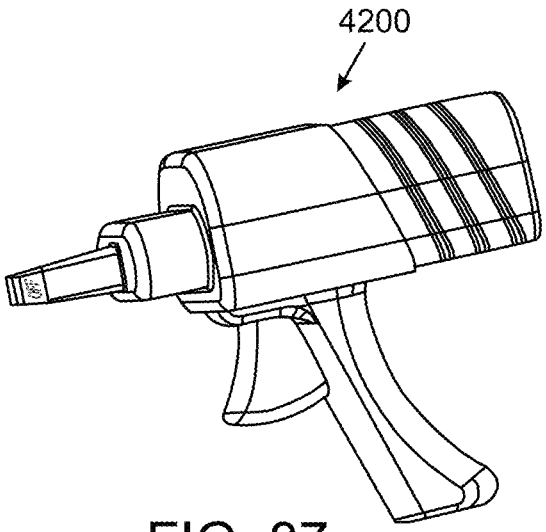
Figure 88:
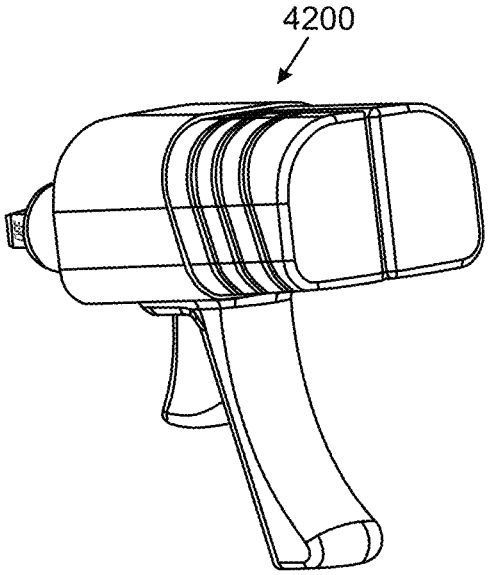
Figure 89:
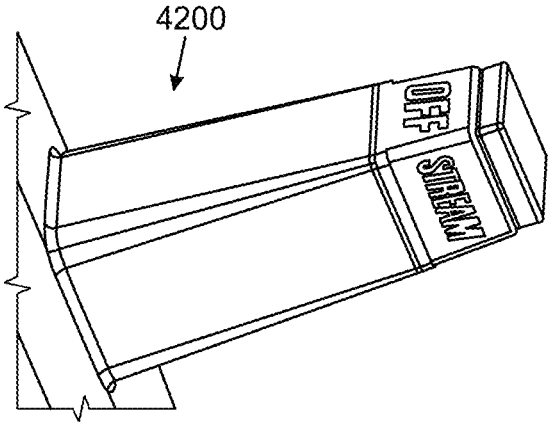
Figure 90:
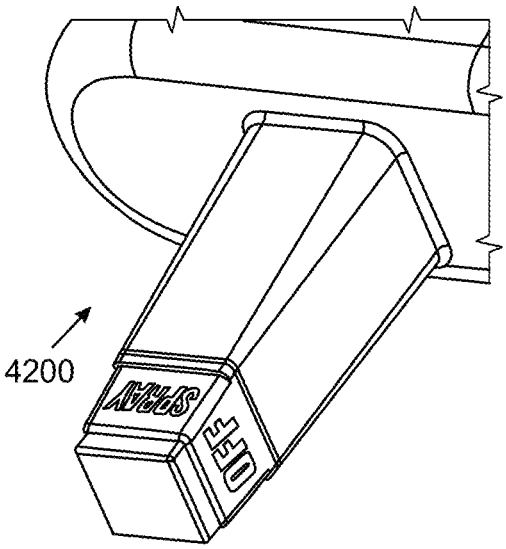
Figure 91:
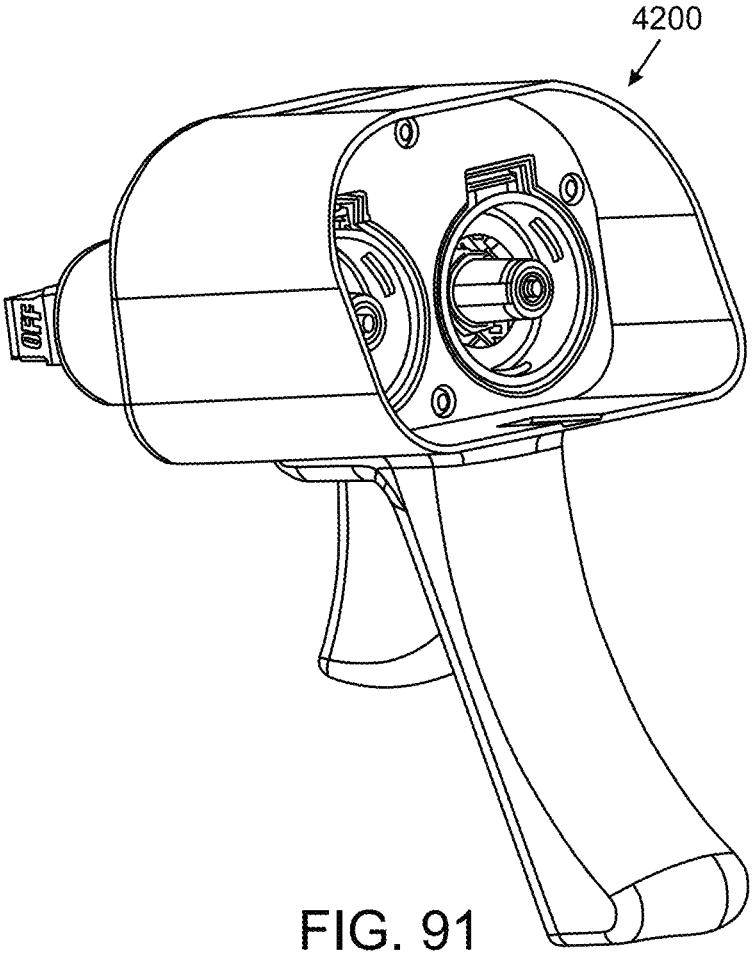
Figure 92A:
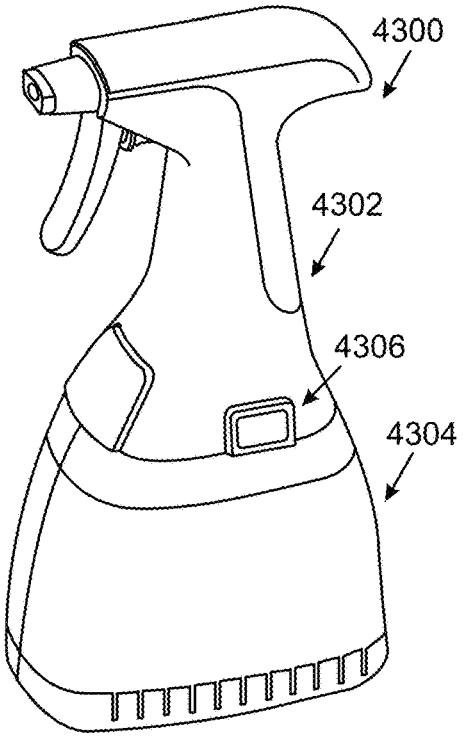
Figure 92B:
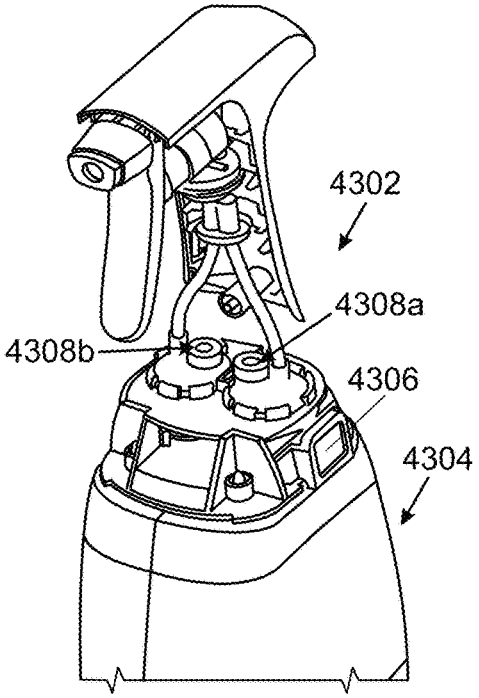
Figure 93:
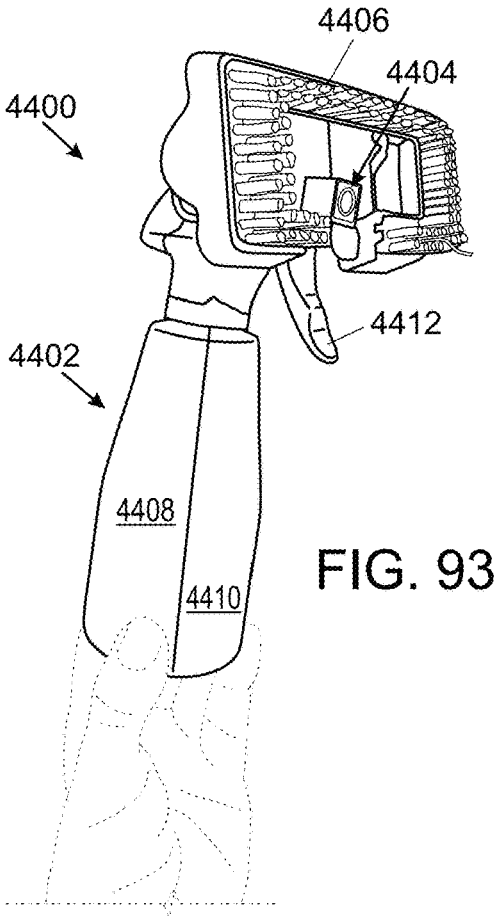
Figure 94A:
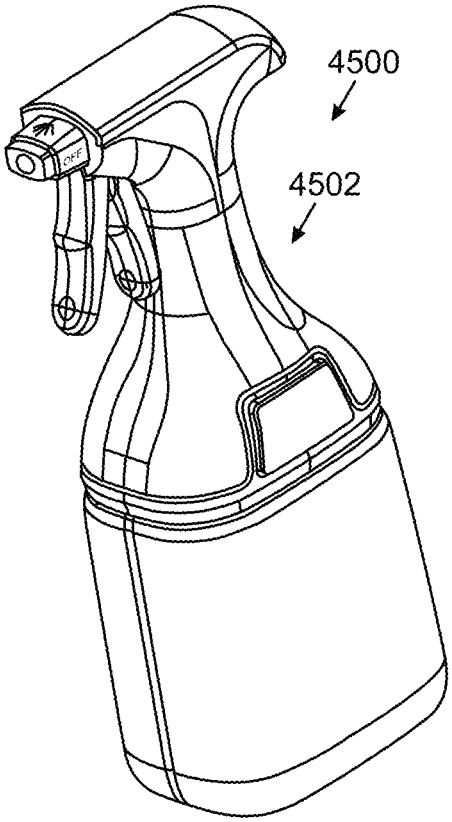
Figure 94B:
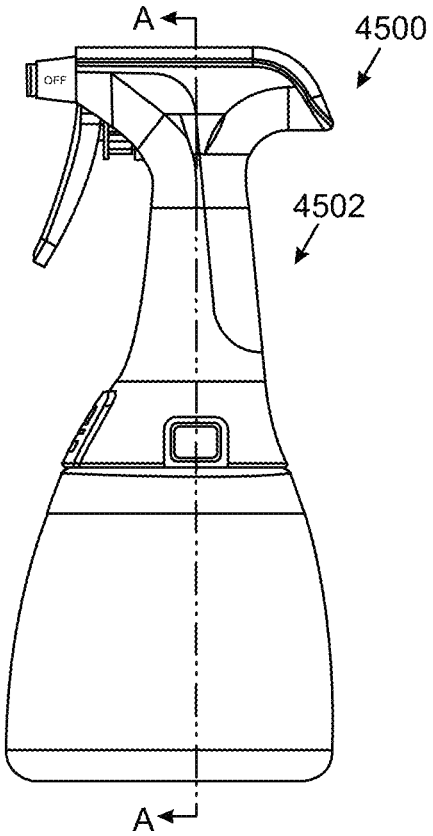
Figure 94C:
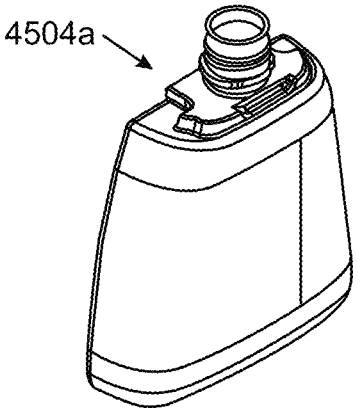
Figure 94D:
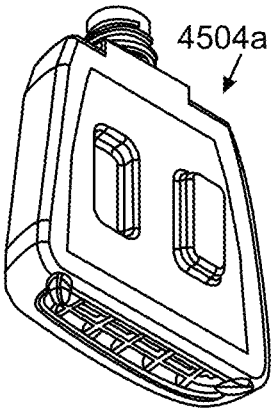
Figure 94E:
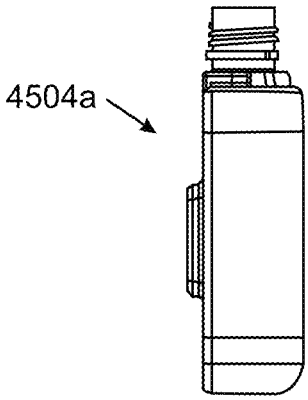

FIG. 72B is another perspective view of the tray of FIG. 72A;

FIG. 72C is a perspective view of one implementation of a cup configured to be removably coupled with the tray of FIG. 72A;

FIG. 72D is a perspective cross-sectional view of the cup of FIG. 72C;

FIG. 73 is a perspective view of one implementation of a spray bottle;

FIG. 74 is cross-sectional view of the spray bottle of FIG. 73;

FIG. 75 is a side view of the spray bottle of FIG. 73;

FIG. 76 is another side view of the spray bottle of FIG. 73;

FIG. 77 is a back end view of the spray bottle of FIG. 73;

FIG. 78 is front end view of the spray bottle of FIG. 73;

FIG. 79 is a perspective view of a spray head of the spray bottle of FIG. 73;

FIG. 80 is another perspective view of the spray head of FIG. 79;

FIG. 81 is a perspective view of a dual cleaning solution container of the spray bottle of FIG. 73;

FIG. 82 is a side view of the dual cleaning solution container of FIG. 81;

FIG. 83 is another side view of the dual cleaning solution container of FIG. 81;

FIG. 84 is a top view of the dual cleaning solution container of FIG. 81;

FIG. 85 is a bottom view of the dual cleaning solution container of FIG. 81;

FIG. 86A is a perspective view of another implementation of a spray bottle;

FIG. 86B is another perspective view of the spray bottle of FIG. 86A;

FIG. 87 is a perspective view of another implementation of a spray bottle;

FIG. 88 is another perspective view of the spray bottle of FIG. 87;

FIG. 89 is a perspective view of a portion of the spray bottle of FIG. 87;

FIG. 90 is another perspective view of a portion of the spray bottle of FIG. 87;

FIG. 91 is a perspective cross-sectional view of the spray bottle of FIG. 87;

FIG. 92A is a perspective view of another implementation of a spray bottle;

FIG. 92B is a perspective view of a portion of the spray bottle of FIG. 92A;

FIG. 93 is a perspective view of another implementation of a spray bottle;

FIG. 94A is a perspective view of yet another implementation of a spray bottle;

FIG. 94B is a side view of the spray bottle of FIG. 94A;

FIG. 94C is a perspective view of a dual cleaning solution container of the spray bottle of FIG. 94A;

FIG. 94D is another perspective view of the dual cleaning solution container of FIG. 94C; and FIG. 94E is side view of the dual cleaning solution container of FIG. 94C.

It is noted that the drawings are not necessarily to scale. The drawings are intended to depict only typical aspects of the subject matter disclosed herein, and therefore should not be considered as limiting the scope of the disclosure.

DETAILED DESCRIPTION

Certain embodiments will now be described to provide an overall understanding of the principles of the structure, function, manufacture, and use of the devices, systems, and methods disclosed herein. One or more examples of these embodiments are illustrated in the accompanying drawings. Those skilled in the art will understand that the devices, systems, and methods specifically described herein and illustrated in the accompanying drawings are non-limiting embodiments and that the scope of the present invention is defined solely by the claims. The features illustrated or described in connection with one exemplary embodiment may be combined with the features of other embodiments. Such modifications and variations are intended to be included within the scope of the present invention.

Further, in the present disclosure, like-named components of the embodiments generally have similar features, and thus within a particular embodiment each feature of each like-named component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape.

Various illustrative handheld surface cleaners and methods of using handheld surface cleaners are provided. In an exemplary implementation, the handheld surface cleaner is configured to use suction to draw debris into the handheld surface cleaner. The debris can include liquid, hair, dirt, and/or other matter. The suction also causes air to be drawn into the handheld surface cleaner. The handheld surface cleaner is configured to separate the air and the debris on board the handheld surface cleaner to allow the air to exit the handheld surface cleaner and to allow the debris to be collected in the handheld surface cleaner for later disposal.

Various illustrative spray bottles for spraying cleaning liquid for use with handheld surface cleaners and methods of using spray bottles for spraying cleaning liquid for use with handheld surface cleaners are also provided. In an exemplary implementation, the cleaning liquid includes a first liquid and a second liquid that are separately stored in the spray bottle and are mixed by the spray bottle. In other implementations, the cleaning liquid is a single cleaning liquid.

Figure 1:
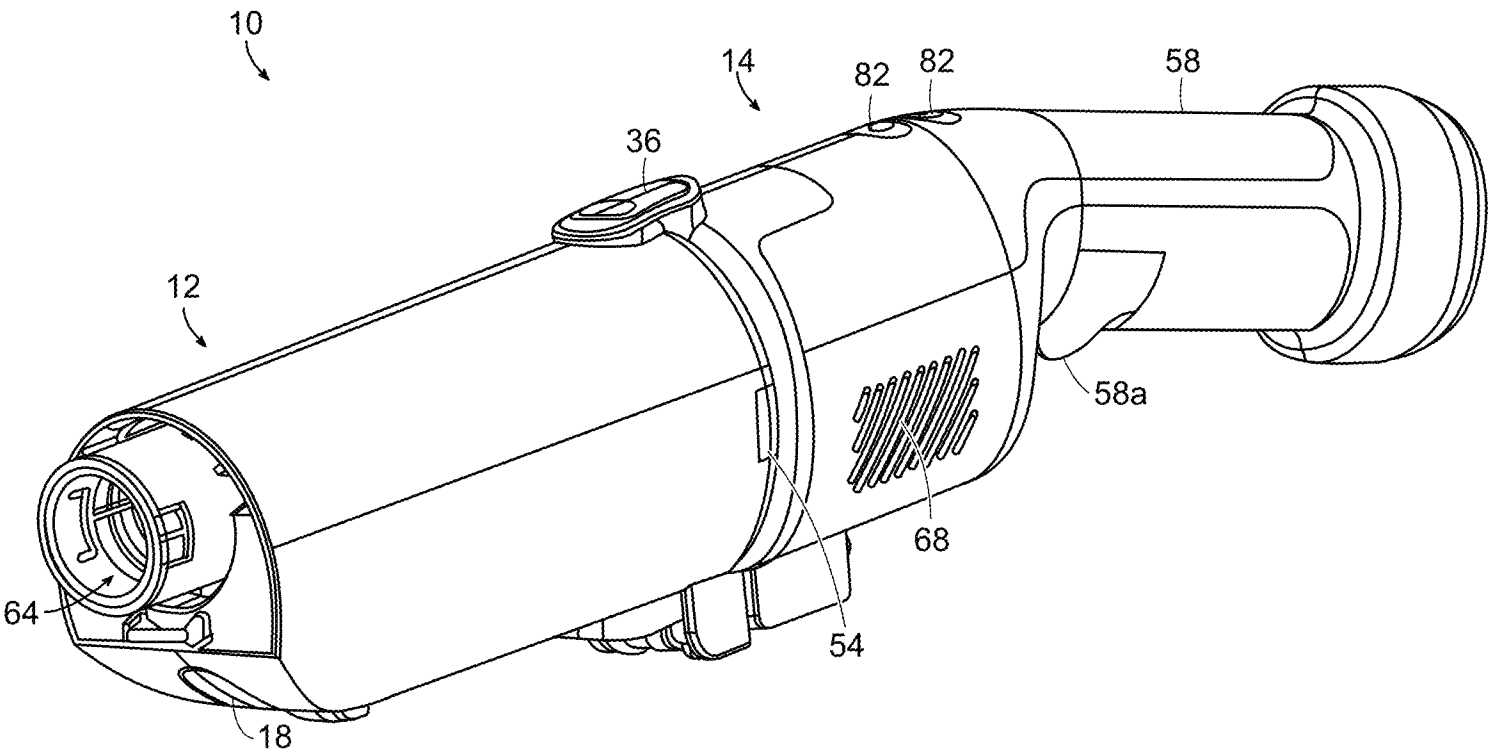
FIG. 1 is a perspective view of one implementation of a handheld surface cleaner.
Figure 2:
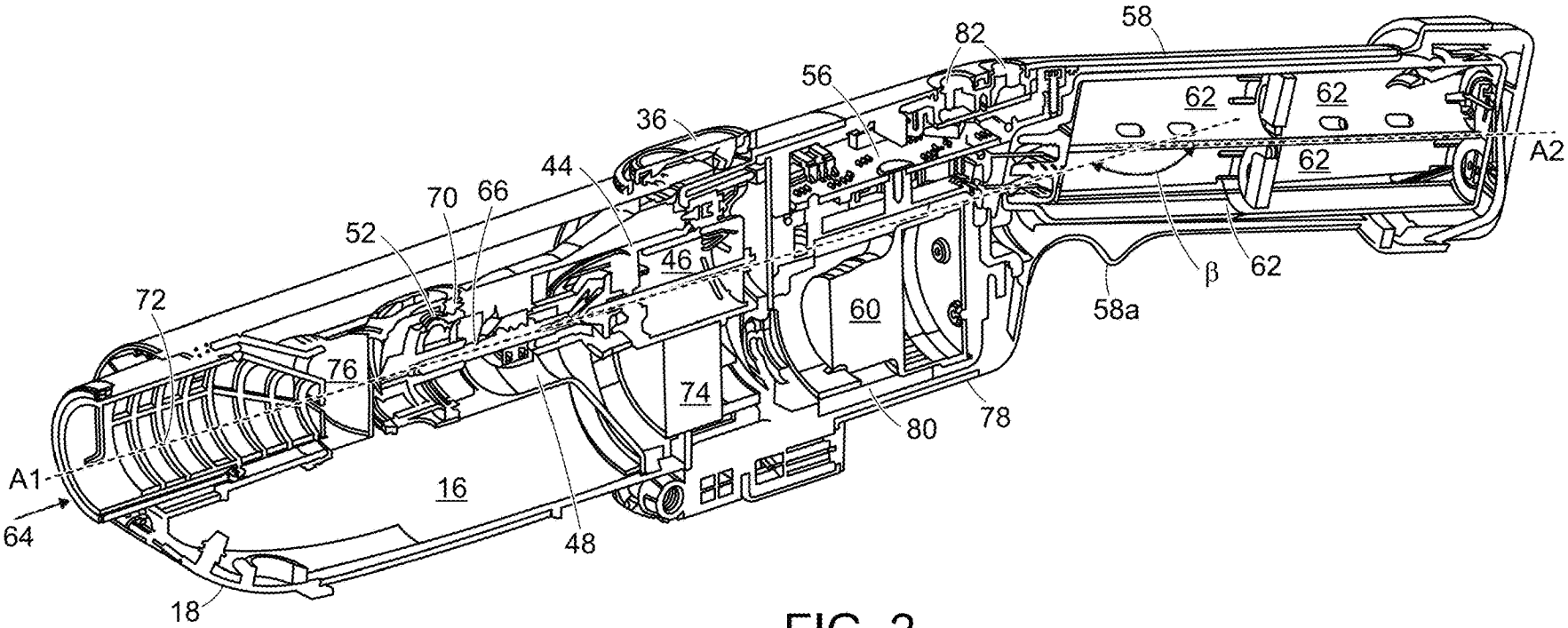
FIG. 2 is a perspective cross-sectional view of the handheld surface cleaner of FIG. 1.
Figure 3:
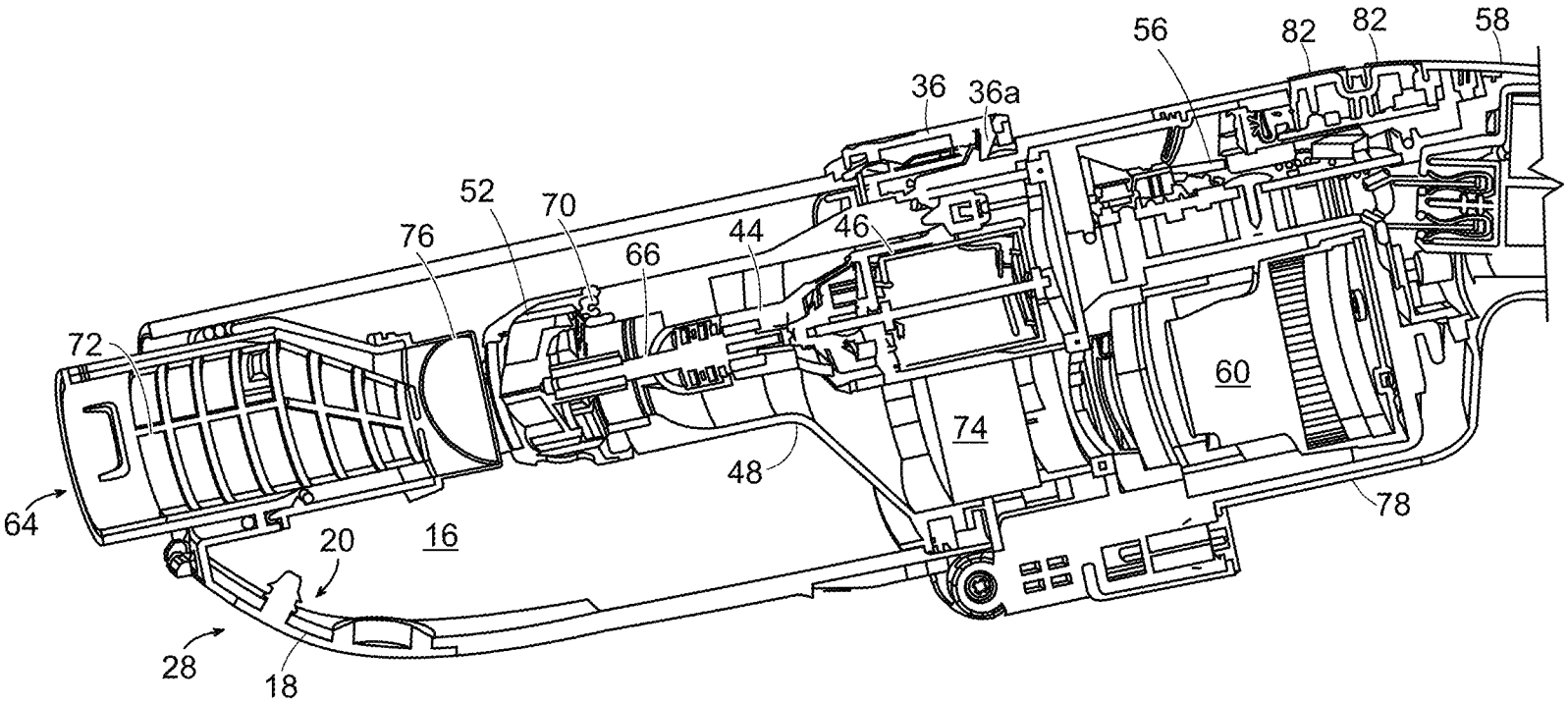
FIG. 3 is a perspective cross-sectional view of a distal portion of the handheld surface cleaner of FIG. 1.

FIG. 1 illustrates one implementation of a handheld surface cleaner 10 configured to use suction to draw debris into the handheld surface cleaner 10 and to separate the air and the debris on board the handheld surface cleaner 10. FIG. 2 shows a cross-section of the handheld surface cleaner 10 of FIG. 1. FIG. 3 shows a cross-section of a distal portion of the handheld surface cleaner 10 of FIG. 1.

Figure 4:
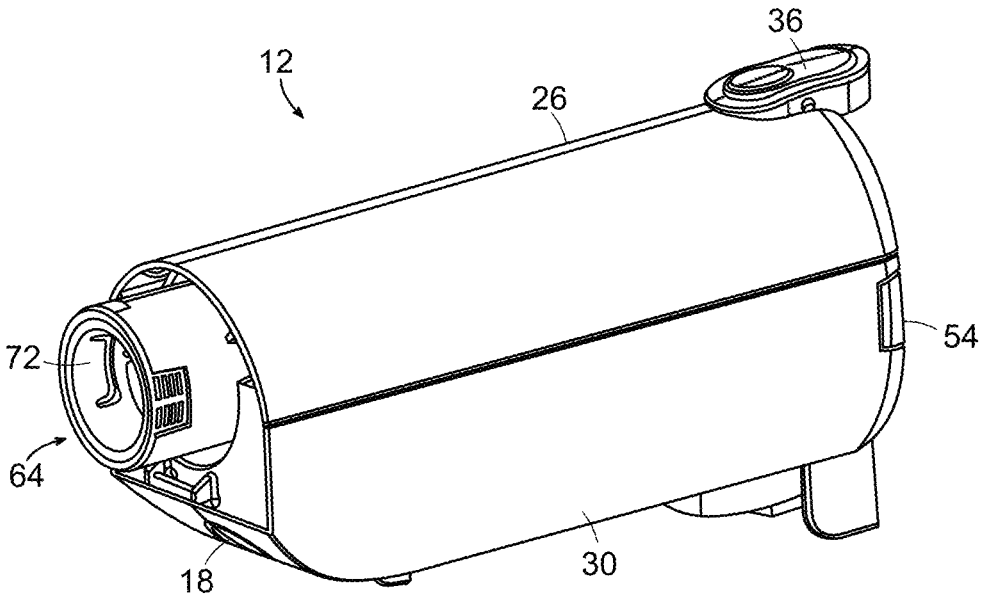
FIG. 4 is a perspective view of a dirty water tank of the handheld surface cleaner of FIG. 1.
Figure 5:
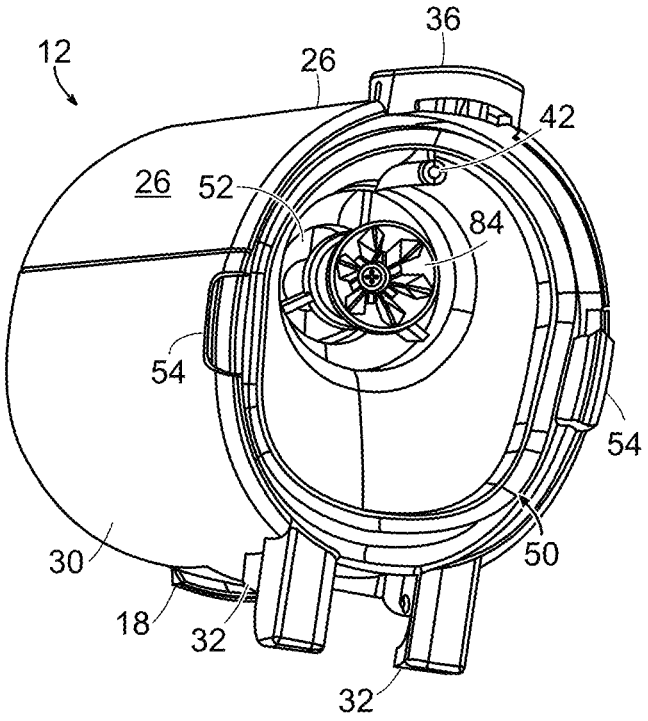
FIG. 5 is another perspective view of the dirty water tank of FIG. 4.
Figure 6:
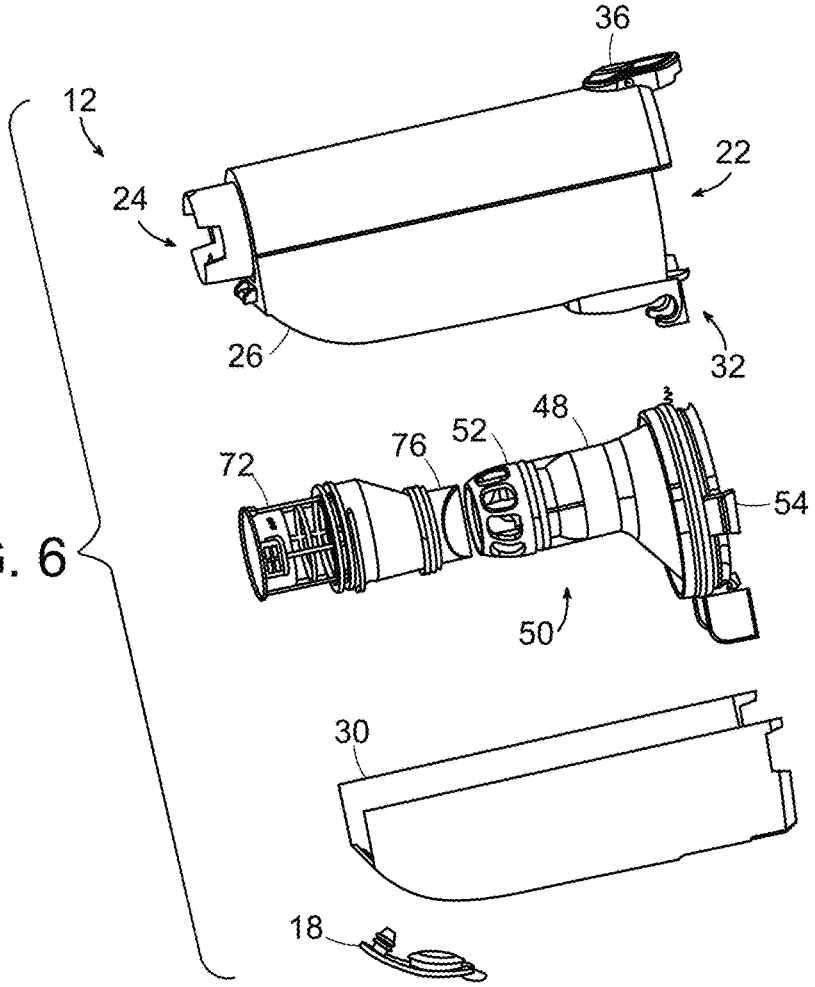
FIG. 6 is an exploded view of the dirty water tank of FIG. 4.
Figure 7:
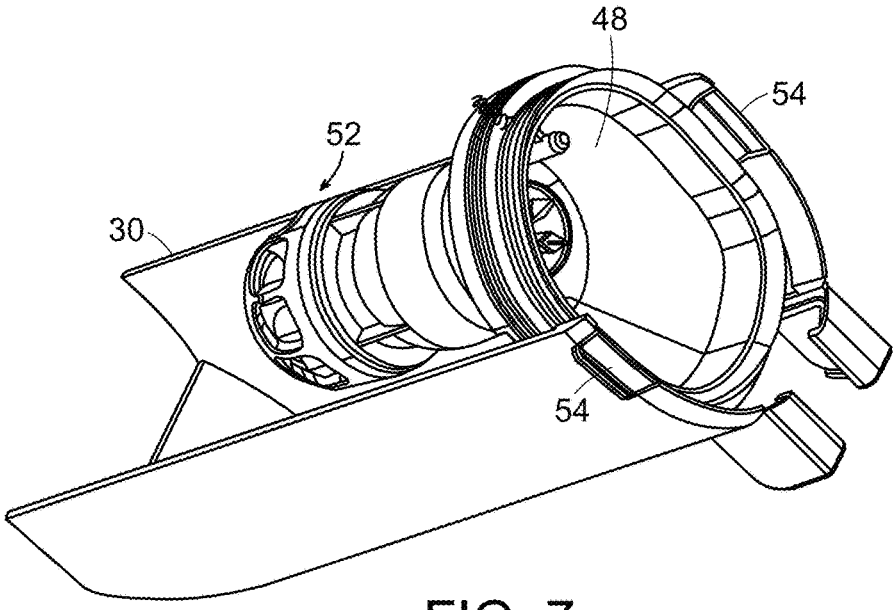
FIG. 7 is a perspective view of a portion of the dirty water tank of FIG. 4.
Figure 8:
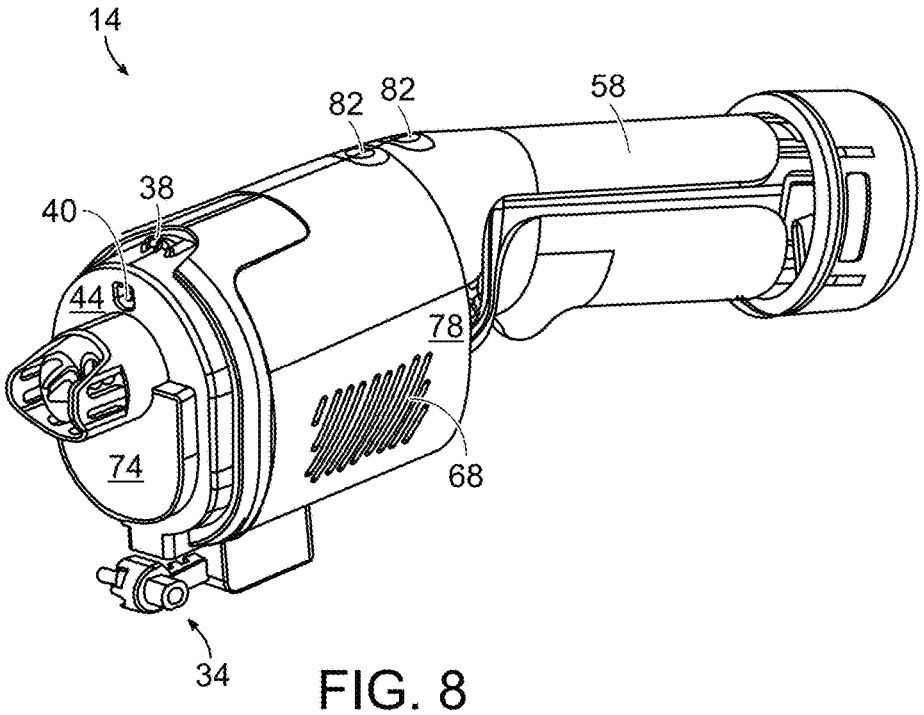
FIG. 8 is a perspective view of a main body of the handheld surface cleaner of FIG. 1.
Figure 9:
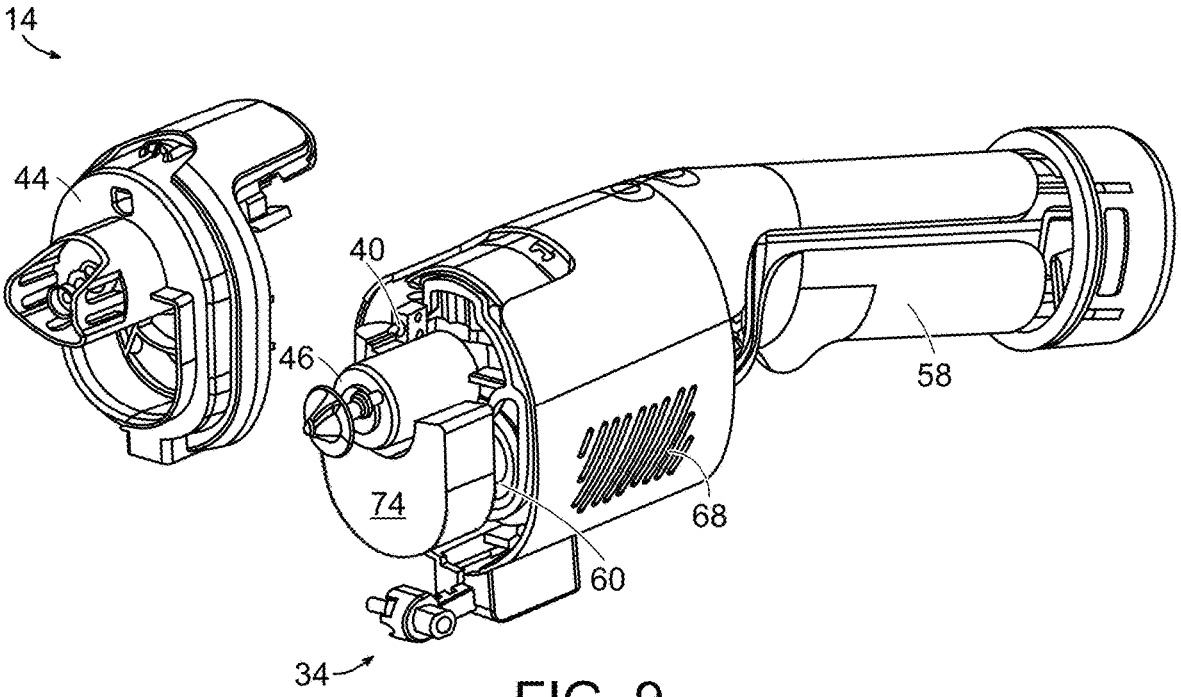
FIG. 9 is an exploded view of the main body of FIG. 8.

The handheld surface cleaner 10 of FIG. 1 includes a dirty water tank (DWT) 12 and a main body 14 configured to releasably couple to the DWT 12. The DWT 12 defines a distal portion of the handheld surface cleaner 10. The main body 14 defines a proximal portion of the handheld surface cleaner 10. FIGS. 4-6 show the DWT 12 as a standalone element. FIG. 7 shows a portion of the DWT 12. FIGS. 8 and 9 show the main body 14 as a standalone element.

In some implementations the DWT 12 is configured to be completely released from the main body 14. The DWT 12 being completely releasable from the main body 14 may facilitate emptying the DWT 12 of debris without the main body 14 getting dirty and/or getting in the way. In other implementations, the DWT is configured to be partially released from the main body 14 to allow emptying of debris from a debris collection and storage cavity 16 in the DWT 12, e.g., by pouring the debris out of an open proximal end 22 of the DWT 12. The DWT 12 being partially releasable from the main body 14 may help prevent loss of one of the DWT 12 and the main body 14 and thus rendering the handheld surface cleaner 10 unusable.

The debris collected in the dirty water tank 12 may or may not include dirty water and in some instances may not include water at all, depending on the matter being suctioned into the handheld surface cleaner 10. For example, a liquid other than or in addition to water may be suctioned into the handheld surface cleaner 10 and collected in the DWT 12. For another example, clean water may be suctioned into the handheld surface cleaner 10 without any other debris, e.g., for cleaning purposes as discussed further below, and collected in the DWT 12.

The DWT 12 includes a cap 18 configured to be opened manually by a user to allow debris to exit the debris collection and storage cavity 16 of the DWT 12 without releasing the DWT 12 from the main body 14. The cap 18 plugs a hole 20 formed through a wall of a housing 26 of the DWT 12 (see FIG. 3). The hole 20 is in communication with the debris collection and storage cavity 16 defined by the housing 26 of the DWT 12. The cap 18 also extends through an opening 28 formed in a lower cover 30 of the DWT 12 (see FIGS. 4-6). The lower cover 30 covers a lower portion of the DWT housing 26. The opening 24 in the DWT housing 26 and the opening 28 in the DWT lower cover 30 are aligned to define a passageway that extends from inside the DWT 12 to outside the DWT 12. The cap 18 is configured to cooperate with the DWT's housing 26 and lower cover 30 to selectively plug the passageway.

In some implementations, the lower cover 30 of the DWT 12 is omitted.

In some implementations, the cap 18 is completely removable from the DWT 12, which may allow for a larger passageway for exiting of debris from the debris collection and storage cavity 16. In other implementations, the cap 18 is attached to the DWT 12, which may allow for debris to exit the debris collection and storage cavity 16 while helping prevent loss of the cap 18. In this illustrated implementation, the cap 18 is attached to the DWT 12 and is formed of rubber and/or other flexible material to allow the cap 18 to bend for opening of the passageway while the cap 18 remains attached to the DWT 12.

In the illustrated implementation of FIG. 1, the DWT 12 is pivotally coupled to the main body 14 to allow partial release of the DWT 12 from the main body 14. In this illustrated implementation, as shown in FIG. 5, the DWT 12 includes a pair of pivot arms 32 operably coupled to a pivot pin 34 of the main body 14. In other implementations, the main body 14 can include pivot arms operably coupled to a pivot pin of the DWT.

In some implementations the DWT 12 is pivotally coupled to the main body 14 to allow complete release of the DWT 12 from the main body 14.

As shown in FIGS. 1-6, the handheld surface cleaner 10 includes a lock configured to help secure the DWT 12 to the main body 14. The lock in this illustrated implementation is a latch 36. The latch 36 can, as in this illustrated implementation, be configured to be manually moved by a user. The latch 36 can have a variety of configurations. The latch 36 in this illustrated implementation includes a hook **36*a* connected to the DWT 12 that is configured to engage, e.g., clip into, a groove 38 formed in the main body 14 (see FIG. 8). In other implementations, the main body 14 can include the hook and the DWT 12** can include the groove.

The handheld surface cleaner 10 is configured to automatically detect whether the DWT 12 is releasably coupled to the main body 14. As shown in FIGS. 8 and 9, the main body 12 includes a microswitch 40 at a distal face of the main body 12. The DWT 12 includes a protrusion 42 that extends proximally and that is configured to push the microswitch 40 to activate the microswitch 40 with the DWT 12 releasably coupled to the main body 14. The activation of the microswitch 40 indicates that the DWT 12 is releasably coupled to the main body 14. Correspondingly, the microswitch 40 not being activated indicates that the DWT 12 is not releasably coupled to the main body 14. Instead of or in addition to the protrusion 42, the DWT 12 can include another element configured to activate the microswitch, such as a pivotable latch that moves into position to engage the microswitch 40 in response to the DWT 12 being coupled to the main body 14.

In this illustrated implementation the microswitch 40 is configured to extend distally through a motor bracket 44 of the main body 12. The motor bracket 44 is configured to help protect the microswitch 40 from being damaged during coupling of the DWT 12 and the main body 14, during de-coupling of the DWT 12 and the main body 14, and when the main body 14 is de-coupled from the DWT 12. The motor bracket 44 has an opening configured to receive the protrusion 42 to allow the protrusion 42 to contact and activate the microswitch 40. As discussed further below, the motor bracket 44 is also configured to support a separator motor 46 of the handheld surface cleaner 10 (see FIGS. 2, 3, and 8).

In this illustrated implementation the protrusion 42 of the DWT 12 extends proximally from a separator bracket 48 of a separator assembly 50 of the DWT 12, shown in FIGS. 10-13, but can be located elsewhere. As discussed further below, the separator assembly 50 also includes a separator 52 (also see FIG. 14) supported by the separator bracket 48.

Instead of or in addition to including the microswitch 40, the handheld surface cleaner 10 can include a switch in a circuit also including the separator motor 46 and a power supply of the handheld surface cleaner 10. The protrusion 42 or another protrusion of the DWT 12 can be configured to push the switch, and thus activate the switch, similar to that discussed herein regarding the microswitch 40. With the switch activated, the switch is closed and the circuit is closed, which allows the power supply to supply power to the separator motor 46. With the switch deactivated, the switch is open and the circuit is open, which prevents the power supply from supplying power to the separator motor 46. The switch can be located, for example, at the main body 12 similar to a location described herein for the microswitch 40.

In some implementations, as in this illustrated implementation, the separator assembly 50 is configured to be removably coupled to the DWT 12 to facilitate cleaning of the separator 52 and/or emptying of debris from the DWT's collection and storage cavity 16. The separator assembly 50 is configured to be de-coupled from the main body 14 with a remainder of the DWT 12, as shown in FIGS. 5 and 6. The separator assembly 50 is configured as a lid that covers the open proximal end 22 of the DWT 12 through which debris is configured to exit the debris collection and storage cavity 16. Thus, removing the DWT 12 from the main body 14 will not cause debris to prematurely and messily exit the debris collection and storage cavity 16 because of the lid functionality of the separator assembly 50.

With the DWT 12 de-coupled from the main body 14, the separator assembly 50 is configured to be removed from the DWT 12 to allow for emptying and/or cleaning of the debris collection and storage cavity 16 and/or to allow cleaning of the separator assembly 50. FIGS. 10-13 show the separator assembly 50 as a standalone element de-coupled from the DWT 12.

The separator assembly 50 in this illustrated implementation includes a pair of tabs 54 configured to facilitate manual removal of the separator assembly 50 from the DWT 12. In another implementation, the separator assembly 50 can include a single tab 54 or can include more than two tabs 54. The tabs 54 are configured to be held by a user to help pull the separator assembly 50 in a proximal direction to remove the separator assembly 50 from the DWT 12. Similarly, the tabs 54 are configured to be held by a user to help push the separator assembly 50 in a distal direction to re-attach the separator assembly 50 to the DWT 12. A user may choose to hold only one of the tabs 54 when removing and/or re-attaching the separator assembly 50.

The tabs 54 in this illustrated implementation extend proximally and are located opposite one another around a perimeter of the separator assembly 50. Free ends of the tabs 54 are configured to be located outside of the DWT 12 (and the main body 14) with the DWT 12 coupled to the main body 14, as shown in FIG. 1 in which one of the tabs 54 is visible. At least a portion of the tabs 54 is thus outside of a debris flow path and an air flow path in the handheld surface cleaner 10 so that at least the portion of the tabs 54 may remain clean and dry when a user holds the tabs 54*e*.

The tabs 54 are configured as a lock configured to lock the separator assembly 50 to the DWT housing 26 (and the DWT lower cover 30 if not omitted). The tabs 54 are configured to move between a locked configuration, shown in FIGS. 1 and 4-7, and an unlocked configuration. In the locked configuration, the tabs 54 are configured to lock the separator assembly 50 to the DWT housing 26 (and the DWT lower cover 30 if not omitted). In the unlocked configuration, the tabs 54 are configured to allow the separator assembly 50 to be removed from the DWT housing 26 (and the DWT lower cover 30 if not omitted).

With the tabs 54 in the locked configuration and locking the separator assembly 50 to the DWT housing 26 (and the DWT lower cover 30 if not omitted), the tabs 54 are configured to be moved manually by a user from the locked configuration to the unlocked configuration, which allows a user to decide whether and when to unlock the separator assembly 50. The tabs 54 are configured to be pushed radially inward relative to the DWT housing 26 (and the DWT lower cover 30 if not omitted) to move from the locked configuration to the unlocked configuration. The tabs 54 are biased to the locked configuration and are resilient. Thus, when a user stops pushing the tabs 54 radially inward, the tabs 54 are configured to move automatically from the unlocked configuration to the locked configuration.

With the tabs 54 in the locked configuration and without the separator assembly 50 being coupled to the DWT housing 26 (and the DWT lower cover 30 if not omitted), the tabs 54 are configured to move automatically from the locked configuration to the unlocked configuration in response to the separator assembly 50 being coupled to the DWT housing 26 (and the DWT lower cover 30 if not omitted). The separator assembly 50 is configured to be inserted into the DWT housing 26, e.g., into the debris collection and storage cavity 16 of the DWT 12, in a distal direction through the open proximal end 22 of the DWT 12 with the separator 52 leading. The tabs 54 being resilient allows the tabs 54 to move automatically from the locked configuration, to the unlocked configuration, and back to the locked configuration as the separator assembly 50 is configured to be inserted into the DWT housing 26.

The main body 14 includes various electronic components configured to facilitate electronic control of various aspects of the handheld surface cleaner 10. The electronic components can be part of a circuit board. As shown in FIGS. 2 and 3, the main body 14 includes a printed circuit board (PCB) 56 that includes electronic components including at least a controller (e.g., processor, microcontroller, etc.) and a memory. The PCB 56 is located at a top of the main body 14 adjacent a handle 58 of the handheld surface cleaner 10 at the main body 14 in this illustrated implementation but can be located elsewhere.

The PCB 56 is operatively coupled to the microswitch 40. The PCB 56 is configured to determine whether or not the DWT 12 is releasably coupled to the main body 14 based on an activation state of the microswitch 40. This is a safety feature to prevent suctioning of debris without the DWT 12 being attached properly to the main body 14. If the microswitch 40 is activated, the PCB 56, e.g., the controller at the PCB 56, is configured to determine that the DWT 12 is releasably coupled to the main body 14 and consequently that the handheld surface cleaner 10 can allow use of the handheld surface cleaner 10 to clean a surface by allowing suction to be activated, e.g., by allowing a suction motor 60 of the handheld surface cleaner 10 to be on and therefore provide a suction force. If the microswitch 40 is not activated, the PCB 56, e.g., the controller at the PCB 56, is configured to determine that the DWT 12 is not releasably coupled to the main body 14 and consequently is configured to prevent use of the handheld surface cleaner 10 to clean a surface by disallowing activation of suction, e.g., by not allowing the suction motor 60 to be on and therefore not provide a suction force.

The handheld surface cleaner 10 includes a power supply configured to supply power to the PCB 56. The power supply includes a plurality of rechargeable batteries in this illustrated implementation but can be another type of power supply, such as a plurality of non-rechargeable batteries, a single rechargeable battery, etc. The main body 14 includes a battery holder 62 (see FIG. 2) in the handle 58 configured to hold the batteries therein. The power supply being on board the handheld surface cleaner 10 may help allow for easy portability and maneuverability of the handheld surface cleaner 10. The handle 58 in this illustrated implementation includes a charging dock to allow for recharging of the rechargeable batteries.

As in this illustrated implementation, the handle 58 can define a pistol grip. A pistol grip may be more securely held by a user as the handheld surface cleaner 10 is moved over a surface than a suitcase-type handle where a user positions their fingers through an opening and holds on to a U-shaped or C-shaped grip. The handle 58 has a substantially cylindrical shape in this illustrated implementation, which may facilitate comfortable holding of the handle 58 around the handle's substantially circular perimeter.

The handle 58 includes a finger grip 58*a* configured to facilitate a user's holding of the handle 58 by providing a surface against which a user's finger can be positioned to provide leverage and/or stability. The handle 58 includes a single finger grip 58*a* in this illustrated implementation but can include another number, e.g., two, three, etc. Including a plurality of finger grips may allow for each of a user's fingers to be positioned against a finger grip.

As shown in FIGS. 1 and 2, the handle 58 defines a proximal portion of the handheld surface cleaner 10, and a longitudinal axis defined by an inlet 64 of the handheld surface cleaner 10 intersects the handle 58. Compared to other surface cleaners that have a handle on a side of the surface cleaner, such as on a top side, the handle 58 may make the handheld surface cleaner 10 easier for a user to hold and use in cleaning a surface since the handheld surface cleaner 10 will typically be used with the inlet 64 facing generally downward. Thus, most of a weight of the handheld surface cleaner 10, and all of a weight of debris in the debris collection and storage cavity 16, will be aligned with or below the handle 58 so a user does not have to counteract gravity as much as in using other surface cleaners that have a handle on a side of the surface cleaner, such as on a top side. Additionally, the handle 58 being so located is configured to leverage weight toward a front of the handheld surface cleaner 10, which may help the inlet 64 be positioned against a surface being cleaned and thus be more likely to draw in more debris.

The power supply of the handheld surface cleaner 10 is also configured to power the separator motor 46 of the handheld surface cleaner 10, which is configured to drive rotation of the separator 52, and to power the suction motor 60 of the handheld surface cleaner 10, which is configured to provide a suction force for suctioning debris into the inlet 64 (see FIGS. 1-4) at a distal end of the handheld surface cleaner 10.

As shown in FIG. 9, the suction motor 60 is located at the main body 14 in this illustrated implementation. The suction motor 60 can include any of a variety of motors configured to provide suction, as will be appreciated by a person skilled in the art. Thus, the suction motor 60 is separated from the DWT 12 when the DWT 12 is de-coupled from the main body 14.

The separator motor 46 is a direct current (DC) motor in this illustrated implementation but other types of motors are possible. As shown in FIG. 9, the separator motor 46 is located at the main body 14 in this illustrated implementation. Thus, the separator motor 46 is separated from the DWT 12 when the DWT 12 is de-coupled from the main body 14.

The separator motor 46 is operatively coupled to the separator 52 via a shaft 66. The shaft 66 is configured to be driven by the separator motor 46 to rotate to cause rotation of the separator 52.

The separator 52 is configured as a rotor configured to separate air from debris. The separator 52 is configured to rotate relative to the housing 26 of the DWT 12 and, if not omitted, the lower cover 30 of the DWT 12. Rotation of the separator 52, e.g., as driven by the separator motor 46, is configured to cause debris entering the separator 52 to be expelled from the separator 52 into the debris collection and storage cavity 16 of the DWT 12 while allowing air entering the separator 52 to flow distally out of the separator 52 for exit from the handheld surface cleaner 10 through air exit holes 68 (see FIGS. 1, 8, and 9). The air exit holes 68 are formed in the main body 14 adjacent to and laterally outward from the suction motor 60 in this illustrated implementation.

As shown in FIGS. 10, 11, and 14-16, the separator 52 in this illustrated implementation includes an inner separator 52*a* and an outer separator 52*b* that is secured to the inner separator 52*a*. The inner and outer separators 52*a*, 52*b* are configured to rotate together as a unit. In other implementations, the separator 52 is a singular member.

The inner separator 52*a* includes a plurality of blades 52*c* (also referred to herein as "vanes") that extend radially outward from a center of the inner separator 52*a*, which is also a center of the separator 52. Each of the blades 52*c* is the same as the other blades 52*c*. Each of the blades 52*c* has a curvature to direct debris radially outward. A proximal end of the inner separator 52*a* is open.

The outer separator 52*b* includes a plurality of holes 52*d* in a sidewall of the outer separator 52*b*. Proximal and distal ends of the outer separator 52*b* are open. Debris flowing into the separator 52 through the open distal end of the outer separator 52*b* encounters the blades 52*c* of the inner separator 52*a*. The blades 52*c* direct debris radially outward to fling the debris through the holes 52*d* in the outer separator 52*b*. Air flows into the separator 52 through the open distal end of the outer separator 52*b* and passes through the separator 52 out of the open proximal end of the separator 52 defined by the open proximal ends of the inner and outer separators 52*a*, 52*b* to allow the air to continue flowing through the handheld surface cleaner 10 for exit from the handheld surface cleaner 10 through the air exit holes 68.

Figure 14:
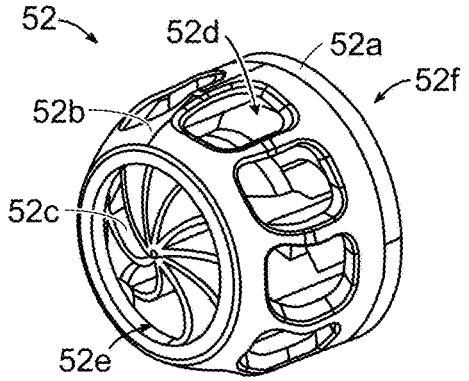
FIG. 14 is a perspective view of a separator of the handheld surface cleaner of FIG. 1.
Figure 15:
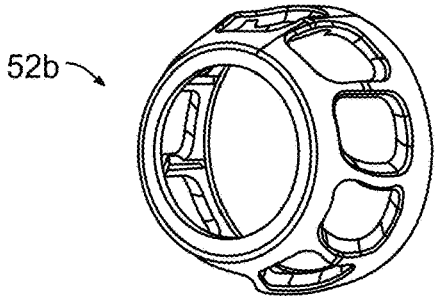
FIG. 15 is a perspective view of an outer separator of the separator of FIG. 14.
Figure 16:
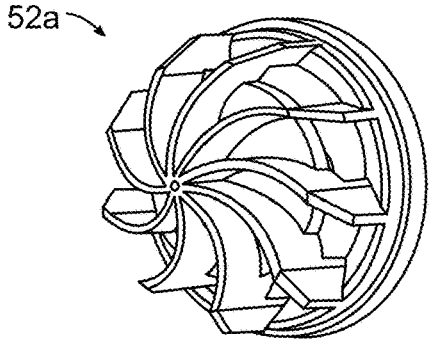
FIG. 16 is a perspective view of an inner separator of the separator of FIG. 14.

As shown in FIG. 14, the separator 52 includes an inlet opening 52*e* and an outlet opening 52*f*. Debris and air is configured to enter the separator 52 through the inlet opening 52*e*. The debris is configured to exit the separator 52 through the plurality of holes 52*d*. The air is configured to exit the separator 52 through the outlet opening 52*f*. The separator 52 has a single inlet opening 52*e* and a single outlet opening 52*f* in this illustrated implementation but can include a plurality of inlet openings and/or a plurality of outlet openings. The inlet opening 52*e* and the outlet opening 52*f* in this illustrated implementation are each centered along a first longitudinal axis A1 but the inlet opening 52*e* and/or the outlet opening 52*f* can be offset from the first longitudinal axis A1. The separator 52 is configured to rotate about the first longitudinal axis A1.

As shown in FIGS. 2 and 3, the debris collection and storage cavity 16 surrounds an entire perimeter of the separator 52. Thus, debris that the separator 52 flings radially outward through the plurality of holes 52*d* will enter the debris collection and storage cavity 16 regardless of a particular rotational position of the separator 52 and regardless of an orientation in which the handheld surface cleaner 10 is being held. The plurality of holes 52*d* in this illustrated implementation each have a substantially rectangular shape that is bent to be in two planes, but the plurality of holes 52*d* can have another shape, e.g., circular, triangular, teardrop, irregular, or other shape.

Figure 11:
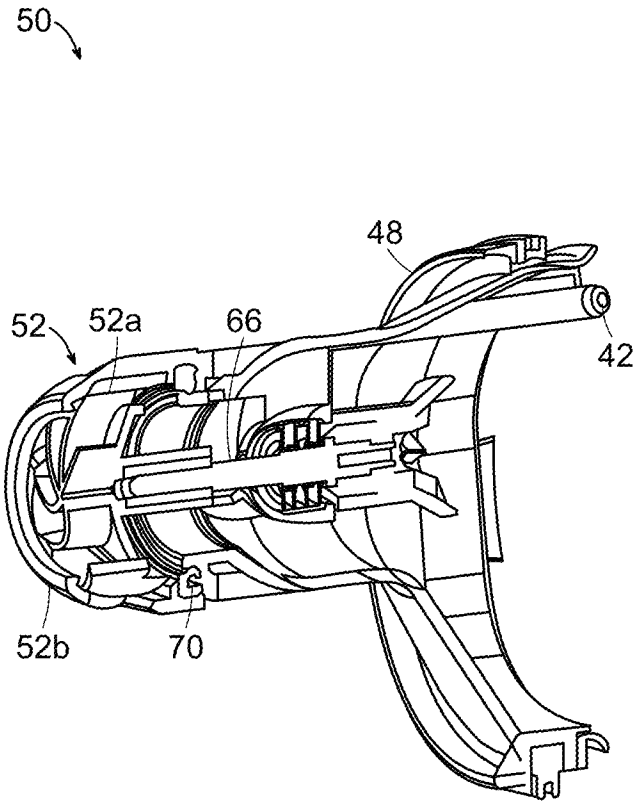
FIG. 11 is a perspective cross-sectional view of the separator assembly of FIG. 10.
Figure 10:
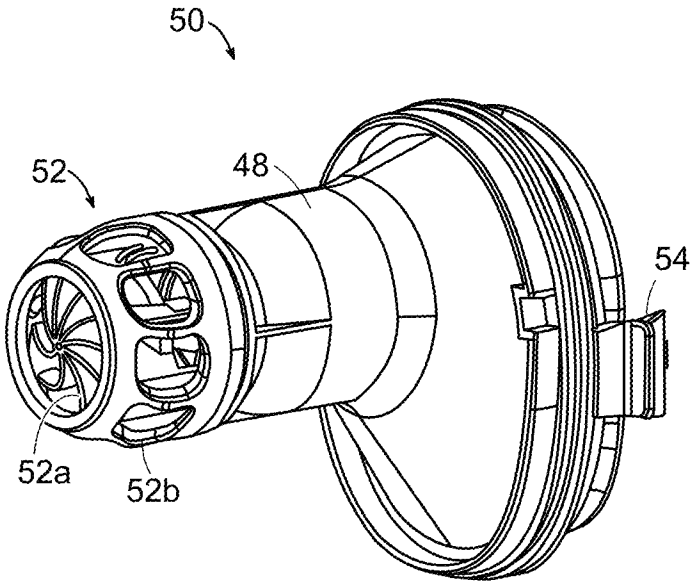
FIG. 10 is a perspective view of a separator assembly of the handheld surface cleaner of FIG. 1.
Figure 13:
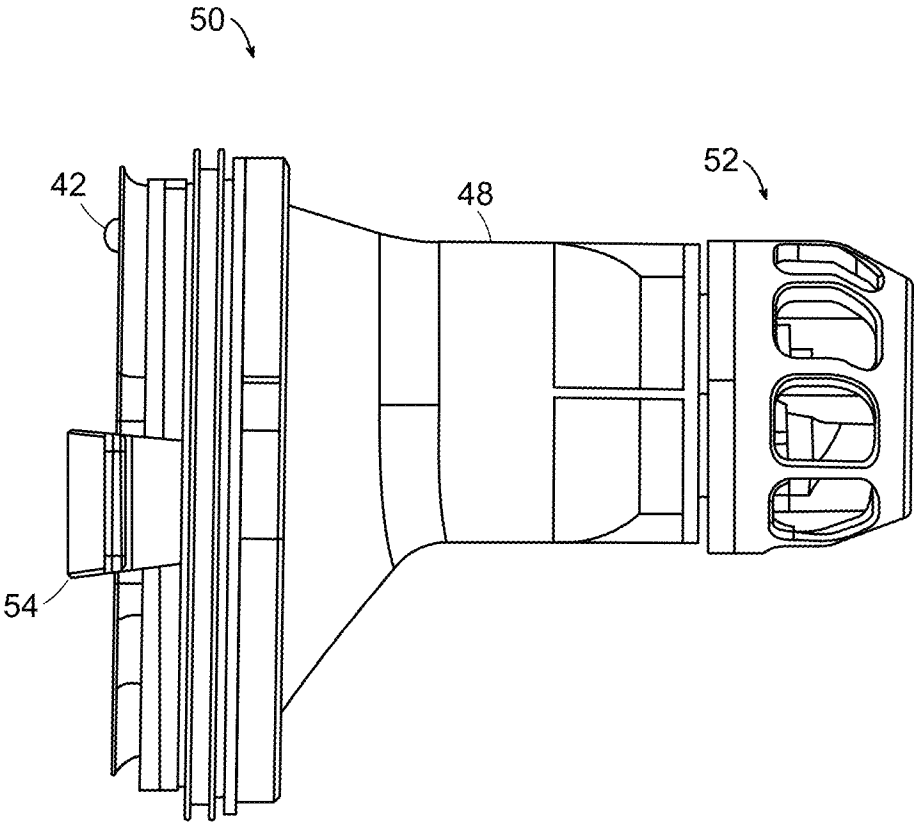
FIG. 13 is a side view of the separator assembly of FIG. 10.
Figure 12:
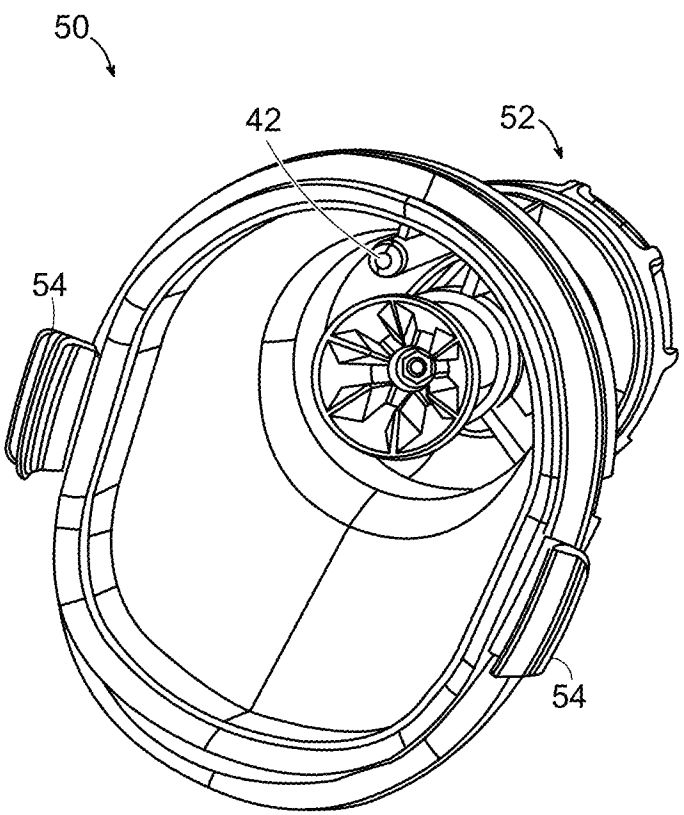
FIG. 12 is another perspective view of the separator assembly of FIG. 10.

As shown in FIGS. 2, 3, and 11, the separator assembly 50 includes a seal 70 configured to help prevent debris from exiting out of the open proximal end of the separator 52, e.g., out of the open proximal ends of the inner and outer separators 52*a*, 52*b*. The seal 70 at the separator 52 in this illustrated implementation is an oil seal but other types of seals may be used.

The handheld surface cleaner 10 includes two filters configured to allow the handheld surface cleaner collect debris within the handheld surface cleaner 10 while allowing air to flow out of the handheld surface cleaner 10. In other implementations, a different number and/or different types of filters may be used.

As shown in FIGS. 2-4, a first filter 72 of the handheld surface cleaner 10, in the form of a hair cage in this illustrated implementation, is located at the DWT 12 upstream of (distal to) the separator 52. The first filter 72 is configured to collect hair and/or other large debris that enters the handheld surface cleaner 10 through the inlet 64 to prevent the hair and/or other large debris from reaching the separator 52, where the hair and/or other large debris may jam the separator 52, clog the separator's holes 52*d*, clog the separator's open proximal end, and/or and prevent rotation of the separator 52.

Figure 17:
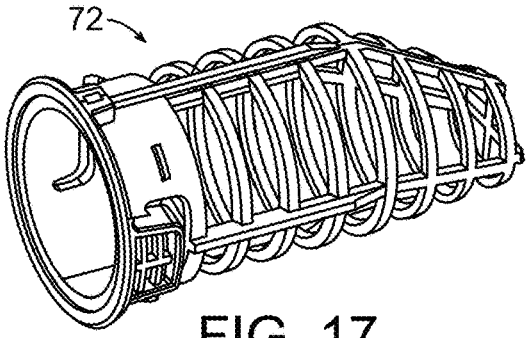
FIG. 17 is a perspective view of a hair cage of the handheld surface cleaner of FIG. 1.

The first filter 72 is removable from the DWT 12 to facilitate cleaning of the first filter 72. FIG. 17 shows the first filter 72 as a standalone element. In other implementations, the first filter 72 is not removable from the DWT 12.

In some implementations, a seal (not shown) is located upstream of or in the first filter 72 to help prevent backflow of hair and/or other matter trapped by the first filter 72 so the hair and/or other matter does not exit the handheld surface cleaner 10 through the inlet 64 of the handheld surface cleaner 10. In some implementations, an attachment releasably coupled to the inlet 64 of the handheld surface cleaner 10 includes such a seal. Attachments are discussed further below.

As shown in FIGS. 2, 3, 8, and 9, a second filter 74 of the handheld surface cleaner 10, in the form of foam in this illustrated implementation, is located at the main body 14 downstream of (proximal to) the separator 52. The second filter 74 is configured to collect the very small amounts of liquid and/or other debris that may inadvertently exit the separator 52 out of the open proximal end of the separator 52. The second filter 74 may therefore help prevent liquid and/or other debris from reaching the air exit holes 68 and from exiting the handheld surface cleaner 10 through the air exit holes 68, which would be messy and/or could clog one or more of the air exit holes 68.

Figure 18:
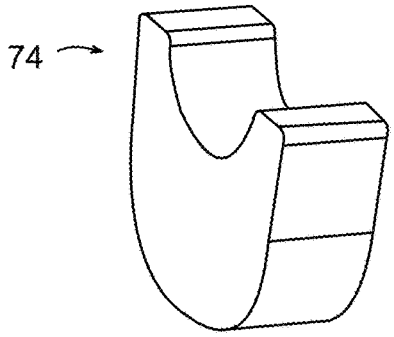
FIG. 18 is a perspective view of filter foam of the handheld surface cleaner of FIG. 1.

The second filter 74 is removable from the main body 14 to facilitate cleaning of the second filter 74. FIG. 18 shows the second filter 74 as a standalone element. In other implementations, the second filter 74 is not removable from the main body 14.

A debris flow path is defined through the handheld surface cleaner 10 by, in order, the inlet 64 at the distal end of the handheld surface cleaner 10, the first filter 72, a duckbill valve 76, and the separator 52, with the debris being collected in the debris collection and storage cavity 16 of the DWT 12. The duckbill valve 76, shown in FIGS. 2, 3, and 6, is located upstream of (distal to) the separator 52 and is a seal configured to allow fluid flow in only one direction toward the separator 52. The duckbill valve 76 is thus configured to prevent fluid from flowing out of the debris collection and storage cavity 16 of the DWT 12 and into the first filter 72 or out of the handheld surface cleaner 10 through the inlet 64.

An air flow path is defined through the handheld surface cleaner 10 by, in order, the inlet 64 at the distal end of the handheld surface cleaner 10, the first filter 72, the duckbill valve 76, the separator 52, the separator bracket 48, the second filter 74, and a gap of space defined between a lower cover 78 (see FIGS. 2, 3, and 8) of the main body 14 and a suction motor housing 80 (see FIG. 2) of the main body 14, with the air exiting the handheld surface cleaner 10 through the air exit holes 68.

The debris and air flow paths are the same from the inlet 64 to the separator 52. As shown in FIG. 2, a flow path from the inlet 64 to the separator 52 defines the first longitudinal axis A1. As also shown in FIG. 2, the handle 58 defines a second longitudinal axis A2 that is at a transverse angle β relative to the first longitudinal axis A1. In an exemplary implementation, the transverse angle β is greater than about 90 degrees and less than about 180 degrees. For example, the angle β can in a range of about 135 degrees to about 175 degrees, e.g., about 140 degrees, about 145 degrees, about 150 degrees, about 155 degrees, about 160 degrees, about 165 degrees, etc. The transverse angle β being at least about 135 degrees and less than about 180 degrees may help provide a center of gravity so a user does not have to counteract gravity as much as with a smaller angle.

The debris that enters the separator 52 through the separator's inlet opening 52*e* along the flow path is configured to travel from the flow path to the debris flow path in the handheld surface cleaner 10 and then flow along the debris flow path. As discussed above, the separator 52 is configured to direct the debris radially outward and into the debris collection and storage cavity 16. The radial outward flow of the debris is in a direction radially outward from the first longitudinal axis A1.

The air that enters the separator 52 through the separator's inlet opening 52*e* along the flow path is configured to travel from the flow path to the air flow path in the handheld surface cleaner 10 and then flow along the air flow path in the handheld surface cleaner 10. The air flow path is different from the debris flow path. As also discussed above, the air is configured to flow out of the separator 52 through the separator's outlet opening 52*f*. This portion of the air flow path is along the first longitudinal axis A1. A remainder of the air flow path is not along the first longitudinal axis A1. As discussed above, downstream of the separator 52, the air flow path is through the separator bracket 48, the second filter 74, and the gap of space defined between the lower cover 78 and the suction motor housing 80.

The handheld surface cleaner 10 includes a plurality of actuators 82, in the form of buttons in this illustrated implementation, configured to be actuated by a user to control various functions of the handheld surface cleaner 10. Each of the actuators 82 is operatively connected to the PCB 56. The handheld surface cleaner 10 includes two actuators 82 in this illustrated implementation but can include another number of actuators 82, e.g., one, three, four, etc.

In this illustrated implementation, a first one of the actuators 82 is a power button configured to control on/off of the handheld surface cleaner 10. If the microswitch 40 is not activated, actuation of the first actuator 82 does not cause suctioning functionality of the handheld surface cleaner 10.

In other words, the controller is configured to allow activation of the suction motor 60 in response to actuation of the first actuator 82 if the microswitch 40 is activated, and the controller is configured to prevent activation of the suction motor 60 in response to actuation of the first actuator 82 if the microswitch 40 is not activated.

In this illustrated implementation, a second one of the actuators 82 is a boost button configured to control suction boost functionality. In response to actuation of the second actuator 82, the controller is configured to increase suction provided by the suction motor 60. In some implementations, the controller is configured to provide suction boost functionality as long as the second actuator 82 is being actuated, e.g., as long as a user holds down the second actuator 82. Such a configuration gives the user greater suction control. In other implementations, the controller is configured to provide suction boost functionality for a predetermined amount of time in response to actuation of the second actuator 82. If a user desires additional suction boost, the user can actuate the second actuator 82 again. Such a configuration helps prevent overheating of the suction motor 82.

In some implementations, the handheld surface cleaner 10 includes a light emitting diode (LED) or other type of light. For example, each of the actuator(s) 82 can have an associated LED or other type of light. The associated light is configured to provide information to a user regarding the functionality of its associated actuator 82, such as a light associated with the first actuator 82 being configured to indicate a power status of the handheld surface cleaner, e.g., illuminated for "on" and not illuminated for "off." For another example, a light can be configured to illuminate to signal to a user that the DWT 12 is full, thereby signaling to the user that the DWT 12 should be emptied to allow for further suctioning of debris. For yet another example, a light associated with the first actuator 82 can be configured to indicate that the first actuator 82 was actuated but the handheld surface cleaner 10 was not powered on due to the DWT 12 not being properly attached to the main body 14, e.g., as indicated by the activation state of the microswitch 40.

In this illustrated implementation, the handheld surface cleaner 10, e.g., the controller at the PCB 56, is configured to determine automatically whether the DWT 12 is full. The fullness detection can be achieved in any of a number of ways. For example, the fullness of the DWT 12 can be determined using a current of a motor. If the current is above a predetermined threshold value, the DWT 12 can be considered to be full. For another example, the fullness of the DWT 12 can be determined using a pair of probes configured to extend into the DWT 12 to indicate a liquid level within the DWT 12. No current will be conducted between the probes until each of the probes is in contact with liquid, e.g., an electrode of each probe is in contact with liquid. The current will thus indicate that a certain fill level in the DWT 12 has been reached.

The handheld surface cleaner 10, e.g., the controller, in this illustrated implementation is configured to determine whether the DWT 12 is full based on a current of the separator motor 46. A current sensor operatively coupled to the controller is configured to measure a current of the separator motor 46, although current may be measured in another way. If the measured current is not above a predetermined threshold value stored in the memory at the PCB 56, the handheld surface cleaner 10, e.g., the controller, is configured to determine that the DWT 12 is not full. If the measured current is above the predetermined threshold value, the handheld surface cleaner 10, e.g., the controller, is configured to determine that the DWT 12 is full. As debris enters the DWT 12 and fills the DWT 12 enough to reach the separator 52, the separator motor 46 pulls more and more current as the DWT's fill level increases and more and more debris is around the separator 52. If the current of the separator motor 46 rises above the predetermined threshold value, the DWT 12 is considered to be full because of the amount of current being pulled by the separator motor 46.

In an exemplary implementation, the current of the separator motor 46 must be above the predetermined threshold value for a predetermined period of time before the current of the separator motor 46 is considered to be above the predetermined threshold value. Waiting the predetermined period of time may account for temporary position of the handheld surface cleaner 10 in which the separator motor 46 may be only temporarily pulling current above the predetermined threshold value because, given the orientation that a user is holding the handheld surface cleaner 10, gravity is causing the debris to settle temporarily around the separator 52 to give a false indication of the DWT 12 being full.

In response to determining that the DWT 12 is full, the handheld surface cleaner 10, e.g., the controller, is configured to cause at least one action to be performed. For example, the handheld surface cleaner 10, e.g., the controller, can be configured to cause a light of the handheld surface cleaner 10 to be illuminated to signal a user that the DWT 12 should be emptied to allow for further suctioning of debris. For another example, the handheld surface cleaner 10, e.g., the controller, can be configured to cause each of the separator motor 46 and the suction motor 60 to turn off in response to determining that the DWT 12 is full, thereby preventing more debris from being suctioned into the handheld surface cleaner 10. In some implementations, the handheld surface cleaner 10, e.g., the controller, can cause the suction motor 60 to turn off before the separator motor 46 is turned off to allow the separator motor 46 to continue running to separate any debris and air that has already entered the handheld suction cleaner 10 and to help clean the separator 52 before a next rotation of the separator 52. In some implementations, the handheld surface cleaner 10, e.g., the controller, can cause the suction motor 60 and the separator motor 46 to turn off simultaneously. For yet another example, the handheld surface cleaner 10, e.g., the controller, can be configured to cause the separator motor 46 to be turned off after the suction motor 60 is turned off in response to determining that the measured current is above a first predetermined threshold value and to cause the suction motor 60 and the separator motor 46 to turn off simultaneously in response to determining that the measured current is above a second predetermined threshold value that is greater than the first predetermined threshold. Using the second predetermined threshold value is a safety feature for short protection.

The inlet 64 at the distal end of the handheld surface cleaner 10 is configured to releasably couple to an attachment to help facilitate surface cleaning. In an exemplary implementation, a plurality of attachments are provided as a kit with the handheld surface cleaner 10. The plurality of attachments are configured to be selectively coupled to the handheld surface cleaner 10, one at a time, based on the particular type of cleaning desired by a user. The attachments described herein are described with respect to a handheld surface cleaner but can similarly be used with another type of cleaner, such as an upright vacuum cleaner including a hose configured to removably attach to an attachment. Additionally, the attachments described herein are described as being removably attachable to a cleaner but can instead be non-removably attached to a cleaner.

Figure 19:
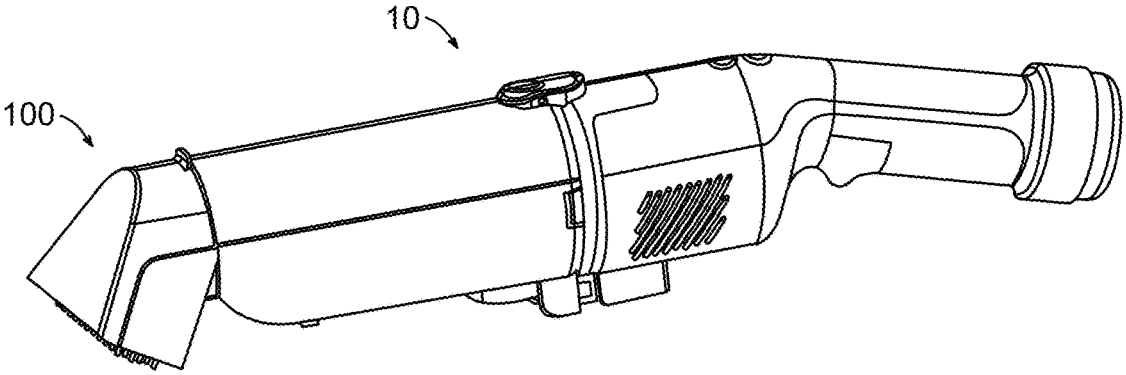
FIG. 19 is a perspective view of the handheld surface cleaner of FIG. 1 releasably coupled to one implementation of a stain tool attachment.
Figure 20:
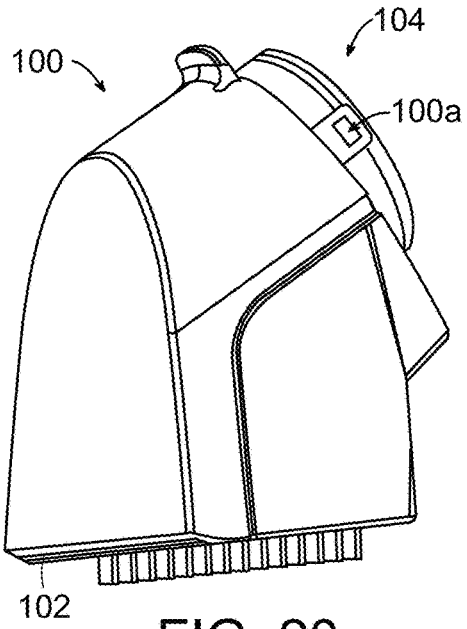
FIG. 20 is a perspective view of the stain tool attachment of FIG. 19 that is configured to releasably couple to a handheld surface cleaner such as the handheld surface cleaner of FIG. 1.
Figure 21:
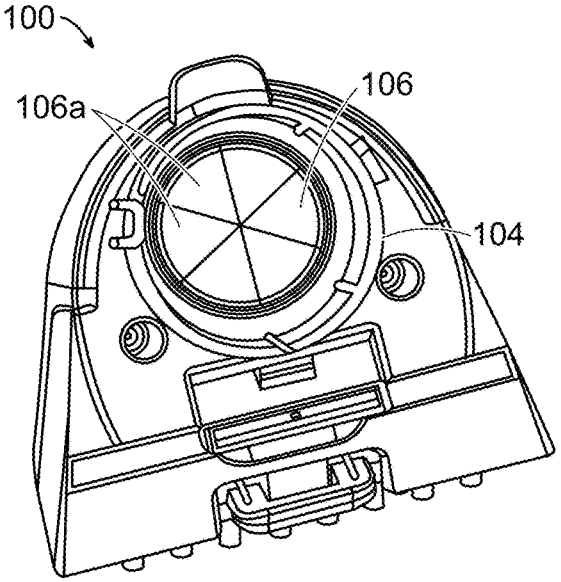
FIG. 21 is another perspective view of the stain tool attachment of FIG. 19.
Figure 22:
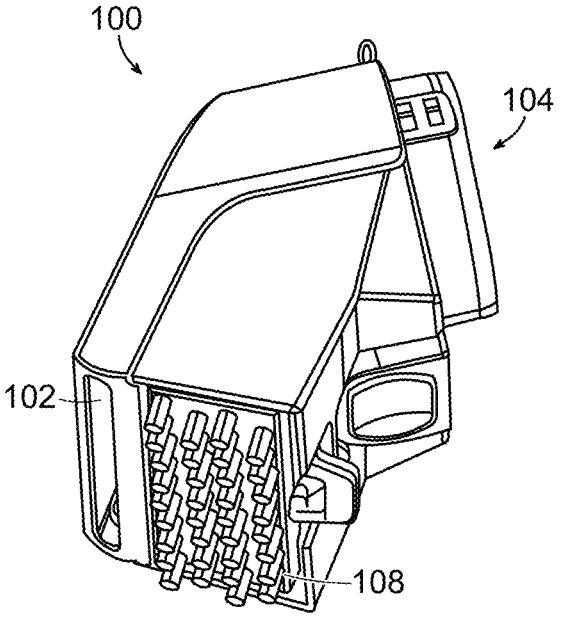
FIG. 22 is yet another perspective view of the stain tool attachment of FIG. 19.

FIGS. 19-22 illustrate one implementation of an attachment in the form of a stain tool attachment 100 configured to releasably couple to an inlet of a handheld surface cleaner such as the handheld surface cleaner 10 of FIG. 1. FIG. 19 shows the stain tool attachment 100 releasably coupled to the handheld surface cleaner 10 of FIG. 1. FIGS. 20-22 show the stain tool attachment 100 as a standalone element.

As shown in FIGS. 20-22, the stain tool attachment 100 includes an inlet opening 102 and an outlet opening 104. Debris is configured to enter the stain tool attachment 100 through the inlet opening 102, e.g., under a suction force provided by a handheld surface cleaner to which the stain tool attachment 100 is attached, and to exit the stain tool attachment 100 through the outlet opening 104, e.g., to pass into a handheld surface cleaner to which the stain tool attachment 100 is attached. The inlet opening 102 is a single opening and has a rectangular shape in this illustrated implementation but can instead include a plurality of openings and/or have a different shape. The outlet opening 104 is a single opening and has a circular shape in this illustrated implementation but can instead include a plurality of openings and/or have a different shape.

As shown in FIG. 21, the stain tool attachment 100 includes a seal 106. The seal 106 is located between the inlet opening 102 and the outlet opening 104 of the stain tool attachment 100. The seal 106 is configured to move between a closed position (shown in FIG. 21) and an open position.

The seal 106 is a dynamic seal configured to move automatically between the open and closed positions in response to application and removal of a suction force, e.g., a suction force provided by a handheld surface cleaner to which the stain tool attachment 100. The application of the suction force is configured to cause the seal 106 to move from the closed position to the open position, e.g., by pulling back a plurality of flexible flaps 106*a* of the seal 106 attached to the stain tool attachment 100 along their radially outward edges. In the open position the seal 106 is configured to allow flow from the inlet opening 102 to the outlet opening 104. The removal of the suction force is configured to cause the seal 106 to move from the open position to the closed position, e.g., by allowing the plurality of flexible flaps 106*a* of the seal 106 to dynamically flex to their default positions (shown in FIG. 21). In the closed position, the seal 106 is configured to prevent flow from the inlet opening 102 to the outlet opening 104 and to prevent flow from the outlet opening 104 to the inlet opening 102. Preventing flow from the inlet opening 102 to the outlet opening 104 stops any debris that inadvertently enters the inlet opening 102 from passing out of the outlet opening 104, whether or not the stain tool attachment 100 is attached to a handheld surface cleaner. Preventing flow from the outlet opening 104 to the inlet opening 102 stops any debris that inadvertently enters the outlet opening 104 from passing out of the inlet opening 102, whether or not the stain tool attachment 100 is attached to a handheld surface cleaner.

Figure 23A:
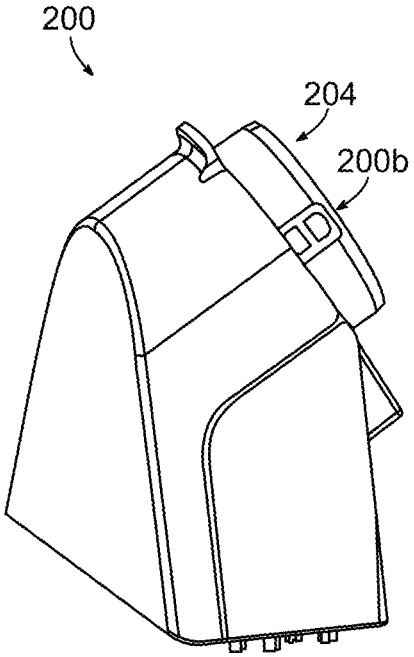
FIG. 23A is a perspective view of another implementation of a stain tool attachment configured to releasably couple to a handheld surface cleaner such as the handheld surface cleaner of FIG. 1.
Figure 23B:
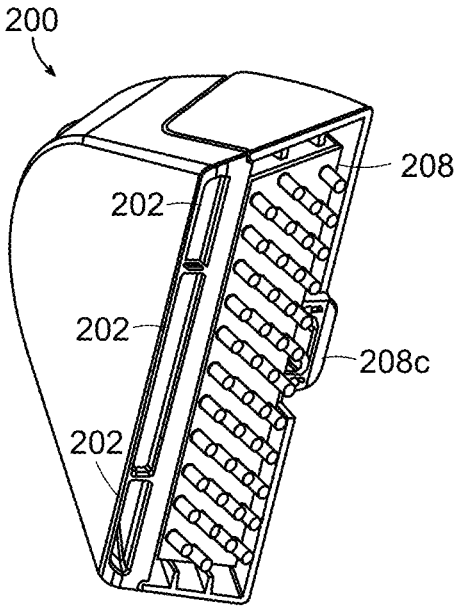
FIG. 23B is another perspective view of the stain tool attachment of FIG. 23A.
Figure 23C:
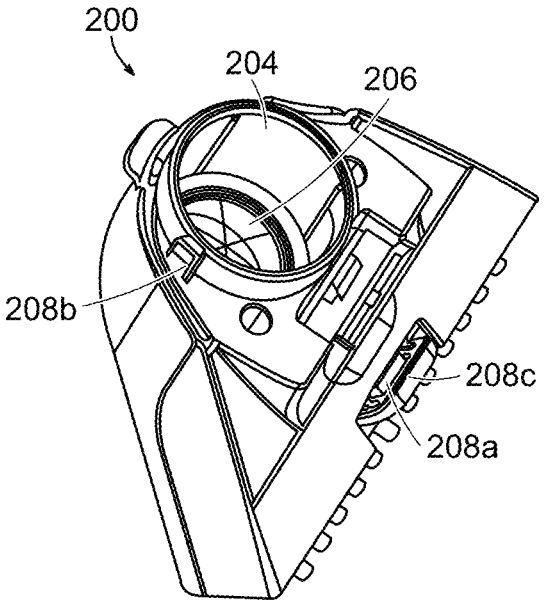
FIG. 23C is yet another perspective view of the stain tool attachment of FIG. 23A.

FIGS. 23A-23C illustrate another implementation of an attachment in the form of a stain tool attachment 200 configured to releasably couple to an inlet of a handheld surface cleaner such as the handheld surface cleaner 10 of FIG. 1. FIGS. 23A-23C show the stain tool attachment 200 as a standalone element. The stain tool attachment 200 of FIGS. 23A-23C is generally configured and used similar to the stain tool attachment 100 of FIGS. 18-21, e.g., includes an inlet opening 202, an outlet opening 204, and a seal 206, but has a larger size than the stain tool attachment 100 of FIGS. 19-22. The inlet opening 202 in this illustrated implementation includes a plurality of openings (3) but can instead have another plural number of openings or, as mentioned above, can instead be a single opening.

The stain tool attachment 200 includes an agitator 208 configured to agitate debris on a surface being cleaned to help the debris be drawn into the inlet opening 202 of the stain tool attachment 200. The agitator 208 is located behind (proximal to) the inlet opening 202 in this illustrated implementation.

Figure 24A:
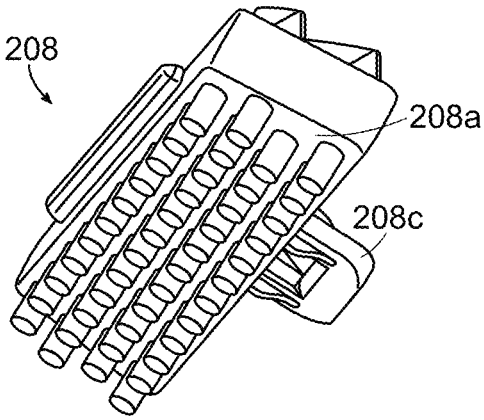
FIG. 24A is a perspective view of an agitator of the stain tool attachment of FIG. 23A.
Figure 24B:
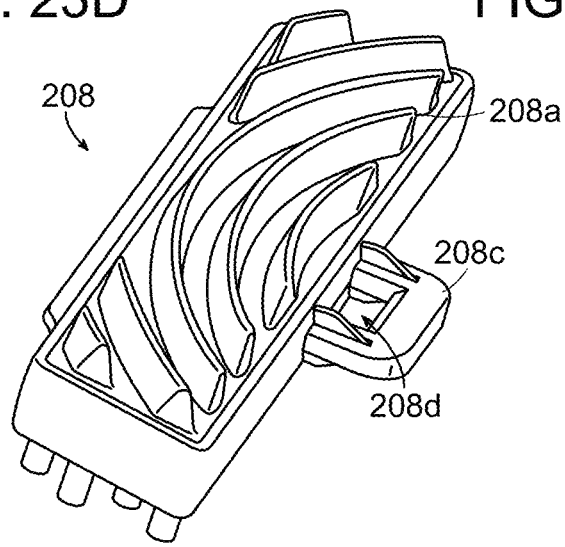
FIG. 24B is another perspective view of the agitator of FIG. 24A.

The agitator 208 can have a variety of configurations. As shown in FIG. 23B, the agitator 208 includes a plurality of bristles. Bristles are typically more effective in agitating certain types of debris than other types of debris, such as being generally more effective in agitating solid debris than liquid debris. Rather than require a user to detach the stain tool attachment 200 from a cleaner to which the stain tool attachment 200 is attached, or to retrieve another attachment even if the stain tool attachment 200 is not currently attached to a cleaner, the agitator 208 is configured to removably attach to the stain tool attachment 200 to allow for a different type of agitation mechanism to be coupled to the stain tool attachment 200. FIGS. 23A-23C show the agitator 208 removably coupled to the stain tool attachment 200. FIGS. 24A and 24B show the agitator 208 as a standalone element. In some implementations, a different agitator can be coupled to the stain tool attachment 200 to allow for the different type of agitation mechanism. In other implementations, as in this illustrated implementation, the same agitator 208 is configured to be coupled to the stain tool attachment 200 in different orientations, with each orientation providing for a different agitation mechanism.

An attachment, e.g., any of the attachments described herein, can include a grip feature. The grip feature can have a variety of configurations. For example, the grip feature can include a textured surface. For another example, the grip feature can include a plurality of raised dimples. For another example, the grip feature can include a plurality of recessed dimples. For yet another example, the grip feature can include a plurality of raised ribs. For still another example, the grip feature can include a plurality of grooves.

Figure 23D:
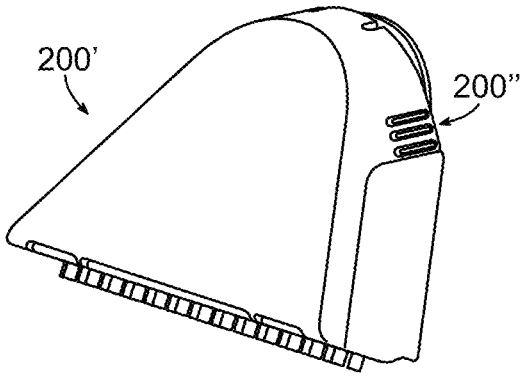
FIG. 23D is a perspective view of another implementation of an attachment in the form of a stain tool attachment configured to releasably couple to an inlet of a handheld surface cleaner such as the handheld surface cleaner of FIG. 1.

FIG. 23D illustrates another implementation of an attachment in the form of a stain tool attachment 200' configured to releasably couple to an inlet of a handheld surface cleaner such as the handheld surface cleaner 10 of FIG. 1. The stain tool attachment 200' of FIG. 23D is the same as the stain tool attachment 200 of 23A-23C except that the stain tool attachment 200' of FIG. 23D includes a grip feature 200". The grip feature 200" is configured to improve a user's hold of the stain tool attachment 200' and/or to indicate to a user, e.g., visually and/or tactilely, where the attachment 200' should be held for efficient attachment of the attachment 200' to and removal of the attachment 200' from a handheld surface cleaner. The grip feature 200" can have a variety of configurations. The grip feature 200" in this illustrated implementation includes a plurality of raised ribs on opposed sides of the attachment 200' (only one side is visible in the view of FIG. 23D).

As shown in FIGS. 24A and 24B, the agitator 208 has two faces 208*a*, 208*b* each with a different type of agitation mechanism. A first face 208*a*, shown in FIGS. 23A-24A, of the agitator 208 includes the plurality of bristles. With the agitator 208 coupled to the stain tool attachment 200 in a first orientation, as shown in FIGS. 23A-23C, the plurality of bristles are provided as the agitation mechanism. A second face 208*b*, shown in FIG. 24B, of the agitator 208 includes one or more ribs. With the agitator 208 coupled to the stain tool attachment 200 in a second orientation, the rib(s) are provided as the agitation mechanism. Ribs are typically more effective in agitating certain types of debris than other types of debris, such as being generally more effective in agitating liquid debris than solid debris.

The agitator 208 is configured to removably attach to the stain tool attachment 200 with a snap lock mechanism but another attachment mechanism may be used. The agitator 208 includes a tab 208*c* configured to be held to facilitate manual coupling of the agitator 208 to the stain tool attachment 200 and manual de-coupling of the agitator 208 from the stain tool attachment 200. The tab 208*c* includes an opening 208*d* configured to releasably receive therein a protrusion 200*a* of the stain tool attachment 200 to lock together the agitator 208 and the stain tool attachment 200. In other implementations, the tab 208 can include the protrusion and the stain tool attachment 200 can include the opening.

The stain tool attachment 100 of FIGS. 19-22 includes an agitator 102 that is generally configured and used similar to the agitator 208 of FIGS. 23A-24B, although as mentioned above the agitator 108 can instead be non-removably attached to the stain tool attachment 100.

Figure 25A:
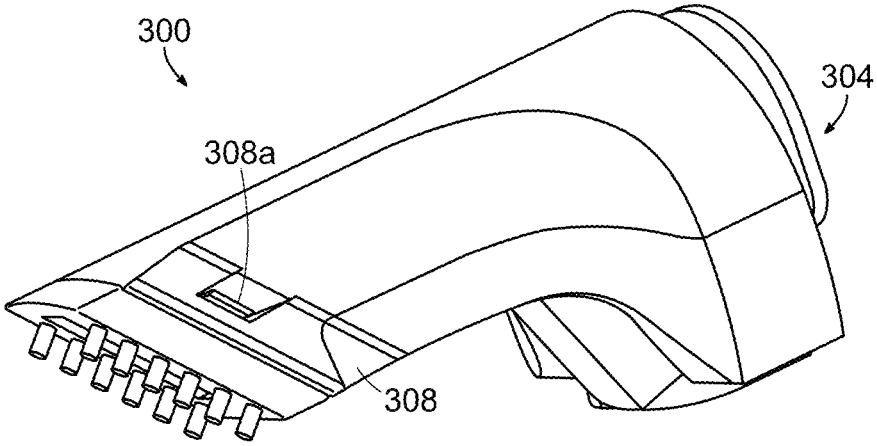
FIG. 25A is a perspective view of one implementation of a crevice tool attachment configured to releasably couple to a handheld surface cleaner such as the handheld surface cleaner of FIG. 1.
Figure 25B:
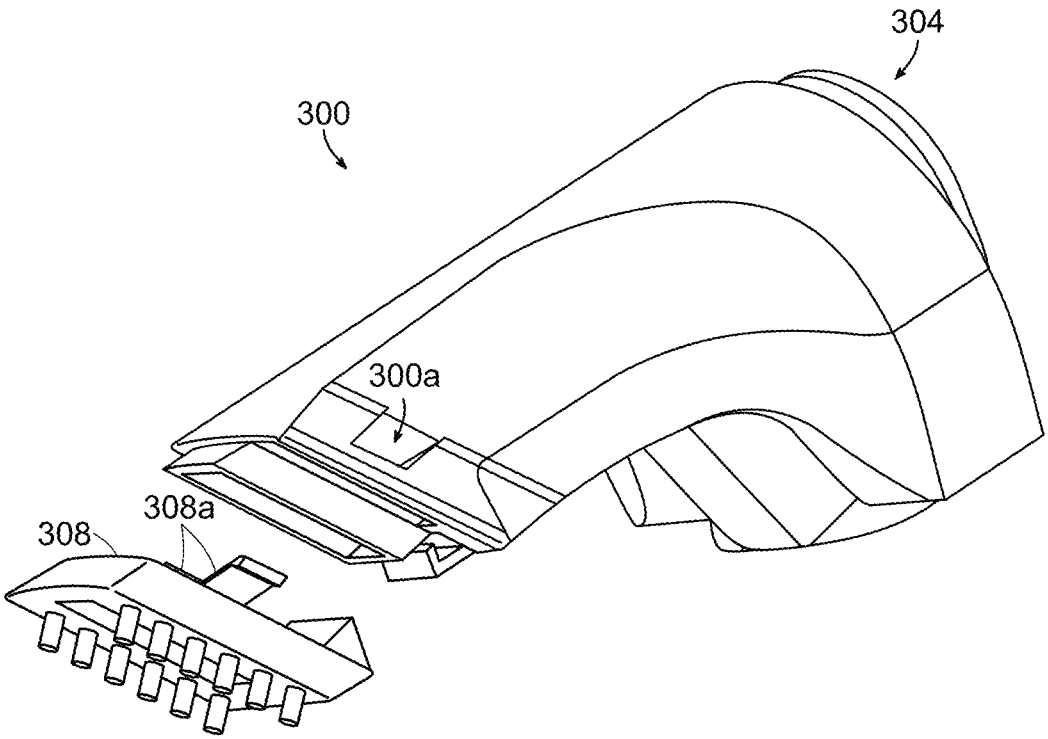
FIG. 25B is a perspective view of the crevice tool attachment of FIG. 25A with an agitator of the crevice tool attachment detached.
Figure 25C:
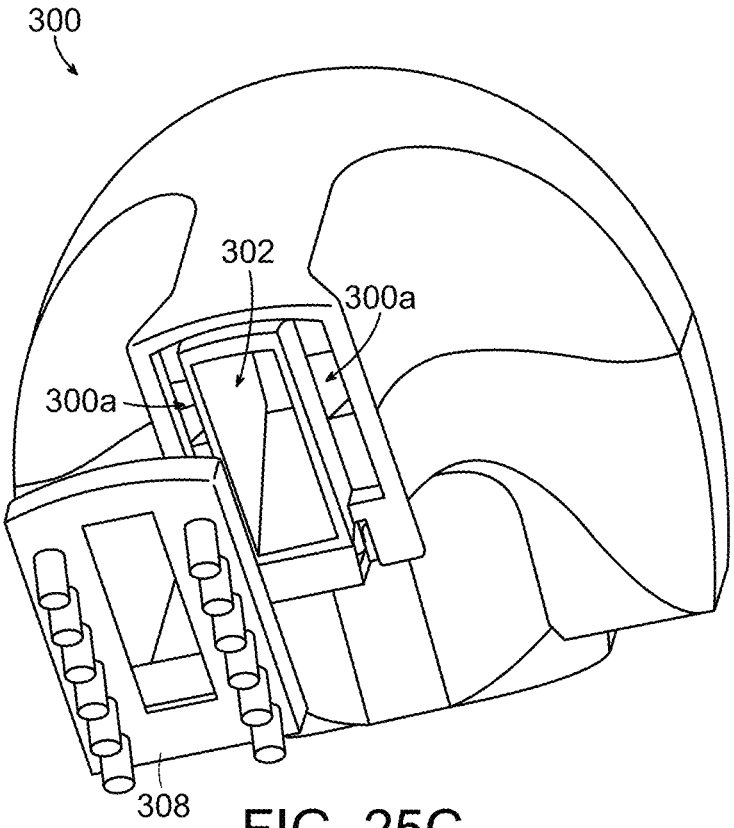
FIG. 25C is another perspective view of the crevice tool of FIG. 25A with the agitator of the crevice tool attachment detached.

FIGS. 25A-25C illustrate another implementation of an attachment in the form of a crevice tool attachment 300 configured to releasably couple to an inlet of a handheld surface cleaner such as the handheld surface cleaner 10 of FIG. 1. The stain tool attachment 300 of FIGS. 25A-25C is generally configured and used similar to the stain tool attachment 100 of FIGS. 18-21, e.g., includes an inlet opening 302, an outlet opening 304, a seal (obscured in the figures), and an agitator 308. The agitator 308 is configured to removably attach to the crevice tool attachment 300 but can instead be non-removably attached to the crevice tool attachment 300. FIG. 25A shows the agitator 308 coupled to the crevice tool attachment 300. FIGS. 25B and 25C show the agitator 308 de-coupled from the crevice tool attachment 300. In this illustrated implementation, the agitator 308 is configured to surround the inlet opening 302, includes an agitation mechanism in the form of bristles, and includes a pair of prongs 308*a* configured to snap lock in a corresponding pair of openings 300*a* of the stain tool attachment 300.

Figure 26:
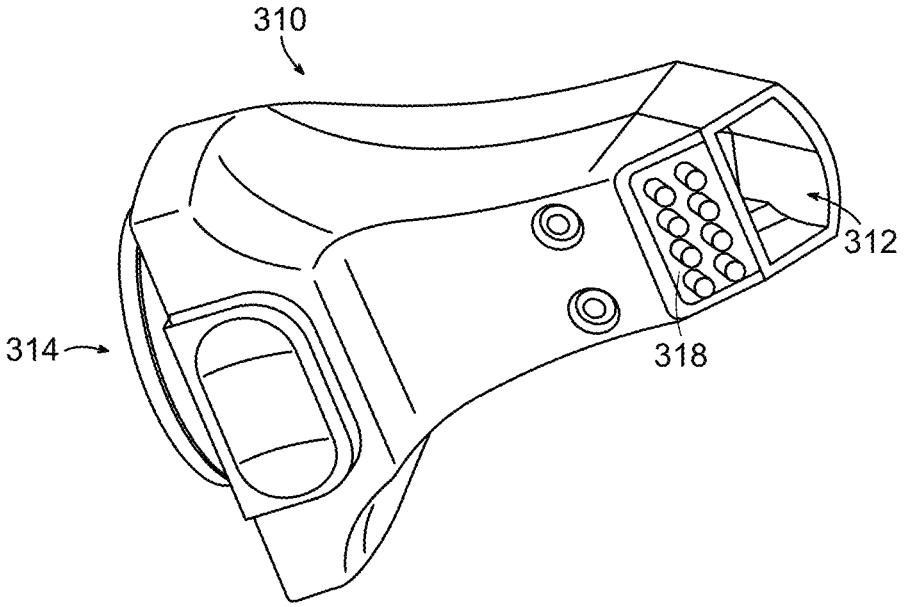
FIG. 26 is a perspective view of another implementation of a crevice tool attachment configured to releasably couple to a handheld surface cleaner such as the handheld surface cleaner of FIG. 1.
Figure 27:
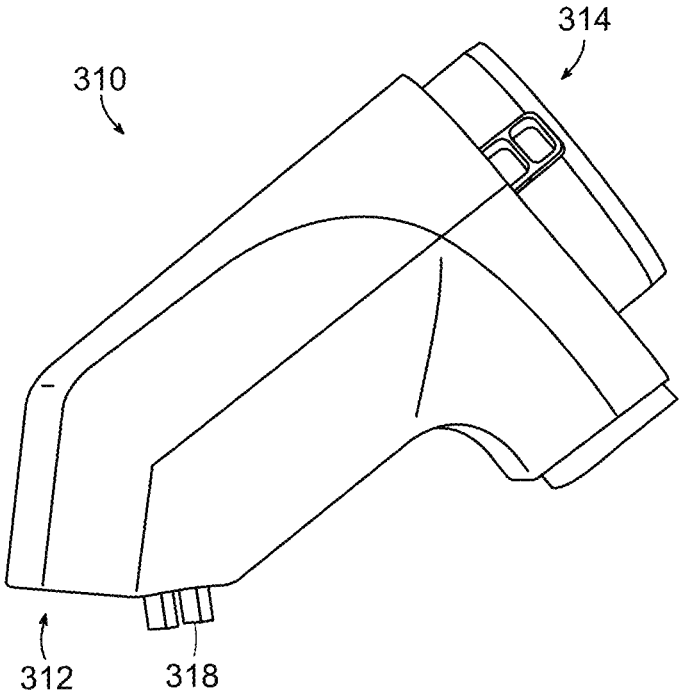
FIG. 27 is a side view of the crevice tool attachment of FIG. 26.
Figure 28:
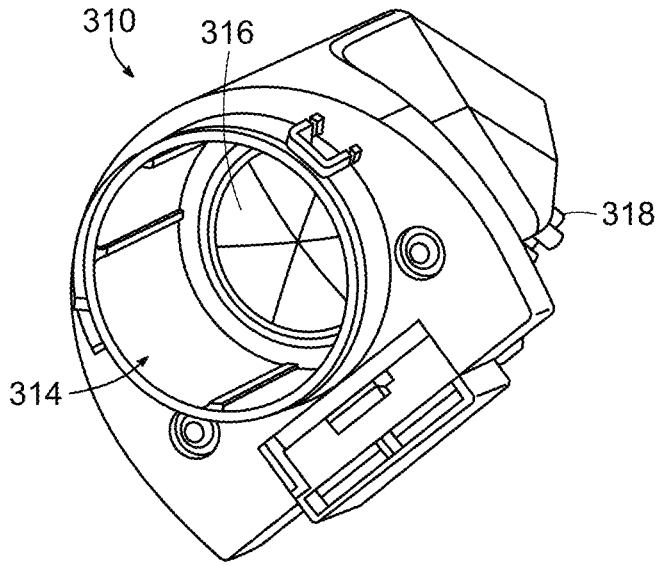
FIG. 28 is another perspective view of the crevice tool attachment of FIG. 26.

FIGS. 26-28 illustrate another implementation of an attachment in the form of a crevice tool attachment 310 configured to releasably couple to an inlet of a handheld surface cleaner such as the handheld surface cleaner 10 of FIG. 1. FIGS. 26-28 show the crevice tool attachment 310 as a standalone element. The crevice tool attachment 310 of FIGS. 26-28 is generally configured and used similar to the stain tool attachment 100 of FIGS. 18-21, e.g., includes an inlet opening 312, an outlet opening 314, a seal 316, and an agitator 318. The agitator 318 is non-removably attached to the crevice tool attachment 310 but can instead be configured to removably attach to the crevice tool attachment 310. In this illustrated implementation, the agitator 318 includes an agitation mechanism in the form of bristles.

Figure 29A:
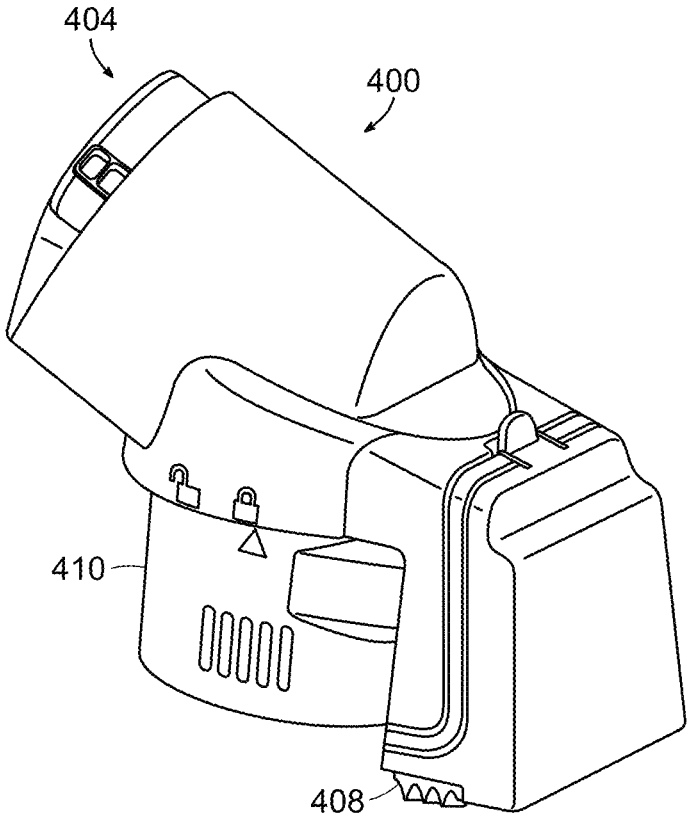
FIG. 29A is a perspective view of one implementation of a pet hair tool attachment configured to releasably couple to a handheld surface cleaner such as the handheld surface cleaner of FIG. 1.
Figure 29B:
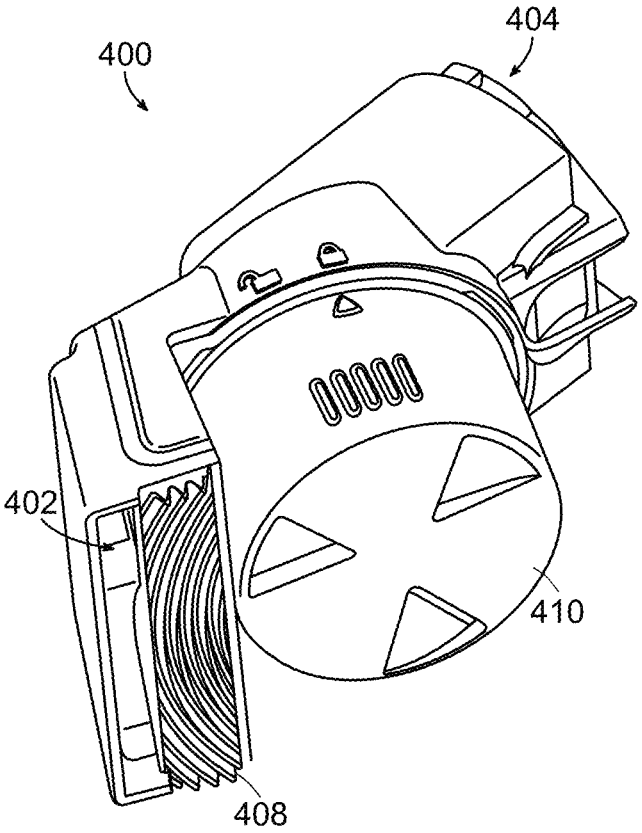
FIG. 29B is another perspective view of the pet hair tool attachment of FIG. 29A.
Figure 29C:
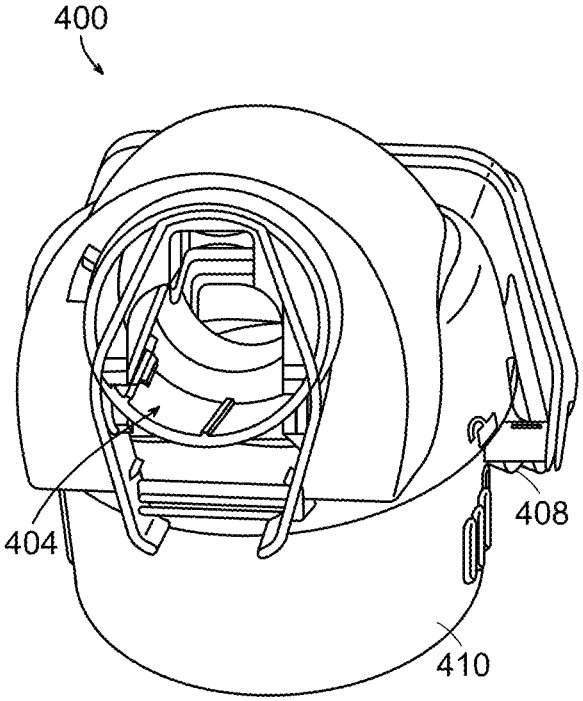
FIG. 29C is another perspective view of the pet hair tool attachment of FIG. 29A.

FIGS. 29A-29C illustrate another implementation of an attachment in the form of a pet hair tool attachment 400 configured to releasably couple to an inlet of a handheld surface cleaner such as the handheld surface cleaner 10 of FIG. 1. FIGS. 29A-29C show the pet hair tool attachment 400 as a standalone element. The pet hair tool attachment 400 of FIGS. 29A-29C is generally configured and used similar to the stain tool attachment 100 of FIGS. 18-21, e.g., includes an inlet opening 402, an outlet opening 404, a seal (obscured in the figures), and an agitator 408. The agitator 408 is non-removably attached to the pet hair tool attachment 400 but can instead be configured to removably attach to the pet hair tool attachment 400. In this illustrated implementation, the agitator 408 includes an agitation mechanism in the form of ribs.

Debris entering the attachments 100, 200, 300, 310 of FIGS. 19-23C and 25A-28 is configured to pass through the attachment (with the seal in the open position) without the debris being collected on board the attachment 100, 200, 300, 310. The pet hair tool attachment 400 of 29A-29C includes a debris storage container 410 configured to collect at least some debris entering the pet hair tool attachment 400

Figure 30:
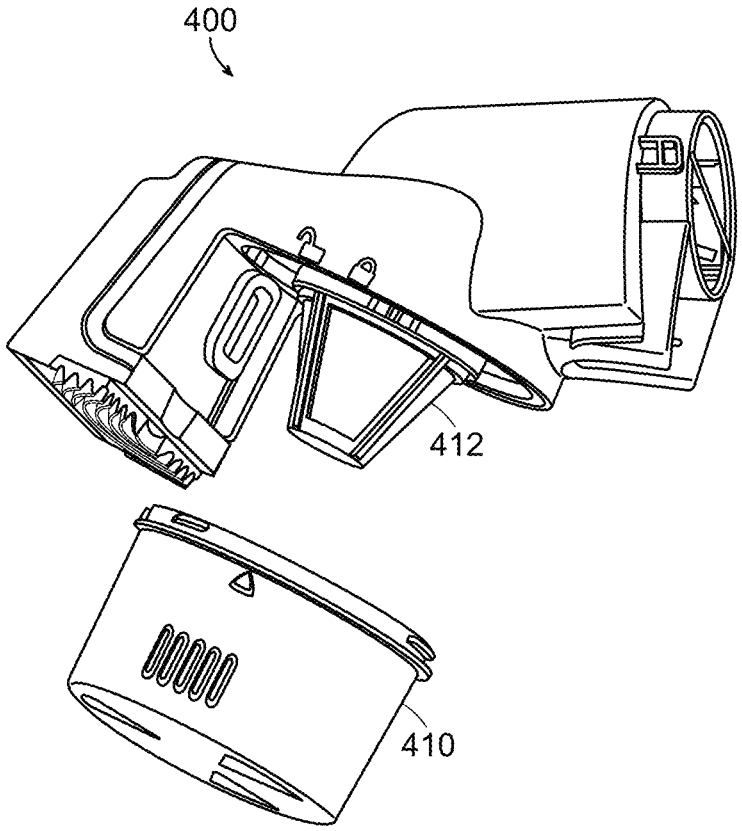
FIG. 30 is a perspective view of the pet hair tool attachment of FIG. 29A with a debris storage container of the pet hair tool attachment detached.
Figure 31:
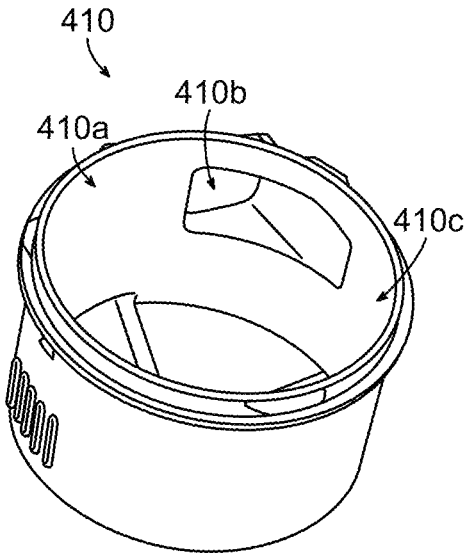
FIG. 31 is a perspective view of the debris storage container of FIG. 30.

The debris storage container 410 is configured to removably attach to the pet hair tool attachment 400 to facilitate emptying and cleaning of the storage container 410. FIGS. 29A-29C show the debris storage container 410 coupled to the pet hair tool attachment 400. FIGS. 30 and 31 show the debris storage container 410 detached from the pet hair tool attachment 400.

In this illustrated implementation, with the debris storage container 410 attached to the pet hair tool attachment 400, the debris storage container 410 is configured to be rotated in a first direction, e.g., clockwise, to move the debris storage container 410 from a locked configuration, in which the debris storage container 410 is locked to the pet hair attachment tool 400, to an unlocked configuration, in which the debris storage container 410 is unlocked from the pet hair attachment tool 400. With the debris storage container 410 detached from the pet hair tool attachment 400, the debris storage container 410 is configured to be rotated in a second direction, e.g., counterclockwise, to move the debris storage container 410 from the unlocked configuration to the unlocked configuration.

The debris storage container 410 and the pet hair tool attachment 400 in this illustrated implementation are attachable and detachable via a bayonet mount. The debris storage container 410 includes a plurality of male members and the pet hair tool attachment 400 includes a plurality of female members, although in other implementations the debris storage container 410 can include a plurality of female members and the pet hair tool attachment 400 can include a plurality of male members. With the debris storage container 410 in the locked configuration, the female and male members are misaligned. Moving the debris storage container 410 from the locked configuration to the unlocked configuration is configured to align the female and male members to allow removal of the debris storage container 410 from the pet hair tool attachment 400. Similarly, moving the debris storage container 410 from the unlocked configuration to the locked configuration is configured to misalign the female and male members.

As shown in FIG. 30, the pet hair attachment tool 400 includes a filter 412 located in a flow path between the inlet opening 402 and the outlet opening 404. The filter 412 is non-removably attached to the pet hair attachment tool 400 in this illustrated implementation but can instead be removably attached to the pet hair attachment tool 400.

Debris small enough to pass through the filter 412 is configured to flow from the inlet opening 402 to the outlet opening 404 (with the seal 406 in the open position). Debris too large to pass through the filter 412 is configured to flow from the inlet opening 402 to a debris collection and storage cavity 410*a* of the debris storage container 410 because the filter 412 is configured to flow prevent the too-large debris from continuing to the outlet opening 404. With the debris storage container 410 attached to the pet hair tool attachment 400, the filter 412 is at least partially located in the debris collection and storage cavity 410*a*. As shown in FIG. 31, the debris storage container 410 includes a side opening 410*b* in fluid communication with the inlet opening 402 to allow debris entering the inlet opening 402 to flow into the debris storage container 410, e.g., into the debris collection and storage cavity 410*a*, with debris less than a certain size defined by the filter 412 passing through the filter 412 and out a top opening 410*c* of the debris storage container 410 to continue along the flow path and with debris less than the certain size remaining in the debris storage container 410, e.g., in the debris collection and storage cavity 410*a*.

Figure 32:
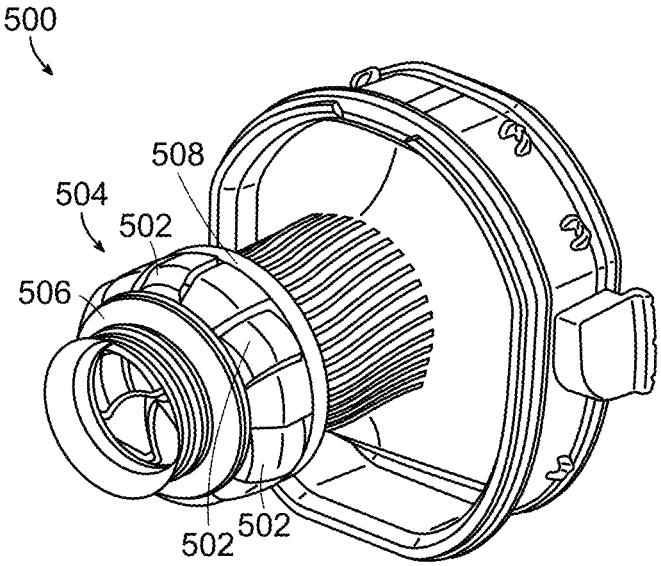
FIG. 32 is a perspective view of another implementation of a separator assembly of a handheld surface cleaner.

FIG. 32 illustrates another implementation of a separator assembly 500 of a handheld surface cleaner configured to use suction to draw debris into the handheld surface cleaner and to separate the air and the debris on board the handheld surface cleaner. The separator assembly 500 of FIG. 32 is generally configured and used similar to the separator assembly 50 of FIGS. 10-13 except that, unlike the side holes 52*d* in the separator 52 of FIGS. 10-13 that are open regardless of whether the separator 52 is rotating, holes (obscured by movable covers 502 in FIG. 32) formed in a sidewall of a separator 504 of the separator assembly 500 of FIG. 32 are not open regardless of whether the separator 504 is rotating. With the separator 504 in a static, non-rotating position, the holes of the separator 504 are closed, as shown in FIG. 32. With the separator 504 rotating, the holes of the separator 504 are open. The holes being open or closed depending on whether the separator 504 is rotating may help prevent any debris from passing into a static, non-rotating separator 504 from the handheld surface cleaner's collection and storage cavity, as such passage may jam the separator 504 and/or allow for debris to exit out of the handheld surface cleaner's inlet.

As discussed further below, in an exemplary implementation, each of the covers 502 is configured as a centrifugal seal configured to respond to a centrifugal force to move automatically between sealing the separator's holes and not sealing the separator's holes. Without the covers 502 sealing the separator's holes, debris is free to pass through the holes from inside the separator to outside the separator, e.g., to a DWT of the cleaner that includes the separator. With the covers 502 sealing the separator's holes, debris in the DWT cannot enter the separator through the holes.

The holes formed in the separator of the separator assembly of FIG. 32, e.g., formed in an outer separator 506 of the separator 504, each have an associated movable cover 502 in the form of a flap. The movable cover 502 is attached to the separator 504, e.g., to the outer separator 506 and/or to the separator's inner separator 508, along one edge of the movable cover 502. The edges of the movable covers 502 that are attached to the separator 504 are the trailing edges of the movable covers 502 in a direction of the separator's rotation. In a resting configuration, shown in FIG. 32 and corresponding to the separator 504 being static and non-rotating, the movable covers 502 cover the separator's holes so that the side holes are closed and are sealed. In an active configuration, corresponding to the separator 504 rotating, the movable covers 502 do not cover the separator's holes so that the holes are open and are not sealed. Because the edges of the movable covers 502 that are attached to the separator 504 are the trailing edges of the movable covers 502, the separator's rotation will urge the movable covers 502 to open automatically in response to centrifugal force. When the separator 504 stops rotating, the movable covers 502 will automatically move from the active configuration to the resting configuration since the centrifugal force is no longer present.

As in this illustrated implementation, each of the movable covers 502 can be configured to selectively cover one of the separator's holes. In another implementation, one or more of the movable covers 502 can be configured to selectively cover more than one of the separator's holes, e.g., cover two of the separator's holes, etc.

In an exemplary implementation, the movable covers 502 are formed of rubber and/or other flexible material configured to help "blow" the movable covers 502 off their respective holes and to help the movable covers 502 seal the holes with the movable covers 502 in the resting configuration.

Figure 33:
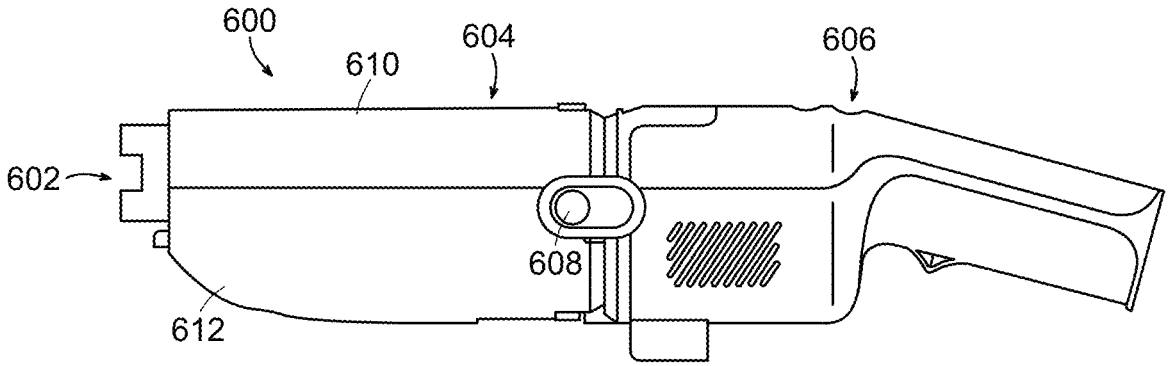
FIG. 33 is a side view of another implementation of a handheld surface cleaner.
Figure 34:
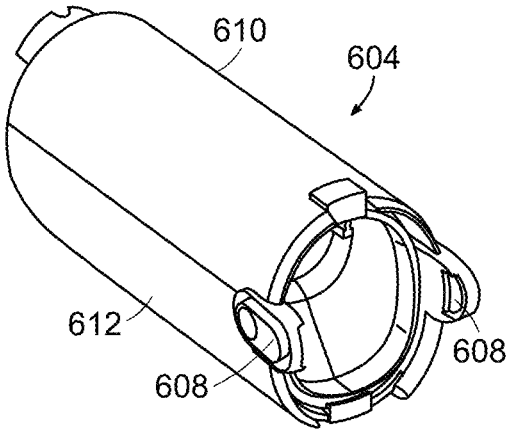
FIG. 34 is a perspective view of a dirty water tank of the handheld surface cleaner of FIG. 33.

FIG. 33 illustrates another implementation of a handheld surface cleaner 600 configured to use suction to draw debris into the handheld surface cleaner 600 through an inlet 602 and to separate the air and the debris on board the handheld surface cleaner 600. The handheld surface cleaner 600 of FIG. 33 is generally configured and used similar to the handheld surface cleaner 10 of FIG. 1 except that instead of a DWT 604 of the handheld surface cleaner 600 being pivotally attached to a main body 606 of the handheld surface cleaner 600, the DWT 604 has a straight, non-pivoting connection with the main body 604. The DWT 604 includes a lock 608 configured to be pressed by a user to release the DWT 604 from the main body 606. FIG. 34 shows the DWT 604 of the handheld surface cleaner 600 of FIG. 33 as a standalone element detached from the main body 606.

The lock 608 is spring-loaded to allow a user to push the main body 606 and the dirty water tank 604 together, e.g., moving one or both of the DWT 604 and the main body 606 toward the other in a straight, longitudinal motion, to automatically lock the DWT 604 and the main body 606 together until a user actuates the lock 608.

The lock 608 in this illustrated implementation includes a pair of buttons on opposite sides of the DWT 604 around a perimeter of the DWT 604. The lock 608 is configured to move between a locked configuration, shown in FIGS. 33 and 34, and an unlocked configuration. In the locked configuration, the lock 608 is configured to lock the DWT 604 and the main body 606 together. In the unlocked configuration, the lock 608 is configured to allow the DWT 604 and the main body 606 to be de-coupled.

With the lock 608 in the locked configuration and locking the DWT 604 and the main body 606 together, the lock 608 is configured to be moved manually by a user from the locked configuration to the unlocked configuration, which allows a user to decide whether and when to de-couple the DWT 604 and the main body 606. The buttons of the lock 608 are configured to be pushed radially inward relative to a housing 610 of the DWT 604 (and a lower cover 612 of the DWT 604 if not omitted) to move from the locked configuration to the unlocked configuration. The lock 608 is biased to the locked configuration, and the buttons of the lock 608 are spring-loaded. Thus, when a user stops pushing the buttons radially inward, the lock 608 is configured to move automatically from the unlocked configuration to the locked configuration.

With the lock 608 in the locked configuration and without DWT 604 being coupled to the main body 606, the lock 608 is configured to move automatically from the locked configuration to the unlocked configuration and back to the locked configuration in response to the DWT 604 being coupled to the main body 606. Pushing the DWT 604 and the main body 606 together longitudinally is configured to cause the lock 608 to move automatically from the locked configuration to the unlocked configuration and back to the locked configuration. The spring-loading of the lock 608 is configured to allow the automatic movement of the lock 608 between the unlocked and locked configurations. A user thus does not need to take any specific action to lock the DWT 604 and the main body 606 together because merely attaching the DWT 604 and the main body 606 together automatically locks the DWT 604 and the main body 606 together until the user decides to unlock the DWT 604 from the main 606.

Figure 35:
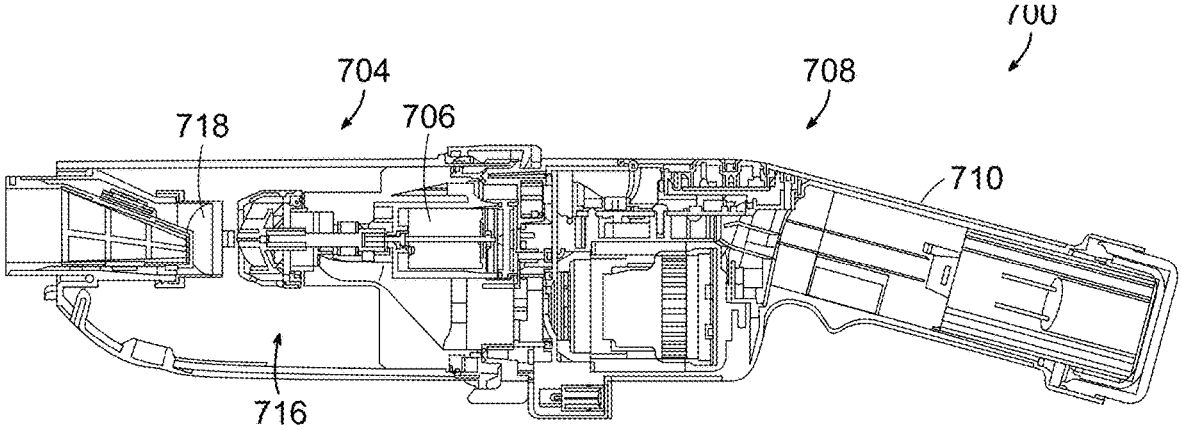
FIG. 35 is a side cross-sectional view of another implementation of a handheld surface cleaner.
Figure 36:
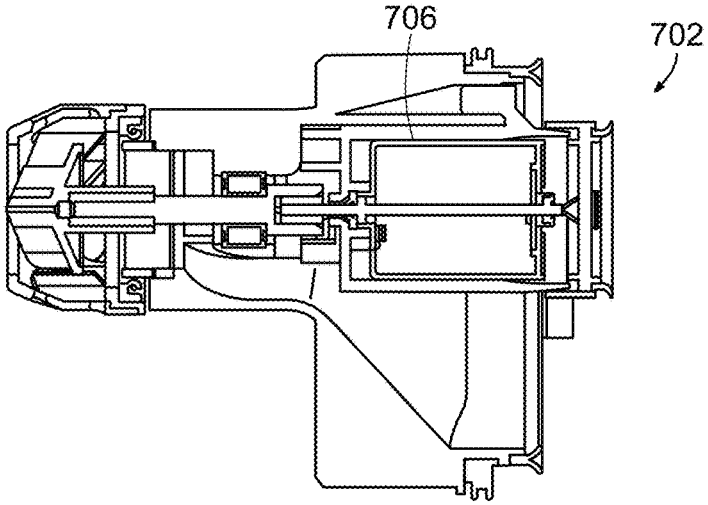
FIG. 36 is a side cross-sectional view of a separator assembly of the handheld surface cleaner of FIG. 35.

FIG. 35 illustrates another implementation of a handheld surface cleaner 700 configured to use suction to draw debris into the handheld surface cleaner 700 and to separate the air and the debris on board the handheld surface cleaner 700. The handheld surface cleaner 700 of FIG. 35 is generally configured and used similar to the handheld surface cleaner 10 of FIG. 1 except that, instead of the handheld surface cleaner's separator motor 46 being located at the handheld surface cleaner's main body 14, a separator assembly 702 of the handheld surface cleaner's DWT 704 includes a separator motor 706, as shown in FIGS. 35-37.

Figure 37:
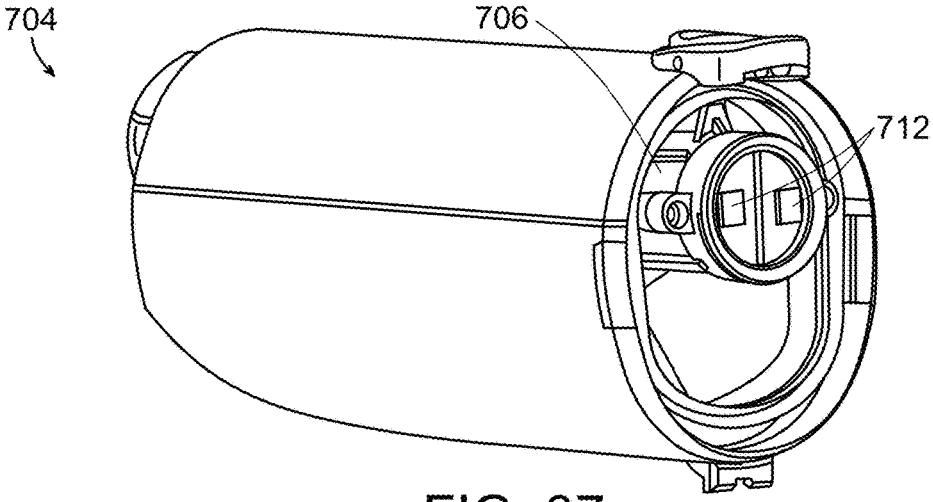
FIG. 37 is a perspective view of a dirty water tank of the handheld surface cleaner of FIG. 35.
Figure 38:
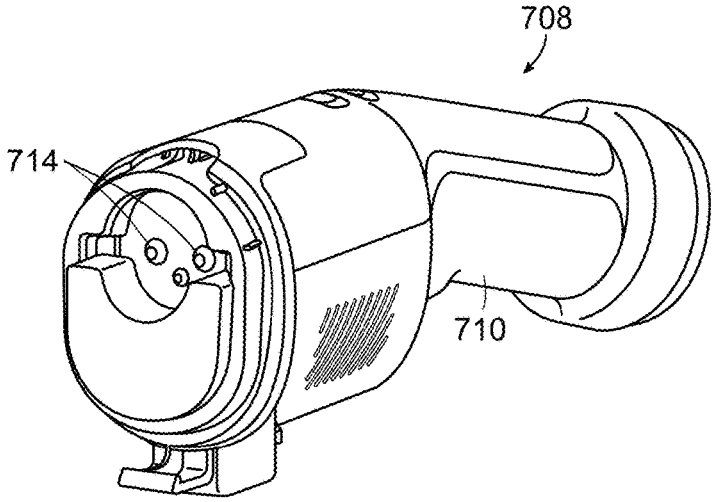
FIG. 38 is a perspective view of a main body of the handheld surface cleaner of FIG. 35.

To allow the separator motor 706 to be powered by a power supply located at the main body 708, e.g., by one or more batteries in a battery holder at a handle 710 of the main body 708, the DWT 704 includes at least one electrical connection 712 (two electrical connections are shown in the illustrated implementation of FIG. 37), e.g., a conductive plate or other electrical connector, operatively connected to the separator motor 706 and configured to contact at least one corresponding electrical connection 714 (two electrical connections are shown in the illustrated implementation of FIG. 38), e.g., a conductive pin or other electrical connector, of the main body 708 that is operatively connected to the power supply. The attachment of the DWT 704 and the main body 708 is configured to cause each of the DWT's one or more electrical connections 712 to conductively engage automatically with the main body's one or more electrical connections 714. Detaching the DWT 704 and the main body 708 is configured to cause the one or more electrical connections 712 to automatically no longer conductively engage with the main body's one or more electrical connections 714.

The electrical connection between the DWT 704 and the main body 708 is configured to be isolated from any air flowing the handheld surface cleaner 700 and from any debris in the handheld surface cleaner 700, whether the debris is flowing in the handheld surface cleaner 700 or is collected in the DWT's debris collection and storage cavity 716. Such isolation may help prevent a short circuit and/or may help prevent rusting and/or other damage to the DWT's one or more electrical connections 712 and/or the main body's one or more electrical connections 714. With the DWT 704 and the main body 708 attached together, the DWT's one or more electrical connections 712 and the main body's one or more electrical connections 714 are configured to be isolated from any debris flowing in the handheld surface cleaner 700, from any air flowing in the handheld surface cleaner 700, and from any debris collected in the DWT's debris collection and storage cavity 716. The electrical connection between the DWT 704 and the main body 708 is thus isolated from any debris flowing in the handheld surface cleaner 700, from any air flowing in the handheld surface cleaner 700, and from any debris collected in the DWT's debris collection and storage cavity 716.

In this illustrated implementation, the at least one electrical connection 712 of the DWT 704 includes a pair of conductive plates, and the at least one corresponding electrical connection 714 of the main body 708 includes a pair of pogo pins. The attachment of the DWT 704 and the main body 708 is configured to cause each of the pogo pins 714 to compress automatically in response to pressing against a respective one of the conductive plates 712. Detaching the DWT 704 and the main body 708 is configured to cause the pogo pins 714 to decompress automatically in response to no longer pressing against either of the conductive plates 712. In another implementation, the DWT 704 includes the one or more pogo pins, and the main body 708 includes the one or more conductive plates.

Figure 39:
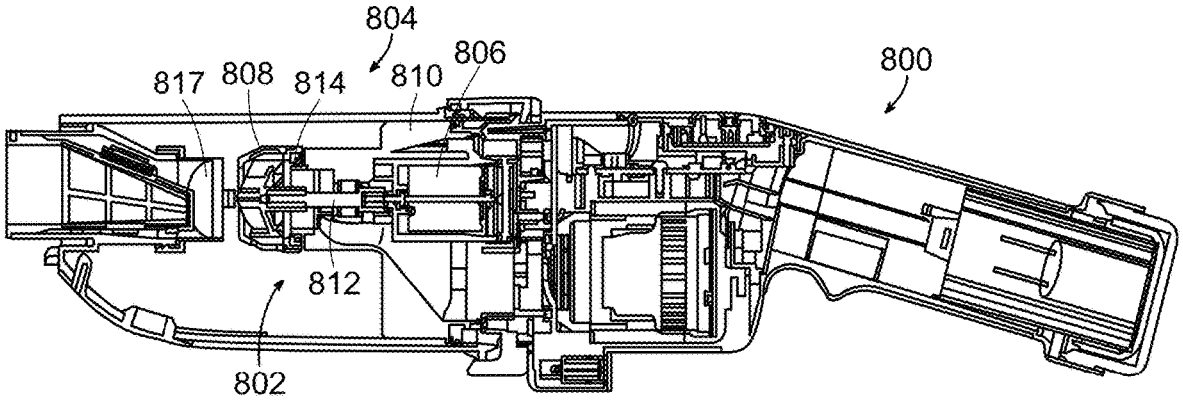
FIG. 39 is a side cross-sectional view of another implementation of a handheld surface cleaner.
Figure 40:
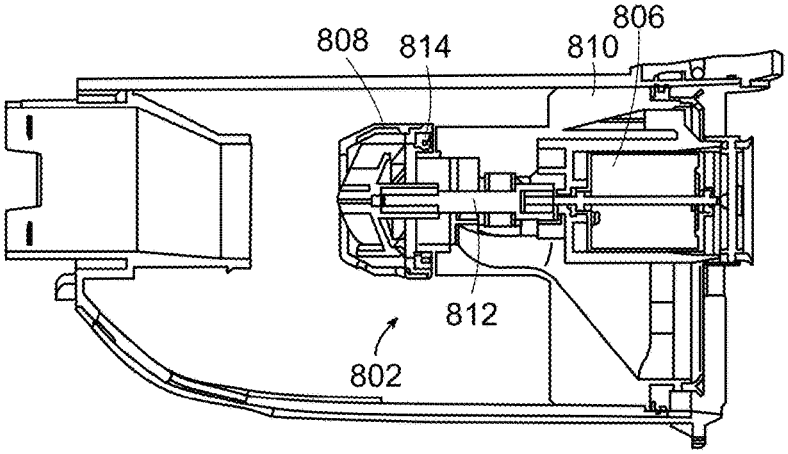
FIG. 40 is a side cross-sectional view of a portion of a dirty water tank of the handheld surface cleaner of FIG. 39.

FIG. 39 illustrates another implementation of a handheld surface cleaner 800 configured to use suction to draw debris into the handheld surface cleaner 800 and to separate the air and the debris on board the handheld surface cleaner 800. The handheld surface cleaner 800 of FIG. 39 is generally configured and used similar to the handheld surface cleaner 10 of FIG. 1 except that a separator assembly 802 of the handheld surface cleaner's DWT 804 includes a separator motor 806, in addition to a separator 808, a separator bracket 810, a shaft 812, and a seal 814 (an oil seal in this illustrated implementation), similar to the implementation shown in FIG. 35, and except that, as shown in FIGS. 39 and 40, no drive dog is used in driving rotation of the handheld surface cleaner's separator motor 806 (see FIG. 5 showing a drive dog 84 of the handheld surface cleaner 10).

Figure 41:
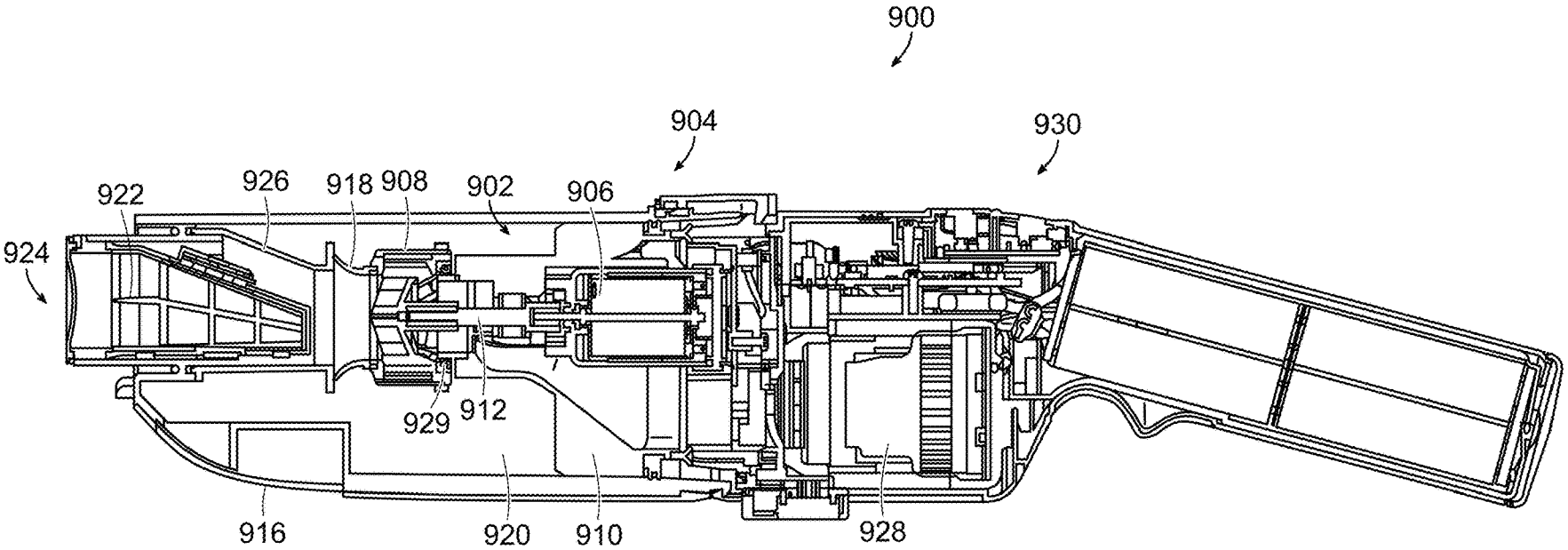
FIG. 41 is a side cross-sectional view of another implementation of a handheld surface cleaner.
Figure 42:
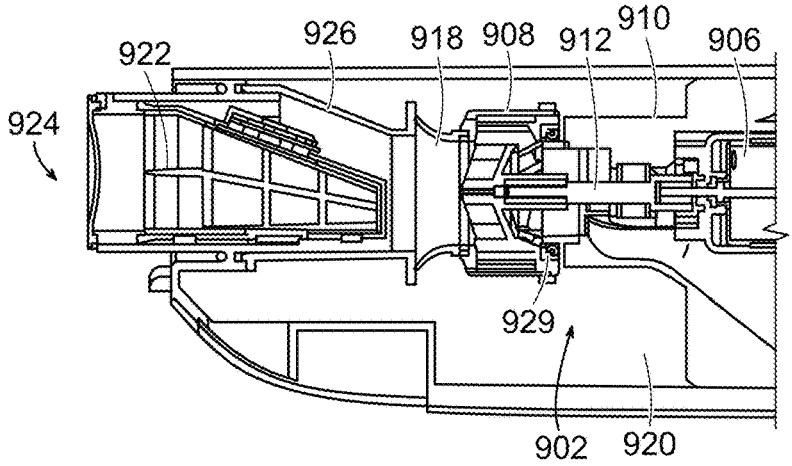
FIG. 42 is a side cross-sectional view of a distal portion of a dirty water tank of the handheld surface cleaner of FIG. 41.
Figure 43:
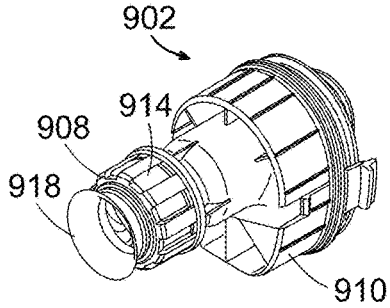
FIG. 43 is a perspective view of a separator assembly of the handheld surface cleaner of FIG. 41.

FIG. 41 illustrates another implementation of a handheld surface cleaner 900 configured to use suction to draw debris into the handheld surface cleaner 900 and to separate the air and the debris on board the handheld surface cleaner 900. The handheld surface cleaner 900 of FIG. 41 is generally configured and used similar to the handheld surface cleaner 10 of FIG. 1 except that, as shown in FIGS. 41 and 42, a separator assembly 902 of the handheld surface cleaner's DWT 904 includes a separator motor 906, in addition to a separator 908, a separator bracket 910, and a shaft 912 similar to the implementation shown in FIG. 35; except that, as shown in FIGS. 42 and 43, holes (obscured in FIG. 43 by movable covers 914) formed in the separator 908 of the separator assembly 902 of FIGS. 42 and 43 each have an associated movable cover 914 in the form of a flap similar to the implementation shown in FIG. 32; except that, as shown in FIG. 41, the DWT 904 includes a spring-loaded spout 916 instead of a cap; and except that, as shown in FIGS. 41-44, the handheld surface cleaner 900 includes a centrifugal seal 918 upstream of (distal to) the separator 908 and does not include a duckbill valve upstream of the separator 908. The centrifugal seal 918 is a seal configured to allow fluid flow toward the separator 908. The centrifugal seal 918 is also configured to prevent fluid from flowing out of a debris collection and storage cavity 920 of the DWT 904 and into a hair cage 922 or an inlet 924 of the handheld surface cleaner 900.

As in this illustrated implementation, each of the movable covers 914 can be configured to selectively cover one of the separator's holes. In another implementation, one or more of the movable covers 914 can be configured to selectively cover more than one of the separator's holes, e.g., cover two of the separator's holes, etc.

As shown in FIG. 43, the separator assembly 902 includes the centrifugal seal 918. The centrifugal seal 918 is thus removable from the DWT 904 with a remainder of the separator assembly 902.

The centrifugal seal 918 is configured to move between a first configuration and a second configuration. The centrifugal seal 918 is configured to be in the first configuration with the separator 908 being in a resting configuration in which the separator 908 is not rotating. In the first configuration, the centrifugal seal 918, e.g., a distal end of the centrifugal seal 918, abuts, as shown in FIGS. 41 and 42, an inlet hosing 926, e.g., a proximal end of the inlet hosing 926, in which the hair cage 922 is at least partially disposed. With the centrifugal seal 918 abutting the inlet hosing 926, fluid cannot flow out of the debris collection and storage cavity 920 of the DWT 904 and into the hair cage 922 or the inlet 924. The movable covers 914, e.g., flaps, covering the holes of the separator 908 with the separator 908 in the resting configuration are configured to prevent any debris in the handheld surface cleaner's debris collection and storage cavity 920 from passing into the separator 908 and from the separator 908 into the centrifugal seal 918 where debris may be free to exit through the handheld surface cleaner's inlet 924. The centrifugal seal 918 and the movable covers 914 are thus configured to cooperate to prevent debris in the debris collection and storage cavity 920 from inadvertently exiting the handheld surface cleaner 900 when suction is not being applied and the separator 908 is not rotating.

The centrifugal seal 918 is configured to be in the second configuration with the separator 908 being in a rotating configuration in which the separator 908 is rotating. In the second configuration, the centrifugal seal 918, e.g., the distal end of the centrifugal seal 918, does not abut the air inlet hosing 926, e.g., the proximal end of the air inlet hosing 926, and a gap of space exists between the centrifugal seal 918 and the air inlet hosing 926. The centrifugal seal 918 is hollow and has a passageway extending therethrough so that with the separator 908 and the centrifugal seal 918 rotating, debris and air can pass from the air inlet hosing 926 and through the centrifugal seal 918 to the separator 908 to allow the separator 908 to separate the debris and the air. Because of the suction force provided via the handheld surface cleaner's suction motor 928 (at the handheld surface cleaner's main body 930, as shown in FIG. 41), debris and air passing out of the air inlet hosing 926 will be urged into the centrifugal seal 918 and thus into the separator 908 instead of passing through the gap of space into the handheld surface cleaner's debris collection and storage cavity 920.

The centrifugal seal 918 is attached to the separator 908, as shown in FIGS. 41-44, e.g., by a proximal end of the centrifugal seal 918 being attached to a distal end of the separator 908. The centrifugal seal 918 is thus configured to rotate with the separator 908. The centrifugal seal 918 is configured to move automatically from the first configuration to the second configuration in response to the rotation of the centrifugal seal 918 and thus in response to the rotation of the separator 908. The centrifugal seal 918 is configured to move automatically from the second configuration to the first configuration in response to the rotation of the centrifugal seal 918 stopping and thus in response to the rotation of the separator 908 stopping. In an exemplary implementation, the centrifugal seal 918 is formed of rubber and/or other flexible material configured to help allow flexing of the centrifugal seal 918 as the centrifugal seal 918 moves dynamically between the first and second configurations.

Figure 44:
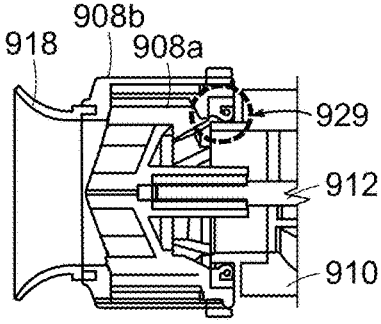
FIG. 44 is a side cross-sectional view of a distal portion of the separator assembly of FIG. 43.

As shown in FIGS. 41, 42, and 44, the separator assembly 902 also includes a seal 929 configured to help prevent debris from exiting out of the open proximal end of the separator 908, e.g., out of the open proximal ends of the separator's inner and outer separators 908*a*, 908*b*. The seal 928 at the separator 908 in this illustrated implementation is an oil seal but other types of seals may be used.

Figure 45:
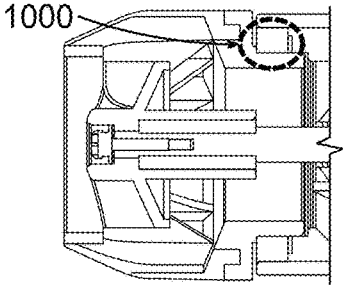
FIG. 45 is a side cross-sectional view of a distal portion of another implementation of a separator assembly of a handheld surface cleaner.

FIG. 45 illustrates another implementation of a handheld surface cleaner configured to use suction to draw debris into the handheld surface cleaner and to separate the air and the debris on board the handheld surface cleaner. The handheld surface cleaner of FIG. 45 is generally configured and used similar to the handheld surface cleaner of FIG. 41 except that a bearing 1000 is used instead of the oil seal 929.

Figure 46:
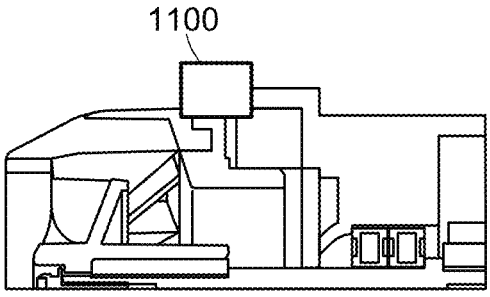
FIG. 46 is a side cross-sectional view of a portion of another implementation of a separator assembly of a handheld surface cleaner.

FIG. 46 illustrates another implementation of a handheld surface cleaner configured to use suction to draw debris into the handheld surface cleaner and to separate the air and the debris on board the handheld surface cleaner. The handheld surface cleaner of FIG. 46 is generally configured and used similar to the handheld surface cleaner of FIG. 41 except that the oil seal 929 is replaced with a rotatable V-ring face seal 1100.

Figure 47:
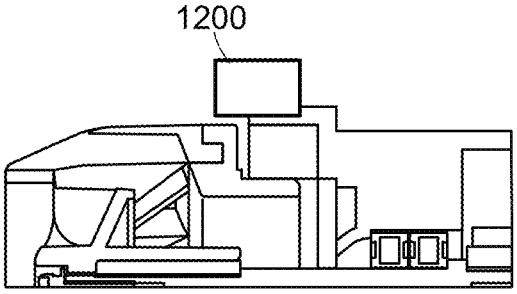
FIG. 47 is a side cross-sectional view of a portion of yet another implementation of a separator assembly of a handheld surface cleaner.

FIG. 47 illustrates another implementation of a handheld surface cleaner configured to use suction to draw debris into the handheld surface cleaner and to separate the air and the debris on board the handheld surface cleaner. The handheld surface cleaner of FIG. 47 is generally configured and used similar to the handheld surface cleaner of FIG. 41 except that a static (non-rotating) V-ring face seal 1200 is used instead of the oil seal 929.

Figure 48:
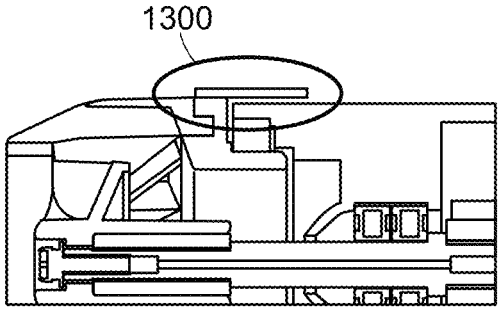
FIG. 48 is a side cross-sectional view of a portion of still another implementation of a separator assembly of a handheld surface cleaner.

FIG. 48 illustrates another implementation of a handheld surface cleaner configured to use suction to draw debris into the handheld surface cleaner and to separate the air and the debris on board the handheld surface cleaner. The handheld surface cleaner of FIG. 48 is generally configured and used similar to the handheld surface cleaner of FIG. 41 except that a convoluted path 1300 is used instead of the oil seal 929.

Figure 49:
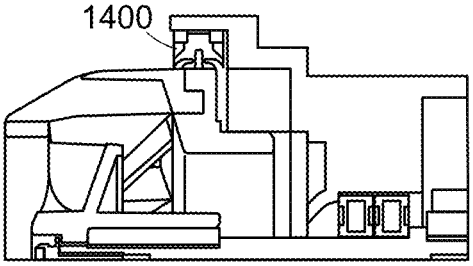
FIG. 49 is a side cross-sectional view of a portion of another implementation of a separator assembly of a handheld surface cleaner.

FIG. 49 illustrates another implementation of a handheld surface cleaner configured to use suction to draw debris into the handheld surface cleaner and to separate the air and the debris on board the handheld surface cleaner. The handheld surface cleaner of FIG. 19 is generally configured and used similar to the handheld surface cleaner of FIG. 41 except that a four lip seal 1400 is used instead of the oil seal 929.

FIGS. 50A-50D illustrate another implementation of a separator 1500 of a handheld surface cleaner configured to use suction to draw debris into the handheld surface cleaner and to separate the air and the debris on board the handheld surface cleaner. The separator 1500 of FIGS. 50A-50D is generally configured and used similar to the separator 908 of FIGS. 41-44 except that the separator 1500 of FIGS. 50A-50D is attached to a rim 1502 and the separator 1500 does not include inner and outer separators.

The separator 1500 in this illustrated implementation is a singular member. Movable covers 1504, which are configured and used similar to the movable covers 502, 914 discussed above, are attached to the separator 1500, such as being glued to the separator 1500, press fit with the separator 1500, overmolded with the separator 1500, or otherwise attached, and cover the separator's holes so that the holes are closed with the separator 1500 being static and non-rotating. FIG. 50C shows a connection area 1506 for the separator 1500 and one of the movable covers 1502 as representative of each of the movable covers 1502.

As in this illustrated implementation, each of the movable covers 1504 can be configured to selectively cover one of the separator's holes. In another implementation, one or more of the movable covers 1504 can be configured to selectively cover more than one of the separator's holes, e.g., cover two of the separator's holes, etc.

The rim 1502 is attached on a first side, e.g., proximal side, to a distal end of the separator 1500 and on a second, opposite side, e.g., distal side, to a centrifugal seal 1508. The separator 1500 is thus attached indirectly to the centrifugal seal 1504 via the rim 1502. The centrifugal seal 1504 is generally configured and used similar to the centrifugal seal 918 of FIGS. 41-44. The rim 1502 is configured to rotate as a unit with the separator 1500 and the centrifugal seal 1504.

The rim 1502 extends entirely around a perimeter of the separator's distal end and entirely around a perimeter of the centrifugal seal's proximal end. The rim 1502 is hollow and is configured to allow any debris flowing proximally through the centrifugal seal 1508 to pass through the rim 1502 to the separator 1508. The rim 1502 is configured to provide a barrier for backflow so any debris in a debris collection and storage cavity of the handheld surface cleaner's dirty water tank cannot enter one or both of the centrifugal seal 1508 and the separator 1500 through any space between the centrifugal seal 1508 and the separator 1500 since the rim 1502 is blocking any such space. The rim 1502 and the movable covers 1504 are thus configured to cooperate to prevent debris in the debris collection and storage cavity from inadvertently exiting the handheld surface cleaner when suction is not being applied and the separator 1500 is not rotating.

Figure 50A:
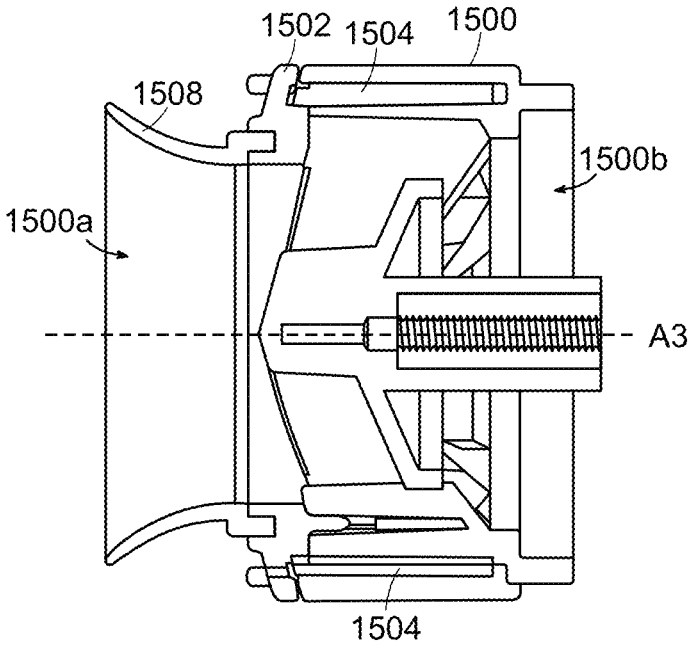
FIG. 50A is a side cross-sectional view of one implementation of a separator, rim, and seal.
Figure 50B:
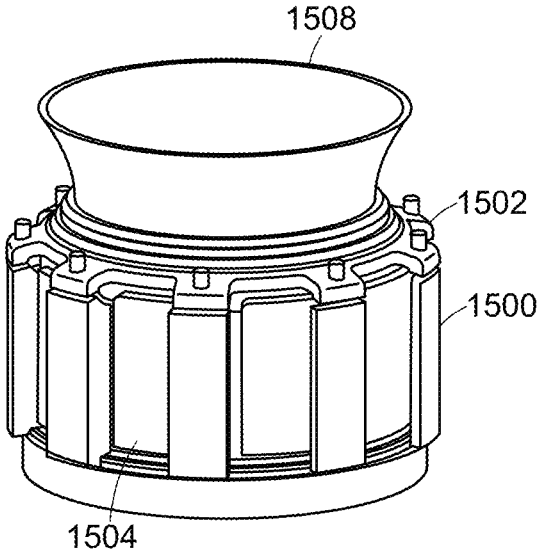
FIG. 50B is a perspective view of the separator, rim, and seal of FIG. 50A.
Figure 50C:
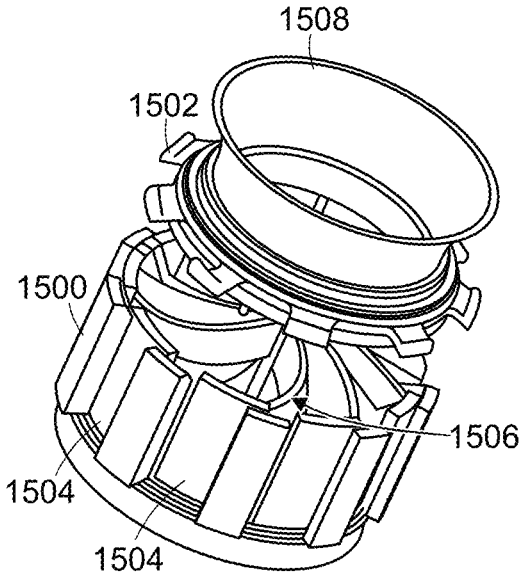
FIG. 50C is an exploded perspective view of the separator, rim, and seal of FIG. 50A.

As shown in FIG. 50A, the separator 1500 includes an inlet opening 1500*a* and an outlet opening 1500*b*. Debris and air is configured to enter the separator 1500 through the inlet opening 1500*a*. The debris is configured to exit the separator 1500 through the separator's plurality of holes. The air is configured to exit the separator 1500 through the outlet opening 1500*b*. The separator 1500 has a single inlet opening 1500*a* and a single outlet opening 1500*b* in this illustrated implementation but can include a plurality of inlet openings and/or a plurality of outlet openings. The inlet opening 1500*a* and the outlet opening 1500*b* in this illustrated implementation are each centered along a central rotational axis A3 of the separator 1500 but the inlet opening 1500*a* and/or the outlet opening 1500*b* can be offset from the central rotational axis A3.

Figure 50D:
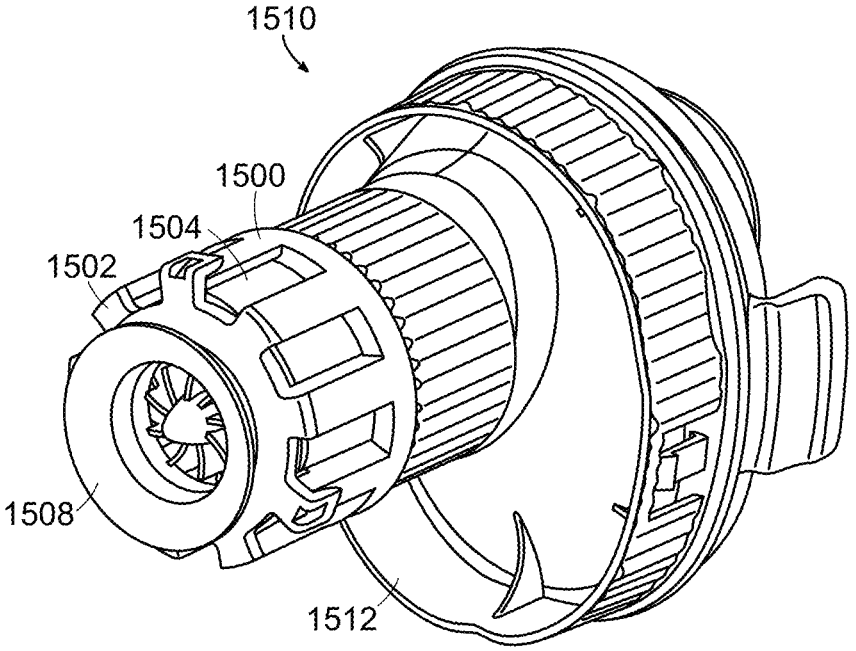
FIG. 50D is a perspective view of a separator assembly including the separator, rim, and seal of FIG. 50A.

FIG. 50D shows an implementation of a separator assembly 1510 including the separator 1500, the rim 1502, and the centrifugal seal 1508 and also including a separator bracket 1512, a motor (obscured in FIG. 50D), and a shaft (obscured in FIG. 50D). The separator assembly 1510 is generally configured and used similar to the separator assembly 902 of FIG. 43.

Figure 51:
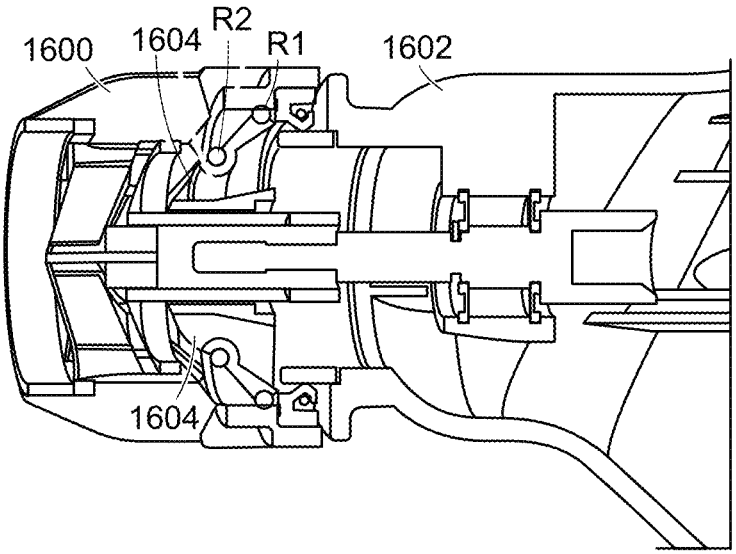
FIG. 51 is a side cross-sectional view of another implementation of a separator assembly.

FIG. 51 illustrates another implementation of a separator 1600 of a handheld surface cleaner configured to use suction to draw debris into the handheld surface cleaner and to separate the air and the debris on board the handheld surface cleaner. The separator 1600 of FIG. 51 is generally configured and used similar to the separator 908 of FIGS. 41-44 except that the separator 1600 of FIG. 51 is not attached to a centrifugal seal (directly or indirectly), does not include movable covers, and does not include inner and outer separators. The separator 1600 in this illustrated implementation is a singular member.

As shown in FIG. 51, a separator bracket 1602 is located downstream of the separator 1600. The separator bracket 1602 is generally configured and used similar to the separator bracket 48 of FIGS. 2 and 3 discussed above. In this illustrated implementation, a seal 1604 is positioned between the separator 1600 and the separator bracket 1602. The seal 1604 is attached to the separator bracket 1602 and thus does not rotate with the separator 1600.

The seal 1604 is hollow with a continuous sidewall. With the separator 1600 rotating, the seal 1604 is configured to allow any debris flowing through the separator 1600 that is not directed by the separator 1600 into a debris collection and storage cavity of the handheld surface cleaner's dirty water tank to pass through the seal 1604 to the separator bracket 1602.

The seal 1604 is configured to move between a first configuration and a second configuration. The movement of the seal 1604 is relative to the separator bracket 1602. The seal 1604 is thus non-removably but movably attached to the separator bracket 1602.

The seal 1604 is configured to be in the first configuration with the separator 1600 being in the resting configuration in which the separator 1600 is not rotating. In the first configuration, the seal 1604 is in a radially outward position, represented by reference R1 in FIG. 51. In the first configuration, the seal 1604 is configured to provide a barrier for backflow so any debris in the debris collection and storage cavity cannot enter one or both of the separator bracket 1602 and the separator 1600 through a space between the separator bracket 1602 and the separator 1600 since the seal 1604 is blocking the space. The seal 1604, the separator 1600, and the separator bracket 1602 are thus configured to cooperate to prevent debris in the debris collection and storage cavity from inadvertently exiting the handheld surface cleaner when suction is not being applied and the separator 1600 is not rotating.

The seal 1604 is configured to be in the second configuration with the separator 1600 being in a rotating configuration in which the separator 1600 is rotating. In the second configuration, the seal 1604 is in a radially inward position, represented by reference R2 in FIG. 51. The seal 1604 is configured to move automatically from the first configuration to the second configuration in response to the rotation of the separator 1600 and to move automatically from the second configuration to the first configuration in response to the separator 1600 stopping rotating. In the second configuration, the seal 1604 no longer blocks the space between the separator bracket 1602 and the separator 1600. Debris flowing in the separator 1600 and directed radially outward by the separator 1600 is configured to pass through the space into the debris collection and storage cavity. Because of the suction force provided via the handheld surface cleaner's suction motor (not shown in FIG. 51), air passing out of the separator 1600 will be urged into the separator bracket 1602 instead of passing through the space into the handheld surface cleaner's debris collection and storage cavity.

Figure 52:
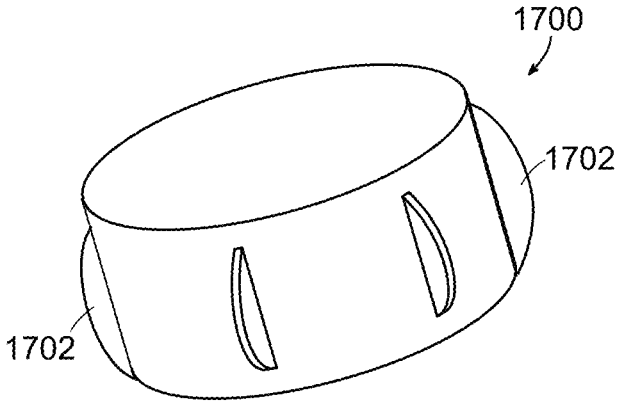
FIG. 52 is a perspective view of another implementation of a separator.

FIG. 52 illustrates another implementation of a separator 1700 of a handheld surface cleaner configured to use suction to draw debris into the handheld surface cleaner and to separate the air and the debris on board the handheld surface cleaner. The separator 1700 of FIG. 52 is simplified for purposes of illustration and is generally configured and used similar to other separators described herein except that the separator 1700 of FIG. 52 includes a plurality of external fins 1702. The fins 1702 are located equidistantly around a perimeter of the separator 1700 in this illustrated implementation, although other spacing of the fins 1702 is possible. The fins 1702 each have a partial elliptical shape in this illustrated implementation, but other shapes are possible.

The fins 1702 extend radially outward and are thus configured to contact debris collected in a debris collection and storage cavity of the handheld surface cleaner's DWT before any other portion of the separator 1700. One or more of fins' contact with the debris in the debris collection and storage cavity is configured to add resistance to the separator's rotation. Thus, in implementations in which the handheld surface cleaner, e.g., the handheld surface cleaner's controller, is configured to determine whether the DWT is full based on a current of the handheld surface cleaner's separator motor, the current will rise above the predetermined threshold value sooner than in implementations in which the fins 1702 are not present. The DWT will thus be considered to be full sooner, which may help prevent DWT overflow and/or facilitate user emptying of the DWT since the DWT will be less likely to be completely full when emptied.

In addition to or instead of a plurality of fins extending radially outward from the separator, a plurality of fins can extend radially outward from another element that rotates with the separator. For example, in implementations including a rim attached to a separator, a plurality of fins can extend radially outward from the rim in addition to or instead of a plurality of fins extending radially outward from the separator.

Figure 53:
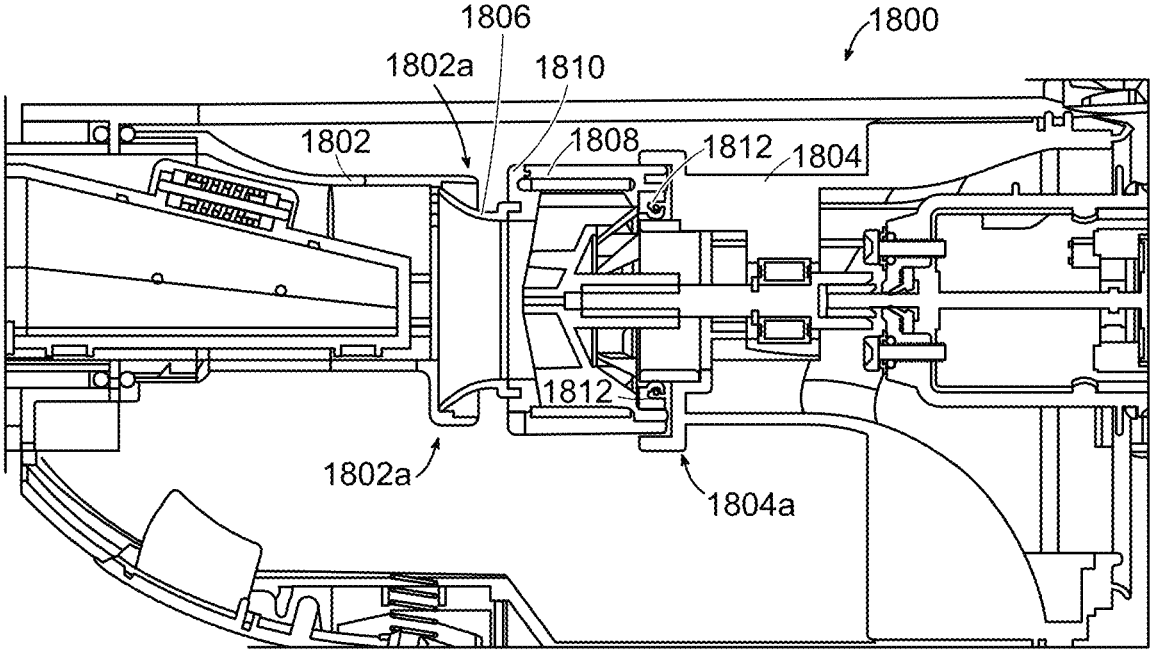
FIG. 53 is a side cross-sectional view of a portion of another implementation of a dirty water tank of a handheld surface cleaner.

FIG. 53 illustrates another implementation of a handheld surface cleaner 1800 configured to use suction to draw debris into the handheld surface cleaner 1800 and to separate the air and the debris on board the handheld surface cleaner 1800. The handheld surface cleaner 1800 of FIG. 53 is generally configured and used similar to the handheld surface cleaner 900 of FIG. 41 except that the handheld surface cleaner's air inlet hosing 1802 includes a proximal overhang 1802*a* and the handheld surface cleaner's separator bracket 1804 includes a distal lip 1804*a*.

The proximal overhang 1802*a* of the air inlet hosing 1802 extends proximally along a length of the handheld surface cleaner's centrifugal seal 1806, at least when the centrifugal seal 1806 is not rotating, to cover and extend radially around that length of the centrifugal seal 1806. For example, the proximal overhang 1802*a* can extend along about 30% to about 60% of the length of the centrifugal seal 1806, e.g., about 30%, about 35%, about 40%, about 45%, about 50%, about 55%, or about 60%. The proximal overhang 1802*a* terminates distal to the handheld surface cleaner's separator 1808 and is spaced a distance away from the separator 1808 to help prevent wear on the separator 1808 and/or the air inlet hosing 1802 caused by the separator's rotation relative to the air inlet hosing 1802. In implementations in which a proximal rim 1810 is attached to the separator 1808, as in this illustrated implementation, the proximal overhang 1802*a* terminates distal to the rim 1810 with a gap of space between the proximal overhang 1802*a* and the rim 1810 to help prevent wear on the rim 1810 and/or the air inlet hosing 1802 caused by the separator's and rim's rotation relative to the air inlet hosing 1802.

As discussed above, the centrifugal seal 1806 is configured to move between first and second configurations where, in the second configuration, the centrifugal seal 1808, e.g., a distal end of the centrifugal seal 1808, does not abut the air inlet hosing 1802 and a gap of space exists between the centrifugal seal 1808 and the air inlet hosing 1802. The proximal overhang 1802*a* is configured to fully cover the gap of space to help prevent any debris flowing distally through the air inlet hosing 1802 from passing into the handheld surface cleaner's debris collection and storage cavity before reaching the separator 1808 and to help prevent backflow by helping to prevent any debris in the debris collection and storage cavity from entering the air inlet hosing 1802.

The distal lip 1804*a* of the separator bracket 1804 extends distally along a length of the separator 1808 at least enough to cover and extend radially around the handheld surface cleaner's oil seal 1812. Over time, the oil seal 1812 may experience wear. The distal lip 1804*a* of the separator bracket 1804 is configured to reduce wear on the handheld surface cleaner's oil seal 1812 by providing a tortuous air path.

Figure 54A:
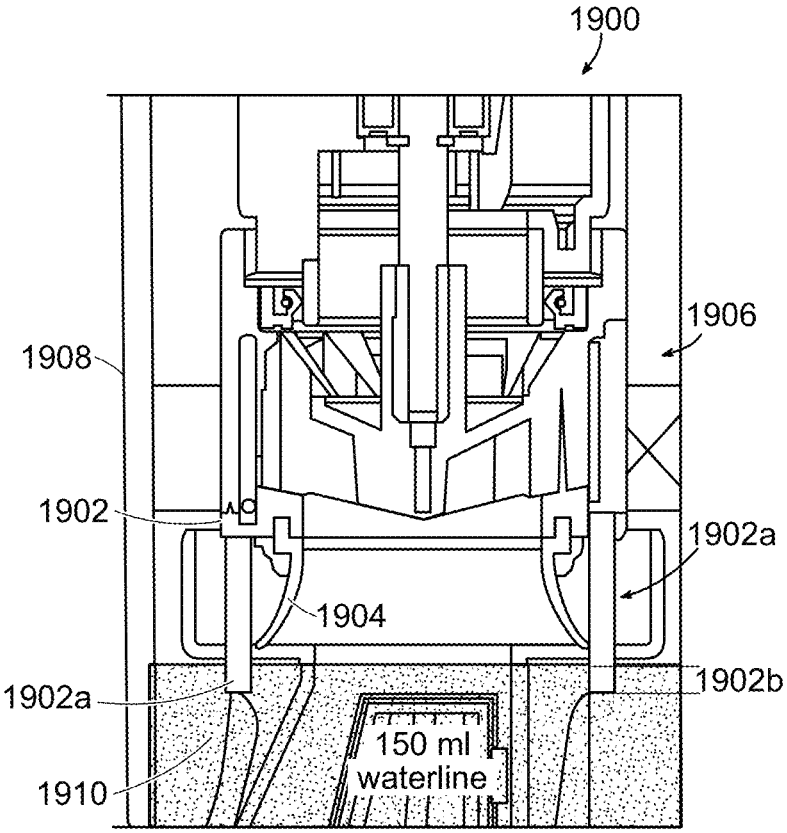
FIG. 54A is a side cross-sectional view of a portion of yet another implementation of a dirty water tank of a handheld surface cleaner.

FIG. 54A illustrates another implementation of a handheld surface cleaner configured to use suction to draw debris into the handheld surface cleaner 1900 and to separate the air and the debris on board the handheld surface cleaner 1900. The handheld surface cleaner 1900 of FIG. 54A is generally configured and used similar to the handheld surface cleaner 900 of FIG. 41 except that the handheld surface cleaner includes a rim 1902 that is generally configured and used similar to the rim 1502 of FIGS. 50A-50B. In this illustrated implementation, the rim 1902 includes a distal overhang 1902*a*. The distal overhang 1902*a* can be a single circumferential overhang or can include a plurality of fins similar to the fins 1702 of FIG. 52 discussed above.

The distal overhang 1902*a* extends distally past a centrifugal seal 1904 attached to the rim 1902. The distal overhang 1902*a* is thus configured to contact debris collected in a debris collection and storage cavity 1906 of the handheld surface cleaner's DWT 1908 before any the centrifugal seal 1904 with the handheld surface cleaner in at least some orientations relative to ground. Debris in the debris collection and storage cavity 1906 will tend to settle toward ground due to gravity. Thus, in implementations in which the handheld surface cleaner, e.g., the handheld surface cleaner's controller, is configured to determine whether the DWT 1908 is full based on a current of the handheld surface cleaner's separator motor, the current will rise above the predetermined threshold value sooner than in implementations in which the distal overhang 1902*a* is not present because the distal overhang 1902*a* will contact the debris. The DWT 1908 will thus be considered to be full sooner, which may help prevent DWT 1908 overflow and/or facilitate user emptying of the DWT 1908 since the DWT 1908 will be less likely to be completely full when emptied.

FIG. 54A shows an amount of debris 1910 in the debris collection and storage cavity 1906. The debris is water in this illustrated implementation but can include solid(s) and/or other types of liquid. The amount of debris 1910 is 150 ml in FIG. 54A, which in this illustrated implementation corresponds to the DWT 1908 being considered full. As shown in FIG. 54A, with the handheld surface cleaner 1900 in a substantially vertical orientation with the handheld surface cleaner's handle being located upwardly (to the top in the view of FIG. 54A), the debris 1910 settles downward due to gravity with a length 1902*b* of the distal overhang 1902*a* being located in the debris 1910. The debris 1910 will thus provide resistance to the rotating rim 902.

Figure 54B:
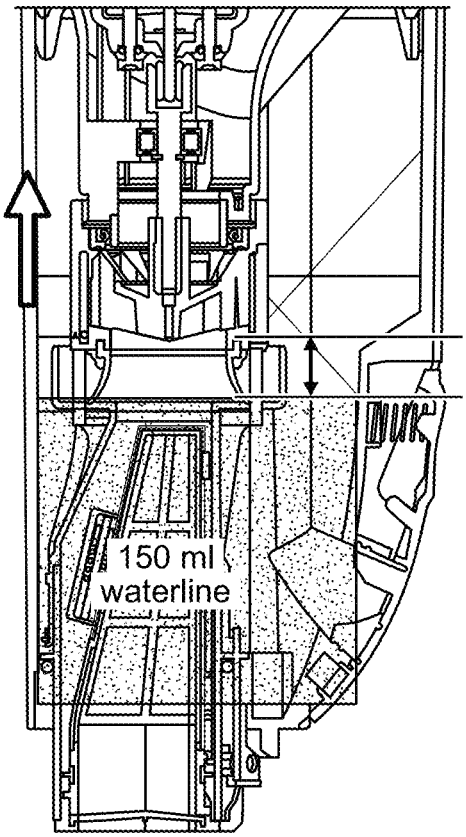
FIG. 54B is a side cross-sectional view of a portion of still another implementation of a dirty water tank of a handheld surface cleaner.

By way of comparison, FIG. 54B shows the handheld surface cleaner 1900 of FIG. 54A without the rim 1902 including the distal overhang 1902*a*. As shown in FIG. 54B, with the same amount of debris 1910 (150 ml) in the debris collection and storage cavity 1906, none of the rotating rim 1902, centrifugal seal 1904, and separator 1912 contact the debris 1910. The DWT 1908 is thus full, but the handheld surface cleaner, e.g., the handheld surface cleaner's controller, will not determine the DWT 1908 to be full, e.g., using a pair of probes, based on a current of the handheld surface cleaner's separator motor, or detecting fullness in another way, at least not until more debris 1910 collects in the debris collection and storage cavity 1906.

In implementations that do not include a rim, the separator can include a distal overhang that is generally configured and used similar to the distal overhang 1902*a* of FIG. 54A.

Figure 55:
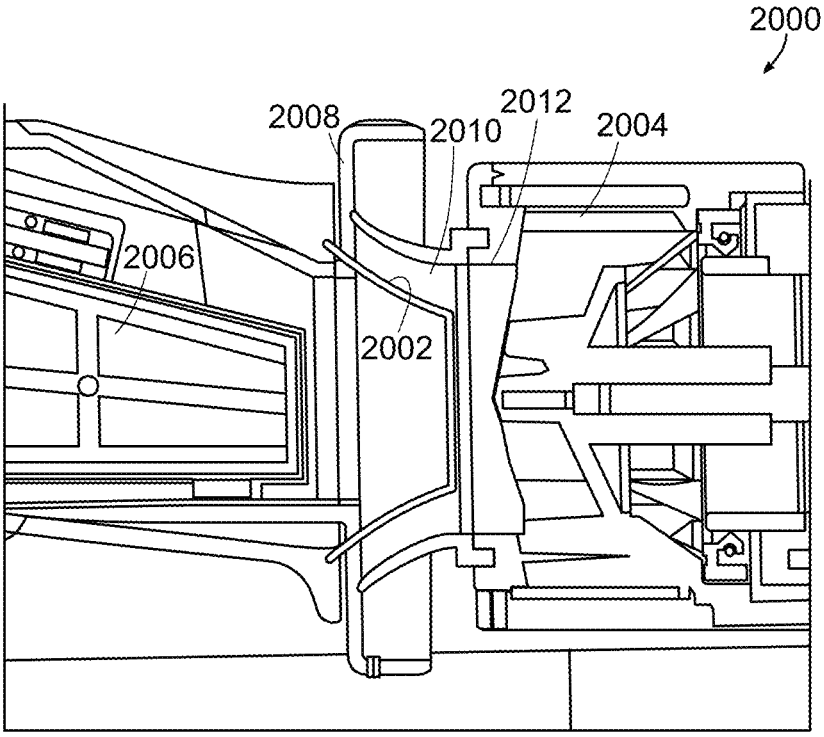
FIG. 55 is a side cross-sectional view of a portion of another implementation of a dirty water tank of a handheld surface cleaner.

FIG. 55 illustrates another implementation of a handheld surface cleaner 2000 configured to use suction to draw debris into the handheld surface cleaner 2000 and to separate the air and the debris on board the handheld surface cleaner 2000. The handheld surface cleaner 2000 of FIG. 55 is generally configured and used similar to the handheld surface cleaner 1800 of FIG. 53 except that the handheld surface cleaner 2000 includes a duckbill valve 2002. The duckbill valve 2002 is generally configured and used similar to the duckbill valve 76 of FIGS. 2, 3, and 6 and is located upstream of (distal to) the handheld surface cleaner's separator 2004, downstream of (proximal to) the handheld surface cleaner's hair cage 2006, and is a seal configured to allow fluid flow in only one direction toward the separator 2004. The duckbill valve 2002 is this illustrated implementation is attached to the handheld surface cleaner's inlet hosing 2008 and extends proximally into the handheld surface cleaner's centrifugal seal 2010, terminating upstream of the handheld surface cleaner's rim 2012.

Figure 56A:
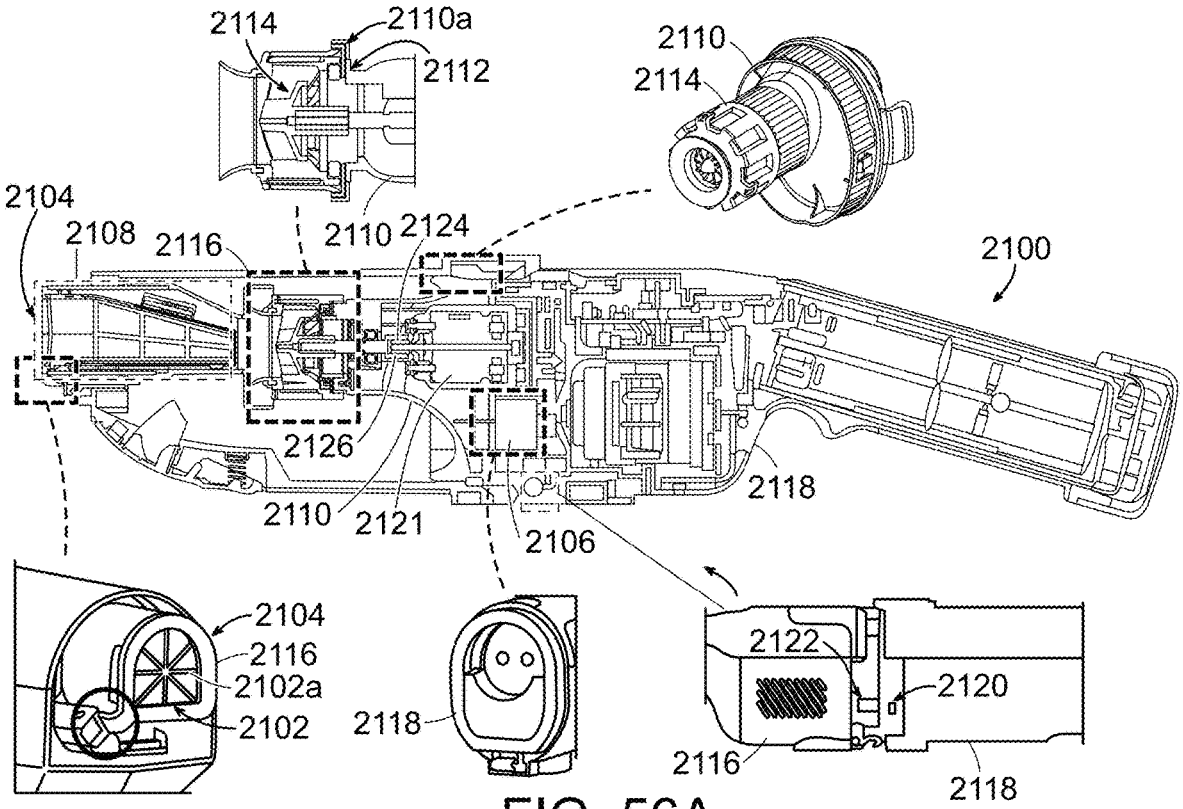
FIG. 56A is a side cross-sectional view of another implementation of a handheld surface cleaner.

FIG. 56A illustrates another implementation of a handheld surface cleaner 2100 configured to use suction to draw debris into the handheld surface cleaner 2100 and to separate the air and the debris on board the handheld surface cleaner 2100. The handheld surface cleaner 2100 of FIG. 56A is generally configured and used similar to the handheld surface cleaner 1800 of FIG. 53 except for some differences discussed below.

The handheld surface cleaner 2100 of FIG. 56A includes a seal 2102 at an inlet 2104 at a distal end of the handheld surface cleaner 2100. For comparison, for example, see the inlet 64 shown in FIG. 1 that does not include a seal. The seal 2102 in this illustrated implementation is a dynamic seal considered and used similar to the seal 106 of FIG. 21 discussed above, e.g., configured to move automatically between open and closed positions in response to application and removal of a suction force provided using a suction motor 2106 of the handheld surface cleaner 2100. The seal 2102 is located upstream (distal to) a hair cage 2108 of the handheld surface cleaner 2100. In the open position the seal 2102 is configured to allow flow from the inlet 2104 to the hair cage 2108. The removal of the suction force is configured to cause the seal 2102 to move from the open position to the closed position, e.g., by allowing the seal's plurality of flexible flaps 2102*a* of the seal 2102 to dynamically flex to their default positions (shown in FIG. 56A). In the closed position, the seal 2102 is configured to prevent flow from the inlet 2104 to the hair cage 2108.

The handheld surface cleaner 2100 of FIG. 56A includes a separator bracket 2110 that includes a distal lip 2110*a* similar to the distal lip 1804*a* of FIG. 53 discussed above. However, in this illustrated implementation, the handheld surface cleaner 2100 includes a bearing 2112 instead of an oil seal. The distal lip 2110*a* extends distally along a length of the handheld surface cleaner's separator 2114 at least enough to cover and extend radially around the bearing 2112. The bearing 2112 is configured and used similar to the bearing 1000 of FIG. 45.

The handheld surface cleaner 2100 of FIG. 56A is configured to automatically detect whether the handheld surface cleaner's DWT 2116 is releasably coupled to the handheld surface cleaner's main body 2118. However, unlike the main body 14 and DWT 12 of FIGS. 8 and 9 that include a cooperating microswitch 40 and protrusion 42, respectively, for detecting DWT coupling, the main body 2118 and DWT 2116 of FIG. 56A include a cooperating magnet 2120 and hall effect sensor 2122, respectively. The hall effect sensor 2122 interacting with the magnetic field of the magnet 2120 indicates, e.g., to the handheld surface cleaner's controller configured to be operatively coupled with the hall effect sensor 2122, that the DWT 2116 is releasably coupled to the main body 2118. Correspondingly, the hall effect Hall Effect sensor 2122 not interacting with the magnetic field of the magnet 2120 indicates that the DWT 2116 is not releasably coupled to the main body 2118.

The shaft of a handheld surface cleaner can be a single shaft or a plurality of shafts. In this illustrated implementation, the shaft includes a first shaft associated with the handheld surface cleaner's separator motor 2121 and a second shaft associated with the separator 2114.

Figure 56B:
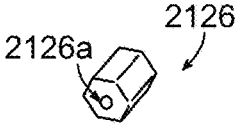
FIG. 56B is a perspective view of one implementation of an inner plug.
Figure 56C:
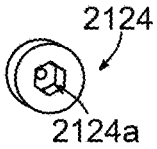
FIG. 56C is a perspective view of one implementation of an outer bearing.

As in this illustrated implementation, a drive dog can be used in driving rotation of the separator 2114. As shown in FIGS. 56A, 56B, and 56C, the drive dog includes an outer bearing 2124 and an inner plug 2126 secured to the outer bearing 2124. The outer bearing 2124 includes an inner passageway 2124*a* configured to seat the inner plug 2126 therein in a fixed rotational relationship. For example, as in this illustrated implementation, the inner plug 2126 and the outer bearing 2124 can be attached together in a friction fit with the inner plug 2126 being plastic and the outer bearing 2124 being rubber. The outer bearing 2124 being rubber may help reduce vibration caused by running of the separator motor 2121 as compared to the outer bearing 2124 being plastic or metal.

As in this illustrated implementation, the inner plug 2126 and the outer bearing 2124 can be keyed to help prevent relative rotation between the inner plug 2126 and outer bearing 2124. The inner plug 2126 has a hexagonal cross-sectional shape and the outer bearing's inner passageway 2124*a* has a corresponding hexagonal cross-sectional shape in this illustrated implementation.

The handheld surface cleaner's second shaft is configured to extend into the outer bearing's inner passageway 2124*a* and be secured to the outer bearing 2124 in a fixed rotational relationship. The handheld surface cleaner's first shaft is configured to extend into an inner passageway 2126*a* of the inner plug 2126 and be secured to the inner plug 2126 in a fixed rotational relationship. As discussed herein, the separator motor 2121 is configured to drive rotation of the first shaft. The rotation of the first shaft is configured to cause the inner plug 2126 to rotate and thus cause the outer bearing 2124 and the second shaft to rotate, thereby causing the separator 2114 to rotate.

Figure 57A:
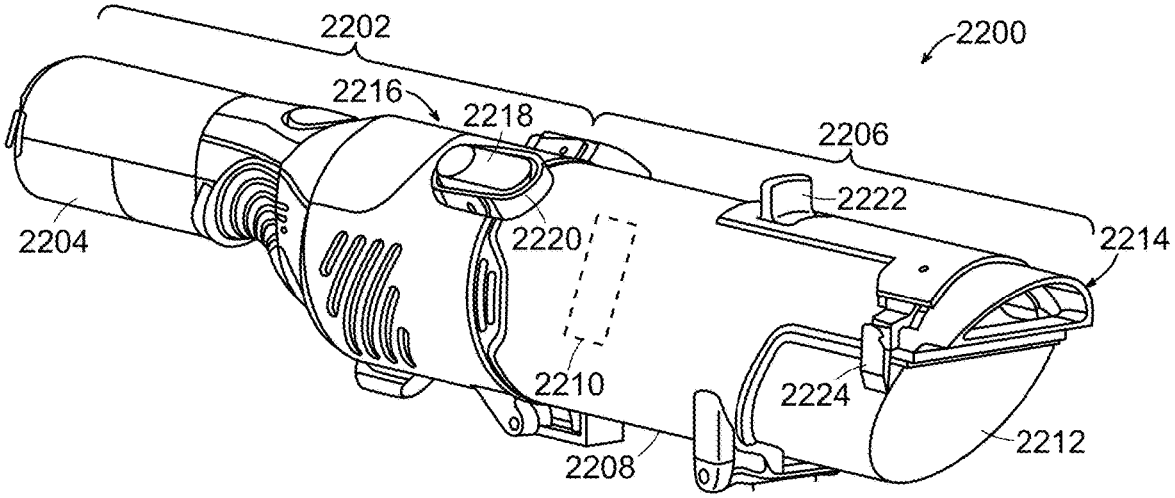
FIG. 57A is a perspective view of another implementation of a handheld surface cleaner.

FIG. 57A illustrates another implementation of a handheld surface cleaner (also referred to herein as a "handheld vacuum cleaner") 2200 configured to use suction to draw debris into the handheld surface cleaner 2200 and to separate the air and the debris on board the handheld surface cleaner 2200. The handheld surface cleaner 2200 of FIG. 57A is generally configured and used similar to the handheld surface cleaner 10 of FIG. 1 except for some differences discussed below.

As shown, the handheld vacuum cleaner 2200 includes a main body 2202 having a handle 2204 and a separation assembly 2206 removably coupled to the main body 2202. The separation assembly 2206 includes a separation body 2208 configured to removably couple to the main body 2202, a separator assembly 2210 (shown schematically for illustration purposes in hidden lines) disposed within the separation body 2208, a dust cup 2212 pivotally coupled to the separation body 2208, and an inlet 2214 defined in the separation body 2208. The separation body 2208 defines a DWT. The separation body 2208 defines a DWT of the handheld vacuum cleaner 2200. The separation body 2208 and the main body 2202 are configured to be removably coupled together using one or more latches 2216. For example, as in this illustrated implementation, a latch body 2218 is pivotally coupled to the main body 2202 and the separation body 2208 includes a latch receptacle 2220 for selectively receiving at least a portion of the latch body 2218.

In some implementations, and as shown in this illustrated implementation, the separation assembly 2206 further includes a dust cup release 2222. The dust cup release 2222 is configured to selectively retain the dust cup 2212 in a closed (or use) position. Actuation of the dust cup release 2222 is configured to allow the dust cup 2212 to transition to (e.g., pivot to) an open (or emptying) position.

Figure 57B:
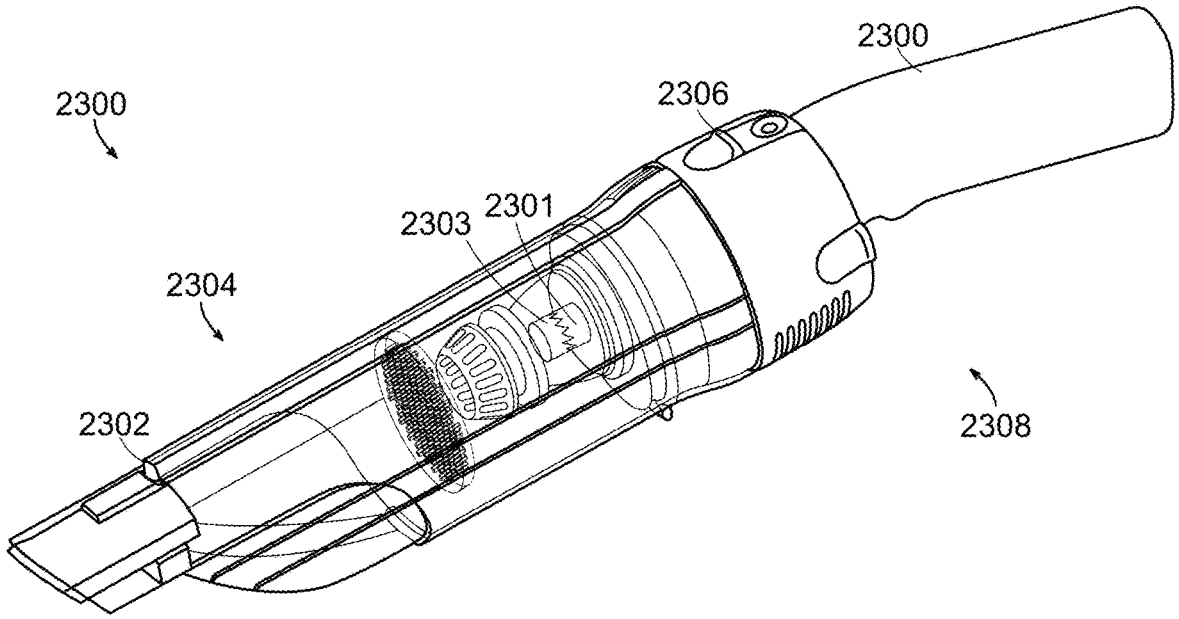
FIG. 57B is a perspective view of yet another implementation of a handheld surface cleaner.

In some implementations, and as shown in this illustrated implementation, the dust cup release 2222 is slidably coupled to the separation body 2208 and is configured to selectively engage a catch 2224 on the dust cup 2212. Such a configuration may allow debris to be emptied from the dust cup 2212 without removal of the separation assembly 2206 from the main body 2202 and/or may allow debris to be emptied from the dust cup 2212 after removal of the separation assembly 2206 from the main body 2202. Additionally, or alternatively, in some instances, the main body 2202 includes a dust cup release configured to selectively retain the dust cup 2212 in the closed position. Positioning a dust cup release on the main body 2202 may allow a user to empty the dust cup 2212 with the same hand that is grasping the handle 2204. For example, and with reference to FIG. 57B, a handheld vacuum cleaner 2300, which is an example of the handheld vacuum cleaner 2200, is shown which includes a forward dust cup release 2302 disposed on a separation assembly 2304 and a rearward dust cup release 2306 disposed on a main body 2308 proximate a handle 2300 of the main body 2308.

Referring again to FIG. 57A, in some implementations, and as shown in this illustrated implementation, the dust cup 2212 includes a debris quantity sensor to detect a quantity of debris within the dust cup 2212. For example, the debris quantity sensor can include a float configured to indicate a liquid level within the dust cup 2212 (e.g., to alert a user when to empty the dust cup 2212 and/or to disable cleaning functions of the handheld vacuum cleaner 2200 in response to the liquid level reaching a predetermined threshold). For another example, the debris quantity sensor can include a pair of probes configured to extend into the dust cup 2212 to indicate a liquid level within the dust cup 2212. No current will be conducted between the probes until each of the probes is in contact with liquid, e.g., an electrode of each probe is in contact with liquid. The current will thus indicate that a certain fill level has been reached.

Figure 58:
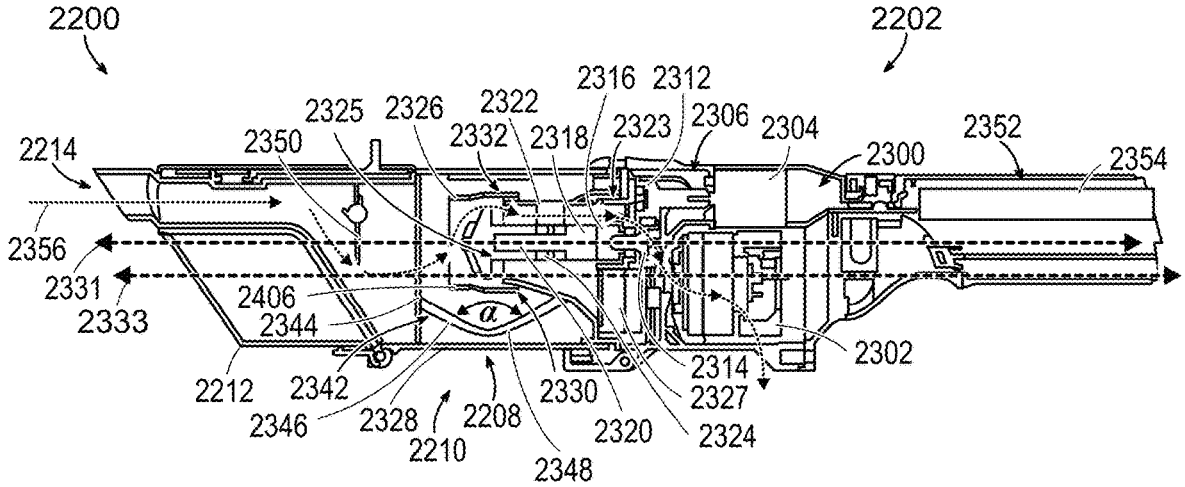
FIG. 58 is a side cross-sectional view of the handheld surface cleaner of FIG. 57A.

FIG. 58 shows a cross-sectional view of the handheld vacuum cleaner 2200. As shown, the main body 2202 defines a cavity 2300 for receiving a suction motor 2302 and a separator motor 2304. The suction motor 2302 and the separator motor 2304 are arranged in a stacked configuration such that output drive shafts of each of the suction motor 2302 and the separator motor 2304 are substantially parallel to each other and spaced apart from each other. The suction motor 2302 and/or the separator motor 2304 can be, for example, a permanent magnet direct current (PMDC) motor.

The separator motor 2304 is configured to cooperate with a drivetrain 2306. The drivetrain 2306 is configured transfer rotational motion from the separator motor 2304 to a separator 2326 of the separator assembly 2210. The drivetrain 2306 includes a drive pulley 2312 connected to a driven pulley 2314. The drive pulley 2312 and the driven pulley 2314 are connected via a belt. The drivetrain 2306 further includes a drive-side drive coupling 2316 connected to the driven pulley 2314 and a driven-side drive coupling 2318 connected to the separator assembly 2210. The drive-side drive coupling 2316 is configured to be selectively coupled to the driven-side drive coupling 2318. For example, when the separation body 2308 is decoupled from the main body 2202 (e.g., for emptying or cleaning), the driven-side drive coupling 2318 is decoupled from the drive-side drive coupling 2316. In this example, the driven-side drive coupling 2318 is coupled to the separation body 2208 (e.g., coupled to a portion of the separator assembly 2210). The drive-side and driven-side couplings 2316 and 2318 include mating gears (e.g., mating gears 2301 and 2303 of FIG. 57B), clutch plates (e.g., high friction pads, such as rubber or foam pads, configured to cooperate to transfer rotational motion as shown in FIG. 58), and/or the like. Use of the drivetrain 2306 to transfer rotational motion from the separator motor 2304 to the separator 2326 may allow one or more electronic components (e.g., the separator motor 2304) to be separate from those components exposed to debris (e.g., the separation assembly 2206) which may encourage easier cleaning of the components exposed to debris (e.g., by allowing a user to submerse the components exposed to debris within water).

The driven side coupling 2318 includes a drive shaft 2320 extending within an air channel 2322 of the separator 2326. The air channel 2322 includes opposing open ends 2323 and 2325 such that air can pass through the air channel 2322. The first open end 2323 is fluidly coupled to the suction motor 2302 downstream of the second open end 2325. A pre-motor filter 2327 (e.g., a foam filter, a pleated filter, a cyclone filter, and/or any other type of filter) is disposed such that air that exits through the first open end 2323 passes through the pre-motor filter 2327 before entering the suction motor 2302. Such a configuration may mitigate a risk of detrimental quantities of residual liquid (e.g., liquid not separated out of the air flow by the separator 2326) and/or solid debris from reaching the suction motor 2302.

The drive shaft 2320 is rotationally supported within the air channel 2322 by one or more bearings 2324. The drive shaft 2320 is coupled to the separator 2326 such that the separator 2326 rotates with the drive shaft 2320 about a rotation axis 2331. The rotation axis 2331 can be aligned with a longitudinal axis of the handle 2204, as in this illustrated implementation. The rotation axis 2331 is offset from a separation assembly central axis 2333 of the separation assembly 2206, and the rotation axis 2331 and the separation assembly central axis 2333 are substantially parallel. The longitudinal axis of the handle 2204 is thus also offset from and parallel to the separation assembly central axis 2333. The separation assembly central axis 2333 can intersect one or more of the handle 2204 and/or the dust cup 2212, with the separation assembly central axis 2333 intersecting both in this illustrated implementation.

The separator 2326 is configured such that liquid entrained within an airflow that is incident on the separator 2326 is urged outwardly from the separator 2326 and into one or more internal sidewalls 2328 of the separation body 2208. The liquid may in some instances not be urged into contact with any of the internal sidewalls 2328, e.g., depending on an orientation in which the cleaner 2200 is being held during and/or after the liquid is urged outwardly. As shown, the separator 2326 partially obstructs the second open end 2325 and extends at least partially around the second open end 2325. In some instances, a portion of the separator 2326 overlaps with and extends around a portion of the air channel 2322 at the second open end 2325.

Figure 59B:
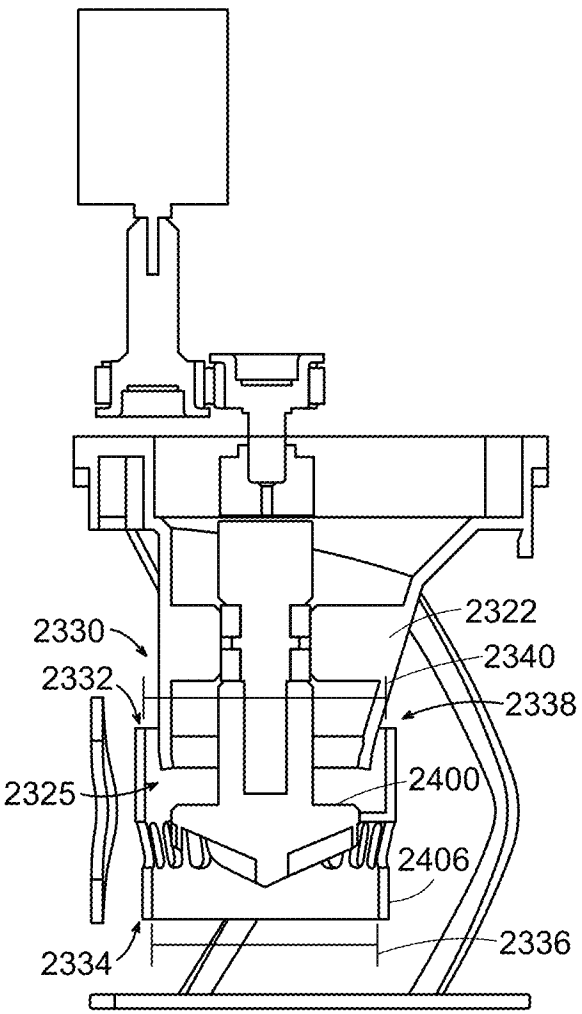
FIG. 59B is a cross-sectional view of a separator of the handheld surface cleaner of FIG. 57A coupled to a separator motor.
Figure 59A:
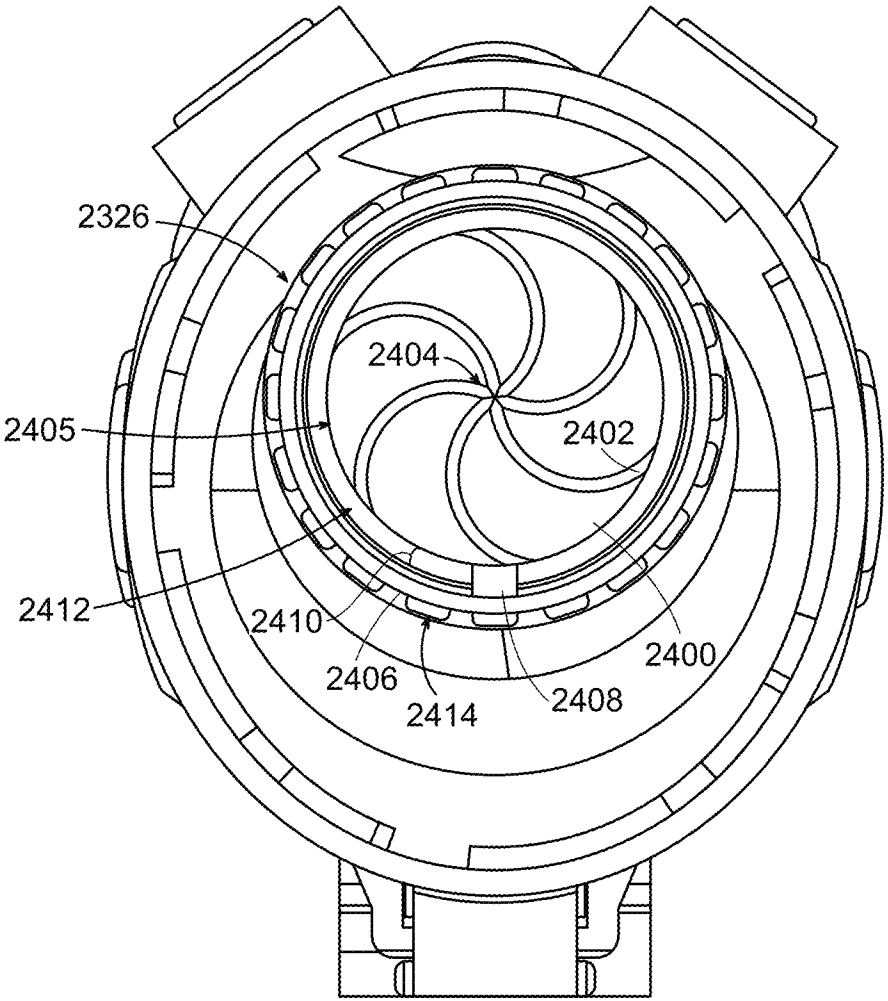
FIG. 59A is a cross-sectional end view of the handheld surface cleaner of FIG. 57A.

With additional reference to FIG. 59A, the separator 2326 includes a separator body 2400 and a plurality of vanes 2402 extending from the separator body 2400. The plurality of vanes 2402 in this illustrated implementation extend from a center 2404 of the separator body 2400. For example, as shown in this illustrated implementation, the plurality of vanes 2402 extend radially outwardly from the center 2404 to a peripheral edge 2405 of the separator body 2400. In some instances, and as shown in FIG. 58, the separator body 2400 may also include an at least partially conical shape (e.g., a frustoconical shape). The plurality of vanes 2402 and/or the separator body 2400 may generally be described as being configured to encourage liquid incident thereon to move radially outwardly. As in this illustrated implementation, at least one of the plurality of vanes 2402 may include an arcuate shape.

As also shown in this illustrated implementation, the separator 2326 includes a shroud 2406 that extends around (e.g., entirely around a perimeter of) the separator body 2400. The shroud 2406 is coupled to the separator body 2400 using one or more supports 2408 such that the shroud 2406 is spaced apart from the separator body 2400 by a shroud separation distance 2410 to form at least one air passthrough 2412. The shroud 2406 further includes a plurality of liquid passthroughs 2414 through which liquid urged radially outward may pass. In some instances, and as shown in this illustrated implementation, the at least one air pass through 2402 and the plurality of liquid passthroughs 2414 may extend within different (e.g., perpendicular) planes.

With additional reference to FIG. 59B, the shroud 2406 further extends around (e.g., entirely around a perimeter of) and along a portion of an outer surface 2330 of the air channel 2322 at the second open end 2325. The shroud 2406 is spaced apart from the outer surface 2330 to form a seal gap 2332. The seal gap 2332 is configured to receive a seal configured to at least partially restrict air flow through the seal gap 2332. The seal may be, for example, an oil seal, a bushing, a bearing, a bristle strip, a felt strip, and/or any other type of seal capable of being disposed within the seal gap 2332 while permitting rotational movement between the shroud 2406 and the air channel 2322.

The shroud 2406 includes an upstream end 2334 having an upstream end width 2336 (e.g., a diameter) and a downstream end 2338 having a downstream end width 2340 (e.g., a diameter). The upstream end width 2336 is less than the downstream end width 2340 in this illustrated implementation. In some instances, the upstream end width 2336 may be less than or equal to a maximum width (e.g., a diameter of) the separator body 2400.

While the handheld vacuum cleaner 200 is shown as including the separator motor 2304, other configurations for rotating the separator 2326 are possible. For example, the suction motor 2302 can be configured to rotate the separator 2326. In such an example, the suction motor 2302 is configured to generate suction while causing the separator 2326 to rotate (e.g., using a drive train coupled to a driveshaft of the suction motor 2302, using a turbine configured to generate rotational motion through airflow generated by the suction motor 2302, or the like).

With reference again to FIG. 58, the separator assembly 2210 includes one or more guide ribs 2342 extending along the one or more sidewalls 2328 of the separation body 2208. The one or more guide ribs 2342 are configured to encourage (e.g., guide) liquid incident on the one or more sidewalls 2328 to flow along the one or more sidewalls 2328 and into the dust cup 2212. The one or more guide ribs 2342 extend from a platform 2344 and are coupled to the air channel 2322. At least one of the one or more guide ribs 2342 include a first guide rib section 2346 and a second guide rib section 2348. The first and second guide rib sections 2346 and 2348 intersect to form a rib angle $\alpha$.

Figure 60:
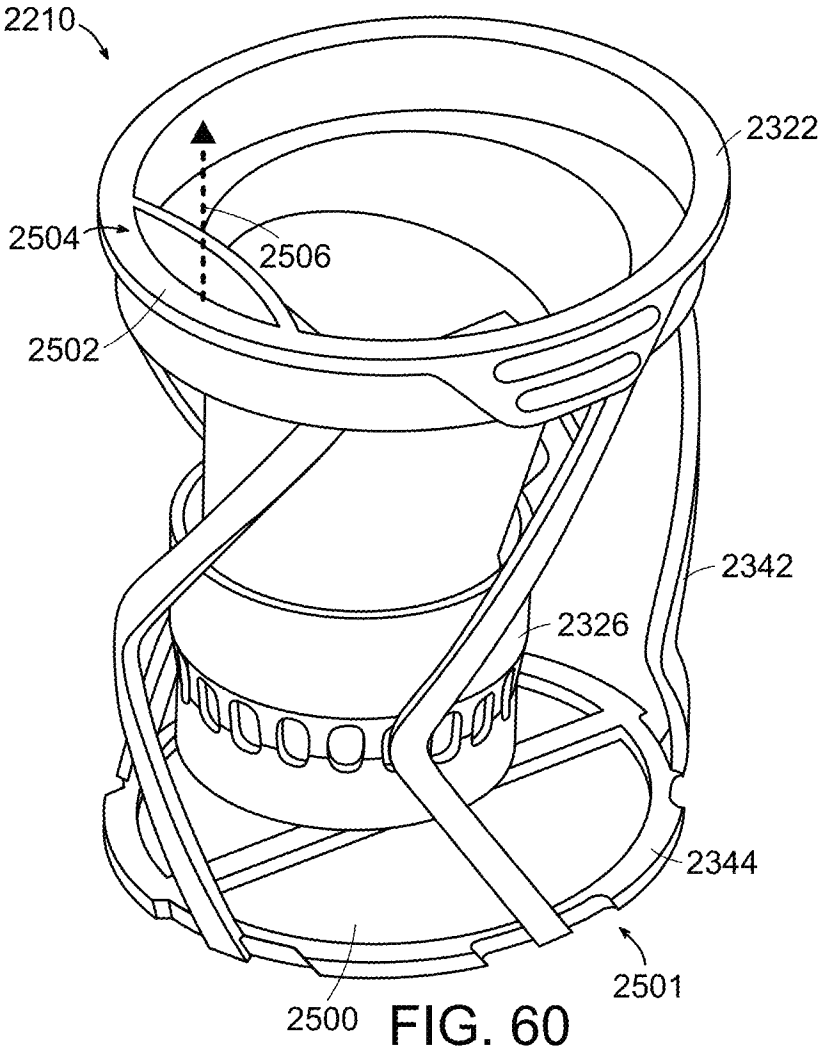
FIG. 60 is a perspective view of the separator of FIG. 59B.

With additional reference to FIG. 60, the platform 2344, the one or more guide ribs 2342, the air channel 2322, and the separator 2326 is configured to be collectively removed as a single assembly from the separation body 2208. In other words, the separator assembly 2210 is configured to be removable from the separation body 2208 as a single assembly. Such a configuration may encourage easier cleaning of the separator assembly 2210. In some instances, one or more of the one or more guide ribs 2342 and/or the platform 2344 may not be removed with the air channel 2322 and the separator 2326. In these instances, the separator assembly 2210 may be removable as two or more assemblies. Additionally, or alternatively, one or more of the one or more guide ribs 2342 and/or the platform 2344 may be non-removable from the separation body 2208.

The platform 2344 includes a platform filter 2500 (e.g., a screen, a cyclone separator, and/or any other type of filter) that extends between the inlet 2214 and the separator 2326. The platform filter 2500 is configured to reduce, which may in at least some instances be to eliminate, a quantity of debris greater than a predetermined size (e.g., fibrous debris such as hair) from reaching the separator 2326. Such a configuration may reduce a risk of the rotation of the separator 2326 being impeded by debris (e.g., fibrous debris wrapped around the separator 2326). Debris that does not pass through the platform filter 2500 collects within the dust cup 2212 for later disposal. The platform 2344 further includes a plurality of liquid cutouts 2501 disposed on opposing sides of a respective guide rib 2342 such that liquid flowing along the respective guide rib 2342 passes thought a corresponding liquid cutout 2501.

As shown, the separator assembly 2210 further includes a pour spout 2502. The pour spout 2502 includes a spout outlet 2504 at the first open end of the 2323 of the air channel 2322. The pour spout 2502 defines a portion of a liquid flow path 2506 that extends from the dust cup 2212 to the spout outlet 2504. The liquid flow path 2506 does not flow through the air channel 2322. In operation, a user may empty dirty liquid from the dust cup 2212 while the separator assembly 2210 is received within the separation body 2208. In this configuration, the platform filter 2500 reduces (e.g., prevents) a quantity of debris greater than a predetermined size (e.g., fibrous debris such as hair) from passing through the pour spout 2502. As such, the platform filter 2500 may generally be described as being configured to provide a filtering function in both a cleaning operation and an emptying operation.

With reference again to FIG. 58, a closure 2350 is movably (e.g., pivotally) coupled to the separation body 2208. The closure 2350 is configured to transition between an open position when the suction motor 2302 is generating suction and a closed position when the suction motor 2302 is not generating suction. In the closed position, the closure 2350 is configured to substantially fluidically isolate the inlet 2214 from the dust cup 2212. Such a configuration may mitigate, which may in at least some instances be to prevent, collected debris (solid and/or liquid) from inadvertently passing through the inlet 2214 when the suction motor 2302 is disabled.

As also shown, the handle 2204 defines a battery cavity 2352. The battery cavity is configured to receive at least one battery 2354. The at least one battery 2354 is configured to provide power to at least one of the suction motor 2302 and/or the separator motor 2304.

When the suction motor 2302 is powered, air (which may include liquid and solid debris entrained therein at least before encountering the separator 2326) flows along an airflow path 2356. The airflow path 2356 enters the handheld vacuum cleaner 2200 via the inlet 2214. From the inlet 2214, the airflow path 2356 passes through the platform filter 500 to be incident on the separator 2326. The separator 2326 imparts a rotational flow to the air incident thereon to propel at least a portion of entrained liquid out of entrainment with the air. The airflow path 2356 flows along the separator body 2400 and passes through the at least one air passthrough 2412 to enter the air channel 2322. From the air channel 2322 the airflow path 2356 extends through the pre-motor filter 2327 to enter the suction motor 2302. From the suction motor 2302 the airflow path 2356 exits the handheld vacuum cleaner 2200 and enters a surrounding environment. In some instances, the airflow path 2356 may pass through an exit filter, such as a high efficiency particulate air (HEPA) filter, before entering the surrounding environment and after passing through the suction motor 2302.

Figure 61:
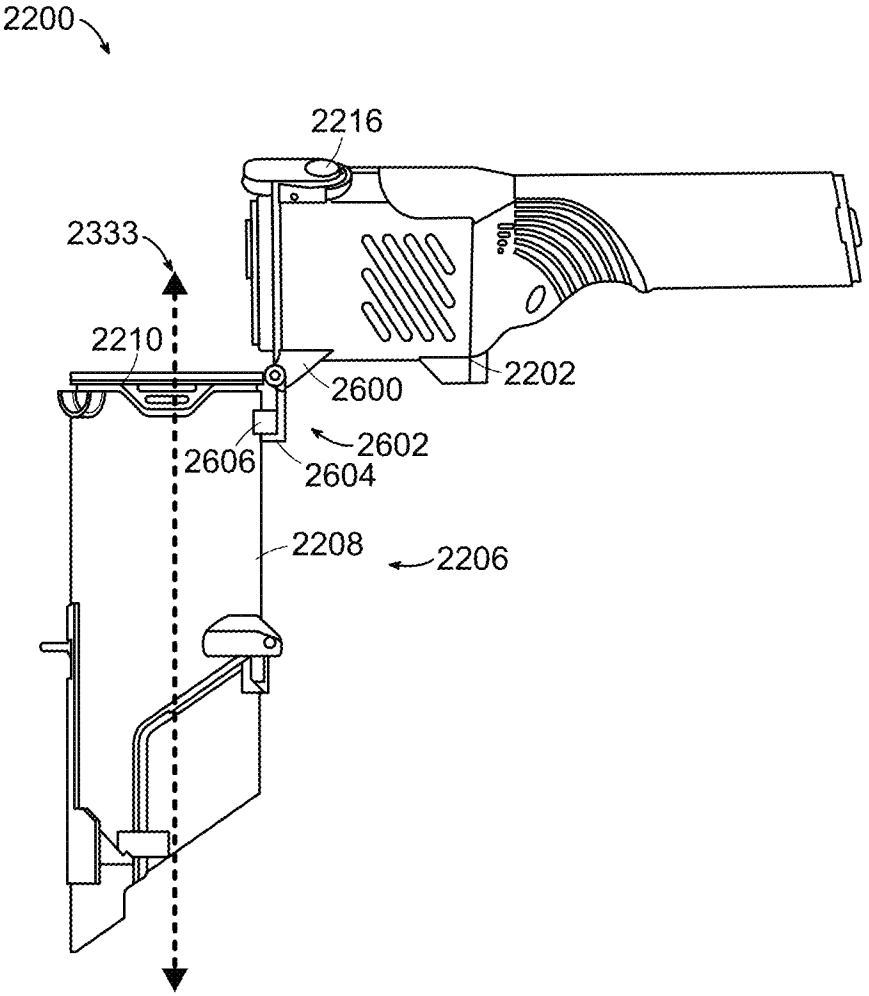
FIG. 61 is a side view of the handheld surface cleaner of FIG. 57A having a separation assembly in a maintenance position.

FIG. 61 shows a side view of the handheld vacuum cleaner 2200 having the separation assembly 2206 in a maintenance position. As shown, the separation assembly 2206 is pivotally coupled to the main body 2202 such that the separation assembly 2206 pivots when transitioning between a use position (shown in FIG. 57A) and the maintenance position. In an exemplary implementation, the pivoting between the use and maintenance positions is achieved with a rotational motion, which can be rotational movement of the separation assembly 2206 relative to the main body 2202, rotational movement of the main body 2202 relative to the separation assembly 2206, or rotational movement of each of the main body 2202 and the separation assembly 2206 relative to one another. The one or more latches 2216 selectively retain the separation assembly 2206 in the use position. In some instances, the main body 2202 may include a sensor (e.g., a mechanical switch, a hall effect sensor, or the like) configured to determine a state of the separation assembly 2206 (e.g., whether or not the separation assembly 2206 is in the use position).

When in the maintenance position, the separator assembly 2210 is configured to be removable from the separation body 2208 and/or the separation assembly 2206 is configured to be removable from the main body 2202. For example, when in the maintenance position, application of a removal force on the separator assembly 2210 in a direction substantially parallel to the separation assembly central axis 2333 may result in the separator assembly 2210 being removed from the separation body 2208. By way of further example, when in the maintenance position, application of a removal force on the separation body 2208 in a direction substantially parallel to the separation assembly central axis 2333 results in the separation body 2208 being removed from the main body 2202.

As shown, the main body 2202 includes a first hinge portion 2600 and the separation assembly 2206 includes a second hinge portion 2602 pivotally coupled to the first hinge portion 2600. The second hinge portion 2602 includes a catch 2604 configured to cooperate with a release 2606 on the separation assembly 2206. The catch 2604 and the release 2606 are configured to selectively couple the separation assembly 2206 to the main body 2202. For example, application of a removal force on the separation body 2208 in a direction substantially parallel to the separation assembly central axis 2333 results in the catch 2604 disengaging the release 2606.

While FIG. 61 shows the separation assembly 2206 pivotally coupled to the main body 2202, other configurations are possible. For example, the separation assembly 2206 may decouple from the main body 2202 in response to actuation of the one or more latches 2216 and the application of a removal force in a direction substantially parallel to the separation assembly central axis 2333.

Figure 62:
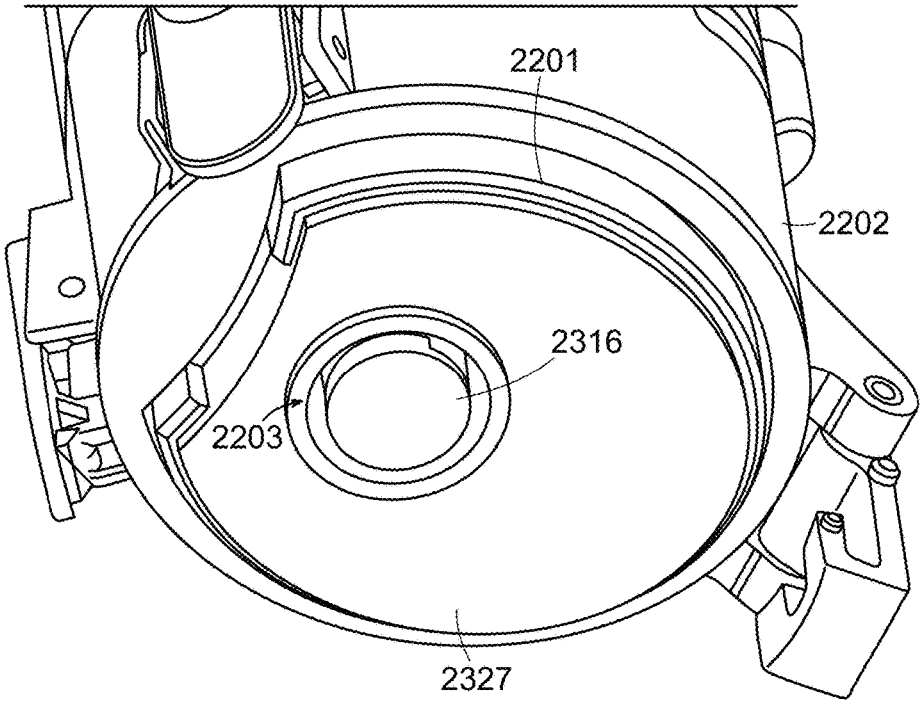
FIG. 62 is a perspective view of a main body of the handheld surface cleaner of FIG. 57A.

FIG. 62 shows a perspective end view of the main body 2202 when the separation assembly 2206 is removed therefrom. As shown, the pre-motor filter 2327 is removably disposed within a filter receptacle 2201 of the main body 2202. As shown, the pre-motor filter 2327 includes a drive passthrough 2203 through which the drive-side drive coupling 2316 is exposed and engageable by the driven-side drive coupling 2318 (FIG. 58). In some instances, and as shown in this illustrated implementation, the drive passthrough 2702 may be positioned such that the pre-motor filter 2327 (and/or a frame retaining the pre-motor filter 2327) completely surrounds the drive-side drive coupling 2316. The drive-side drive coupling 2316 is configured to selectively engage and disengage the driven-side drive coupling 2318 in response to the separation assembly 2206 being removed from or coupled to the main body 2202 or being pivoted between the maintenance position and the use position.

FIGS. 63A-63E illustrate another implementation of a handheld surface cleaner 2700 configured to use suction to draw debris into the handheld surface cleaner 2700 and to separate the air and the debris on board the handheld surface cleaner 2700. The handheld surface cleaner 2700 includes a DWT 2702, a main body 2704, a debris collection and storage cavity 2706 in the DWT 2702, a cap 2708, a lower cover 2710 of the DWT 2702, a latch 2712 (also shown in FIG. 63S), a microswitch 2714 (also shown in FIGS. 63T and 63U), a motor bracket 2716, a separator motor 2718, a separator bracket 2720, a separator assembly 2722 (see FIGS. 63K and 63L), a separator 2724, a PCB 2726, a suction motor 2728, a suction motor housing 2729, a handle 2730, a battery holder 2732 (shown in FIG. 63E holding four rechargeable batteries 2734), an inlet 2736, an inlet seal 2738, a shaft 2740, air exit holes 2742, a seal 2744 (a bearing in this illustrated implementation, although other seals are possible as discussed herein) at the separator 2724, a first filter 2746 (a hair cage in this illustrated implementation, also shown in FIGS. 63P-63R) upstream of the separator 2724, a second filter 2748 (filter foam in this illustrated implementation) downstream of the separator 2724, a duckbill valve 2750 (also shown in FIGS. 63Y-63AA), a lower cover 2752 of the main body 2704, an actuator 2754 (a depressible button in this illustrated implementation), a charging port 2756, and inlet hosing 2758. The handheld surface cleaner 2700 of FIGS. 63A-63E is generally configured and used similar to handheld surface cleaners discussed above except for some differences discussed below.

Figure 63A:
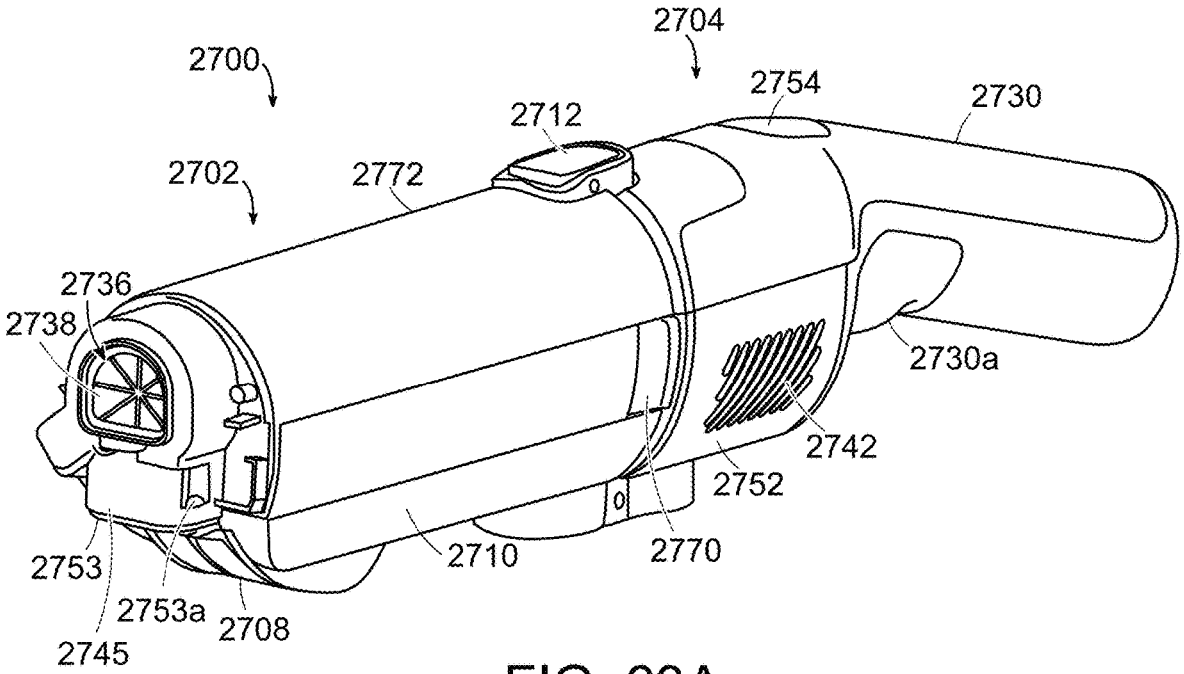
FIG. 63A is perspective view of another implementation of a handheld surface cleaner.
Figure 63B:
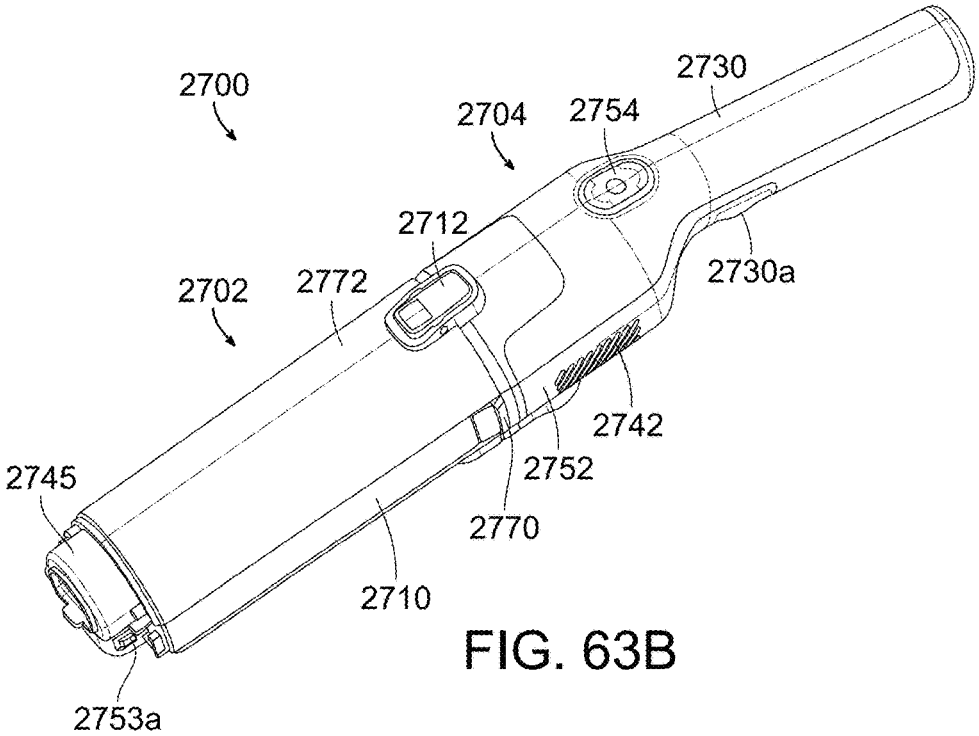
FIG. 63B is another perspective view of the handheld surface cleaner of FIG. 63A.
Figure 63C:
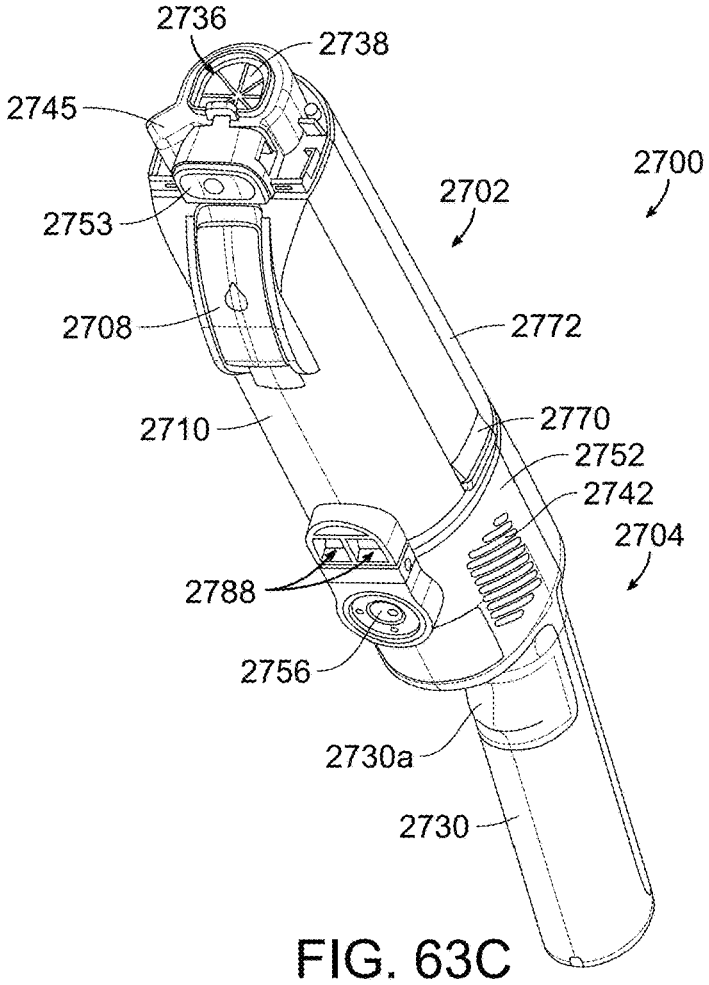
FIG. 63C is yet another perspective view of the handheld surface cleaner of FIG. 63A.

The main body 2704 is configured to releasably couple to the DWT 2702. In this illustrated implementation, the DWT 2702 is configured to be completely released from the main body 2704. FIGS. 63A-63F show the DWT 2702 and the main body 2704 releasably attached together. FIGS. 63G and 63H show the DWT 2702 as a standalone element. FIGS. 63I and 63J show the main body 2704 as a standalone element.

In this illustrated implementation, the handheld surface cleaner 2700, e.g., a controller at the PCB 2726, is configured to determine automatically whether the DWT 2702 is full. As in this illustrated implementation, the fullness of the DWT 2702 can be determined using a current of the separator motor 2718.

In this illustrated implementation, the handle 2730 defines a pistol grip and includes a finger grip 2730*a*. The handle 2730 thus extends downwardly relative to the flow path from the inlet 2736 to the separator 2724, where downward and upward are relative directions depending on an orientation of the handheld surface cleaner 2700. Downward and upward directions are labeled in the views of FIGS. 63D and 63V.

In this illustrated implementation, debris and air flow paths in the handheld surface cleaner 2700 are the same from the inlet 2736 to the separator 2724. As shown in FIG. 63E, a flow path from the inlet 2736 to the separator 2724 defines a first longitudinal axis A4. As also shown in FIG. 63E, the handle 2730 defines a second longitudinal axis A5 that is at a transverse angle θ relative to the first longitudinal axis A4. As discussed above, in an exemplary implementation, the transverse angle θ is greater than about 90 degrees and less than about 180 degrees, for example in a range of about 135 degrees to about 175 degrees, e.g., about 140 degrees, about 145 degrees, about 150 degrees, about 155 degrees, about 160 degrees, about 165 degrees, etc.

Figure 63D:
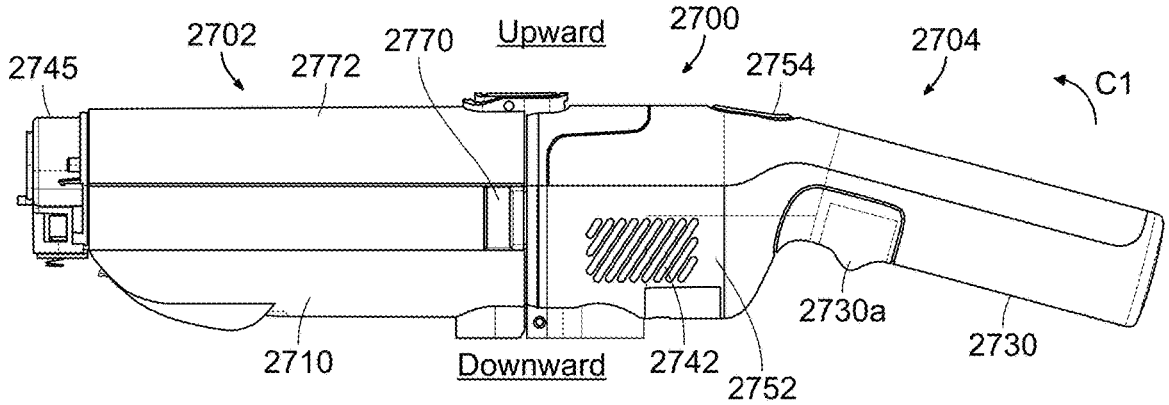
FIG. 63D is a side view of the handheld surface cleaner of FIG. 63A.
Figure 63E:
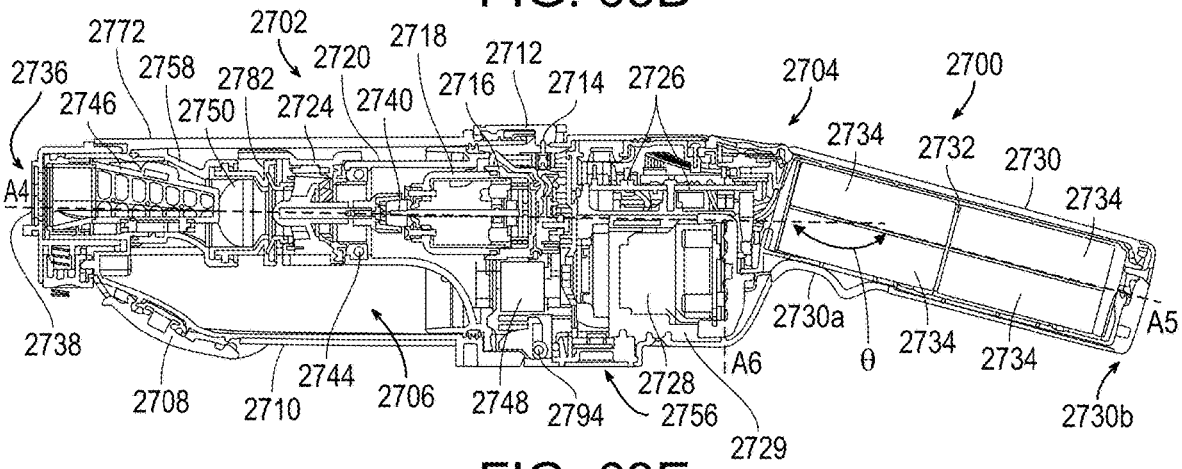
FIG. 63E is a side cross-sectional view of the handheld surface cleaner of FIG. 63A.
Figure 63F:
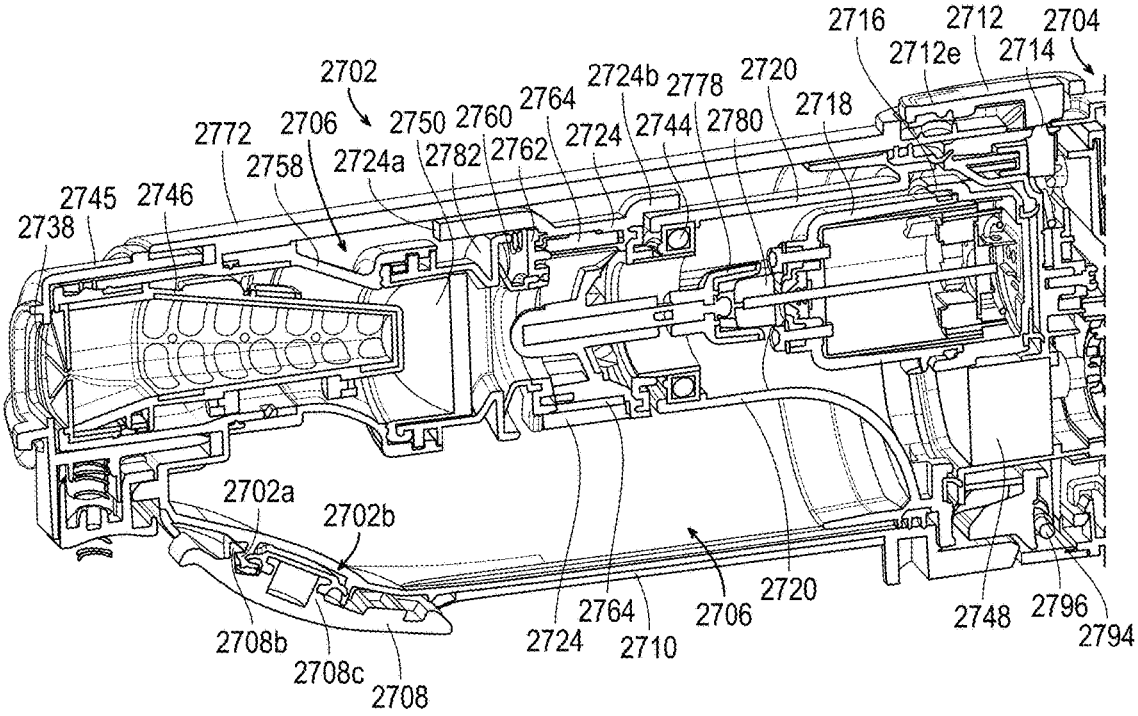
FIG. 63F is perspective cross-sectional view of a distal portion of the handheld surface cleaner of FIG. 63A.
Figure 63G:
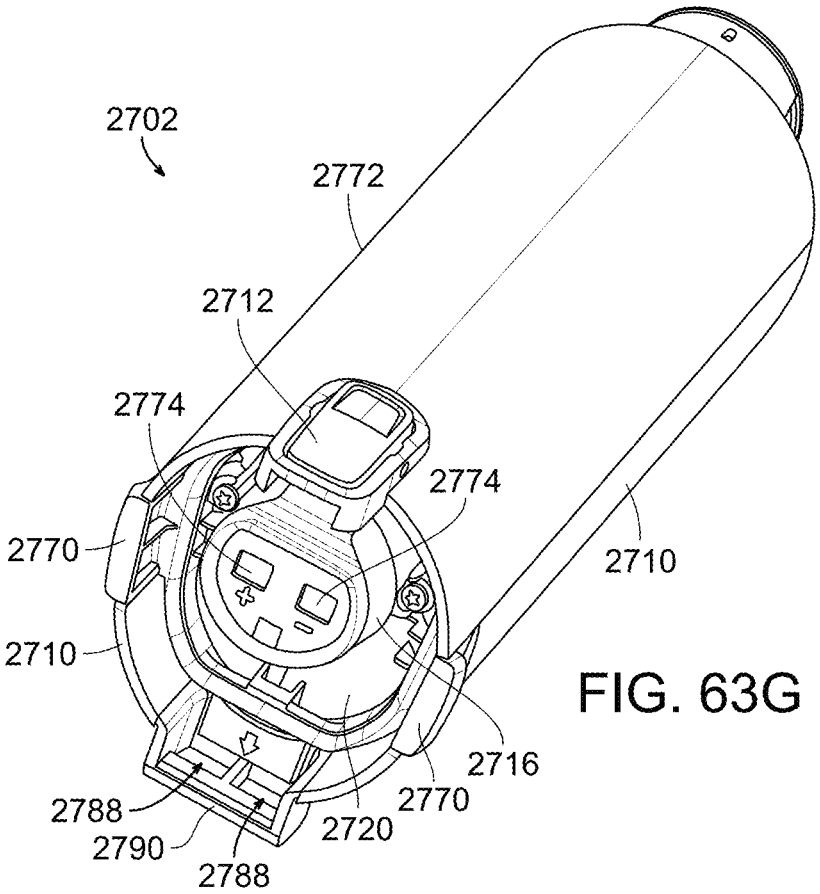
FIG. 63G is a perspective view of a dirty water tank of the handheld surface cleaner of FIG. 63A.
Figure 63H:
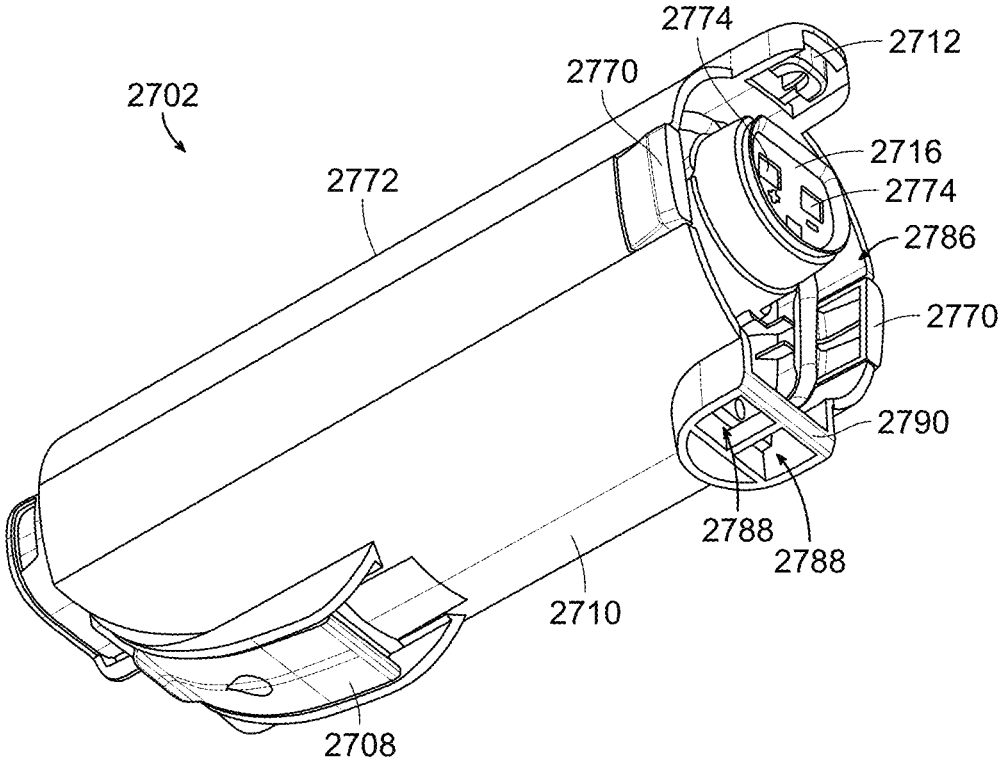
FIG. 63H is another perspective view of the dirty water tank of FIG. 63G.
Figure 63I:
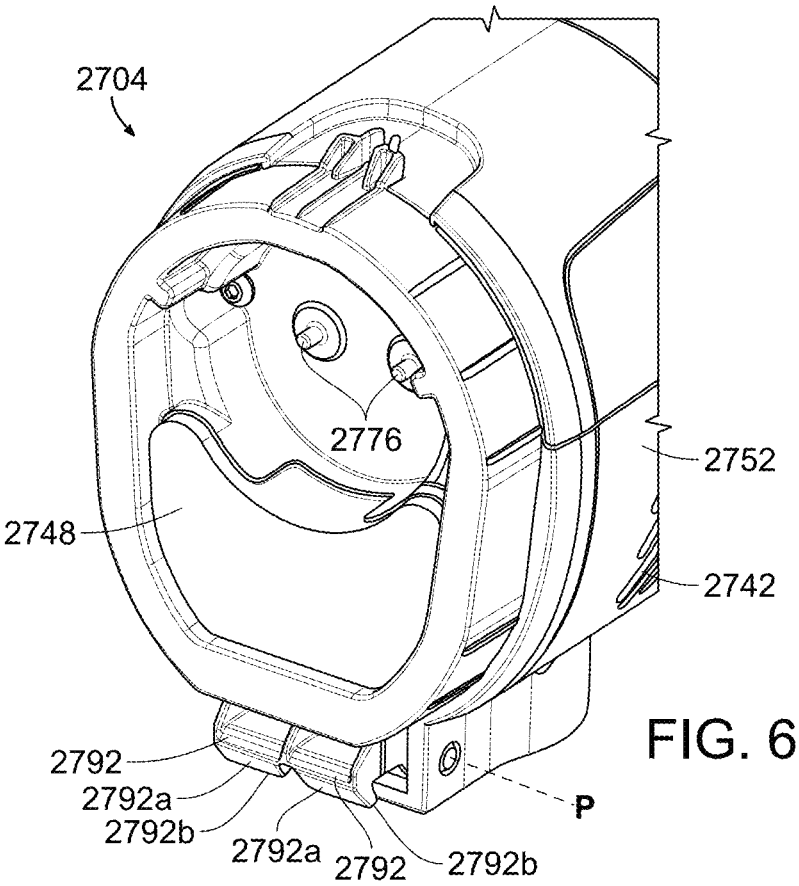
FIG. 63I is a perspective view of a distal portion of a main body of the handheld surface cleaner of FIG. 63A.
Figure 63J:
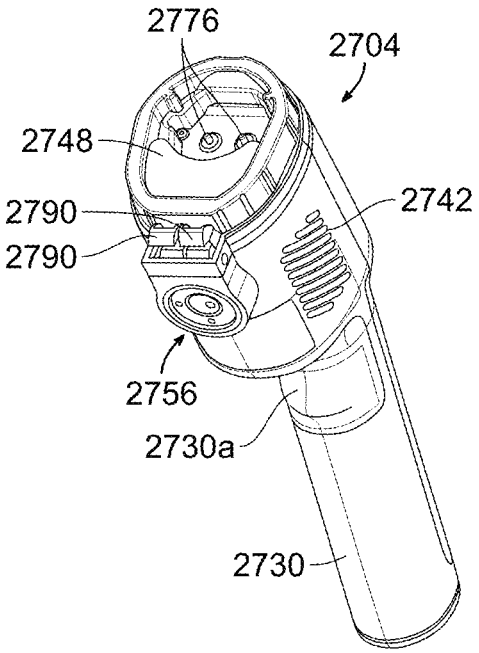
FIG. 63J is a perspective view of the main body of FIG. 63I.
Figure 63K:
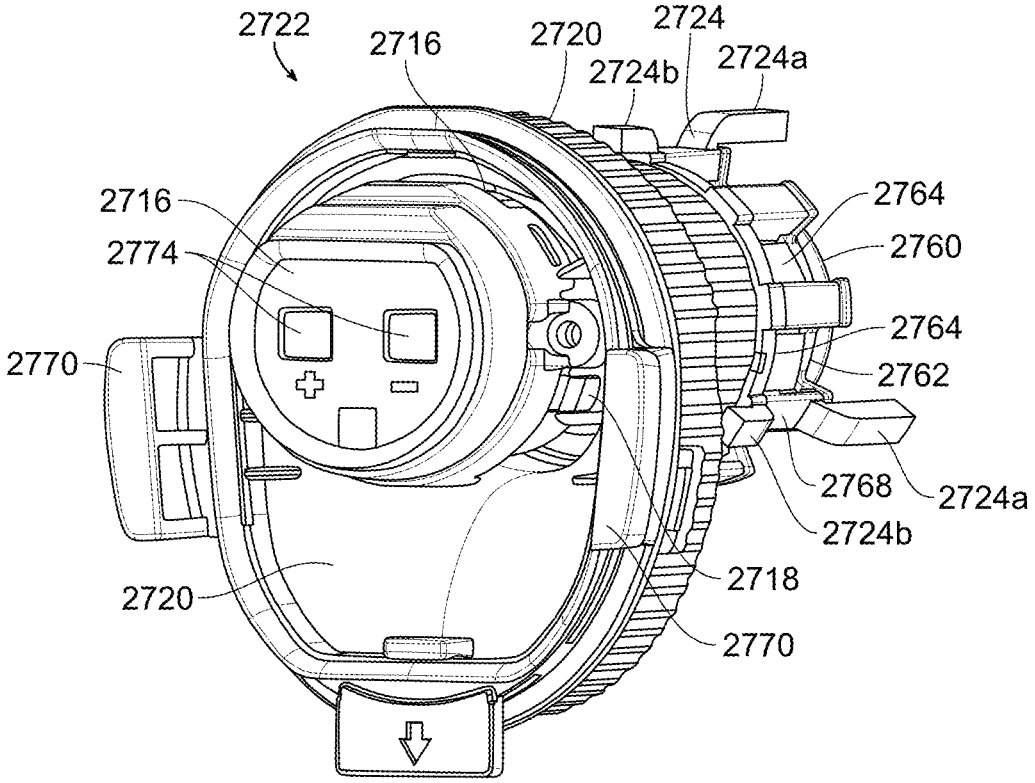
FIG. 63K is a perspective view of a separator assembly of the handheld surface cleaner of FIG. 63A.
Figure 63L:
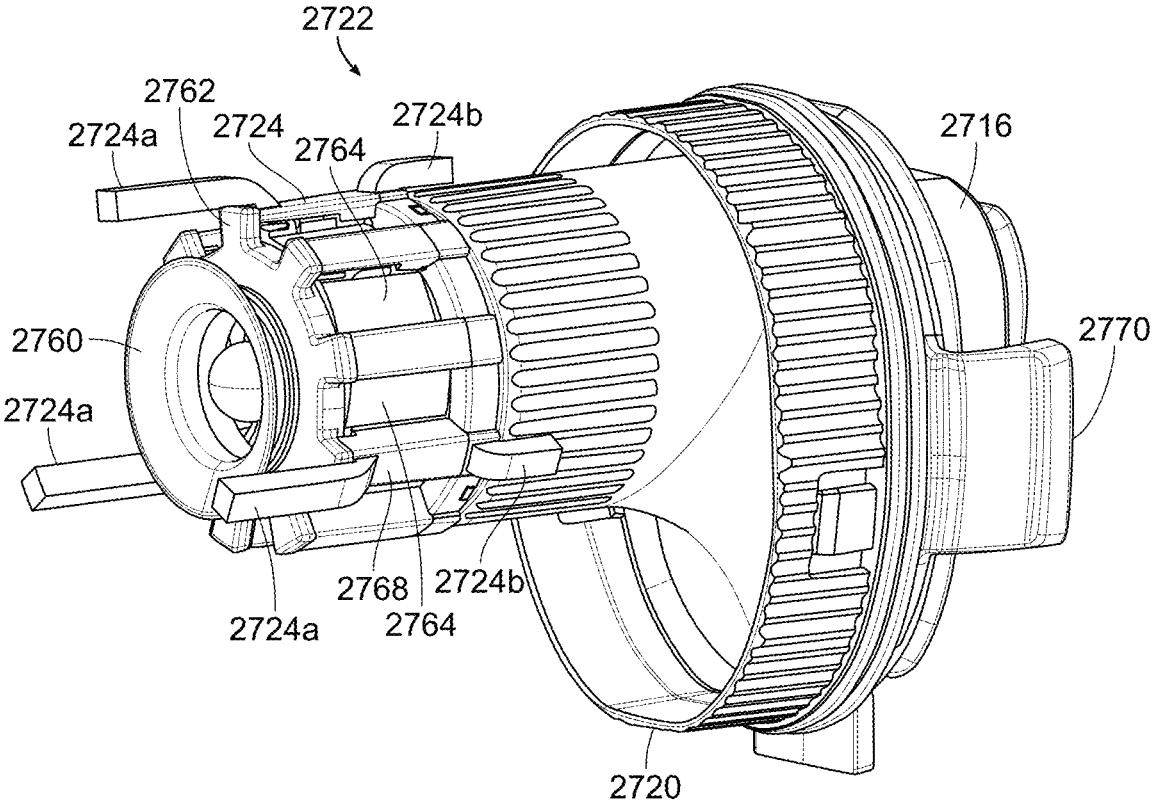
FIG. 63L is another perspective view of the separator assembly of FIG. 63K.
Figure 63M:
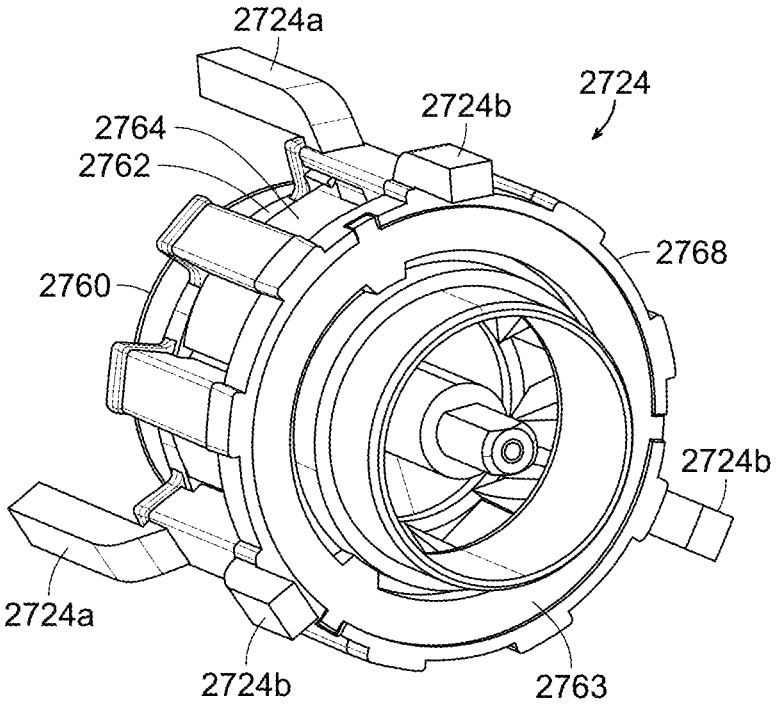
FIG. 63M is a perspective view of a separator of the handheld surface cleaner of FIG. 63A.
Figure 63N:
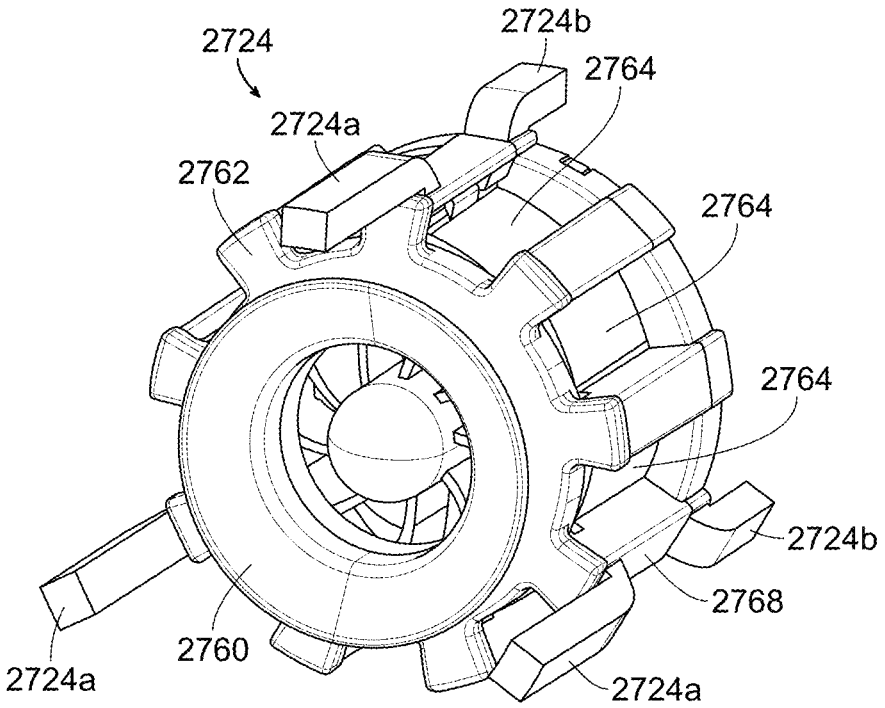
FIG. 63N is another perspective view of the separator of FIG. 63M.
Figure 63O:
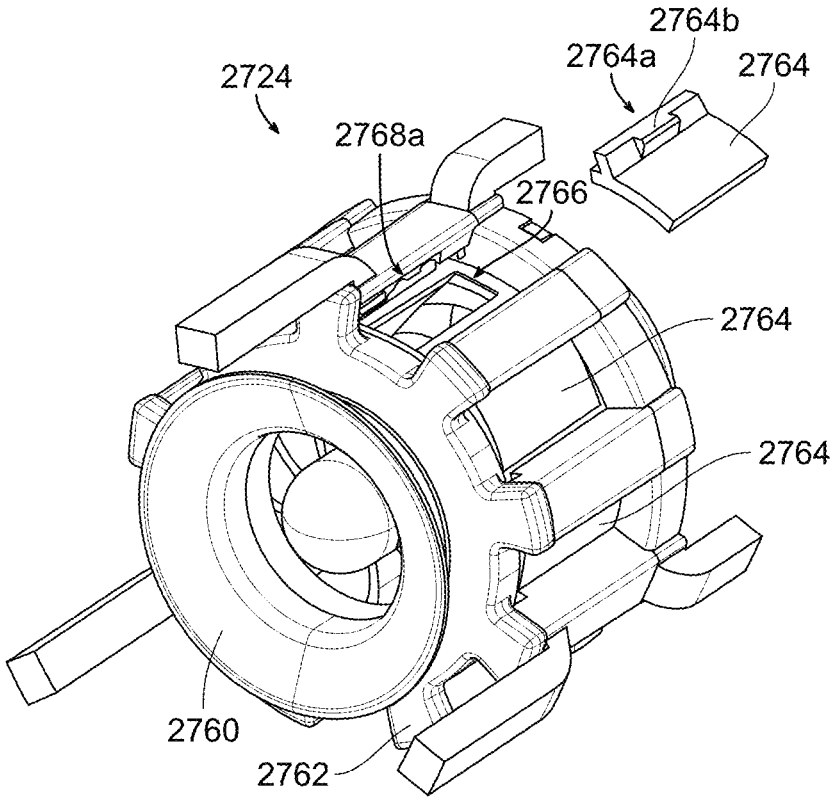
FIG. 63O is a perspective, partially exploded view of the separator of FIG. 63M.
Figure 63P:
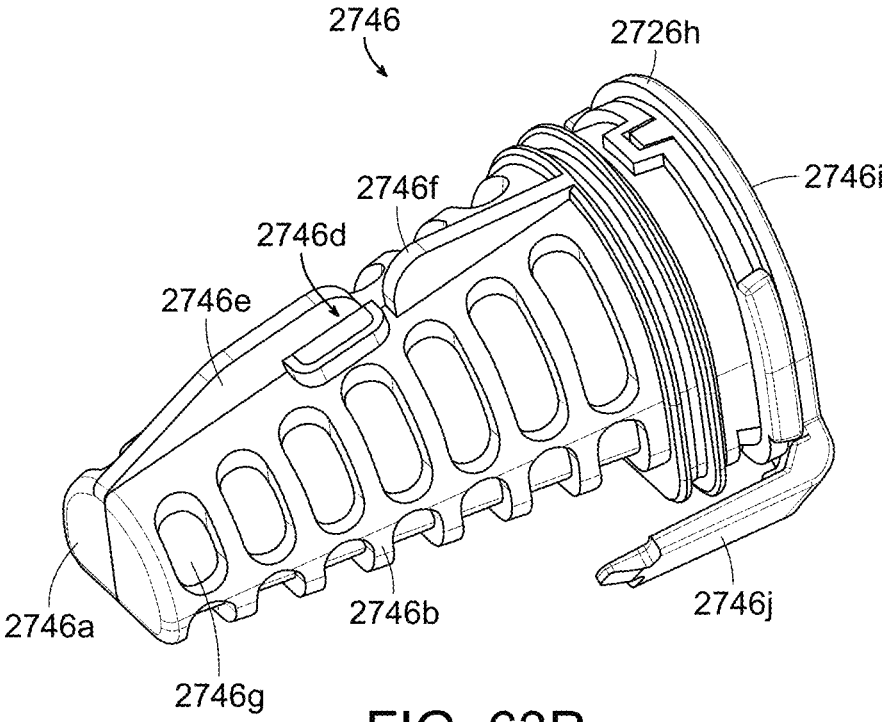
FIG. 63P is a perspective view of a hair cage of the handheld surface cleaner of FIG. 63A.
Figure 63Q:
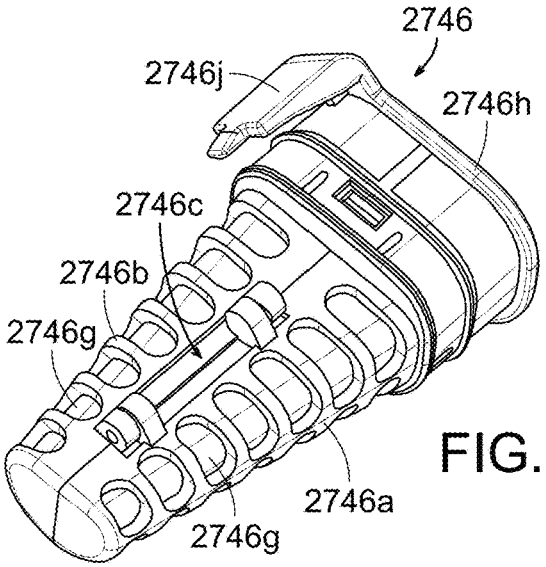
FIG. 63Q is another perspective view of the hair cage of FIG. 63P.
Figure 63R:
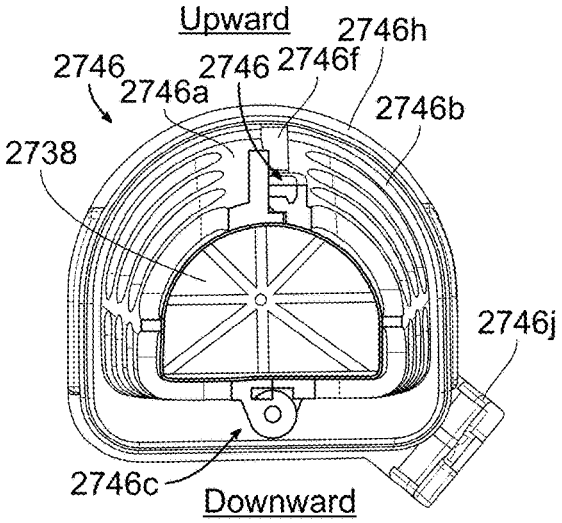
FIG. 63R is an end view of the hair cage of FIG. 63P.
Figure 63S:
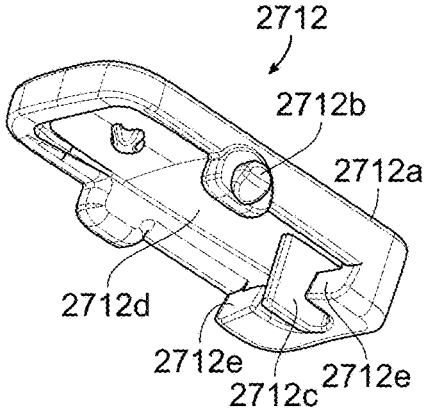
FIG. 63S is a perspective view of a latch of the handheld surface cleaner of FIG. 63A.
Figure 63T:
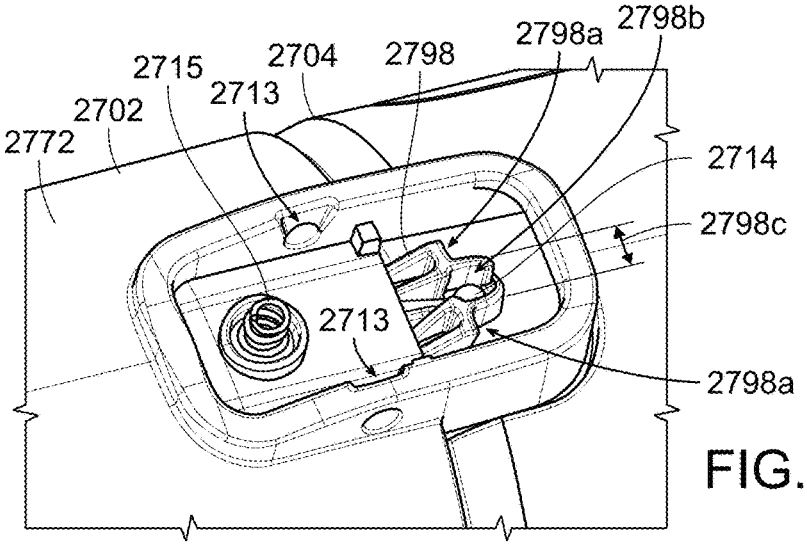
FIG. 63T is a perspective view of a portion of the handheld surface cleaner of FIG. 63A without the latch of FIG. 63S omitted.
Figure 63U:
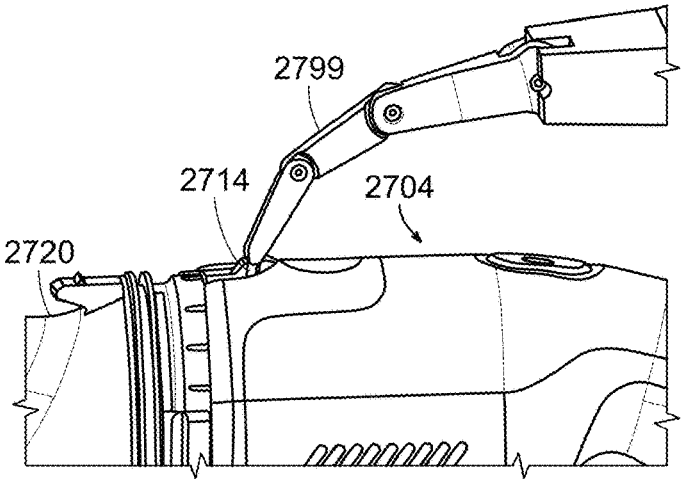
FIG. 63U is a side, partial view of the handheld surface cleaner of FIG. 63A with one implementation of a tool engaging a microswitch of the handheld surface cleaner of FIG. 63A.
Figure 63V:
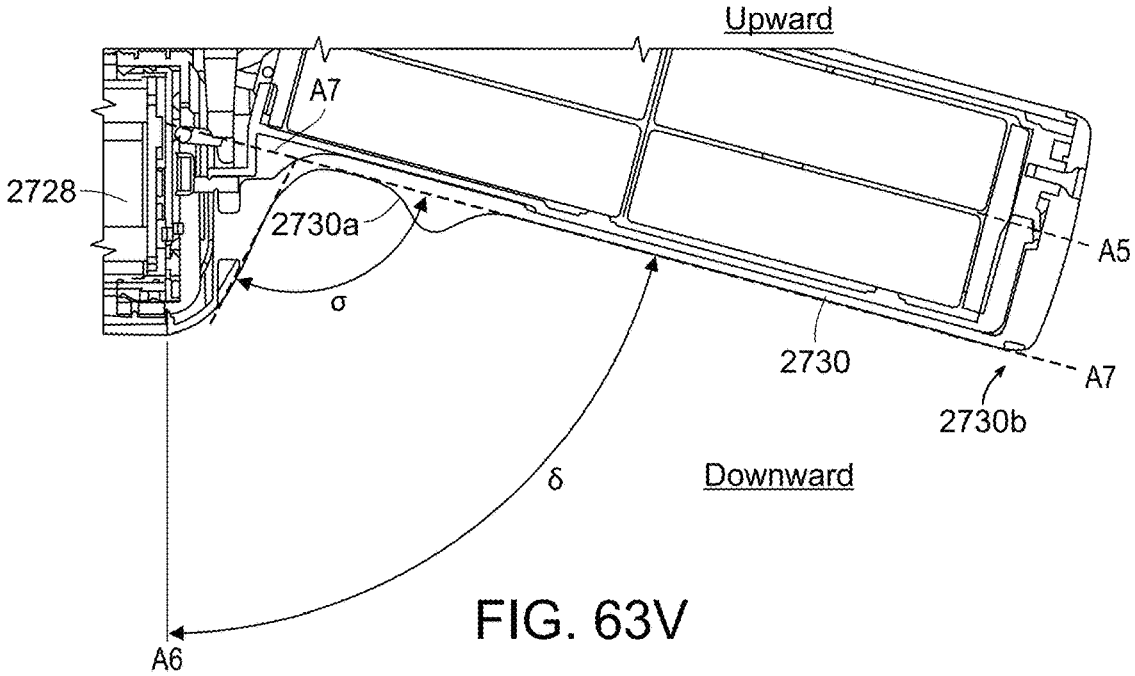
FIG. 63V is side cross-sectional view of a portion of the handheld surface cleaner of FIG. 63A.

FIGS. 63E and 63V show a third axis A6 that is substantially perpendicular to the first longitudinal axis A4 and is thus substantially perpendicular to the flow path from the inlet 2736 to the separator 2724. FIG. 63V shows that a fourth longitudinal axis A7 is at an acute angle δ relative to the third axis A6. The fourth longitudinal axis A7 is substantially parallel to the second longitudinal axis A5 and is defined by a bottom of the handle 2730. The handle 2730 is thus at the acute angle δ relative to the third axis A6 and extends from a distal portion of the main body 2704 at the acute angle δ. In an exemplary implementation, the acute angle δ is in a range of about 60 degrees to about 80 degrees, e.g., in a range of about 60 degrees to about 75 degrees, in a range of about 70 degrees to about 78 degrees, about 60 degrees, about 65 degrees, about 70 degrees, about 75 degrees, etc. The handle 2730 extending downwardly at the acute angle δ is configured to facilitate stable resting of the handheld surface cleaner 2700 on a support surface, e.g., a floor, a tabletop, a countertop, etc., with a downward-most portion 2730*b* of the handle 2730 being configured to rest on the support surface.

FIG. 63V also shows that the fourth longitudinal axis A7 (and thus also the second longitudinal axis A5) is at an obtuse angle σ relative to the third axis A6. In an exemplary implementation, the obtuse angle σ is in a range of about 95 degrees to about 135 degrees, e.g., about 95 degrees, about 100 degrees, about 105 degrees, about 110 degrees, in a range of about 100 degrees to about 110 degrees, in a range of about 100 degrees to about 105 degrees, in a range of about 105 degrees to about 110 degrees, etc. The obtuse angle σ is also configured to facilitate stable resting of the handheld surface cleaner 2700 on a support surface with the downward-most portion 2730*b* of the handle 2730 being configured to rest on the support surface.

As shown in FIGS. 63K and 63L, the separator assembly 2722 in this illustrated implementation includes the separator motor 2718, the separator 2724 (also shown in FIGS. 63M-63O), the separator bracket 2720, the shaft 2740 (obscured in FIGS. 63K and 63L), a centrifugal seal 2760 (also shown in FIGS. 63M-63O), a rim 2762 (also shown in FIGS. 63M-63O), a separator base 2763 (see FIG. 63M), and a plurality of movable covers 2764 (also shown in FIGS. 63M-63O). As discussed herein, the movable covers 2764 are each configured to move between configurations in which the movable covers 2764 seal holes 2766 formed in a body 2768 of the separator 2724 and do not seal the holes 2766. For purposes of illustration, FIG. 63O shows one of the movable covers 2764 removed from the separator body 2768 to show the movable cover's associated hole 2766. The holes 2766 each have a substantially rectangular shape in this illustrated implementation, but as mentioned above, other hole shapes are possible.

The movable covers 2764 in this illustrated implementation are each attached to the separator body 2768 along one edge 2764*a* of the cover 2764. The movable covers 2764 can each be attached to the separator body 2768 in a variety of ways. As in this illustrated implementation, each of the movable covers 2764 can be hingedly attached to the separator body 2768, e.g., by including a hinge pin 2764*b* hingedly attached to a corresponding hinge knuckle 2768*a* of the separator body 2768.

As in this illustrated implementation, each of the movable covers 2764 can be configured to selectively cover one of the separator's holes 2766. In another implementation, one or more of the movable covers 2764 can be configured to selectively cover more than one of the separator's holes 2766, e.g., cover two of the separator's holes 2766, etc.

The separator 2724 in this illustrated implementation is a singular member. The separator 2724 is configured to rotate, as discussed herein, with the separator body 2768, the centrifugal seal 2760, and the rim 2762 being configured to rotate as a unit.

A separator, e.g., any of the separators described herein, can include a vibration reduction feature configured to reduce vibration of components adjacent to the separator during the separator's rotation. Reducing vibration may help reduce wear experienced by the adjacent components and/or may improve user experience by reducing noise heard by the user during separator rotation.

The separator 2724 of the handheld surface cleaner 2700 of FIG. 63E includes one implementation of a vibration reduction feature. As in this illustrated implementation, the vibration reduction feature can include a plurality of proximal arms 2724*a* and a plurality of distal arms 2724*b*. The separator 2724 includes three proximal arms 2724*a* spaced substantially equidistantly around the separator body 2728 and three distal arms 2724*b* spaced substantially equidistantly around the separator body in this illustrated implementation, but other spacings and numbers of proximal arms 2724*a* and distal arms 2724*b* are possible. Including at least two proximal arms 2724*a* spaced equidistantly around the body 2728 may help limit reduce vibration at a proximal end of the separator 2724 regardless of the separator's rotational position. Including at least two distal arms 2724*b* spaced equidistantly around the body 2728 may help limit reduce vibration at a distal end of the separator 2724 regardless of the separator's rotational position. In some implementations, a separator includes only proximal arms or only distal arms.

The separator's plurality of proximal arms 2724*a* extend proximally from the body 2768 of the separator 2724. The plurality of proximal arms 2724*a* are configured to rotate around the duckbill valve 2750. With the separator 2724 coupled to the DWT 2702, e.g., with the separator assembly 2722 removably coupled to the DWT 2702, and with the duckbill valve 2750 coupled to the DWT 2702, e.g., with the duckbill valve assembly (discussed further below) removably coupled to the DWT 2702, the plurality of proximal arms 2724*a* are configured to extend proximally past a proximal end of the separator body 2768 and a distal end of the duckbill valve 2750, as shown in FIG. 63F.

The plurality of distal arms 2724*b* extend distally from the body 2768 of the separator 2724. The plurality of proximal arms 2724*a* are configured to rotate around the separator bracket 2720. With the separator 2724 coupled to the DWT 2702, e.g., with the separator assembly 2722 removably coupled to the DWT 2702, the plurality of distal arms 2724*b* are configured to extend distally past a distal end of the separator body 2768 and a proximal end of the separator bracket 2720, as shown in FIG. 63F.

In this illustrated implementation, the debris that enters the handheld surface cleaner 2700 through the inlet 2736 and flows into the separator 2724 through the separator's inlet opening along the flow path is configured to travel from the flow path to the debris flow path in the handheld surface cleaner 2700 and then flow along the debris flow path. The separator 2724 is configured to direct the debris radially outward through the holes 2766 and into the debris collection and storage cavity 2706. The radial outward flow of the debris is in a direction radially outward from the first longitudinal axis A4.

In this illustrated implementation, the air that enters the handheld surface cleaner 2700 through the inlet 2736 and flows into the separator 2724 through the separator's inlet opening along the flow path is configured to travel from the flow path to the air flow path in the handheld surface cleaner 2700 and then flow along the air flow path in the handheld surface cleaner 2700. The air flow path is different from the debris flow path. The air is configured to flow out of the separator 2724 through the separator's outlet opening. This portion of the air flow path is along the first longitudinal axis A4. A remainder of the air flow path is not along the first longitudinal axis A4. Downstream of the separator 2724, the air flow path is through the separator bracket 2720, the second filter 2748, and a gap of space defined between the main body lower cover 2752 and the suction motor housing 2729.

The separator assembly 2722 in this illustrated implementation includes a pair of tabs 2770 configured to facilitate manual removal of the separator assembly 2722 from the DWT 2702. In another implementation, the separator assembly 2722 can include a single tab 2770 or can include more than two tabs 2770. The tabs 2770 are configured to be held by a user to help pull the separator assembly 2722 in a proximal direction to remove the separator assembly 2722 from the DWT 2702. Similarly, the tabs 2770 are configured to be held by a user to help push the separator assembly 2722 in a distal direction to re-attach the separator assembly 2722 to the DWT 2702. A user may choose to hold only one of the tabs 2770 when removing and/or re-attaching the separator assembly 2722.

The tabs 2770 in this illustrated implementation extend proximally and are located opposite one another around a perimeter of the separator assembly 2722. Free ends of the tabs 2770 are configured to be located outside of the DWT 2702 (and the main body 14) with the DWT 2702 coupled to the main body 2704, as shown in FIGS. 63A-63D in which one of the tabs 2770 is visible. At least a portion of the tabs 2770 is thus outside of the debris flow path in the handheld surface cleaner 2700 so that at least the portion of the tabs 2770 may remain clean and dry when a user holds the tabs 2770.

The tabs 2770 are configured as a lock configured to lock the separator assembly 2722 to the DWT's housing 2772 (and the DWT lower cover 2710 if not omitted), similar to the tabs 54 discussed above with respect to the handheld surface cleaner 10 of FIG. 1.

To allow the separator motor 2718 to be powered by a power supply at the main body 2704, e.g., by the rechargeable batteries 2734 in the handle 2730, the DWT 2702 includes at least one electrical connector 2774, e.g., a conductive plate or other electrical connector, operatively connected to the separator motor 2718 and configured to contact at least one corresponding electrical connector 2776, e.g., a conductive pin or other electrical connector, of the main body 2704 that is operatively connected to the power supply. The attachment of the DWT 2702 and the main body 2704 is configured to cause each of the DWT's one or more electrical connectors 2774 to conductively engage automatically with the main body's one or more electrical connectors 2776. Detaching the DWT 2702 and the main body 2704 is configured to cause the DWT's one or more electrical connectors 2774 to automatically no longer conductively engage with the main body's one or more electrical connectors 2776. Two electrical connectors 2774, positive and negative, are shown in the illustrated implementation of FIGS. 63G, 63H, and 63K. Two electrical connectors 2776, positive and negative, are shown in the illustrated implementation of FIGS. 63I and 63J.

As in this illustrated implementation, the electrical connectors 2774, 2776, and thus the electrical connection between the DWT 2702 and the main body 2704, can be configured to be isolated from any air flowing the handheld surface cleaner 2700 and from any debris in the handheld surface cleaner 2700, whether the debris is flowing in the handheld surface cleaner 2700 or is collected in the DWT's debris collection and storage cavity 2706. Such isolation from debris and air may help prevent a short circuit, and/or may help prevent rusting and/or other damage to the DWT's one or more electrical connectors 2774 and/or the main body's one or more electrical connectors 2776.

In this illustrated implementation, the at least one electrical connector 2774 of the DWT 2702 includes a pair of conductive plates, and the at least one electrical connector 2776 of the main body 2704 includes a pair of pogo pins. The attachment of the DWT 2702 and the main body 2704 is configured to automatically cause each of the pogo pins 2776 to compress in response to pressing against a respective one of the conductive plates 2774. Detaching the DWT 2702 and the main body 2704 is configured to automatically cause the pogo pins 2776 to decompress in response to no longer pressing against either of the conductive plates 2774. In another implementation, the DWT 2702 includes the one or more pogo pins, and the main body 2704 includes the one or more conductive plates.

The shaft 2740 of the handheld surface cleaner 2700 can be a single shaft or a plurality of shafts. In this illustrated implementation, the shaft 2740 includes a first shaft associated with the handheld surface cleaner's separator motor 2121 and a second shaft associated with the separator 2114.

Figure 63W:
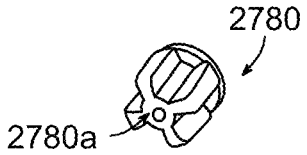
FIG. 63W is a perspective view of an inner plug of the handheld surface cleaner of FIG. 63A.
Figure 63X:
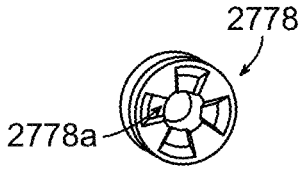
FIG. 63X is a perspective view of an outer bearing of the handheld surface cleaner of FIG. 63A.

As in this illustrated implementation, a drive dog can be used in driving rotation of the handheld surface cleaner's separator motor 2718. As shown in FIGS. 63F, 63W, and 63X, the drive dog includes an outer bearing 2778 and an inner plug 2780 attached to the outer bearing 2778. The outer bearing 2778 includes an inner passageway 2778*a* configured to seat the inner plug 2780 therein in a fixed rotational relationship. For example, as in this illustrated implementation, the inner plug 2780 and the outer bearing 2778 can be attached together in a friction fit with the inner plug 2780 being plastic and the outer bearing 2778 being rubber. The outer bearing 2778 being rubber may help reduce vibration caused by running of the separator motor 2718 as compared to the outer bearing 2778 being plastic or metal.

The handheld surface cleaner's second shaft is configured to extend into the outer bearing's inner passageway 2778*a* and be secured to the outer bearing 2778 in a fixed rotational relationship. The handheld surface cleaner's first shaft is configured to extend into an inner passageway 2780*a* of the inner plug 2780 and be secured to the inner plug 2780 in a fixed rotational relationship. As discussed herein, the separator motor 2718 is configured to drive rotation of the first shaft. The rotation of the first shaft is configured to cause the inner plug 2780 to rotate and thus cause the outer bearing 2778 and the second shaft to rotate, thereby causing the separator 2724 to rotate.

As in this illustrated implementation, the inner plug 2780 and the outer bearing 2778 can be keyed to help prevent relative rotation between the inner plug 2780 and outer bearing 2778. In this illustrated implementation, the inner plug 2780 has a generally X-shaped cross-sectional shape including four lobes and the outer bearing's inner passageway 2780*a* has a corresponding generally X-shaped cross-sectional shape including four lobes to help prevent relative rotation between the inner plug 2780 and outer bearing 2778. Although four lobes are used in this illustrated implementation, another number of lobes may be used. As compared to the implementation of FIGS. 56A-56C in which the inner plug 2126 has a hexagonal cross-sectional shape and the outer bearing's inner passageway 2124*a* has a corresponding hexagonal cross-sectional shape, the inner plug 2780 of FIG. 63F has more contact surface area with the outer bearing 2778 than the inner plug 2126 of FIG. 56A has with the outer bearing 2124. Having more contact surface area may reduce current draw of the separator motor 2718 and thus operate more efficiently and better transfer motion to the separator 2724.

A handheld surface cleaner can include a separator and a valve that is located upstream of the separator and that is configured to allow flow through the valve in a direction toward the separator. The valve can have a variety of configurations. For example, various illustrated implementations of handheld surface cleaners described herein include the valve as a duckbill valve, although another type of valve can be used. As mentioned above, the handheld surface cleaner 2700 of FIG. 63E includes the duckbill valve 2750, which is configured to allow flow through the duckbill valve 2750 in a direction toward the separator 2724.

The duckbill valve 2750 of the handheld surface cleaner 2700 is generally configured and used similar to the duckbill valve 76 of FIGS. 2, 3, and 6 and is located upstream of (distal to) the separator 2724, downstream of (proximal to) the hair cage 2746, and is a seal configured to allow fluid flow in only one direction toward the separator 2724. The duckbill valve 2750 in this illustrated implementation is attached to the handheld surface cleaner's inlet hosing 2758, as shown in FIGS. 63F and 63AA, and terminates upstream of the handheld surface cleaner's rim 2762 and centrifugal seal 2760.

A handheld surface cleaner's duckbill valve can be non-removable from the handheld surface cleaner's DWT or can be removable from the DWT. A duckbill valve being non-removable from the DWT may help ensure that the duckbill valve is properly positioned in the DWT, is always present to provide sealing functionality, and/or does not get lost. A duckbill valve being removable may facilitate a user cleaning of the duckbill valve and/or may allow for the duckbill valve to be replaced if the duckbill valve gets torn or otherwise damaged, e.g., by debris flowing through the duckbill valve.

The duckbill valve 76 of FIGS. 2, 3, and 6, a duckbill valve 718 of FIG. 35, a duckbill valve 817 of FIG. 39, and the duckbill valve 2002 of FIG. 55 are each non-removable from their respective handheld surface cleaner's DWT. (The duckbill valve 817 is omitted from FIG. 40 for purposes of illustration.)

Figure 63Y:
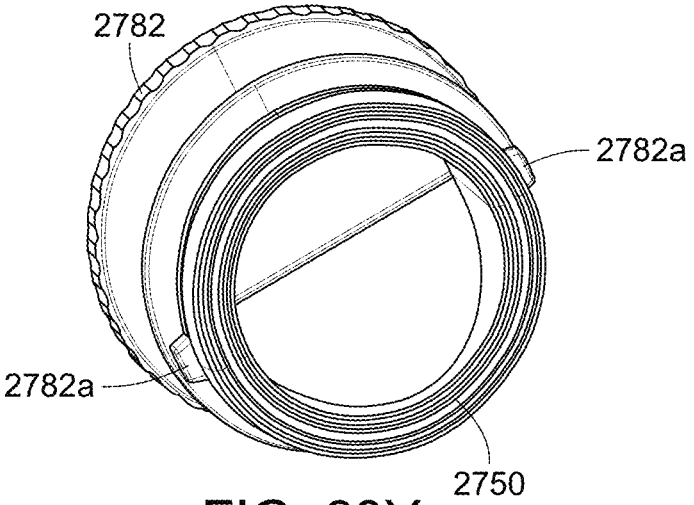
FIG. 63Y is a perspective view of a duckbill valve assembly of the handheld surface cleaner of FIG. 63A.
Figure 63Z:
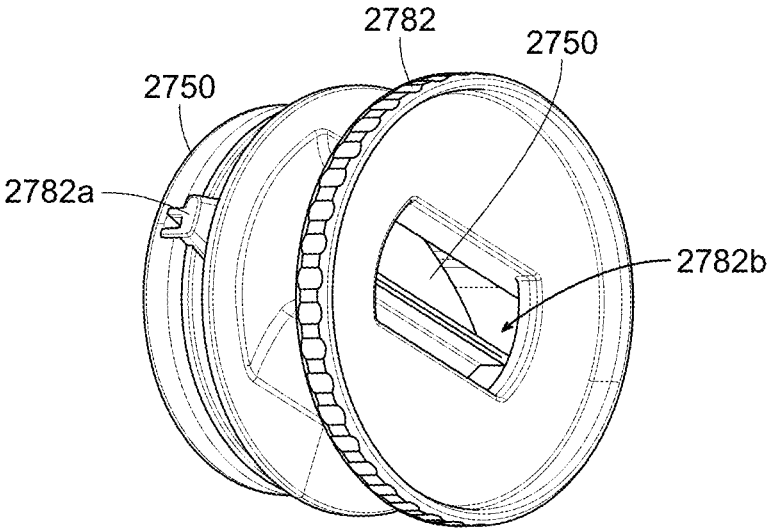
FIG. 63Z is another perspective view of the duckbill valve assembly of FIG. 63Y.
Figure 63A:
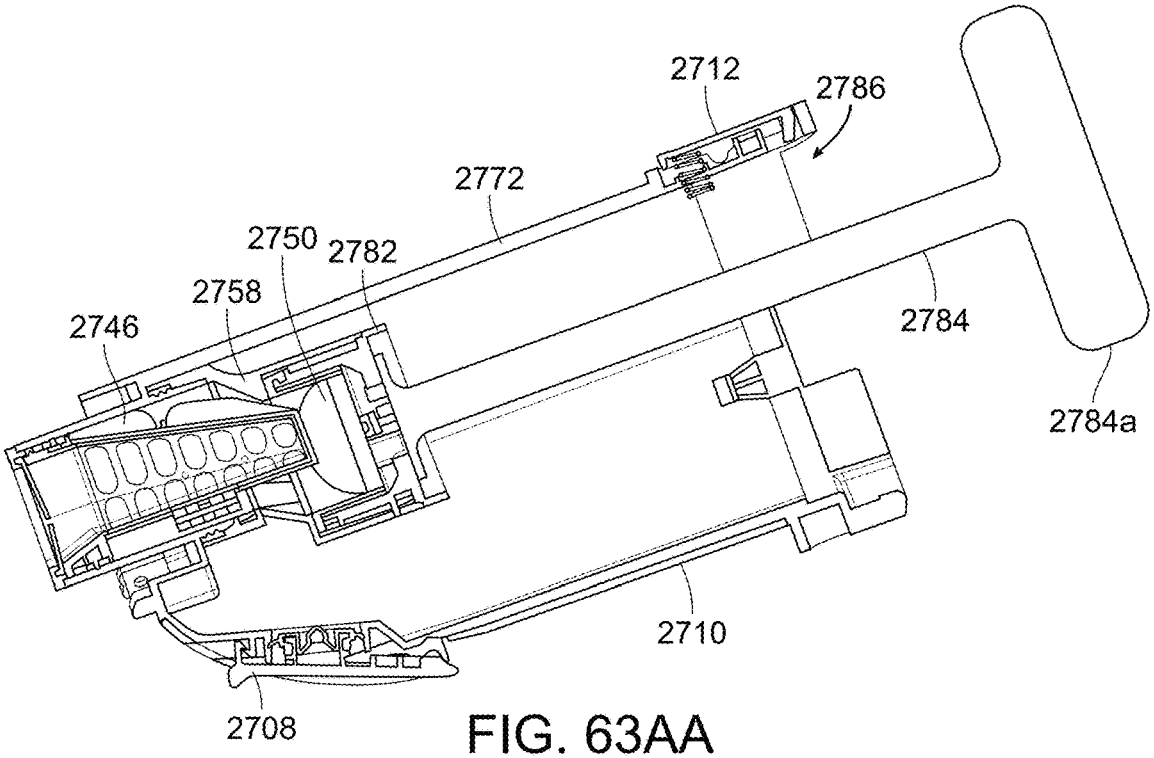
Figure 63B:
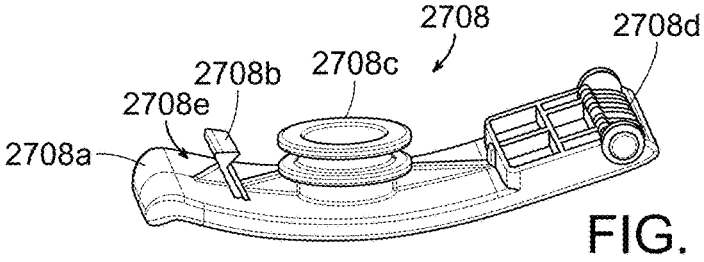
Figure 63C:
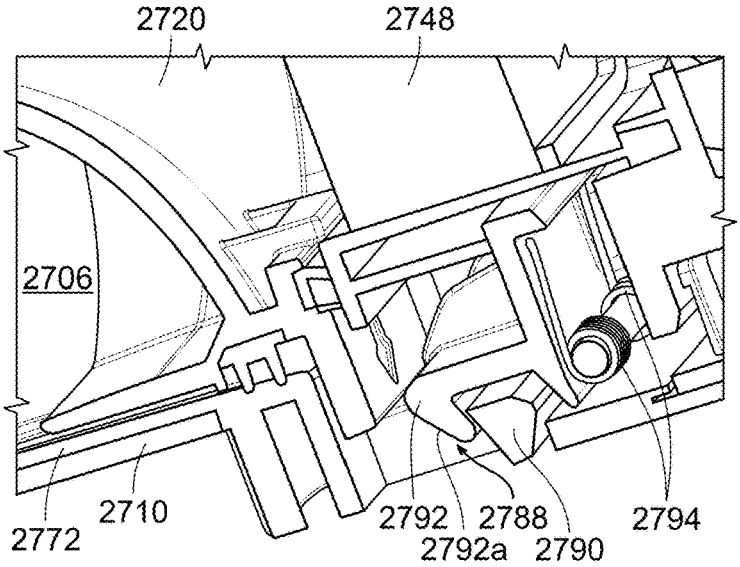
Figure 63D:
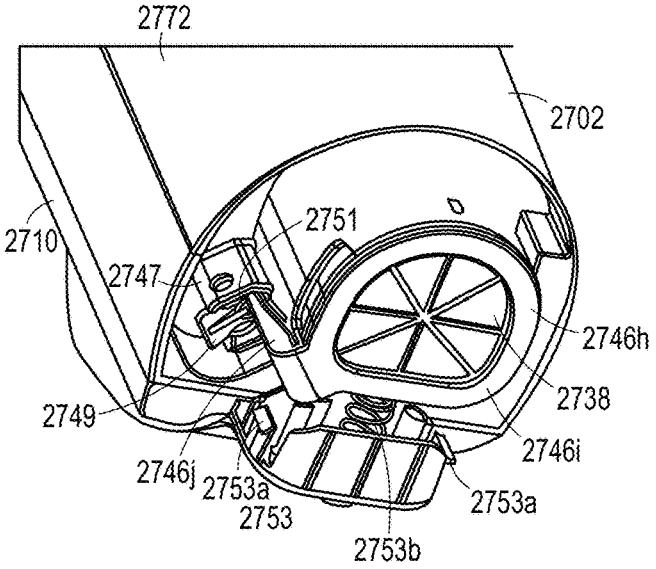
Figure 63E:
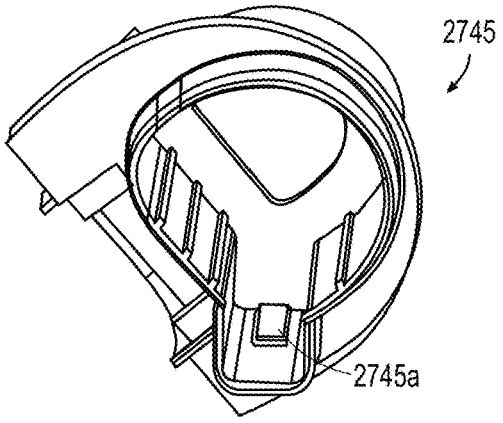
Figure 63F:
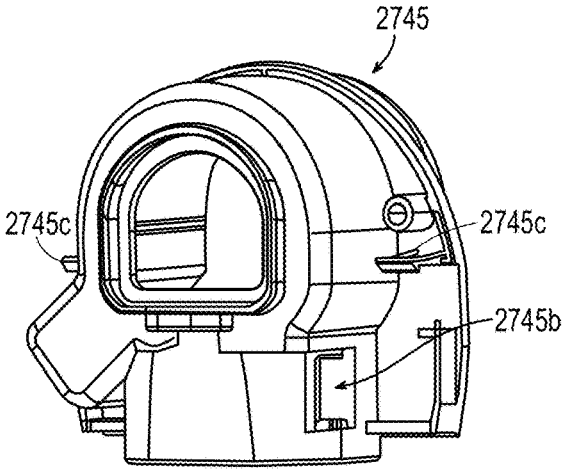
Figure 63G:
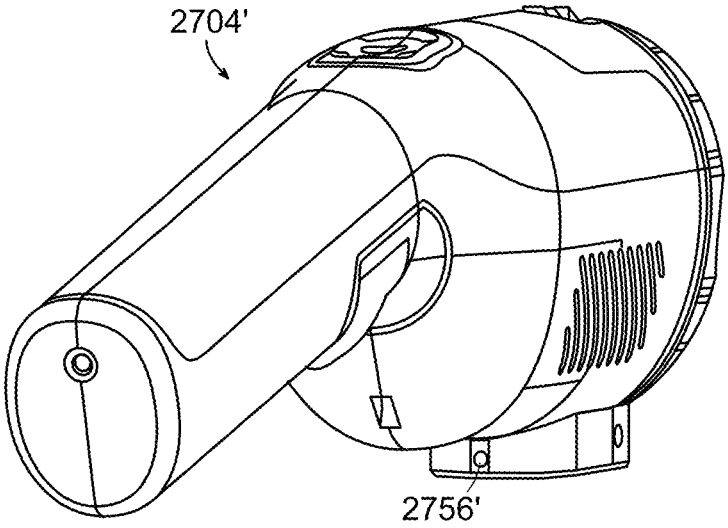
Figure 63H:
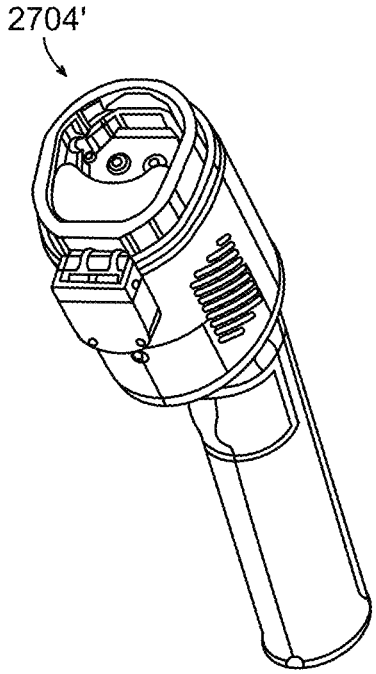
Figure 63I:
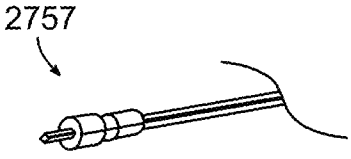
Figure 63J:
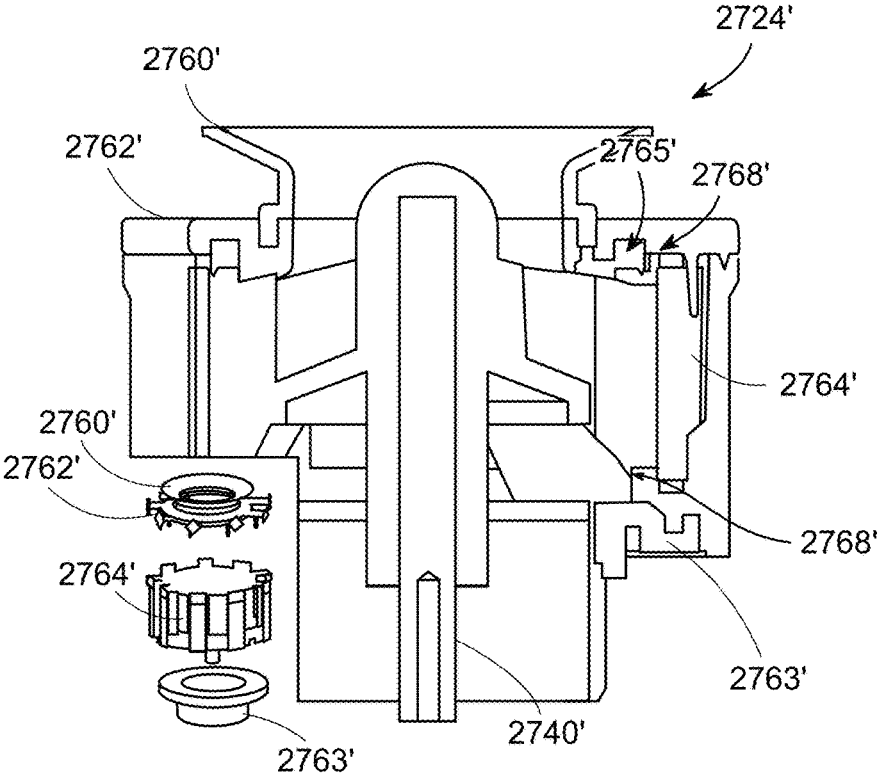
Figure 63K:
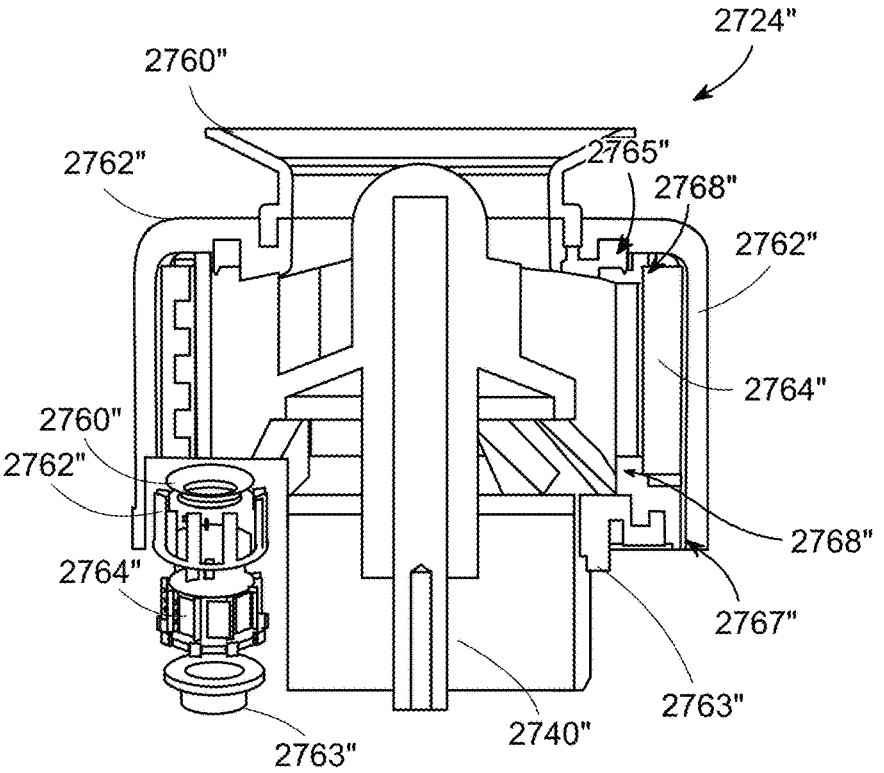

The duckbill valve 2750 of FIGS. 63E and 63F is configured to be removed from the DWT 2702. The handheld surface cleaner 2700 includes a duckbill valve housing 2782 that is attached to the duckbill valve 2750. The duckbill valve 2750 and the duckbill valve housing 2782 define a duckbill valve assembly. The duckbill valve housing 2782 is configured to be removably coupled with the DWT 2702 with the duckbill valve 2750. The duckbill valve 2750 and the duckbill valve housing 2782 are shown attached to the DWT 2702 in FIGS. 63E, 63F, and 63AA. The duckbill valve 2750 and the duckbill valve housing 2782 are shown in FIGS. 63Y and 63Z removed from the DWT 2702.

The duckbill valve housing 2782 includes an inner passageway having an open distal end and an open proximal end. With the duckbill valve 2750 open, e.g., under a suction force provided by the suction motor 2728, the inner passageway of the duckbill valve housing 2782 is configured to allow debris and air to flow through the duckbill valve housing 2782 and the duckbill valve 2750 toward the separator 2724.

The duckbill valve housing 2782 includes a bayonet mechanism 2782*a* configured to engage a corresponding bayonet feature of the inlet hosing 2758. With the bayonet mechanism 2782*a* and the bayonet feature engaged, the duckbill valve housing 2782 and the duckbill valve 2750 are attached to the DWT 2702 via the inlet hosing 2758. The bayonet mechanism 2782*a* of the duckbill valve housing 2782 is configured to be disengaged from the bayonet feature of the inlet hosing 2758 to detach the duckbill valve housing 2782 from the inlet hosing 2758 to allow the duckbill valve housing 2782, and the duckbill valve 2750 attached to the duckbill valve housing 2782, to be removed from the DWT 2702.

The bayonet mechanism 2782*a* of the duckbill valve housing 2782 can be configured to be disengaged manually from the bayonet feature of the inlet hosing 2758 by a user holding and rotating the duckbill valve housing 2782 relative to the inlet hosing 2758. However, it may be difficult for some users to comfortably put their hand into the DWT 2702 to access the duckbill valve housing 2782 and/or a user may not want to put their hand in the DWT 2702.

The bayonet mechanism 2782*a* of the duckbill valve housing 2782 can be configured to be disengaged manually from the bayonet feature of the inlet hosing 2758 using a tool inserted into the DWT 2702 and into a proximal opening 2782*b* of the duckbill valve housing 2782. Using the tool does not necessarily require a user to put their hand into the DWT 2702.

FIG. 63AA shows one implementation of a tool 2784 configured to remove the duckbill valve 2750 from the DWT 2702 and to attach the duckbill valve 2750 to the DWT 2702. The tool 2784 is also configured to remove the duckbill valve housing 2782 with the duckbill valve 2750 and to attached the duckbill valve housing 2782 to the DWT 2702 with the duckbill valve 2750.

As in this illustrated implementation, the separator assembly 2722 can be removable from the DWT 2702 and can be configured as a lid that covers an open proximal end 2786 of the DWT 2702 through which debris is configured to exit the debris collection and storage cavity 2706. FIG. 63AA shows the DWT 2702 with the separator assembly 2722 removed from the DWT 2702.

In an exemplary implementation, the tool 2784 has a length that is greater than a distance between the open proximal end 2786 of the DWT 2702 and the duckbill valve housing 2782 with the duckbill valve housing 2782 attached to the DWT 2702, e.g., attached to the inlet hosing 2758. A user may thus hold a handle 2784*a* of the tool 2784 outside of the DWT 2702 to access the duckbill valve housing 2782, and thus access the duckbill valve 2780, without the user's hand being inside the DWT 2702.

With the separator assembly 2722 removed from the DWT 2702, the tool 2784 is configured to be inserted into the DWT 2702, e.g., into the debris collection and storage cavity 2706, through the DWT's open proximal end 2786 and engage the duckbill valve housing 2782. The engagement can be, as shown for example in FIG. 63AA, a distal end of the tool 2784 being inserted through the proximal opening 2782*b* of the duckbill valve housing 2782 to be positioned in the duckbill valve housing's 2782 inner passageway where the tool 2784 is configured to engage an inner surface of the duckbill valve housing 2782.

In an exemplary implementation, with the tool 2784 engaging the duckbill valve housing 2782, the tool 2784 is configured to be rotated relative to the inlet hosing 2758. The rotation of the tool 2784 is configured to rotate the duckbill valve housing 2782 and thus the duckbill valve 2750 attached to the duckbill valve housing 2782. The rotation of the duckbill valve housing 2782 relative to the inlet hosing 2758 is configured to cause the bayonet mechanism 2782*a* of the duckbill valve housing 2782 to become disengaged from the bayonet feature of the inlet hosing 2758. Thereafter, the tool 2784 is configured to be removed from the DWT 2702. The removal of the tool 2784 can be configured to also remove the duckbill valve housing 2782 and the duckbill valve 2750, or the duckbill valve housing 2782 and the duckbill valve 2750, rotated out of engagement with the inlet hosing's bayonet feature, can be manually removed from the DWT 2702 such as by pouring the duckbill valve housing 2782 and the duckbill valve 2750 out of the DWT's open proximal end 2786.

In another exemplary implementation, the duckbill valve housing 2782 includes at least one distal-facing shoulder in the inner passageway of the duckbill valve housing 2782. The distal end of the tool 2784 is configured to be inserted through the proximal opening 2782*b* of the duckbill valve housing 2782 in a first rotational orientation and to then be rotated relative to the duckbill valve housing 2782, e.g., rotated about a longitudinal axis of the tool 2784, to be in a second rotational orientation that is different from the first rotational orientation. For example, the first and second rotational orientations can be about 90 degrees apart. For another example, the first and second rotational orientations can be in a range of about 45 degrees to about 135 degrees. For yet another example, the first and second rotational orientations can be in a range of about 80 degrees to about 100 degrees. For still another example, the first and second rotational orientations can be in a range of about 85 degrees to about 95 degrees. With the tool 2784 in the first configuration and inserted through the proximal opening 2782*b* of the duckbill valve housing 2782, the tool 2784 is misaligned from the at least one distal-facing shoulder of the duckbill valve housing 2782. The rotation of the tool 2784 from the first rotational orientation to the second rotational orientation is configured to cause the tool 2784 to align with the at least one distal-facing shoulder. With the tool 2784 in the second configuration, the tool 2784 is configured to be pulled proximally to pull the duckbill valve housing 2782, and thus the duckbill valve 2750 attached to the duckbill valve housing 2782, out of the DWT 2702 due. The duckbill valve housing 2782 proximal pulling of the tool 2784 is configured to cause the tool 2784 to abut the at least one distal-facing shoulder if not already abutting the at least one distal-facing shoulder when rotated to the second rotational orientation.

The tool 2784 is configured to reattach the duckbill valve housing 2782 and the duckbill valve 2750 to the DWT 2702 in a similar manner as discussed above but in reverse order. Instead of the same duckbill valve 2750 that was removed from the DWT 2702 being reattached to the DWT 2702, a different, e.g., new, duckbill valve can be attached to the DWT 2702 either with the same duckbill valve housing 2782 that was removed from the DWT 2702 or with, a different, e.g., new, duckbill valve housing. In an exemplary implementation, a new duckbill valve and a new duckbill valve housing are attached to the DWT 2702, which may improve user experience by not requiring a user to detach a duckbill valve from a valve housing or to attach a duckbill valve to a duckbill valve housing.

As in this illustrated implementation, the cap 2708 can be configured to be opened manually by a user to allow debris to exit the debris collection and storage cavity 2706 of the DWT 2702 without releasing the DWT 2702 from the main body 2704. The cap 2708 can have a variety of configurations. As in this illustrated implementation, as shown in FIG. 63BB, the cap 2708 can include a body 2708*a*, a hook 2708*b*, a plug 2708*c*, and a pivot member 2708*d*. The cap body 2708*a* can have any of a variety of shapes.

The cap hook 2708*a* extends from an inner surface 2708*e* of the body 2708*a*. The cap hook 2708*a* is configured to engage a corresponding hook 2702*a* of the DWT 2702, e.g., of the DWT housing 2772, to lock the cap 2708 in a closed position. FIG. 63F shows the hooks 2708*a*, 2704*a* of the cap 2708 and the DWT 2702 engaged with one another. The handheld surface cleaner 2700 includes corresponding single hooks 2708*a*, 2704*a* in this illustrated implementation, but another number of hooks can be used, e.g., corresponding pairs of hooks, etc.

In other implementations, the DWT 2702 can include a groove configured to engage the cap hook 2708*a*, or the cap 2708 can include the groove and the DWT 2702 can include the hook. Using engaging hooks 2708*a*, 2704*a* may help prevent accidental leakage of debris out of the debris collection and storage cavity 2706 through a groove formed in the DWT 2702 or the cap 2708 in the event that the cap 2708 is not fully engaged with the DWT 2702.

The cap plug 2708*c* extends from the inner surface 2708*e* of the body 2708*a*. The cap plug 2708*c* is configured to plug a corresponding hole 2702*b* formed through a wall of the DWT 2702, e.g., of the DWT housing 2772, and, if present, through the DWT lower cover 2710. The hole 2702*b* and the cap plug 2708*c* have corresponding circular shapes in this illustrated implementation, but other shapes are possible, e.g., ovular, rectangular, etc. The hole 2702*b* is in communication with the debris collection and storage cavity 2706. With the cap plug 280*c* seated in the hole 2702*b*, the cap 2708 seals the hole 2702*b* to prevent debris from exiting the debris collection and storage cavity 2706 through the hole 2702*b* and to prevent debris from entering the debris collection and storage cavity 2706 through the hole 2702*b*.

The cap's pivot member 2708*d* is configured to engage a corresponding pivot member of the DWT 2702, e.g., of the DWT housing 2772. With the pivot members engaged, the cap 2708 is configured to pivot at the cap's pivot member 2708*d* to move the cap 2708 between its open position, in which the hole 2702*b* is not plugged closed, and closed position, in which the hole 2702*b* is plugged closed.

In this illustrated implementation, the cap's pivot member 2708*d* is fixedly attached to the DWT's pivot member. The cap 2708 is thus non-removable from the DWT 2702, which may help prevent loss of the cap 2708.

In other implementations, the cap 2708 can be removably attached to the DWT 2702. The cap 2708 being removably attached to the DWT 2702 may facilitate replacement of the cap 2708 should be cap 2708 be damaged, e.g., the cap plug 2708*c* becoming worn due to repeated opening and closing of the cap 2708, the cap plug 2708*c* being damaged by rubbing against a surface during use of the handheld surface cleaner 2700, the handheld surface cleaner 2700 being dropped accidentally, etc. For example, instead of having fixedly attached corresponding pivot members, the cap 2708 and the DWT 2702 can include releasably attached corresponding pivot members, the cap 2708 and the DWT 2702.

In an exemplary implementation, the cap 2708 can include at least one C-shaped clip, and the DWT 2702 can include at least one pin configured to be releasably engaged by the at least one C-shaped clip. With the at least one C-shaped clip clipped to the at least one pin, the cap 2708 is configured to rotate open and closed. To remove the cap 2708 from the DWT 2702, the cap 2708 can be rotated beyond a threshold amount to cause the C-shaped clips to pop off the pin. The cap 2708, or a different, e.g., new, cap can be then reattached to the DWT 2702. The at least one C-shaped clip can be rubber or other flexible material to facilitate release of the at least one C-shaped clip from the at least one pin.

In another exemplary implementation, the cap 2708 can include at least one magnet, and the DWT 2702 can include at least one magnet configured to magnetically engage the cap's at least one magnet. With the cap's at least one magnet magnetically engaged with the DWT's at least one magnet, the cap 2708 is configured to be selectively removed from the DWT 2702 by moving the cap 2708 to break the magnetic bond. The cap 2708, or a different, e.g., new, cap can be then reattached to the DWT 2702.

As discussed herein, the DWT 2702 and the main body 2704 are releasably attachable. As in this illustrated implementation, the DWT 2702 can be configured to be released completely from the main body 2704. The releasable attachment can be achieved in any of a variety of ways.

The DWT 2702 can be configured to be attached to the main body 2704 using rotational motion only, translational motion (also referred to herein as "longitudinal motion") only, or a selected one or both of rotational motion and translational motion. Achieving releasable attachment using only one of rotational motion and translation motion may ease user experience since attachment may be achieved using a single known movement. Achieving releasable attachment using rotational motion and/or translation motion may improve user experience by allowing the user to attach the DWT 2702 and the main body 2704 together using motion(s) most comfortable for the user and/or without the user becoming frustrated at a lack of attachment when a wrong of one of rotational motion and translation motion is used. In this illustrated implementation, as discussed further below, the DWT 2702 is configured to be attached to the main body 2704 using rotational motion and/or translational motion.

The DWT 2702 and the main body 2704 include corresponding attachment mechanisms configured to engage one another to releasably attach the DWT 2702 and the main body 2704. The attachment mechanisms can have a variety of configurations. In general, the corresponding attachment mechanisms are configured to allow the DWT 2702 and the main body 2704 to be attached together using a selected one or more of rotational motion and translational motion.

As in this illustrated implementation, as shown in FIGS. 63G-63J, the attachment mechanism of the DWT 2702 includes at least one opening 2788 and at least one bar 2790, and the attachment mechanism of the main body 2704 includes at least one hook 2792. The at least one hook 2792 is configured to be seated in the at least one opening 2788 to attach the DWT 2702 and the main body 2704.

In this illustrated implementation, two openings 2788 and two hooks 2792 are used, but another corresponding number of openings 2788 and hooks 2792 can be used, e.g., one, three, etc. In other implementations, the DWT's attachment mechanism can include at least one hook and the main body's attachment mechanism can include at least one opening and at least one pivot bar. In this illustrated implementation, one bar 2790 is used, but another number can be used, such as one bar for each of the hooks.

The at least one hook 2792 is biased radially outward by at least one bias element 2794. The radial outward direction is downward in the views of FIGS. 63D and 63V. As shown in FIG. 63CC, the handheld surface cleaner 2700 in this illustrated implementation includes a pair of bias elements 2794, one per hook 2792, although another number of bias elements can be used. The at least one bias element 2794 includes a spring belt in this illustrated implementation but another type of bias element can be used.

In some implementations, the at least one bias element 2794 is omitted and the hook 2792 is not configured to be urged into engagement and is configured to remain disengaged. For example, the handheld surface cleaner 2700 can include a bump detent configured to keep the hook 2792 out of engagement until the hook 2792 is manually pressed over the bump detent.

The DWT 2702 and the main body 2704 are configured to be attached using longitudinal motion along the first longitudinal axis A4 (see FIG. 63E). One of the DWT 2702 and the main body 2704 can be stationary while the other of the DWT 2702 and the main body 2704 is moved longitudinally toward the one of the DWT 2702 and the main body 2704, or both of the DWT 2702 and the main body 2704 can be moved longitudinally toward each other. When the DWT 2702 and the main body 2704 become sufficiently close, an exterior chamfered surface 2792*b* of the at least one hook 2792 is configured to slide along the at least one bar 2790, which causes the bias element force to be overcome and the at least one hook 2792 to pivot radially inward, e.g., upwardly, about a pivot axis P defined by a pivot pin 2796. When the at least one hook 2792 has pivoted radially inward a sufficient amount, a tip 2792*b* of the at least one hook 2792 is configured to clear the at least one bar 2790 to cause the at least one hook 2792 to be seated in the at least one opening 2988 by the at least one hook 2792 pivoting radially outward, e.g., downwardly, due to the biasing element force applied to the at least one hook 2792. The main body 2704 and the DWT 2702 abut one another with the main body 2704 positioned over the DWT's open proximal end 2786.

The DWT 2702 and the main body 2704 are also configured to be attached using rotational motion. The at least one hook 2792 is configured to be seated in the at least one opening 2988 with the main body 2704 angled relative to the DWT 2702, e.g., with a longitudinal axis of the main body 2704 angled relative to a longitudinal axis of the DWT 2702 that is substantially parallel to the first longitudinal axis A4. With the at least one hook 2792 seated in the at least one opening 2988, the main body 2704 is configured to be rotated in a counterclockwise direction C1 (see FIG. 63D) relative to the DWT 2702. Alternatively, the DWT 2702 can be rotated in a clockwise direction relative to the main body 2704, or the main body 2704 can be rotated in the counterclockwise direction C1 simultaneously with the DWT 2702 being rotated in the clockwise direction. Once the DWT 2702 and/or the main body 2704 has rotated a sufficient amount, the main body 2704 and the DWT 2702 abut one another with the main body 2704 positioned over the DWT's open proximal end 2786.

The DWT 2702 and the main body 2704 are configured to be detached using rotational motion in a similar manner as discussed above but in reverse order.

In this illustrated implementation, the handheld surface cleaner 2700 includes a lock configured to help secure the DWT 2702 to the main body 2704. The lock in this illustrated implementation is the latch 2712. The latch 2712 can have a variety of configurations. As shown in FIG. 63S, the latch 2712 in this illustrated implementation includes a body 2712*a*, at least one pivot pin 2712*b*, and a finger 2712*c*.

The finger 2712*c* extends radially inward, e.g., downwardly in the view of FIGS. 63D and 63V, from an inner surface 2712*d* of the body 2712*a*. The finger 2712*c* has a rectangular shape in this illustrated implementation, but other shapes are possible. The finger 2712*c* is configured to engage the microswitch 2714, as discussed further below. The latch 2712 includes a single finger 2712*c* in this illustrated implementation to correspond to the handheld surface cleaner 2700 include a single microswitch 2714.

The at least one pivot pin 2712*b* is configured to be seated in a corresponding at least one groove 2713 formed in the DWT 2702, e.g., the DWT housing 2772. The latch 2712 is configured to pivot about the at least one pivot pin 2712*b* relative to the DWT 2702, e.g., the DWT housing 2772, and, with the DWT 2702 attached to the main body 2704, relative to the main body 2704. The latch 2712 includes a pair of opposed pivot pins 2712*b* and the DWT 2702 includes a corresponding pair of grooves 2713 in this illustrated implementation, but another number of pivot pins and grooves is possible.

The latch 2712 is attached to the DWT 2702, e.g., the DWT housing 2772. As in this illustrated implementation, the latch 2712 can be pivotally attached to the DWT 2702, e.g., the DWT housing 2772.

The handheld surface cleaner 2700 includes a bias element 2715 (see FIG. 63T) attached to the DWT 2702, e.g., the DWT housing 2772, and to the latch 2712. The latch 2712 is thus attached to the DWT 2702, e.g., the DWT housing 2772, by the bias element 2715 in this illustrated implementation. The bias element 2715 is configured to bias the latch 2712 downwardly, e.g., toward the microswitch 2714 with the DWT 2702 attached to the main body 2704. The bias element 2715 includes a single coil spring in this illustrated implementation but another number of bias elements is possible and another type of bias element is possible.

The latch 2712 is configured to move between a locked configuration, in which the latch 2712 prevents the DWT 2702 and the main body 2704 from being detached, and an unlocked configuration, in which the latch 2712 allows the DWT 2702 and the main body 2704 to be detached. FIGS. 63A, 63B, 63E, 63F, 63G, 63H, and 63AA show the latch 2712 in the locked configuration.

The latch 2712 includes a stop surface 2712*e* that faces proximally, e.g., away from the main body 2704 with the DWT 2702 and the main body 2704 being attached together. The latch's stop surface 2712*e* includes a pair of opposed stop surfaces on either side of the finger 2712*c* in this illustrated implementation, but another number and/or position of stop surfaces is possible. The latch's stop surface 2712*e* is configured to abut a corresponding stop surface 2798*a* of the main body 2704 with the DWT 2702 and the main body 2704 being attached together. The main body's stop surface 2798*a* faces distally, e.g., away from the DWT 2702 with the DWT 2702 and the main body 2704 being attached together. The main body's stop surface 2798*a* includes a pair of opposed stop surfaces on either side of the microswitch 2714 in this illustrated implementation, but another number and/or position of stop surfaces is possible. The main body's stop surface 2798*a* is defined by a microswitch housing 2798 of the main body 2704, which is discussed further below.

With the latch 2712 in the locked configuration, the main body's stop surface 2798*a* abuts the latch's stop surface 2712*e* to prevent detachment of the DWT 2702 and the main body 2704.

The latch 2712 is configured to move automatically to the locked configuration in response to the DWT 2702 and the main body 2704 being attached together, whether the attachment is via longitudinal motion or rotational motion. A user thus does not have to take a separate action to lock the DWT 2702 and the main body 2704 together. The biasing of the latch 2712 by the bias element 2715 is configured to allow for the automatic movement of the latch 2712 to the locked configuration.

The latch 2712 is configured to be moved manually from the locked configuration to the unlocked configuration. The DWT 2702 and the main body 2704 may thus remain locked together until a user chooses to separate the DWT 2702 and the main body 2704. The latch 2712, e.g., an outer surface 2712*f* of the body 2712*a* (see FIG. 63F), is configured to be pushed by a user over the bias element 2715 to move the latch 2712 from the locked configuration to the unlocked configuration. The pushing of the latch 2712 is configured to cause the latch 2712 to pivot the latch 2712 upwardly, e.g., in a direction away from the microswitch 2714.

The handheld surface cleaner 2700 is configured to automatically detect whether the DWT 2702 is releasably coupled to the main body 2704. Similar to that discussed above regarding the microswitch 40 of the handheld surface cleaner 10 of FIG. 1, the activation of the microswitch 2714 of the handheld surface cleaner 2700 of FIG. 63A indicates that the DWT 2702 is releasably coupled to the main body 2704. Correspondingly, the microswitch 2714 not being activated indicates that the DWT 2702 is not releasably coupled to the main body 2704.

With the latch 2712 in the locked position, the latch 2712, e.g., the finger 2712*c* of the latch 2712, is configured to push the microswitch 2714 to activate the microswitch 2714. With the latch 2712 in the unlocked configuration, the microswitch 2714 is configured to not be activated, e.g., the finger 2712*c* of the latch 2712 does not push the microswitch 2714.

As shown in FIG. 63T, the microswitch 2714 is located in a recessed area 2798*b* of the microswitch housing 2798. The finger 2712*c* of the latch 2712 has a size and shape configured to fit in the recessed area 2798*b* of the microswitch housing 2798.

The recessed area 2798*b* has a width 2798*c* that is large enough to allow the finger 2712*c* of the latch 2712 to enter the recessed area 2798*a* and push the microswitch 2714. The width 2708*c* of the recessed area 2798*b* is too small for a finger of a user to enter the recessed area 2798*a* to prevent pushing of the microswitch 2714 by a user, such as when the user is holding the main body 2704 without the main body 2704 being attached to the DWT 2702. The microswitch housing 2798 is thus configured to help prevent accidental activation of the microswitch 2714 and falsely indicate that the DWT 2702 is attached to the main body 2704. In an exemplary implementation, the width 2708*c* of the recessed area 2798*b* is in a range of about 1 mm to about 10 mm, e.g., about 1 mm to about 5 mm, a range of about 1 mm to about 3 mm, a range of about 1 mm to about 2 mm, a range of about 2 mm to about 3 mm, a range of about 3 mm to about 4 mm, a range of about 2 mm to about 4 mm, a range of about 3 mm to about 5 mm, a range of about 4 mm to about 5 mm, a range of a range of about 4 mm to about 6 mm, a range of about 5 mm to about 6 mm, a range of about 5 mm to about 7 mm, a range of about 6 mm to about 7 mm, a range of about 6 mm to about 8 mm, a range of about 7 mm to about 8 mm, a range of about 7 mm to about 9 mm, a range of about 8 mm to about 9 mm, a range of about 8 mm to about 10 mm, a range of about 9 mm to about 10 mm, about 1 mm, about 2 mm, about 3 mm, about 4 mm, about 5 mm, about 6 mm, about 7 mm, about 8 mm, about 9 mm, about 10 mm, etc.

The width 2708*c* of the recessed area 2798*b* is large enough for a tool to enter the recessed area 2798*b* and push the microswitch 2714 without the DWT 2702 and the main body 2704 being attached, which may be desirable for, e.g., testing purposes. FIG. 63U illustrates one implementation of a tool 2799 configured to enter the recessed area 2798*b* and push the microswitch 2714.

Instead of or in addition to including the microswitch 2714, the handheld surface cleaner 2700 can include a switch in a circuit also including the separator motor 2718 and the power supply 2734. The finger 2712*c* or another protrusion of the DWT 2702 can be configured to push the switch, and thus activate the switch, similar to that discussed herein regarding the microswitch 2714. With the switch activated, the switch is closed and the circuit is closed, which allows the power supply 2734 to supply power to the separator motor 2718. With the switch deactivated, the switch is open and the circuit is open, which prevents the power supply 2734 from supplying power to the separator motor 2718. The switch can be located, for example, at the main body 2704 similar to a location described herein for the microswitch 2714.

The inlet 2736 at the distal end of the handheld surface cleaner 2700, e.g., the distal end of the DWT 2702, is configured to releasably couple to an attachment to help facilitate surface cleaning, such as any of the attachments 100, 200, 300, 310, 400 of FIGS. 19-23C and 25A-29C. As in this illustrated implementation, and as discussed further below, the handheld surface cleaner 2700 can be configured to prevent releasable coupling of an attachment to the inlet 2736 without the hair cage 2746 being coupled to the handheld surface cleaner 2700, e.g., to the DWT 2702.

A hair cage of a handheld surface cleaner can be a singular part or can include a plurality of parts. The hair cage 72 of FIG. 17 illustrates one implementation of a hair cage as a singular part. The hair cage 2746 of FIGS. 63P-63Q illustrates one implementation of a hair cage that includes a plurality of parts.

As shown in FIGS. 63P-63Q, the hair cage 2746 includes a first part 2746*a* and a second part 2746*b*. The first and second parts 2746*a*, 2746*b* of the hair cage 2746 are movably attached to one another, which may facilitate cleaning of the hair cage 2746, as discussed further below. The first and second parts 2746*a*, 2746*b* of the hair cage 2746 can be movably attached together in a variety of ways. As in this illustrated implementation, the first and second parts 2746*a*, 2746*b* of the hair cage 2746 can be hingedly attached together at a hinge 2746*c* on a bottom side of the hair cage 2746 that faces downwardly, although the first and second parts 2746*a*, 2746*b* can be attached elsewhere. The bottom of the hair cage 2746 is relative to an orientation of the hair cage 2746, with the downward direction being as shown in the views of FIGS. 63D, 63R, and 63V.

The hair cage 2746 includes a lock 2746*d* configured to lock the first and second parts 2746*a*, 2746*b* of the hair cage 2746 together. The lock 2746*d* is configured to move between a locked configuration, in which the hair cage 2746 is in a closed position and the lock 2746*d* prevents the first and second parts 2746*a*, 2746*b* from moving at the hinge 2746*c*, and an unlocked configuration, in which the hair cage 2746 is in an open position and the lock 2746*d* allows the first and second parts 2746*a*, 2746*b* to move at the hinge 2746*c*. With the hair cage 2746 in the open position, an interior of the hair cage 2746 is configured to help clean out debris because, in some instances, some debris may become dried to or otherwise stuck to the hair cage 2746.

The lock 2746*d* can have any of a variety of configurations. In this illustrated implementation, the lock 2746*d* includes a pair of interlocking lips. The hair cage's first part 2746*a* includes a first one of the interlocking lips, and the hair cage's second part 2746*b* includes a second one of the interlocking lips.

The hair cage lock 2746*d* is configured to be moved manually between the locked and unlocked configurations, which may allow the hair cage 2746*d* to remain locked while coupled to the handheld surface cleaner 2700, e.g., to the DWT 2702. As in this illustrated implementation, the hair cage 2746 can include a finger rest configured to facilitate manual handling of the hair cage 2746 for locking and unlocking. As in this illustrated implementation, the finger rest can include a first finger rest 2746*e* of the first part 2746*a* and a second finger rest 2746*f* of the second part 2746*b*. The first and second finger rests 2746*e*, 2746*f* are each configured to provide a surface on which a user can rest a finger to provide leverage for pushing the first and second parts 2746*a*, 2746*b* apart to move the hair cage 2746 from the locked configuration to the unlocked configuration or to push the first and second parts 2746*a*, 2746*b* together to move the hair cage 2746 from the unlocked configuration to the locked configuration.

A hair cage of a handheld surface cleaner can include a mesh filter. The mesh filter may help provide structural stability to the hair cage and/or may facilitate manufacturing of the part(s) of the hair cage. The hair cage 72 of FIG. 17 illustrates one implementation of a hair cage without a mesh filter. The hair cage 2746 of FIGS. 63P-63Q illustrates one implementation of a hair cage that includes a mesh filter 2746*g*. As in this illustrated implementation, the mesh filter 2746*g* can be located in an interior of the hair cage 2746.

As in this illustrated implementation, as shown in FIGS. 63P-63Q and 63DD, the hair cage 2746 can include a distal housing 2746*h*. The distal housing 2746*h* is configured to seat the inlet seal 2738, as shown in FIGS. 63R and 63DD. The distal housing 2746*h* includes a frame 2746*i* surrounding an opening in which the inlet seal 2738 is positioned. The distal housing 2746*h* includes an arm 2746*j* extending proximally from the frame 2746*i* of the distal housing 2746*h*.

As mentioned above, the hair cage 2746 can, as in this illustrated implementation, be configured to be removably coupled to the handheld surface cleaner 2700, e.g., to the DWT 2702. As also mentioned above, the handheld surface cleaner 2700 in this illustrated implementation is configured to prevent releasable coupling of an attachment to the inlet 2736 without the hair cage 2746 being coupled to the handheld surface cleaner 2700, e.g., to the DWT 2702.

As shown in FIG. 63DD, the handheld surface cleaner 2700, e.g., the DWT 2702, includes a lockout housing 2747 configured to releasably seat the arm 2746*j* of the hair cage 2746. FIG. 63DD shows the arm 2746*j* seated in the locking housing 2747.

A lockout member 2749 is movably attached to the lockout housing 2747. The movable attachment is a hinged attachment in this illustrated implementation, but other attachments are possible. The lockout member 2749 can have a variety of configurations. As in this illustrated implementation, the lockout member 2749 can include a plate although other configurations are possible, such as a button or other member.

The lockout member 2749 is configured to move between a retracted configuration, in which the arm 2746*j* is seated in the lockout housing 2747, the lockout member 2749 allows distal housing 2745 to be attached to the handheld surface cleaner 2700, and the lockout member 2749 allows an attachment to be attached to the handheld surface cleaner 2700, and an extended configuration, in which the arm 2746*j* is not seated in the lockout housing 2747, the lockout member 2749 prevent the distal housing 2745 from being attached to the handheld surface cleaner 2700 and the lockout member 2749 prevent an attachment from being attached to the handheld surface cleaner 2700. FIG. 63DD shows the lockout member 2749 in the retracted configuration. FIGS. 63EE and 63FF show the distal housing 2745 as a standalone element.

The handheld surface cleaner 2700 includes a bias element 2751 is configured to bias the lockout member 2749 to the extended configuration. The bias element 2751 is a coil spring in this illustrated implementation, but other types of bias elements may be used.

The hair cage 2746 is configured to be pushed into the DWT 2702 in a proximal direction without the distal housing 2745 attached to the handheld surface cleaner 2700 and without an attachment attached to the handheld surface cleaner 2700. The arm 2746*j* is configured to move proximally into the locking housing 2747 during the proximal movement of the hair cage 2746. The arm's movement into the locking housing 2747 is configured to cause the lockout member 2749 to move from the extended configuration to the retracted configuration by pivoting in response to the arm 2746*j* pushing on the lockout member 2749.

With the hair cage 2746 attached to the DWT 2702, the distal housing 2745 is configured to be attached to the DWT 2702 by being pushed proximally onto the DWT 2702. The handheld surface cleaner 2700 includes a distal housing lock 2753 configured to move from an unlocked configuration, in which the distal housing 2745 is not locked to the handheld surface cleaner 2700, e.g., the DWT 2702, and a locked configuration, in which the distal housing 2745 is locked to the handheld surface cleaner 2700, e.g., the DWT 2702. The distal housing lock 2753 is configured to move automatically from the unlocked configuration to the locked configuration in response to the distal housing 2745 being coupled to the handheld surface cleaner 2700, e.g., the DWT 2702, which may improve user experience by helping to ensure that the distal housing 2753 is locked to the handheld surface cleaner 2700. The distal housing lock 2753 is configured to be manually actuated by a user to move the distal housing lock 2753 from the locked configuration to the unlocked configuration, which may help ensure that the distal housing 2753 remains attached to the handheld surface cleaner 2700 unless desired to be removed by a user, e.g., to gain access to the hair cage 2746 to remove the hair cage 2746 for cleaning or replacement.

The distal housing lock 2753 can have a variety of configurations. As in this illustrated implementation, the distal housing lock 2753 can include at least one hook 2753*a* configured to engage, e.g., clip into, at least one groove 2745*b* formed in the distal housing 2745. The distal housing lock 2753 includes a pair of opposed hooks 2753*a* in this illustrated implementation that are configured to engage a corresponding pair of grooves of the distal housing 2745, but another number and/or positioning of the at least one hook 2753*a* and the at least one groove is possible. FIGS. 63A and 63B show the at least hook 2753*a* engaged with the at least one groove formed in the distal housing 2745. The at least one hook 2753*a* is configured to move automatically into the at least one groove of the distal housing 2745 in response to the distal housing 2745 being attached to the handheld surface cleaner 2700, e.g., the DWT 2702.

The distal housing lock 2753 includes at least one bias element 2753*b* configured to bias the distal housing lock 2753, and thus the at least one hook 2753*a* downwardly. The at least one hook 2753*a* will thus be urged into engagement with the distal housing 2745. The downward direction is relative to an orientation of the distal housing lock 2753 and is as shown in the views of FIGS. 63D, 63R, and 63V. The at least one bias element 2753*a* includes a single coil spring in this illustrated implementation, but the at least one bias element 2753*a* can include a different number and/or different type of bias element.

With the hair cage 2746 attached to the DWT 2702, the lockout member 2749 is in the retracted configuration and does not impede the proximal movement of the distal housing 2745 into position to engage the distal housing lock 2753. A shoulder 2745*a* of the distal housing 2745 is spaced a distance away from the lockout member 2749.

Without the hair cage 2746 attached to the DWT 2702, and thus with the lockout member 2749 in the extended configuration, the lockout member 2749 is configured to abut the shoulder 2745*a* of the distal housing 2745 as the distal housing 2745 is being attempted to be attached to the handheld surface cleaner 2700. The abutting of the lockout member 2749 and the distal housing 2745, e.g., the shoulder 2745*a*, is configured to stop proximal movement of the distal housing 2745 and thus prevent attachment of the distal housing 2745 to the DWT 2702.

With the distal housing 2745 attached to the DWT 2702, an attachment is configured to be attached to the handheld surface cleaner 2700. Correspondingly, without the distal housing 2745 attached to the DWT 2702, an attachment cannot be attached to the handheld surface cleaner 2700. Thus, the distal housing 2745 being configured to be locked out from attachment to the handheld surface cleaner 2700, e.g., the DWT 2702, unless the hair cage 2746 is attached to the handheld surface cleaner 2700, e.g., the DWT 2702, is configured to prevent attachment of an attachment to the handheld surface cleaner 2700, e.g., the DWT 2702, unless the hair cage 2746 is attached to the handheld surface cleaner 2700. Debris larger than a certain size that would otherwise be trapped by the hair cage 2746 and prevented from flowing through the hair cage 2746 to the separator 2724 may thus be ensured of being trapped by the hair cage 2746 instead of flowing to the separator 2724, where the larger-size debris may risk damage to and/or jamming of the separator 2724.

A handheld surface cleaner can be configured to be removably attached to an attachment in a variety of ways. For example, in some implementations, the attachment can be configured to slide onto the handheld surface cleaner, e.g., by a rail and a cooperating track. For another example, in some implementations, the attachment can be configured to snap onto the handheld surface cleaner, e.g., by a hook and a cooperating groove or opening.

As shown in FIG. 63FF, the distal housing 2745 in this illustrated implementation includes at least one hook 2745*c*. The at least one hook 2745*c* is configured to releasably engage an attachment, e.g., be releasably seated in at least one groove or opening in the attachment, to attach the attachment to the distal housing 2745 and thus to the handheld surface cleaner 2700 to which the distal housing 2745 is attached. The at least one hook 2745*c* includes a pair of opposed hooks 2745*c* in this illustrated implementation, but another number of hooks 2745*c* is possible. FIG. 20 illustrates one implementation of at least one opening 100*a* of an attachment 100 configured to be engaged by the at least one hooks 2745 (only one of the pair of openings 100*a* is visible in the view of FIG. 20). FIGS. 23A and 23C illustrate another implementation of at least one opening 200*b* of an attachment 200 configured to be engaged by the hooks 2745*c* (only one of the pair of openings 200*a* is visible in the views of FIGS. 23A and 23C).

In another implementation, the distal housing includes the at least one groove, and the attachment includes the at least one hook.

As mentioned above, the handheld surface cleaner 2700 in this illustrated implementation includes a charging port 2756. As shown in FIGS. 63C, 63E, and 63J, the charging port 2756 in this illustrated implementation includes a magnetic port configured to magnetically mate with a corresponding charging contact of a charger, e.g., a charger 3100 of FIGS. 68A and 68B (discussed further below) or another charger.

FIGS. 63GG and 63HH illustrate another implementation of the main body 2704 of FIG. 63A as a main body 2704' that includes a different type of charging port 2756'. The charging port 2756' in this illustrated implementation includes a DC jack configured to be plugged into by a DC charger cord, e.g., a DC charger cord 2757 of FIG. 63II or other charger cord.

FIG. 63JJ illustrates another implementation of the separator 2724, the shaft 2740, the centrifugal seal 2760, the rim 2762, the base 2763, the plurality of movable covers 2764 of FIGS. 63M and 63N as a separator 2724', a centrifugal seal 2760', a rim 2762', a base 2763', and a plurality of movable covers 2764' respectively. In this illustrated implementation, a seal 2765' is provided between the rim 2762' and a body 2768' of the separator 2724', and the separator body 2768' and the rim 2762' are welded together.

FIG. 63KK illustrates another implementation of the separator 2724, the shaft 2740, the centrifugal seal 2760, the rim 2762, the base 2763, the plurality of movable covers 2764 of FIGS. 63M and 63N as a separator 2724", a centrifugal seal 2760", a rim 2762", a base 2763", and a plurality of movable covers 2764" respectively. In this illustrated implementation, a seal 2765" is provided between the rim 2762" and a body 2768" of the separator 2724", the rim 2762" has a plurality of arms that extend proximally to a circumferential ring base of the rim 2762" and are located outside of the separator body 2768", and the separator body 2768" includes at least one hook 2767" configured to attach to the rim 2762" to attach the rim 2762" and the separator body 2768" together. The rim's arms extend along an entire length of the rim 2762" in this illustrated implementation but can instead extend along only a partial length of the rim 2762" in a proximal direction. In such an implementation, the circumferential ring base of the rim 2762" is omitted.

A handheld surface cleaner (e.g., any of the handheld surface cleaners described herein) can be configured to be seated in a tray (also referred to herein as a "dock"). The tray is configured to provide convenient storage of the handheld surface cleaner. In some implementations, the handheld surface cleaner is configured to be recharged while seated in the tray, and/or the tray is also configured to seat one or more accessories configured for use with the handheld surface cleaner. Examples of the accessories include attachments and spray bottles.

A tray can have any of a variety of configurations. In general, the tray has a size and shape configured to complement a size and shape of the handheld surface cleaner and, if configured to seat one or more accessories, to complement a size and shape of each of the one or more accessories.

Figure 64:
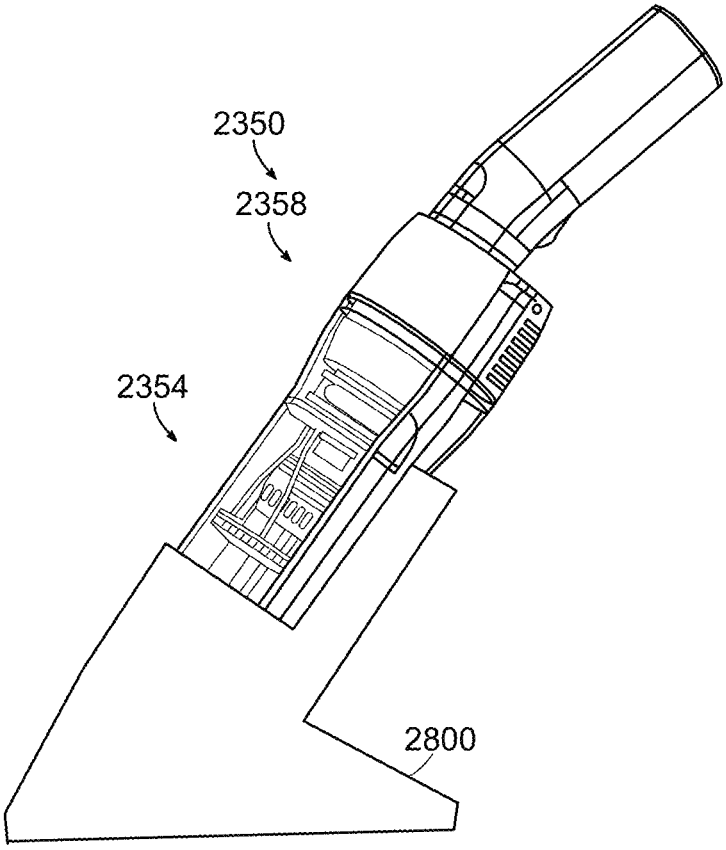
FIG. 64 is a side schematic view of one implementation of a dock and a side view of the handheld vacuum cleaner of FIG. 57B seated in the dock.

FIG. 64 illustrates schematically one implementation of a dock 2800 configured to seat a handheld surface cleaner. FIG. 64 shows the handheld vacuum cleaner 2350 of FIG. 57B disposed within the dock 2800 although seating of another handheld surface cleaner is possible.

The dock 2800 in this illustrated implementation is configured as a charging dock configured to recharge one or more batteries of the handheld vacuum cleaner 2350 with the handheld vacuum cleaner 2350 seated in the dock 2800. In some instances, as in this illustrated implementation, one or more of the separation assembly 2354 and/or the main body 2358 include charging contacts for recharging the one or more batteries. When the separation assembly 2354 includes charging contacts, the separation assembly 2354 included wiring and electrical connectors for electrically coupling the charging contacts to the one or more batteries. The electrical connectors are configured to electrically couple to corresponding electrical connectors on the main body 2358.

In some instances, and as shown in this illustrated implementation, the dock 2800 covers at least a portion of the separation assembly 2354 (e.g., a dirty water tank) of the handheld vacuum cleaner 2350.

The dock 2800 is configured to provide one or more maintenance functions to the handheld vacuum cleaner 2350. For example, the dock 2800 can be configured to encourage a drying of one or more components of the handheld vacuum cleaner 2350 and/or to empty debris from the separation assembly 2354.

In the example of drying, a self-drying cycle can be configured to run to dry one or more components of the handheld vacuum cleaner 2350 by running the suction motor 2302 for a predetermined amount of time (e.g., ten seconds, thirty seconds, sixty seconds, ninety seconds, etc.) to draw air through the handheld vacuum cleaner 2350. Some components, such as filter foam, may be more likely to not be dry than other components when suction stops in a cleaning operation. In an exemplary implementation, with the handheld vacuum cleaner 2350 docked a user can push a button (e.g., on the handheld vacuum cleaner 2350 or on the dock 2800) to start the self-drying cycle. In some implementations, the self-drying cycle is locked out unless the handheld vacuum cleaner 2350, e.g., a charging port of the cleaner 2350, is coupled to a charger, e.g., the DC charger cord 2757 of FIG. 63HH, the charger 3100 of FIGS. 67A and 66B, or other charger, which may help ensure that the suction motor 2302 receives sufficient power to run for the predetermined amount of time.

Figure 65A:
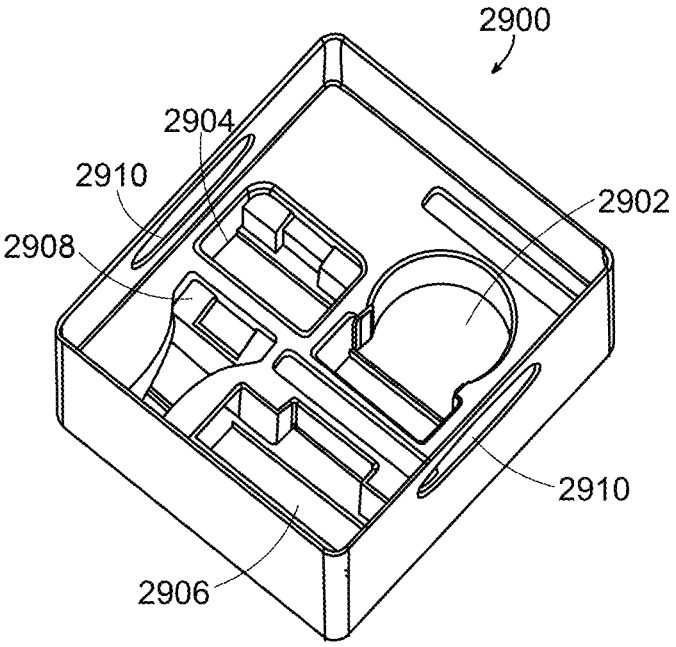
FIG. 65A is a perspective view of one implementation of a tray.
Figure 65B:
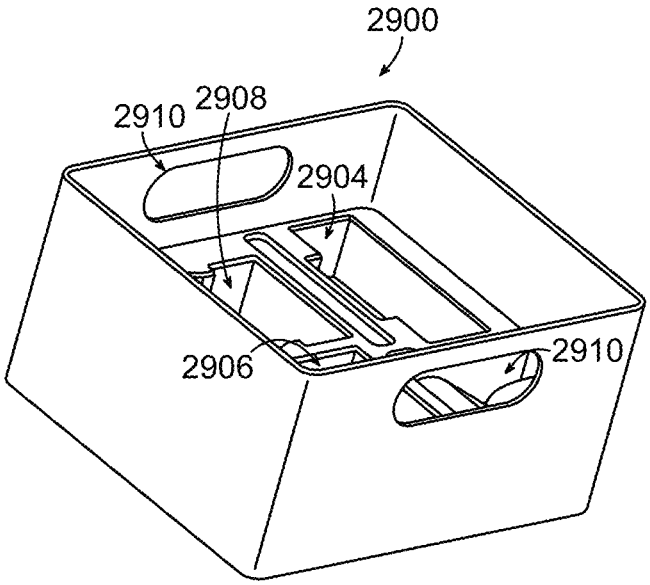
FIG. 65B is another perspective view of the tray of FIG. 65A.

FIGS. 65A and 65B illustrate another implementation of a tray 2900 configured to seat a handheld surface cleaner. In particular, the illustrated tray 2900 of FIGS. 65A and 65B is configured to seat the handheld surface cleaner 10 of FIG. 1 and the attachments 100, 200, 400 of FIGS. 19-23C and 29A-29C although seating of another handheld surface cleaner and/or other attachment(s) is possible. The tray 2900 includes first, second, third, and fourth docking areas to seat the handheld surface cleaner 10 and the attachments 100, 200, 400, respectively. In this illustrated implementation the docking areas include first, second, third, and fourth cavities 2902, 2904, 2906, 2908 configured to seat the handheld surface cleaner 10 and the attachments 100, 200, 400, respectively. The docking areas 2902, 2904, 2906, 2908 may help keep the handheld surface cleaner 10 and the attachments 100, 200, 400 organized in the tray 2900 and/or may help a user easily identify which one or more of the handheld surface cleaner 10 and the attachments 100, 200, 400 are not stored in the tray 2900. In some implementations, the tray 2900 can also include a cavity configured to store a spray bottle.

The tray 2900 in this illustrated implementation is configured as a caddy to facilitate carrying together all of the handheld surface cleaner 10 of FIG. 1 and the attachments 100, 200, 400 of FIGS. 19-23C and 29A-29C seated in the tray 2900. The tray 2900 includes one or more handles 2910 to help a user hold the tray 2900. The tray 2900 includes a pair of opposed cut-outs as the one or more handles 2910 in this illustrated implementation but can have other configurations, such as opposed hand grips attached to an exterior of the tray 2900, a single arced handle attached to the tray 2900 similar to a bucket handle or picnic basket handle, or other configuration.

Figure 66A:
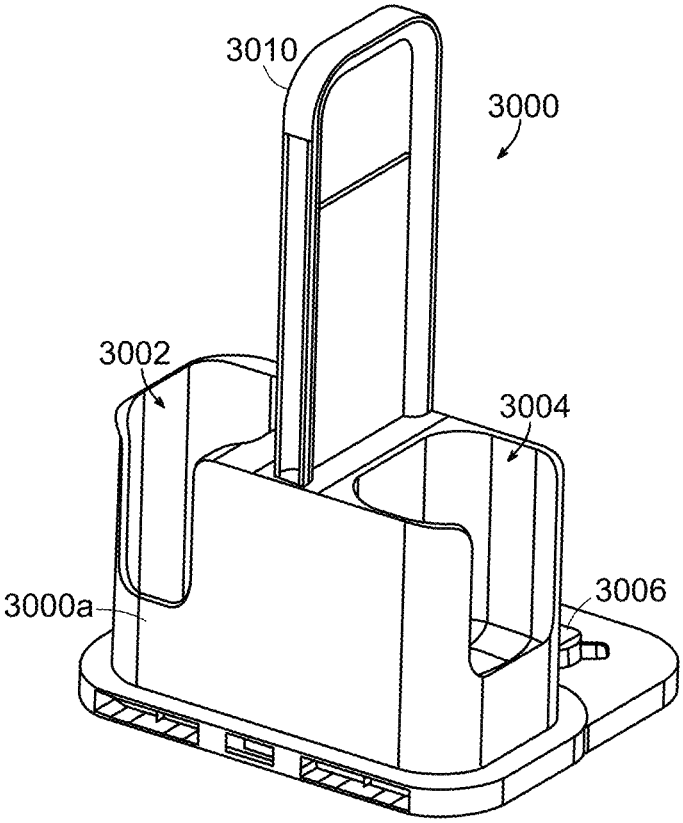
Figure 66B:
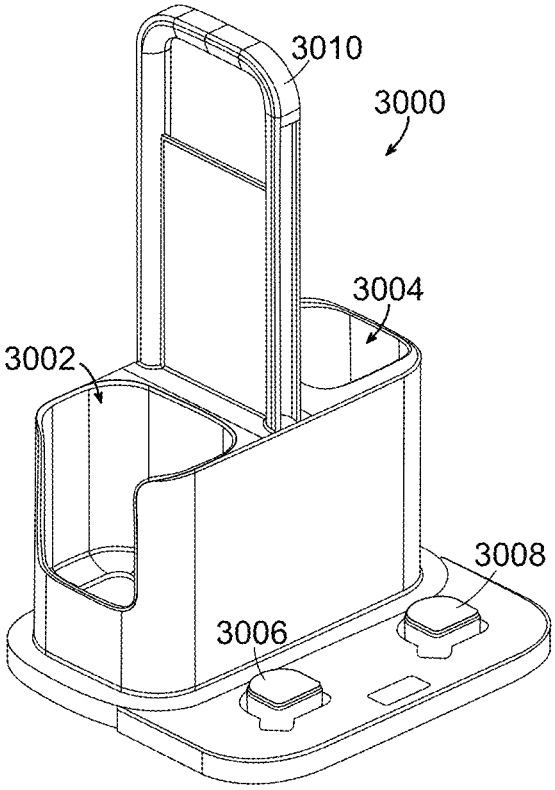
Figure 66C:
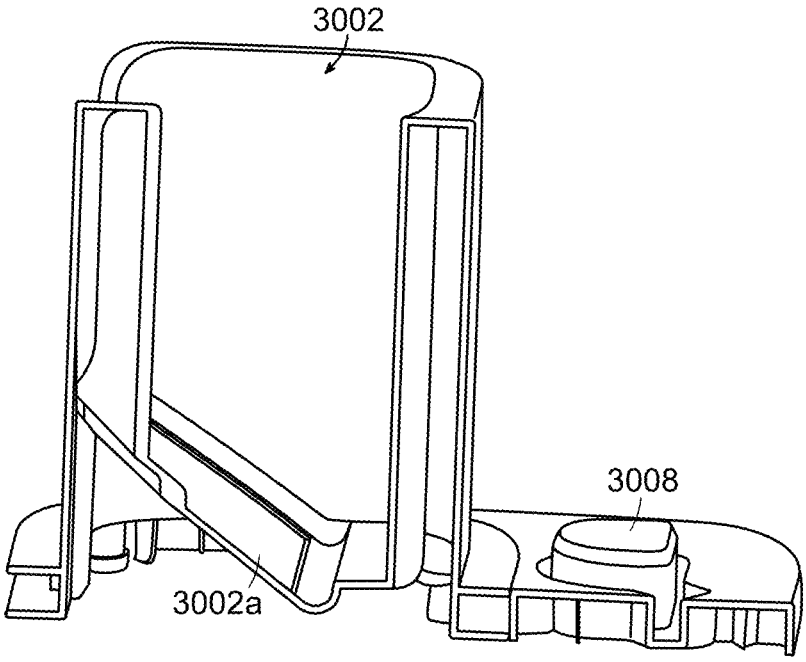

FIGS. 66A and 66B illustrate another implementation of a tray 3000 configured to seat a handheld surface cleaner. The tray 3000 includes first, second, third, and fourth docking areas to seat a handheld surface cleaner, a first attachment, a second attachment, and a spray bottle, respectively. In this illustrated implementation the docking areas include first and second cavities 3002, 3004 configured to seat the handheld surface cleaner and a spray bottle, respectively, and first and second stands 3006, 3008 configured to seat the first and second attachments, respectively. As shown in FIG. 66C, the first docking area 3002 includes a sloped bottom surface 3002*s* having a size and shape complementary to a corresponding surface of the handheld surface cleaner.

The tray 3000 in this illustrated implementation is configured as a caddy to facilitate carrying together all of the handheld surface cleaner, the spray bottle, and the first and second attachments seated in the tray 3000. The tray 3000 includes one or more handles 3010 to help a user hold the tray 3000. The tray 3000 includes a single arced handle 3010 attached to the tray 3000 in this illustrated implementation but can have other configurations, such as opposed hand grips attached to an exterior of the tray 3000, a pair of opposed cut-outs, or other configuration.

The tray 3000 in this illustrated implementation is configured as a charging dock configured to allow the handheld surface cleaner to be charged while seated in the tray 3000, e.g., seated in the first cavity 3002. As shown in FIG. 66A, the tray 3000 has a lowered sidewall 3000*a* adjacent the first cavity 3002. The lowered sidewall 3000*a* is configured to facilitate access to a charging contact of the handheld surface cleaner with the handheld surface cleaner seated in the first cavity 3002.

In some implementations, a handheld surface cleaner is configured to run a cleaning cycle (also referred to herein as a "rinse operation") while seated in a tray configured to seat the handheld surface cleaner. After the handheld surface cleaner is used to clean a surface, a small amount of debris may occasionally be in the handheld surface cleaner along a debris flow path of the handheld surface cleaner distal to an endpoint of the debris flow path defined by a collection area in the handheld surface cleaner where debris is configured to be collected prior to disposal, e.g., in a collection cavity of a dirty water tank of the handheld surface cleaner. For example, suction may be turned off before all debris that has entered an inlet of the handheld surface cleaner has traveled far enough along the debris flow path to be collected in the collection area in the handheld surface cleaner.

The cleaning cycle may help ensure that the flow path in the handheld surface cleaner is as clean as possible before a next use of the handheld surface cleaner to clean a surface and/or may help prevent debris from drying inside the handheld surface cleaner. Dried debris stuck to an interior surface of the handheld surface cleaner will be generally more difficult to draw into the handheld surface cleaner's debris collection area than debris that is not dried and stuck to an interior surface of the handheld surface cleaner. The cleaning cycle may be run automatically and not require a user to stop the cleaning cycle, which may help ensure that the full cleaning cycle is run and may improve user experience by not requiring the user to attend to the handheld surface cleaner during the cleaning cycle.

Figure 67:
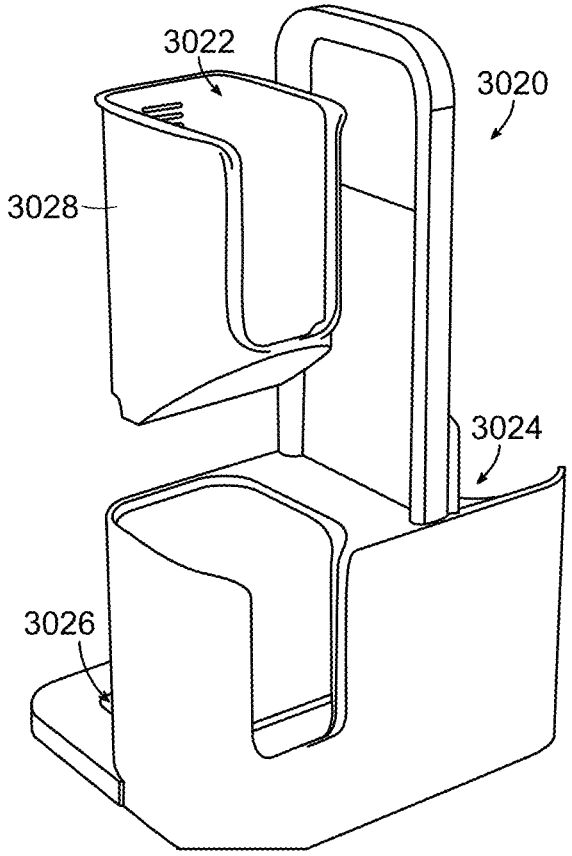

FIG. 67 illustrates another implementation of a tray 3020 configured to seat a handheld surface cleaner. In this illustrated implementation, the handheld surface cleaner is configured to run a cleaning cycle while seated in the tray 3020.

The tray 3020 includes a first docking area 3022, a second docking area 3024, a third docking area (obscured in FIG. 67), and a fourth docking area 3026 configured to seat a handheld surface cleaner, a first attachment, a second attachment, and a spray bottle, respectively. The tray 3020 of FIG. 67 is generally configured and used similar to the tray 3000 of FIGS. 66A-66C except that, unlike the first docking area 3002 that is non-removable from the tray 3000 of FIGS. 66A-66C, the first docking area 3022 of FIG. 67 is defined by a cup 3028 configured to be removably coupled to the tray 3020. As shown in FIG. 67, the first docking area 3022 includes a sloped bottom surface having a size and shape complementary to a corresponding surface of the handheld surface cleaner.

The cup 3028 being removable may facilitate cleaning of the first docking area 3028. Debris may occasionally fall into the first docking area 3028 from a handheld surface cleaner seated in the first docking area 3028, particularly if the handheld surface cleaner includes a hair cage or other filter proximal to an inlet of the handheld surface cleaner and distal to a separator of the handheld surface cleaner and the hair cage or other filter is not cleaned by a user prior to seating the handheld surface cleaner in the first docking area 3028. Similar to the tray 3000 of FIGS. 66A-66C, a handheld surface cleaner is configured to be seated in the first docking area 3028 with an inlet of the handheld surface cleaner facing downward.

The cup 3028 being removable may facilitate running a cleaning cycle and thus facilitate cleaning of a debris flow path of a handheld surface cleaner seated in the first docking area 3028, e.g., seated in the cup 3028. The cup 3028 includes a fill line configured to indicate a level where a cleaning liquid, e.g., clean water and/or other cleaning liquid, is configured to be filled in the cup 3028, e.g., in the first docking area 3028, prior to seating a handheld surface cleaner in the cup 3028, e.g., in the first docking area 3028. The fill line in this illustrated implementation is on an interior surface of the cup 3028, e.g., printed on, etched on, embossed in, on a sticker applied to, or otherwise on the interior surface. The fill line is obscured in FIG. 67. With the cup 3028 filled with cleaning liquid up to the fill line and with the handheld surface cleaner seated in the cup 3028, an inlet of the handheld surface cleaner is configured to be submerged in the cleaning liquid and spaced a distance away from the interior surface of the cup 3028 to allow cleaning liquid to enter the inlet upon application of a suction force.

With cleaning liquid in the cup 3028 up to the fill line and with the handheld surface cleaner seated in the cup 3028, the handheld surface cleaner is configured to be activated for a cleaning cycle by a user, e.g., by pushing a cleaning cycle start button on the handheld surface cleaner or otherwise beginning the cleaning cycle. Activating the cleaning cycle is configured to cause the handheld surface cleaner to provide suction for a predetermined amount of time. The predetermined amount of time generally depends on one or more factors such as an amount of cleaning liquid configured to be held by the cup 3028 up to the fill line, a size of the handheld surface cleaner's collection cavity, a strength of the suction force, and/or other factor(s). The activated handheld surface cleaner draws the cleaning liquid from the cup 3028 into the handheld surface cleaner via a suction force according to the handheld surface cleaner's normal operation. The cleaning liquid flows along the debris flow path in the handheld surface cleaner and is collected in the handheld surface cleaner's collection area, cleaning the debris flow path as the cleaning liquid flows along the debris flow path. The collection area may then be emptied by a user. Although the suction force will tend to draw all the cleaning liquid from the cup 3028 into the handheld surface cleaner, a very small amount of cleaning liquid may remain in the cup 3028 when the cleaning cycle ends, and the cup 3028 may be emptied of this remaining cleaning liquid.

Figure 68A:
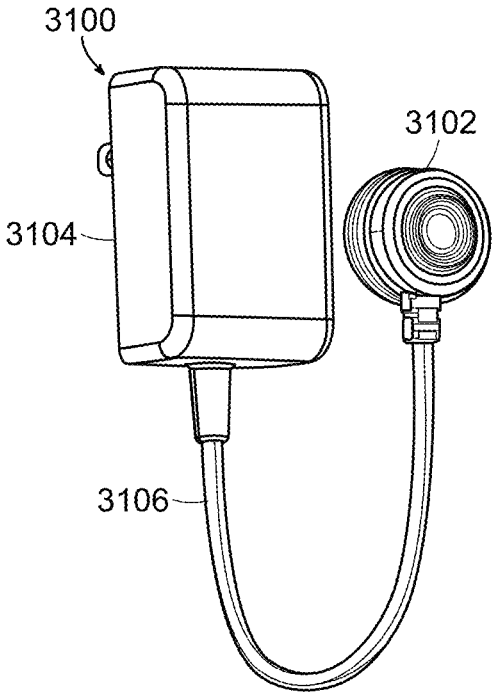
Figure 68B:
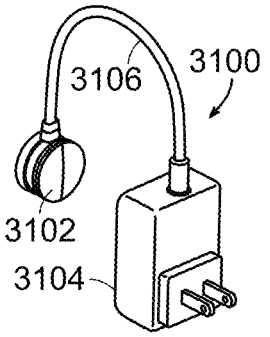

FIGS. 68A and 68B illustrate one implementation of a charger 3100 configured to be used in recharging a handheld surface cleaner. The charger 3100 includes a charging contact 3102, a plug 3104 configured to be plugged into a wall socket, and a cord 3106 connecting the charging contact 3102 and the plug 3104. The charging contact 3102 is configured to mate with a corresponding charging contact of a handheld surface cleaner. The charging contact 3102 in this illustrated implementation includes a magnetic port configured to magnetically mate with a corresponding charging port of a handheld surface cleaner.

The charger 3100 can be used, for example, to recharge a handheld surface cleaner seated in the tray 3000, e.g., seated in the first cavity 3002. The lower sidewall 3000*a* is configured to ease access to the handheld surface cleaner's charging contact for mating with the charger's charging contact 3102 and help prevent the tray 3000 from snagging or interfering with the cord 3106 extending from the charging contact 3102.

Figure 69:
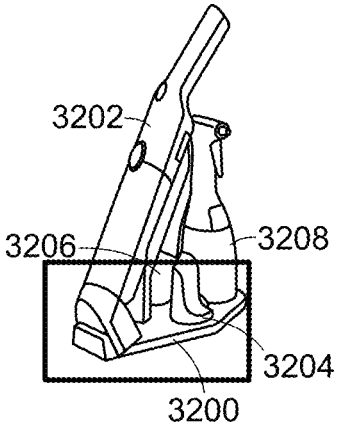

FIG. 69 illustrates another implementation of a tray 3200 configured to seat a handheld surface cleaner. The tray 3200 includes first, second, third, and fourth docking areas configured to seat a handheld surface cleaner 3202, a first attachment 3204, a second attachment 3206, and a spray bottle 3208, respectively. In this illustrated implementation the docking areas include first, second, third, and fourth stands configured to seat the handheld surface cleaner 3202, the first and second attachments 3204, 3206, and the spray bottle 3208, respectively.

Figure 70A:
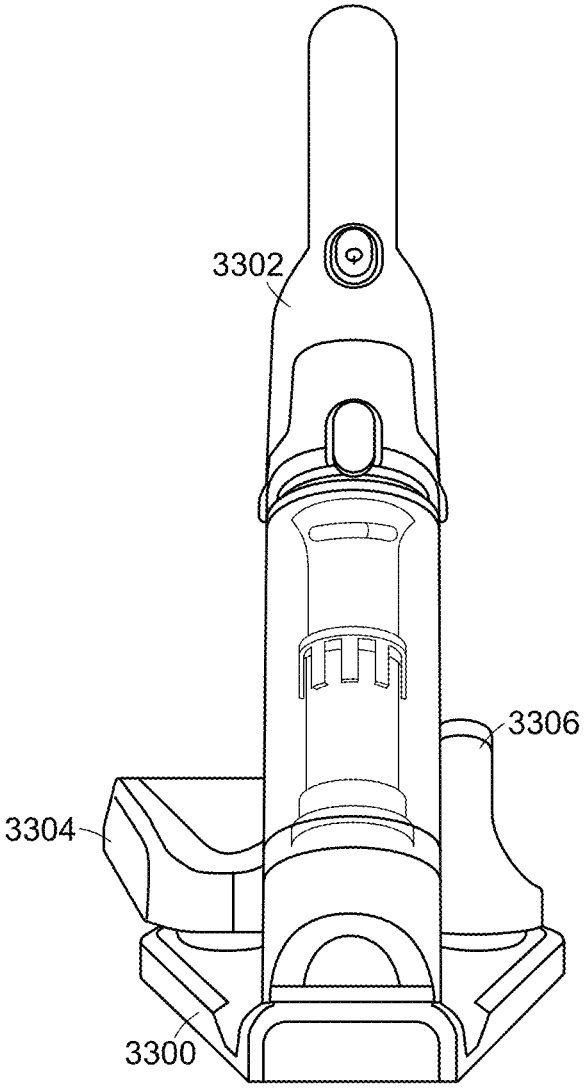
Figure 70B:
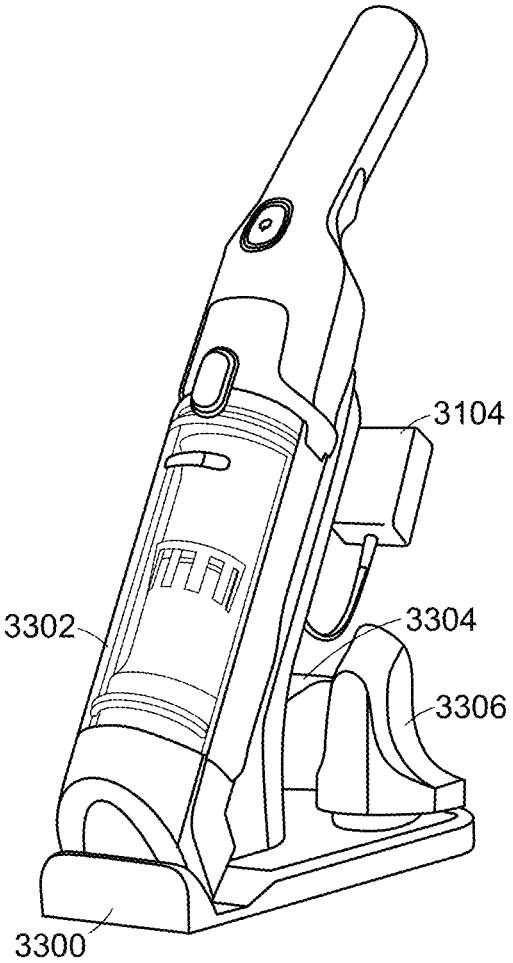

FIGS. 70A and 70B illustrate another implementation of a tray 3300 configured to seat a handheld surface cleaner. The tray 3300 includes first, second, third, and fourth docking areas configured to seat a handheld surface cleaner 3302, a first attachment 3304, a second attachment 3306, and a charger, respectively. In this illustrated implementation the docking areas include first, second, and third stands configured to seat the handheld surface cleaner 3302, the first attachment 3304, and the second attachment 3306, respectively, and an opening 3308, shown in FIG. 70C, configured to seat the charger, e.g., seat the charging contact 3102 of the charger 3100 of FIGS. 68A and 68B.

Figure 70C:
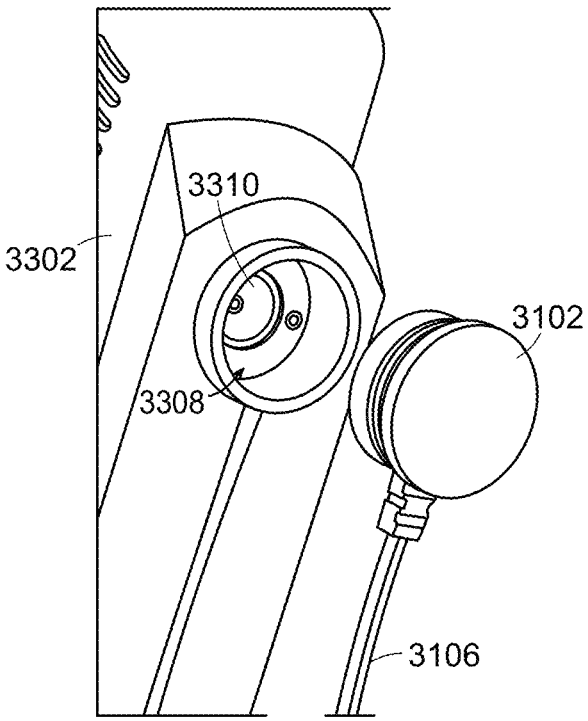

The tray 3300 in this illustrated implementation is configured as a charging dock configured to allow the handheld surface cleaner 3302 to be charged while seated in the tray 3300. FIGS. 70B and 70C show the charger 3100 of FIGS. 68A and 68B but another charger may be used. With the handheld surface cleaner 3302 seated in the first docking area 3302, the charger is configured to access the handheld surface cleaner's charging contact 3310 through the opening 3308.

Figure 71:
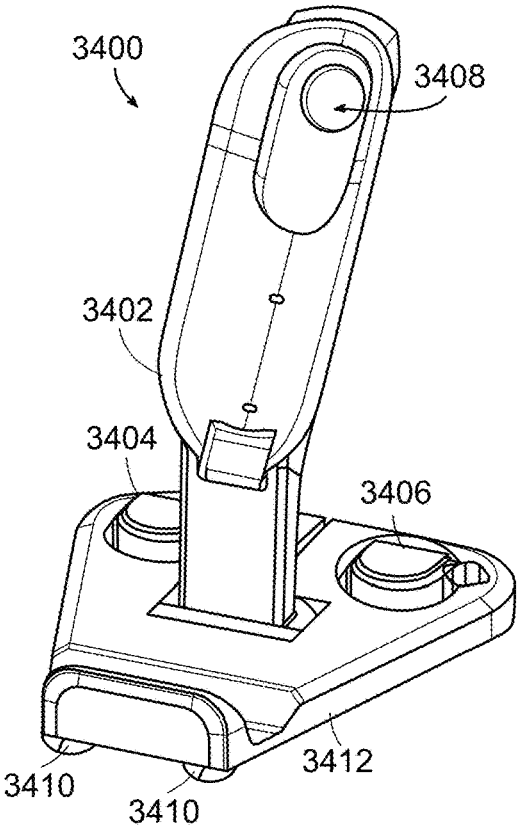

FIG. 71 illustrates another implementation of a tray 3400 configured to seat a handheld surface cleaner. The illustrated tray 3400 of FIG. 71 is configured to seat the handheld surface cleaner 2700 of FIG. 63A although seating of another handheld surface cleaner is possible. The tray 3400 includes first, second, and third docking areas configured to seat a handheld surface cleaner, a first attachment, a second attachment, and a charger. In this illustrated implementation the docking areas include first, second, and third stands 3402, 3404, 3406 configured to seat the handheld surface cleaner, the first attachment, and the second attachment, respectively, and an opening 3408 configured to seat the charger, e.g., seat the charging contact 3102 of the charger 3100 of FIGS. 68A and 68B.

The tray 3400 in this illustrated implementation also includes a plurality of feet 3410 on a bottom side of a base 3412 of the tray 3400. The tray 3400 includes two feet 3410 at a front of the base 3412 and two feet 3410 (obscured in FIG. 71) at a back of the base 3412, although another number and/or positioning of feet can be used.

The tray 3400 in this illustrated implementation is configured as a charging dock configured to allow the handheld surface cleaner to be charged while seated in the tray 3400. With the handheld surface cleaner seated in the first docking area 3402, the charger is configured to access the handheld surface cleaner's charging contact through the opening 3408.

FIGS. 72A and 72B illustrate another implementation of a tray 3500 configured to seat a handheld surface cleaner, a spray bottle, and a plurality of attachments. The illustrated tray 3500 of FIGS. 72A and 72B is configured to seat the handheld surface cleaner 2700 of FIG. 63A and the attachments 100, 200, 400 of FIGS. 19-23C and 29A-29C although seating of another handheld surface cleaner and/or other attachment(s) is possible. In this illustrated implementation, the handheld surface cleaner is configured to run a cleaning cycle while seated in the tray 3500 similar to that discussed above regarding the tray 3020 of FIG. 67.

The tray 3500 includes a first docking area 3502, a second docking area 3504, a third docking area 3506, a fourth docking area 3508, and a fifth docking area 3510 configured to seat a handheld surface cleaner, a first attachment, a second attachment, a third attachment, and a spray bottle, respectively. The tray 3500 of FIGS. 72A and 72B is generally configured and used similar to the tray 3000 of FIGS. 66A-66C except that, unlike the first docking area 3002 that is non-removable from the tray 3000 of FIGS. 66A-66C, the first docking area 3502 of FIGS. 72A and 72B is defined by a cup 3512 configured to be removably coupled to the tray 3500. FIGS. 72A and 72B show the cup 3512 coupled to the tray 3500. FIGS. 72C and 72D show the cup 3512 as a standalone element. As shown in FIG. 72D, the cup 3512 includes a sloped bottom surface having a size and shape complementary to a corresponding surface of the handheld surface cleaner.

The tray 3500 in this illustrated implementation also includes a plurality of feet 3514 on a bottom side of a base 3516 of the tray 3500. The tray 3500 includes two feet 3514 at a back of the base 3516, shown in FIG. 72B, and two feet 3514 (obscured in FIGS. 72A and 72B) at a front of the base 3516, although another number and/or positioning of feet can be used.

A handheld surface cleaner (e.g., any of the handheld surface cleaners described herein) can be used to clean a surface (e.g., a floor, upholstery, etc.) without prior application of a cleaning aid, such as a cleaning liquid or other cleaning aid, to the surface. A cleaning aid may not be pre-applied for any of one or more reasons, such as the surface being cleaned not being very soiled, a cleaning aid not being available to a user of the handheld surface cleaner, and/or other reason. However, a user may decide to pre-apply a cleaning aid to the surface to be cleaned using the handheld surface cleaner for any of one or more reasons, such as the surface being cleaned being very soiled and/or other reason.

A cleaning aid can have any of a variety of configurations (e.g., a liquid, a paste, etc.) and can be applied to a surface to be cleaned in any of a variety of ways. The applied cleaning aid can be recovered from the surface to be cleaned using a handheld surface cleaner.

In an exemplary implementation, a spray bottle is configured to apply a cleaning liquid to a surface to be cleaned with a handheld surface cleaner (e.g., any of the handheld surface cleaners described herein). The spray bottle can have a variety of implementations.

The spray bottles described herein are not limited to use with a handheld surface cleaner or in spraying cleaning liquid to a surface to be cleaned. For example, a spray bottle described herein can be configured to spray another type of liquid.

FIGS. 73-78 illustrate one implementation of a spray bottle 4000 for spraying cleaning liquid for use with a handheld surface cleaner, such as any of the handheld surface cleaners described herein. The spray bottle 4000 in this illustrated implementation includes a spray head 4002 (shown as a standalone unit in FIGS. 79 and 80) and a dual cleaning solution container 4004 (shown as a standalone unit in FIGS. 81-85) configured to removably attach to the spray head 4002. In an exemplary implementation, the spray head 4002 is reusable and the dual cleaning solution container 4004 is disposable.

FIGS. 73, 75, 76, 79, and 80 show a hole 4006 on each of left and right sides of the spray head 4002 where a depressible button or other lock (not shown) is located. A user pressing both of the buttons (or other locks) is configured to allow the disposable dual cleaning solution container 4004 to be removed from the spray head 4002.

The dual cleaning solution container 4004 includes two separate containers 4004*a*, 4004*b* attached together, such as via shrink wrap (not shown) and/or a band (not shown) wrapped around the two separate containers 4004*a*, 4004*b*. Pulling a trigger 4008 of the spray head 4002 is configured to draw liquid from each of the two containers 4004*a*, 4004*b* and sprays the two liquids mixed together from a spray nozzle 4010 of the spray head 4002. The spray nozzle 4010 has a cover 4012 in this illustrated implementation that is shown in an open position in FIGS. 73-80. In an exemplary implementation, each of the containers 4004*a*, 4004*b* contains a different type of liquid therein, e.g., two different cleaning liquids such as a base cleaning solution in one of the container 4004*a*, 4004*b* and a peroxide boost cleaning solution in the other one of the containers 4004*a*, 4004*b*, and pulling the trigger 4008 causes a substantially same amount of each of the two liquids to be drawn out of the two separate containers 4004*a*, 4004*b*.

FIGS. 86A and 86B illustrate another implementation of a spray bottle 4100 for spraying cleaning liquid for use with a handheld surface cleaner, such as any of the handheld surface cleaners described herein. The spray bottle 4100 of FIGS. 86A and 86B is generally configured and used similar to the spray bottle 4000 of FIGS. 73-78.

FIGS. 87 and 88 illustrate another implementation of a spray bottle 4200 for spraying cleaning liquid for use with a handheld surface cleaner, such as any of the handheld surface cleaners described herein. The spray bottle 4200 of FIGS. 87 and 88 is generally configured and used similar to the spray bottle 1500 of FIGS. 50A-50D. FIGS. 89-91 show portions of the spray bottle 4200.

FIG. 92A illustrates another implementation of a spray bottle 4300 for spraying cleaning liquid for use with a handheld surface cleaner, such as any of the handheld surface cleaners described herein. The spray bottle 4300 of FIG. 92A is generally configured and used similar to the spray bottle 4000 of FIGS. 73-78. FIG. 92B shows a portion of the spray bottle 4300.

As shown in FIGS. 92A and 92B, the spray bottle 4300 in this illustrated implementation includes a spray head 4302 and a dual cleaning solution container 4304 configured to removably attach to the spray head 4302. In an exemplary implementation, the spray head 4302 is reusable and the dual cleaning solution container 4304 is disposable.

The spray head 4302 includes a lock 4306 configured to allow the dual cleaning solution container 4304 to be removed from the spray head 4302. The lock 4306 in this illustrated implementation includes a pair of buttons with one button on a left side of the spray head 4302 and one button on a right side of the spray head 4302. A user pressing both of the buttons is configured to allow the disposable dual cleaning solution container 4304 to be removed from the spray head 4302.

A top of each of the containers 4304*a*, 4304*b* of the dual cleaning solution container 4304 includes a vented membrane 4308*a*, 4308*b*. The vented membranes 4308*a*, 4308*b* are enclosed within the spray head 4302 regardless of whether or not the spray head 4302 and the dual cleaning solution container 4304 are attached together. A portion of the spray head 4302 is omitted in FIG. 92B to show the vented membranes 4308*a*, 4308*b*. Each of the vented membranes 4308*a*, 4308*b* is configured to allow venting of the cleaning solution in its associated one of the containers 4304*a*, 4304*b* as a safety feature.

FIG. 93 illustrates another implementation of a spray bottle 4400 for spraying cleaning liquid for use with a handheld surface cleaner, such as any of the handheld surface cleaners described herein. As shown, the spray bottle 4400 includes a supply tank 4402, a spray nozzle 4404, and an agitator 4406. The agitator 4400 includes a brush in this illustrated implementation but can have another configuration, e.g., ribs, etc. The agitator 4406 is configured to be replaceable by a user (e.g., to enable a user to tailor the fluid applicator 4400 to a surface type of a surface to be cleaned), but in other implementations the agitator 4406 can be non-removable from the spray bottle 4400 and non-replaceable. In some implementations, the agitator 4406 is pivotable and configured to adjust an angle of the agitation brush relative to the surface to be cleaned, which may adjust an angle of a debris flow path, e.g., the flow path 2356 when entering the inlet 2214 of the handheld surface cleaner 2200 of FIG. 57A.

The supply tank 4402 includes a first chamber 4408 and a second chamber 4410 that is fluidically separated from the first chamber 4408. The first chamber 4408 is configured to store a first cleaning solution, and the second chamber 4410 is configured to store a second cleaning solution. When an actuator 4412 of the spray bottle 4400 is actuated, the first and second cleaning solutions are urged (e.g., using a manual or electrical fluid pump) from the first and second chambers 4408, 4410, respectively, and distributed to a surface to be cleaned via the spray nozzle 4404. Once deposited on the surface to be cleaned, the cleaning solutions are configured to be agitated into the surface to be cleaned using the agitator 4406.

In an exemplary implementation, the first cleaning solution is different from the second cleaning solution. In such an implementation, the first and second cleaning solutions may be configured to be reactive with each other upon mixing to enhance a cleaning performance.

FIGS. 94A and 94B illustrate another implementation of a spray bottle 4500 for spraying cleaning liquid for use with a handheld surface cleaner, such as any of the handheld surface cleaners described herein. The spray bottle 4500 of FIGS. 94A and 94B is generally configured and used similar to the spray bottle 4000 of FIGS. 73-78. The spray bottle 4500 in this illustrated implementation includes a spray head 4502 and a dual cleaning solution container 4504 configured to removably attach to the spray head 4502. The dual cleaning solution container 4504 includes two separate containers 4504*a*, 4504*b* attached together. FIGS. 94C-94E show one of the containers 4504*a* as a standalone element and is representative of both containers 4504*a*, 4504*b*.

The subject matter described herein can be implemented in analog electronic circuitry, digital electronic circuitry, and/or in computer software, firmware, or hardware, including the structural means disclosed in this specification and structural equivalents thereof or in combinations of them. The subject matter described herein can be implemented as one or more computer program products, such as one or more computer programs tangibly embodied in an information carrier (e.g., in a machine-readable storage device), or embodied in a propagated signal, for execution by, or to control the operation of, data processing apparatus (e.g., a programmable processor, a computer, or multiple computers). A computer program (also known as a program, algorithm, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code).

The processes and logic flows described in this specification, including the method steps of the subject matter described herein, can be performed by one or more programmable processors executing one or more computer programs to perform functions of the subject matter described herein by operating on input data and generating output. The processes and logic flows can also be performed by, and apparatus of the subject matter described herein can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processor of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, (e.g., EPROM, EEPROM, and flash memory devices). The processor and the memory can be supplemented by, or incorporated in, special purpose logic circuitry.

The techniques described herein can be implemented using one or more modules. As used herein, the term "module" refers to computing software, firmware, hardware, and/or various combinations thereof. At a minimum, however, modules are not to be interpreted as software that is not implemented on hardware, firmware, or recorded on a non-transitory processor-readable recordable storage medium (i.e., modules are not software per se). Indeed "module" is to be interpreted to always include at least some physical, non-transitory hardware such as a part of a processor or computer. Two different modules can share the same physical hardware (e.g., two different modules can use the same processor). The modules described herein can be combined, integrated, separated, and/or duplicated to support various applications. Also, a function described herein as being performed at a particular module can be performed at one or more other modules and/or by one or more other devices instead of or in addition to the function performed at the particular module.

A feature described with respect to one implementation may also be incorporated into other implementations. For example, a handheld surface cleaner can include a duckbill valve upstream of the separator, e.g., similar to the duckbill valve 76 shown in FIGS. 2, 3, and 6. For another example, a separator can include a rim, e.g., similar to the rim 1502 of FIGS. 50A-50C. For yet another example, an illustrated implementation of a handheld surface cleaner that includes inner and outer separators can instead include a singular separator. For still another example, an illustrated implementation of a handheld surface cleaner that includes a singular separator can instead include inner and outer separators. For yet another example, a handheld surface cleaner can include a debris quantity sensor. For another example, a self-drying cycle can be run for a handheld surface cleaner.

One skilled in the art will appreciate further features and advantages of the devices, systems, and methods based on the above-described embodiments. Accordingly, this disclosure is not to be limited by what has been particularly shown and described, except as indicated by the appended claims.

All publications and references cited herein are expressly incorporated herein by reference in their entirety for all purposes.

The present disclosure has been described above by way of example only within the context of the overall disclosure provided herein. It will be appreciated that modifications within the spirit and scope of the claims may be made without departing from the overall scope of the present disclosure.

What is claimed is:

1. A cleaning system, comprising:

a surface cleaner comprising:

an inlet through which debris and air is configured to be suctioned into the surface cleaner, a separator proximal to the inlet, having an outlet opening, having a plurality of holes formed in a sidewall of the separator, and having a plurality of covers, each one of the plurality of covers being associated with at least one of the plurality of holes, and a motor configured to drive rotation of the separator;

wherein the rotation of the separator is configured to:

cause the plurality of covers to move from a closed position, in which each of the plurality of covers closes the associated at least one of the plurality of holes, to an open position, in which each of the plurality of covers does not close the associated at least one of the plurality of holes, separate the debris from the air by directing the debris radially outward through the plurality of holes, and direct the air out of the separator through the outlet opening; and the rotation of the separator stopping is configured to:

cause the plurality of covers to move from the open position to the closed position.

2. The cleaning system of claim 1, wherein each of the plurality of covers in the closed position provides a fluid seal of the associated at least one of the plurality of holes.

3. The cleaning system of claim 1, wherein each of the plurality of covers is attached to the separator along a single edge of the respective cover.

4. The cleaning system of claim 1, wherein each of the plurality of covers is flexible.

5. The cleaning system of claim 4, wherein the separator is rigid.

6. The cleaning system of claim 1, wherein the outlet opening is at a proximal end of the separator; and the separator includes an inlet opening at a distal end of the separator, and the inlet opening is configured to allow the debris and air to enter the separator through the inlet opening.

7. The cleaning system of claim 1, wherein the sidewall of the separator extends from an inlet opening to the outlet opening.

8. The cleaning system of claim 1, wherein the surface cleaner further comprises a tank having a cavity configured to contain and store therein the debris that is directed radially outward through the plurality of holes.

9. The cleaning system of claim 8, wherein the surface cleaner further comprises an air exit hole configured to allow the air that is directed out of the separator through the outlet opening to exit to external atmosphere.

10. The cleaning system of claim 1, wherein the surface cleaner further comprises at least one of:

a first filter upstream of the separator, and a second filter downstream of the separator.

11. The cleaning system of claim 1, wherein each one of the plurality of covers is associated with only one of the plurality of holes.

12. A separation apparatus, comprising:

a separator comprising:

a body;

an inlet opening through which debris and air is configured to enter the separator, an outlet opening through which the air is configured to exit the separator, a plurality of holes formed in a sidewall of the body and through which the debris is configured to exit the separator, and a plurality of covers, each one of the plurality of covers being configured to move from a sealed configuration, in which each of the plurality of covers seals closed at least one of the plurality of holes, to an unsealed configuration, in which each of the plurality of covers does not seal closed the associated at least one of the plurality of holes, wherein rotation of the separator is configured to cause the plurality of covers to move from the sealed configuration to the unsealed configuration; and the rotation of the separator stopping is configured to cause the plurality of covers to move from the unsealed configuration to the sealed configuration.

13. The separation apparatus of claim 12, further comprising a motor configured to drive the rotation of the separator.

14. The separation apparatus of claim 12, wherein each of the plurality of covers is attached to the body along a single edge of the respective cover.

15. The separation apparatus of claim 12, wherein the separator further comprises a plurality of blades positioned downstream of the inlet opening and upstream of the outlet opening.

16. The separation apparatus of claim 12, further comprising a surface cleaner that comprises the separator;

the surface cleaner further comprises an inlet through which the debris and the air is configured to be suctioned into the surface cleaner; and the separator is downstream of the inlet.

17. The separation apparatus of claim 16, wherein the surface cleaner further comprises a motor configured to drive rotation of the separator.

18. The separation apparatus of claim 16, wherein the surface cleaner further comprises a tank having a cavity configured to contain and store therein the debris that enters the separator;

with the plurality of covers in the sealed configuration, an interior of the separator is not in fluid communication with the cavity through the plurality of holes; and with the plurality of covers in the unsealed configuration, the interior of the separator is in fluid communication with the cavity through the plurality of holes.

19. The separation apparatus of claim 16, wherein the surface cleaner is configured to be handheld.

* * * * *